US007086312B1

(12) United States Patent
Tortolani

(10) Patent No.: US 7,086,312 B1
(45) Date of Patent: Aug. 8, 2006

(54) PARALLEL JAW LOCKING TOGGLE WRENCH/PLIERS WITH ECONOMIC/ERGONOMIC HANDLES

(76) Inventor: Kenneth Guy Tortolani, 22615 S. 194th Pl., Queen Creek, AZ (US) 85242

( * ) Notice: Subject to any disclaimer, the term of this patent is extended or adjusted under 35 U.S.C. 154(b) by 121 days.

(21) Appl. No.: 10/461,988

(22) Filed: Jun. 13, 2003

Related U.S. Application Data

(63) Continuation-in-part of application No. 10/034,684, filed on Dec. 28, 2001, now abandoned.

(51) Int. Cl.
*B25B 7/12* (2006.01)

(52) U.S. Cl. ..... 81/355; 81/367; 81/389

(58) Field of Classification Search ..... 81/126, 81/389, 398, 379, 373, 363, 347, 370, 376, 81/415, 352–356
See application file for complete search history.

(56) References Cited

U.S. PATENT DOCUMENTS

| | | | | | |
|---|---|---|---|---|---|
| 578,249 | A | | 3/1897 | Letteer | |
| 1,110,220 | A | * | 9/1914 | Millsap, Jr. | 81/362 |
| 2,417,013 | A | | 3/1947 | Petersen | |
| 2,464,472 | A | * | 3/1949 | Ward et al. | 81/367 |
| 2,481,435 | A | * | 9/1949 | Meunier | 81/356 |
| 2,481,866 | A | * | 9/1949 | Petersen | 81/356 |
| 2,519,630 | A | * | 8/1950 | Boyer | 81/373 |
| 2,731,867 | A | * | 1/1956 | Daugherty | 81/356 |
| 3,195,382 | A | * | 7/1965 | Rommel et al. | 81/373 |
| 3,202,022 | A | * | 8/1965 | Lothaire | 81/362 |
| 3,496,808 | A | * | 2/1970 | Schmidt | 81/370 |
| 3,608,405 | A | * | 9/1971 | Schmidt | 81/356 |
| 3,635,107 | A | * | 1/1972 | Schmidt | 81/367 |
| 3,710,658 | A | * | 1/1973 | Wilson | 81/367 |
| 3,981,209 | A | | 9/1976 | Caroff | |
| 3,990,137 | A | | 11/1976 | Kulba | |
| 4,028,971 | A | | 6/1977 | Budrose | |
| 4,048,878 | A | | 9/1977 | Nystrom | |
| 4,074,597 | A | | 2/1978 | Jansson | |
| 4,091,696 | A | | 5/1978 | Wahlberg | |
| 4,114,482 | A | | 9/1978 | Houdeshell | |
| 4,232,573 | A | | 11/1980 | Dace, Jr. | |
| 4,271,732 | A | | 6/1981 | Vaughan, Jr. | |
| 4,274,312 | A | * | 6/1981 | Finn | 81/356 |

(Continued)

OTHER PUBLICATIONS

S-K Hand Tool Corporation 2003 Catalog—A943200 printed in U.S.A. pp. 184 and 185: Copyright 2002 S-K Hand Tool Coporation, Oct. 2002.

(Continued)

*Primary Examiner*—David B. Thomas

(57) ABSTRACT

"Parallel Jaw Locking Toggle Wrench/Pliers with Economic/Ergonomic Handles" comprising: a fixed jaw member being in parallel relationship to a slidable jaw member; the fixed jaw member constructed (by riveting or welding means) to support member - the support members being formed integral to a lower handle; the slidable jaw member slidably contiguous to said support member; the slidable jaw member pivotably attachable (by riveting) to a rotatable upper handle opposing said lower handle; a spring tensioned to said slidable jaw member - with the spring attachable to said lower handle; the spring allowing for the operation of said slidable jaw member, a toggle, said upper handle, and an adjustment screw; the toggle pivotably attachable (by riveting) to said upper handle; the toggle pivotably contacting said adjustment screw; the adjustment screw rotatably mounted in said lower handle; a release lever levered off of said toggle; the release lever pivotably attachable (housed) in said upper handle; and a compound toggle link means levered off of said toggle as an alternate design to said release lever.

16 Claims, 188 Drawing Sheets

U.S. PATENT DOCUMENTS 4,283,933 A 8/1981 Wiener
D260,476 S 9/1981 Knaus
4,296,655 A 10/1981 Tesoro
4,375,174 A 3/1983 Shanley, Jr.
4,438,668 A * 3/1984 Solomon ..... 81/352
4,438,669 A 3/1984 Hastings et al.
4,462,284 A 7/1984 Gowers
4,472,986 A 9/1984 Gottlieb
4,478,114 A * 10/1984 Arena ..... 81/363
4,526,070 A 7/1985 Wiener
4,538,485 A 9/1985 Saila
4,542,669 A 9/1985 Roux
4,546,680 A 10/1985 Petersen
4,563,921 A 1/1986 Wallace
4,581,960 A 4/1986 Putsch et al.
4,602,535 A 7/1986 Wiener
4,628,602 A 12/1986 Kolterman
4,635,510 A 1/1987 Box
4,651,598 A 3/1987 Warheit
4,660,241 A 4/1987 Chen et al.
4,662,252 A 5/1987 Warheit
4,669,340 A 6/1987 Igarashi
4,709,601 A 12/1987 Petersen
4,726,265 A 2/1988 Reich
RE32,614 E 3/1988 Wilson
4,748,876 A 6/1988 Solf et al.
4,773,288 A 9/1988 Jang et al.
4,797,965 A * 1/1989 Mazzone ..... 81/126
4,802,390 A 2/1989 Warheit
4,825,735 A 5/1989 Undin
4,829,858 A 5/1989 Kern et al.
4,884,479 A * 12/1989 Mazzone ..... 81/128
4,889,022 A 12/1989 Peviani
4,890,519 A 1/1990 Le Duc
4,890,520 A 1/1990 Vassiliou
4,893,530 A 1/1990 Warheit
4,901,609 A 2/1990 Crum
4,922,770 A 5/1990 Dlugolecki et al.
4,944,204 A 7/1990 West
4,957,020 A 9/1990 Monceret
4,989,479 A 2/1991 Anderson et al.
5,020,399 A 6/1991 Annis et al.
5,022,291 A 6/1991 McBain
5,050,465 A 9/1991 Haugs
5,052,251 A 10/1991 Mills
5,052,252 A 10/1991 Szymber
5,056,385 A 10/1991 Petersen
5,094,132 A 3/1992 Engel
5,121,662 A 6/1992 Wright
5,150,488 A 9/1992 Yuan et al.
5,176,048 A 1/1993 Jore et al.
5,176,049 A 1/1993 Neff
5,191,816 A * 3/1993 Burpo ..... 81/361
5,289,746 A * 3/1994 Finn ..... 81/356
5,347,670 A 9/1994 Duguette et al.
5,351,585 A 10/1994 Leseberg et al.
5,385,072 A * 1/1995 Neff ..... 81/405
5,423,236 A 6/1995 Bickler
5,435,214 A 7/1995 Sisson
5,456,144 A 10/1995 Dahl et al.
5,499,800 A 3/1996 Albin
5,501,126 A 3/1996 Wright
5,528,965 A * 6/1996 Finn ..... 81/356
5,531,750 A 7/1996 Even-Esh
5,535,650 A 7/1996 McNatt
5,582,084 A 12/1996 Sarmiento
5,609,080 A 3/1997 Flavigny
5,630,345 A 5/1997 Ciccotelli
5,644,960 A * 7/1997 O'Brien ..... 81/363
5,660,089 A 8/1997 Chow
5,676,029 A 10/1997 Putsch
5,685,205 A 11/1997 Suksi
5,707,371 A 1/1998 Metz-Stavenhagen
5,761,948 A 6/1998 Malagnoux
5,791,210 A 8/1998 Wolff et al.
D398,497 S 9/1998 Gomas
D399,398 S 10/1998 Neyton
6,161,455 A * 12/2000 Ping ..... 81/358
6,227,080 B1 5/2001 Grayo
6,578,452 B1 * 6/2003 Duffy ..... 81/368
6,626,070 B1 9/2003 Peperkorn et al.

OTHER PUBLICATIONS

MAC Tools 2001 Catalog—MT2001CAT p. # 141: Copyright 2000 The Stanley Works. All Rights Reserved. Distributed in U.S.A.

SNAP-ON Catalog—printed in U.S.A. p. # 191: Copyright 1993 by Snap-on Tools Corporation. All Rights Reserved. Issued Jul. 1993.

2 Black and White photographs; CRAFTSMAN(Registered) Professional 7in Pliers: Date of photos—Mar. 7, 2005 Sold in U.S.A.

2 Black and White photographs; IRWIN(Registered) Sold in U.S.A. VISE-GRIP(Registered) Pliers: Date of photos—Mar. 9, 2005.

2 Black and White photographs; AUTOZONE(Registered) Sold in U.S.A. DURALAST(Trademark) 10" Locking Pliers: Date of photos—Mar. 7, 2005.

2 B&W photographs; Home Depot(Registered) HUSKY(Registered) Long Nose Jaw Locking Pliers: Date of photos—Mar. 7, 2005 Sold in U.S.A.

Craftsman® Trademark Autolock® Trademark—Pliers and Patent Pending Pliers: Craftsman®™—Pliers, Serial No. 45604; Sears, Roebuck and Co., 3333 Beverly Rd., Hoffman Estates, Illinois 60179.

1 B&W photograph; IRWIN(Registered) VISE-GRIP(Registered) One-Hand Fast Release(Trademark) - Sold in U.S.A. :Photo date - Oct. 30, 2005.

* cited by examiner 90
86
40

92

90
86
94
92
40

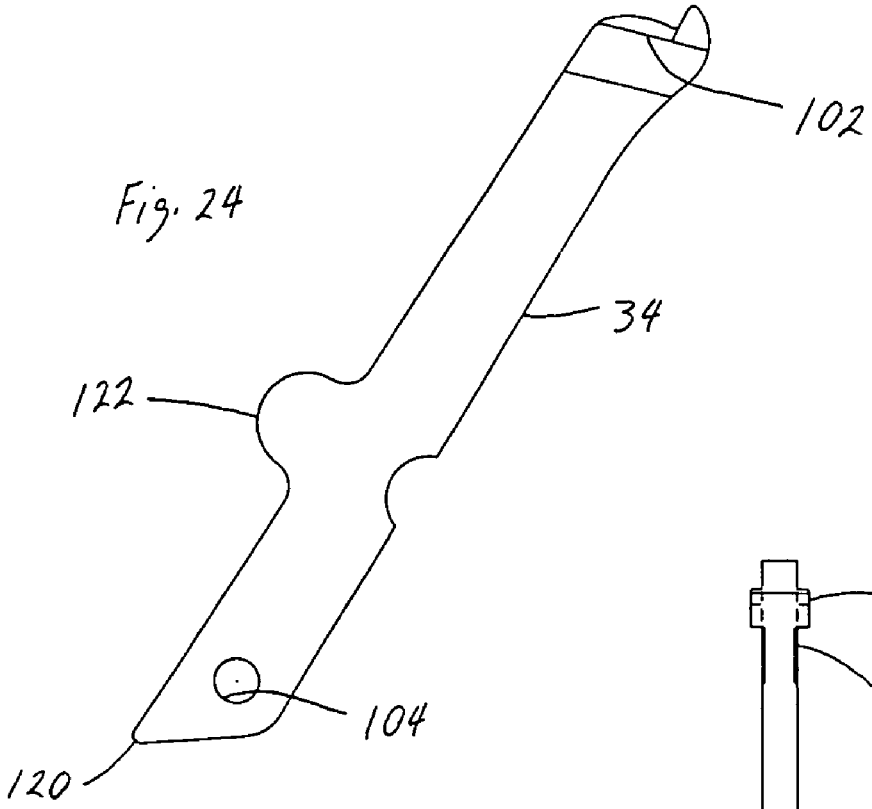
Fig. 24
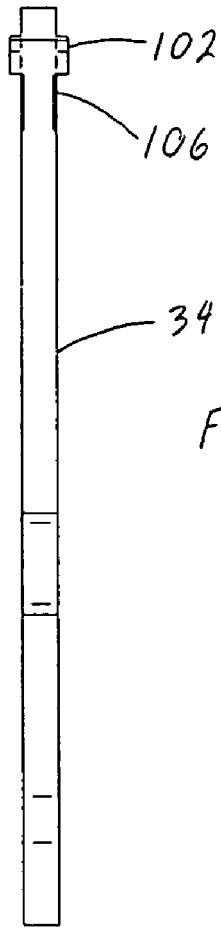
Fig. 25
Fig. 26
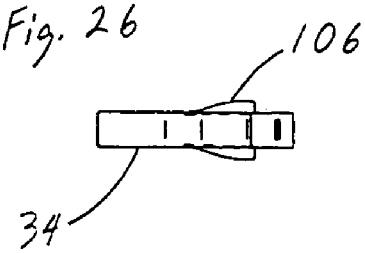

Fig. 27
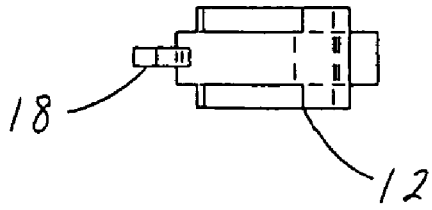
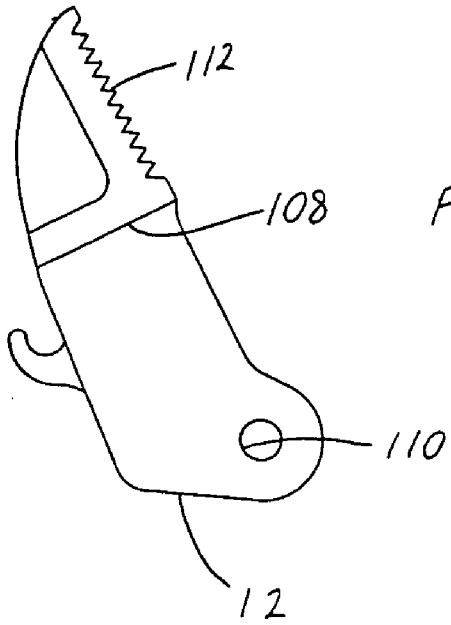
Fig. 28
Fig. 29
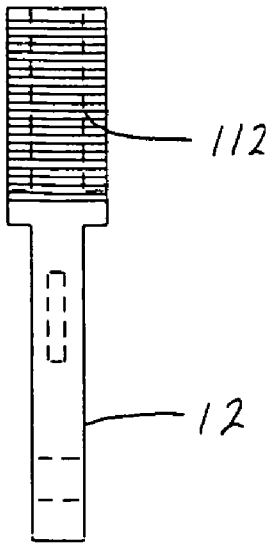

Fig. 93
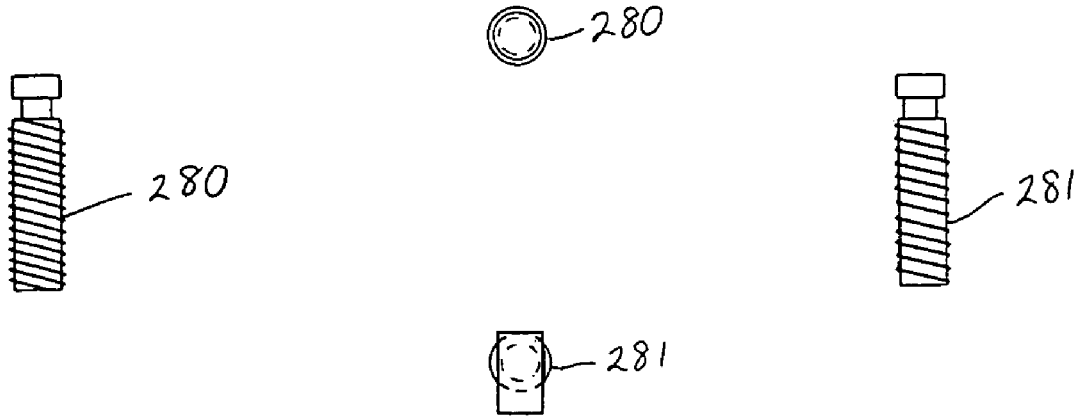
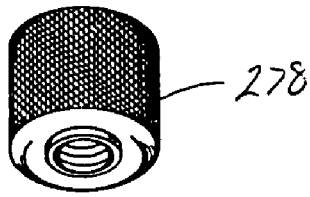
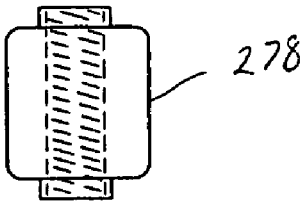
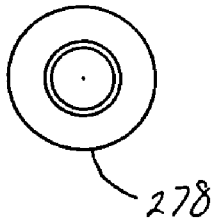
Fig. 92

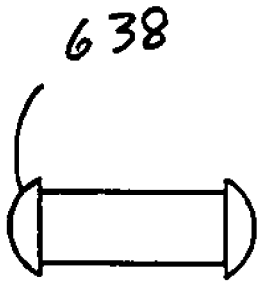
Fig. 158
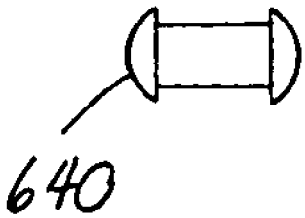
Fig. 159
Fig. 160
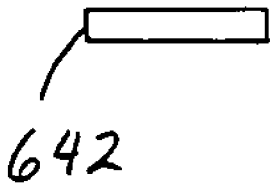

968
970
954
958
950
948
960
946
952
962
966
956
972
964

Fig. 203
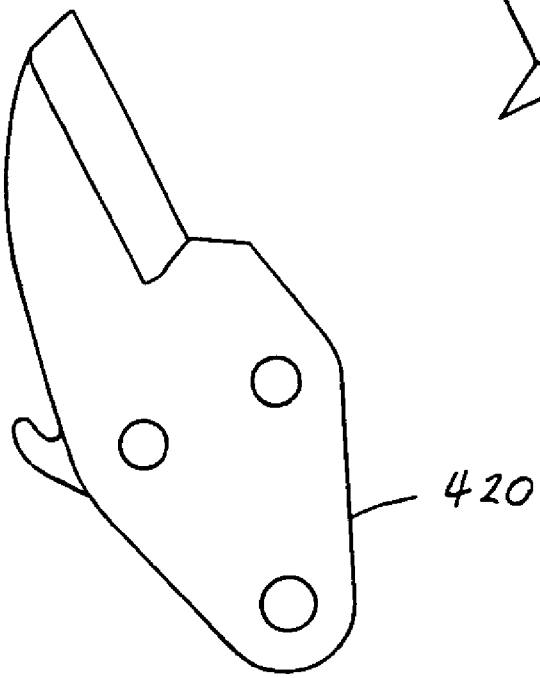
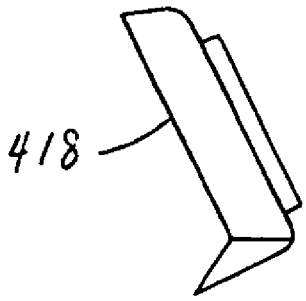
Fig. 204

Fig. 211
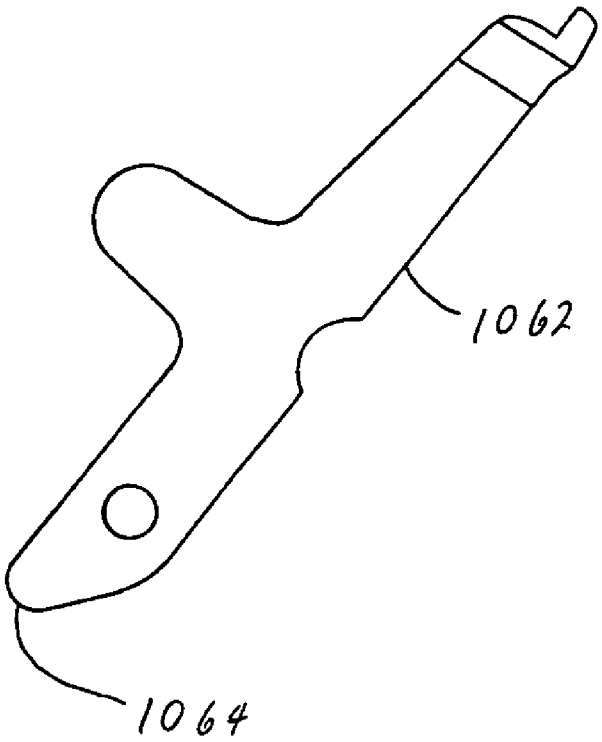
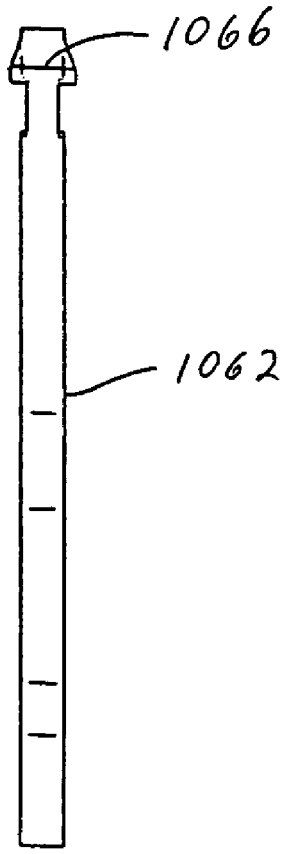
Fig. 212

Fig. 213
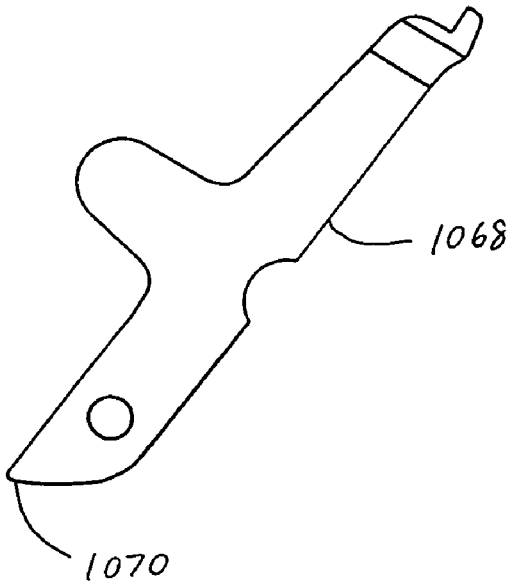
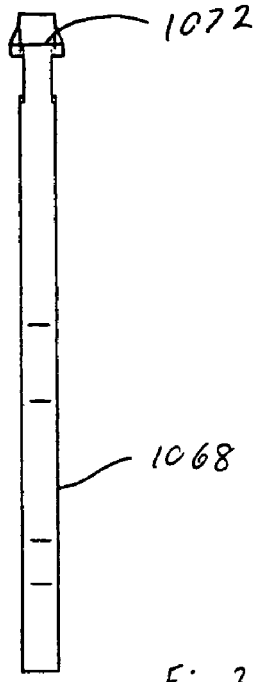
Fig. 214

1268

PARALLEL JAW LOCKING TOGGLE WRENCH/PLIERS WITH ECONOMIC/ERGONOMIC HANDLES

CROSS-REFERENCE TO RELATED APPLICATIONS

This is a Continuation-In-Part Application of my earlier filed nonprovisional application: "PARALLEL JAW LOCKING TOGGLE PLIERS/WRENCH WITH ERGONOMIC/ECONOMIC HANDLES"—Appn. No. 10/034,684—Filing Date Dec. 28, 2001, now abandoned; and discloses information contained in my earlier filed nonprovisional application "PARALLEL JAW LOCKING PLIERS WITH MODIFIED ERGONOMIC/ECONOMIC HANDLES"—Appn. No. 09/654,870—Filing Date Sep. 1, 2000, now abandoned; and discloses information contained in my earlier filed provisional applications: "PARALLEL JAW LOCKING PLIERS"—Appn. No. 60/138,571—Filing Date Jun. 11, 1999 and "PARALLEL JAW LOCKING PLIERS WITH ERGONOMIC HANDLES"—Appn. No. 60/267,914—Filing Date—02/06/2001; and also discloses information contained in my earlier filed nonprovisional application: "AUTOMATIC SELF-SIZING PARALLEL JAW LOCKING PLIERS"—Appn. No. 09/200,189—Filing Date Nov. 25, 1998, now-abandoned.

FEDERALLY SPONSORED RESEARCH

Not Applicable

SEQUENCE LISTING OR PROGRAM

Not Applicable

BACKGROUND OF THE INVENTION

1. Field of the Invention

This invention broadly relates to a class of adjustable locking pliers (such as the type utilizing a locking toggle), and more narrowly relates to adjustable locking pliers embodying opposing jaw members having parallel relationship (being also categorized as toggle wrenches), with handles economically constructed incorporating an ergonomic design.

2. Description of Related Art including information disclosed under 37 CFR 1.97 and 1.98

Well known to the art are conventional locking pliers having opposing jaw members communicating pivotally - with a movable jaw member applying clamping force by its levered rotation around a central point housed in the body of the conventional locking pliers. Known to the art are parallel grip pliers having opposing jaw members communicating pivotally in an adjustable parallel relationship - with a movable jaw member applying clamping force by its levered rotation around multiple points housed in the body of the parallel grip pliers. Also known in the art are parallel action toggle wrenches having opposing jaw members communicating slidable in an adjustable parallel relationship - with a movable lower jaw member slidable and secured to parallel opposing outer side edge length dimensions of a rectangularly shaped support member.

As it is known in the prior art concerning the type of pliers above-mentioned, all parallel action toggle wrenches have in common a movable lower jaw member constructed with parallel opposing structures slidable and contacting and pressuring parallel opposing outer side edge length dimensions of a rectangularly shaped support member - resulting in a tendency for the movable lower jaw member to bind (while opposing jaw members are under pressure) along the above-mentioned outer side edge length dimensions of the rectangularly shaped support member. This binding pressure makes releasing the movable lower jaw member from the outer side edge length dimensions of the rectangularly shaped support member difficult during the release of clamping pressure from the clamped object.

In contemplation of the Specification, the prior art has not provided adjustable toggle locking pliers embodying parallel opposing jaw members utilizing a substantially rectangular shape support member section with mechanisms of releasing clamping pressure more closely resembling the release of clamping pressure employed by conventional toggle locking pliers.

(1) Disadvantages of Conventional Locking Pliers and/or Automatic Adjusting Locking Pliers:

(a) Jaw members not in parallel relationship - resulting in jaw slippage from less surface area contact with object (or objects) being clamped.

(b) Width adjustment between handles (toggle angle adjustment) being difficult to determine and keep secured during clamping/releasing procedure - resulting in an awkward over adjustment and subsequent readjustment of adjustment screw and/or toggle stop screw.

(2) Disadvantages of Parallel Grip Pliers:

(a) A movable lower handle located below its fixed upper handle - resulting in a reduction of mechanical advantage - when compared to pliers having a movable upper handle located over a fixed lower handle (as in tongue and groove slip-joint pliers).

(b) Handle construction being not of ergonomic/economic design - results in awkwardness during handle operation by the reduction of hand grip.

(3) Disadvantages of Parallel Action Toggle Wrenches:

(a) Handle construction being not of ergonomic/economic design - results in awkwardness during handle operation by the reduction of hand grip.

(b) Toggle release lever upper handle design being partially housed slidable in a lower handle design - results in awkwardness during the clamping/releasing procedure from the subsequent increased lower handle width dimension (width dimension measured from either top or bottom view).

(c) Lower handle design having an externally mounted toggle adjustment assembly - results in uncomfortableness during handle operation by the reduction of hand grip.

(d) Movable lower jaw member design has rigidly mountable parallel opposing structures slidable and binding along parallel opposing side edge lengthwise dimensions of a rectangularly shaped support member.

The disadvantages of conventional and/or parallel locking pliers are the difficulty in determining the readjustment of the locking toggle before different size objects are clamped; and cost of manufacture.

(4) The disadvantages of automatic self-sizing locking pliers are:

(a) The awkward release of the locking mechanism.

(b) The awkward position of the locking mechanism when in the unlocked mode.

(c) Jaw members being not parallel when clamped.

BRIEF SUMMARY OF THE INVENTION

As defined by the above-identified Invention: To provide locking pliers with jaw members having an adjustable parallel relationship - applying a symmetrical clamping force across the surface area of the object (or objects) being clamped; including having mechanical leverage advantages by locating a movable upper handle pivoting over a lower fixed handle; and including having ease of use advantages of presetting the clamping force to be applied - by having one of the two toggle angle positioning apparatus located in the movable upper handle; and including having ease of use advantages of a movable upper handle always being in a readily gripping distance from a lower fixed handle - during the toggle angle adjustment or handle manipulation; and including having ease of use advantages by incorporating ergonomics into handle design; and including having economical advantages by affording a handle design which makes use of construction techniques commonly used in the field; and also having pliers incorporating a compound toggle link assembly to easily release clamping pressure.

Therefore in contemplation of the Specification, thereby allowing the user to easily determine the proper handle position (toggle angle adjustment) by singularly adjusting the jaw members (by turning the toggle angle adjustment located in the lower fixed handle) to contact the object or objects once before being clamping - as compared to pliers of similar design where the above-defined clamping procedures have to be repeated in order to achieve the desired clamping pressure.

(5) The advantages of the above-identified invention are:

(a) An increase in work efficiency.

(b) A symmetrical clamping force applied to the surface area of jaw members.

(c) A compound toggle link allows for the user a way of easily unlocking locked handle mechanisms, thereby releasing the clamping exerted by jaw members.

(d) A reduction in cost by having a support member with integral strengthening ribs serving the dual purpose of providing rigidity to the support member, and providing the track assembly (under (8)(e)) a guide mechanism to maintain the parallelism of jaw members.

(6) Advantages of the Invention are:

(a) A reduction in jaw slippage is accomplished with parallel jaw members.

(b) An easily determined handle position (toggle angle) and securable toggle stop allow for increased work efficiency - by not having to repeatedly readjust the toggle angle to determine clamping pressure during the clamping/releasing procedure.

(c) Increased mechanical advantage is provided (by locating a movable upper handle over a fixed lower handle) during the clamping procedure - resulting in increased work efficiency.

(d) Ergonomic/economic mechanism of manufacture reduces consumer cost and increases work efficiency.

(e) The use of (7)(e)(i), (7)(e)(ii), or (7)(e)(iii) increases work efficiency by allowing for the clamping/releasing procedure to be performed more speedily as compared to the clamping/releasing procedures of the prior art parallel action toggle wrenches.

(7) Objects of Parallel Jaw Locking Toggle Wrench/Pliers with Economic/Ergonomic Handles (the Invention)

(a) To provide locking pliers with opposing jaw members having parallel relation.

(b) To provide locking pliers with readily manipulatable handles - having securable toggle angle adjustments being easily determined during the clamping/releasing procedure.

(c) To provide locking pliers with increased mechanical advantage by locating a movable upper handle over a fixed lower handle.

(d) To provide locking pliers with an ergonomic/economic mechanism of manufacture by the utilization of stamping, rivets, welds, forging and the other forms of construction as described herein; and also to provide locking pliers with a comfortable movable upper handle hand grip section conforming more to the shape of the palm of the hand.

(e) To provide locking pliers with mechanisms of clamping/releasing objects more closely resembling the ease of the clamping/releasing procedure of conventional toggle locking pliers: by (i) use of rectangular shape parallel opposing center slots in the support member; or by (ii) use of mountable movable lower jaw member structures contacting and pressuring slidable along the parallel opposing outer side edge lengthwise dimensions of a rectangular support member; or by (iii) use of a combination of both (i) and (ii).

(8) The objects of the above-identified Invention are:

(a) To provide easily releasable locking mechanism.

(b) To provide handle members having easily accessible position.

(c) To provide jaw members being parallel during operation.

(d) To provide handle members a mechanism of incorporating a compound toggle link.

(e) To provide a support member with substantially rectangularly shaped integral strengthening ribs; and the integral strengthening ribs having substantially accurate internal parallel guide surfaces spaced parallel apart; and the internal parallel guide surfaces forming substantially parallel voids running internally and centrally lengthwise along the support member; and the parallel voids accepting a movable jaw member having substantially accurate slidable guide mechanisms internally contiguous to the internal parallel guide surfaces; and the mechanisms described under (8)(e) form a track assembly.

BRIEF DESCRIPTION OF THE SEVERAL VIEWS OF THE DRAWINGS

Drawing figures, closely related have the same number but different alphabetic suffixes.

FIG. 1A is simplified by omitting some details, for purposes of conveying a better comprehension of related parts.

FIG. 24 - side view of toggle with lines indicating position of forming process.

FIG. 25 - top view of toggle showing position of rivet hole.

FIG. 26 - rear view of toggle with hidden dimensions shown by dashed lines.

FIG. 27 - front view of slidable jaw member with hidden dimensions shown by dashed lines.

FIG. 28 - side view of slidable jaw member showing contact edge (edge which slides along support member of lower handle).

FIG. 29 - top view of slidable jaw member showing position of rivet hole by dashed lines.

FIG. 92 - is an isometric, rear, and side view of a rotatable adjustable knob internally mountable in an upper handle.

FIG. 93 - is a front and side view of an adjustable threaded member threading into adjustable knob and attachable to an adjustment member.

Figure 116:
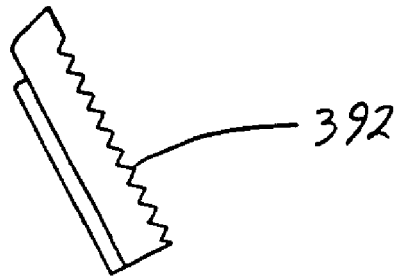
Figure 116:
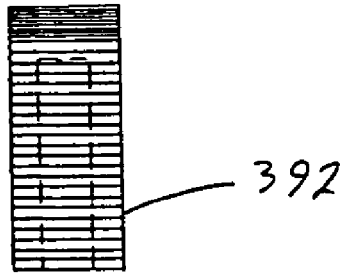

FIG. 116 - is a side and bottom view of fixed jaw member insert having an attachment portion.

Figure 117:
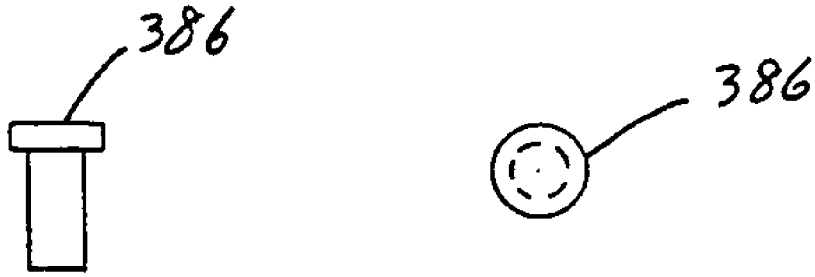

FIG. 117 - is a side and top view of slidable jaw member pin being substantially in a constructible shape prior to assembly.

Figure 112:
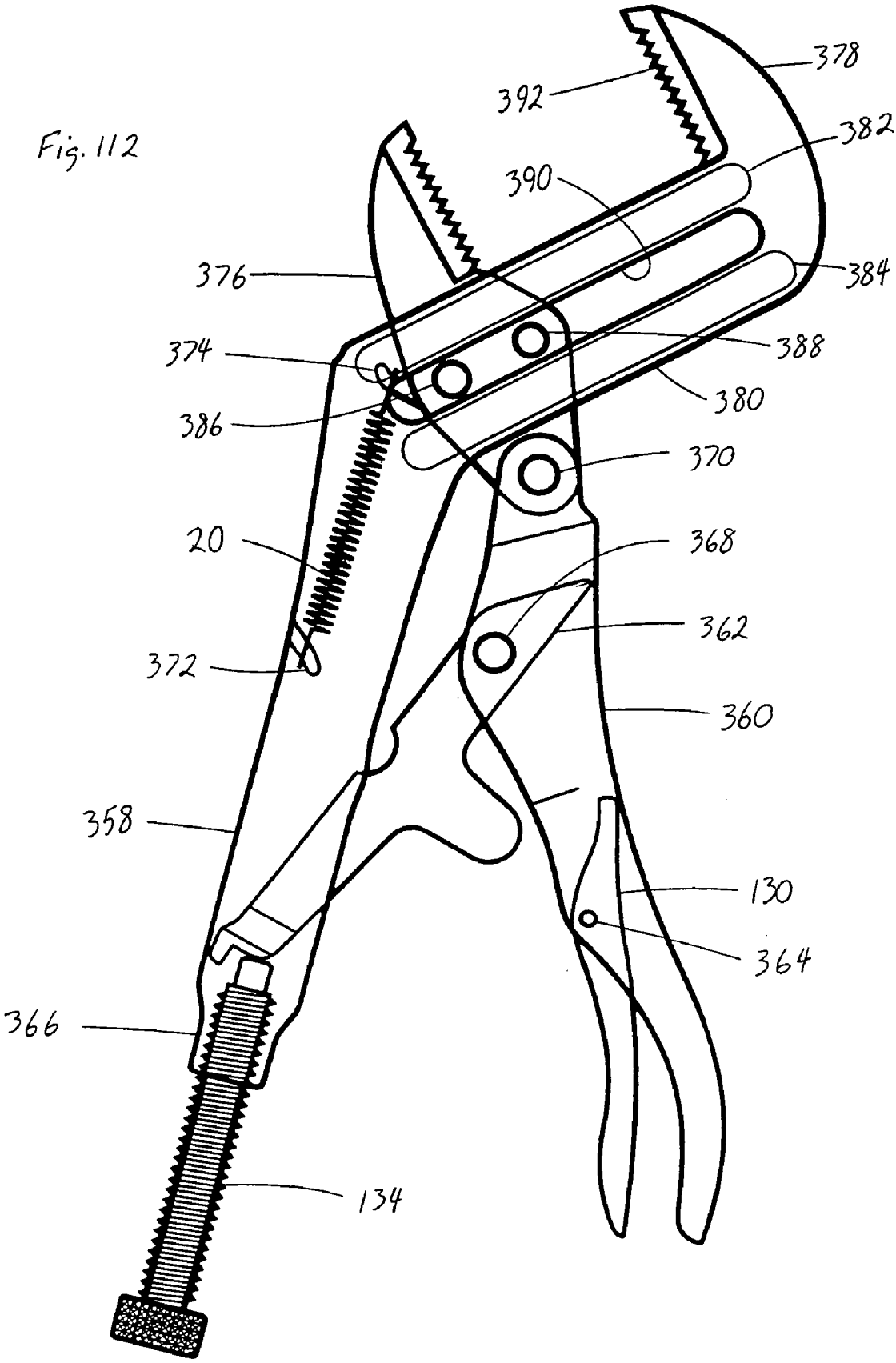
FIG. 112 - is a comprehensive side view showing overall dimensions of mechanisms in working relationship, with the thinnest lines representing metal formation, with hidden mechanisms represented by thicker continuous lines, with the outer dimensions represented by the thickest continuous lines.
Figure 118:
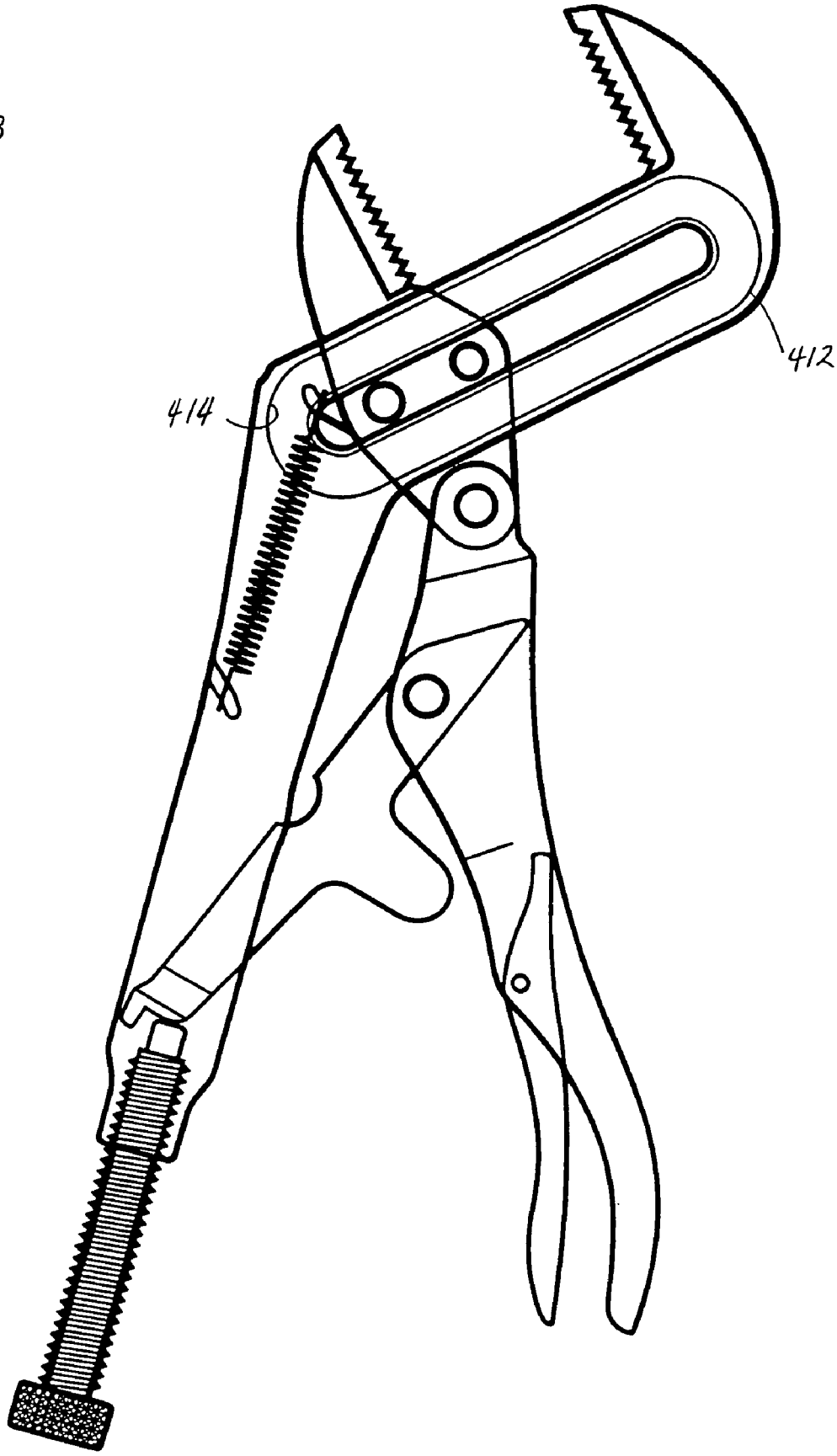

FIG. 118 - is a side view of an alternate design to FIG. 112 showing strengthening ribs surrounding center slots.

Figure 119:
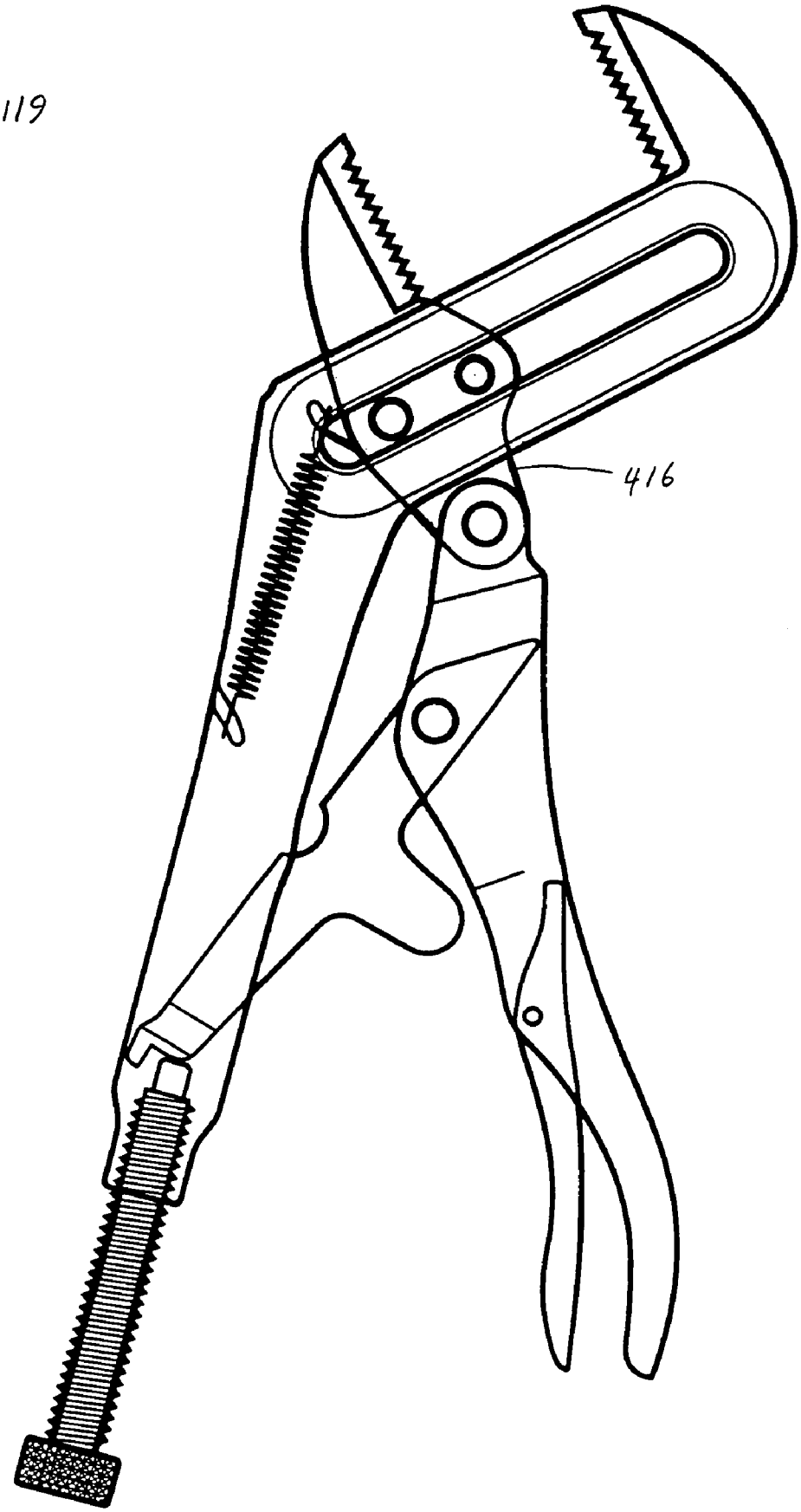

FIG. 119 - is a side view of an alternate design to FIG. 118 showing slidable jaw member with a reduced height dimension.

Figure 120:
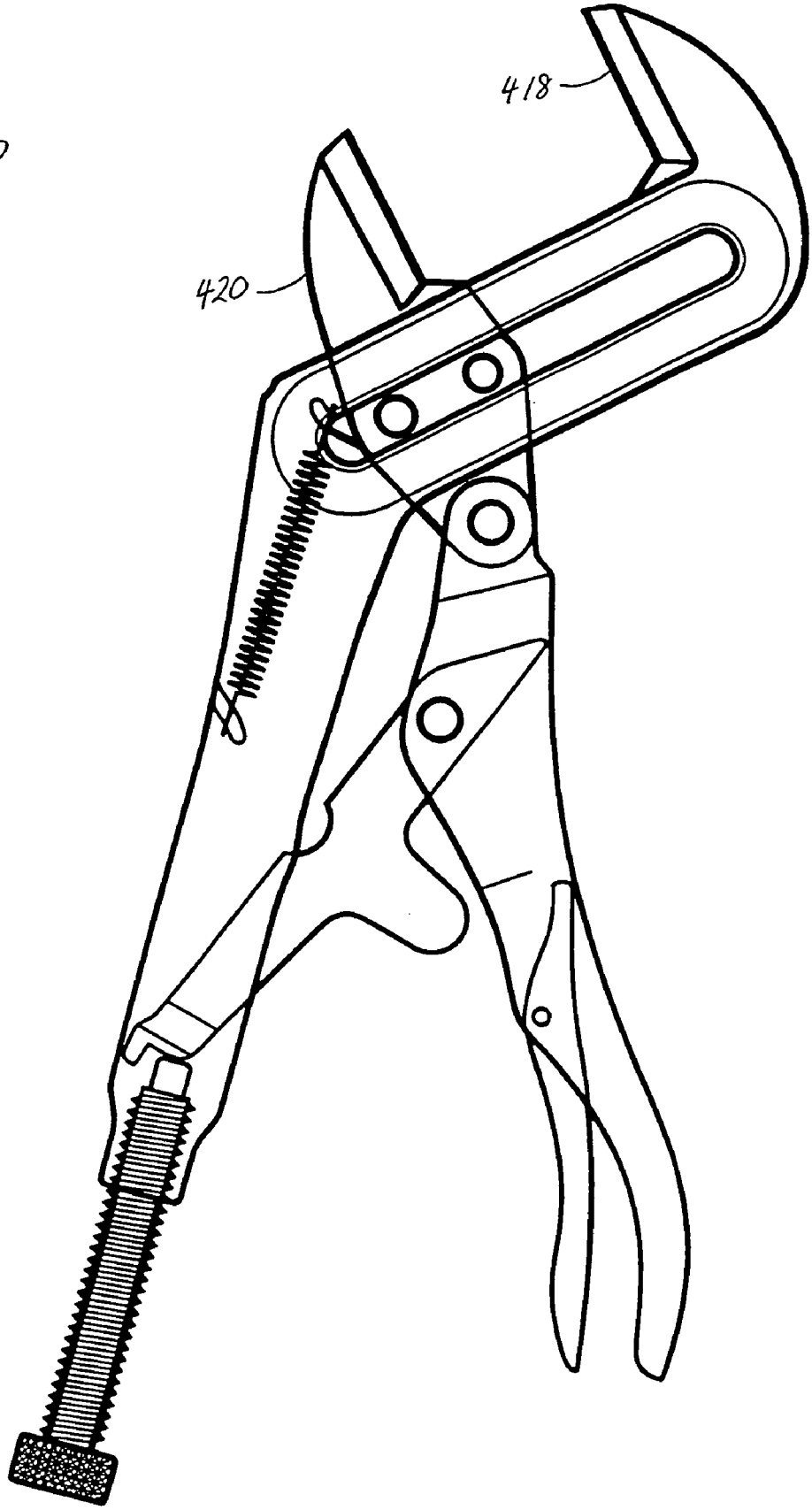

FIG. 120 - is a side view of an alternate design to FIG. 118 showing fixed and slidable jaw members having compression surfaces comparable in design and function to those utilized in adjustable wrench designs.

Figure 121:
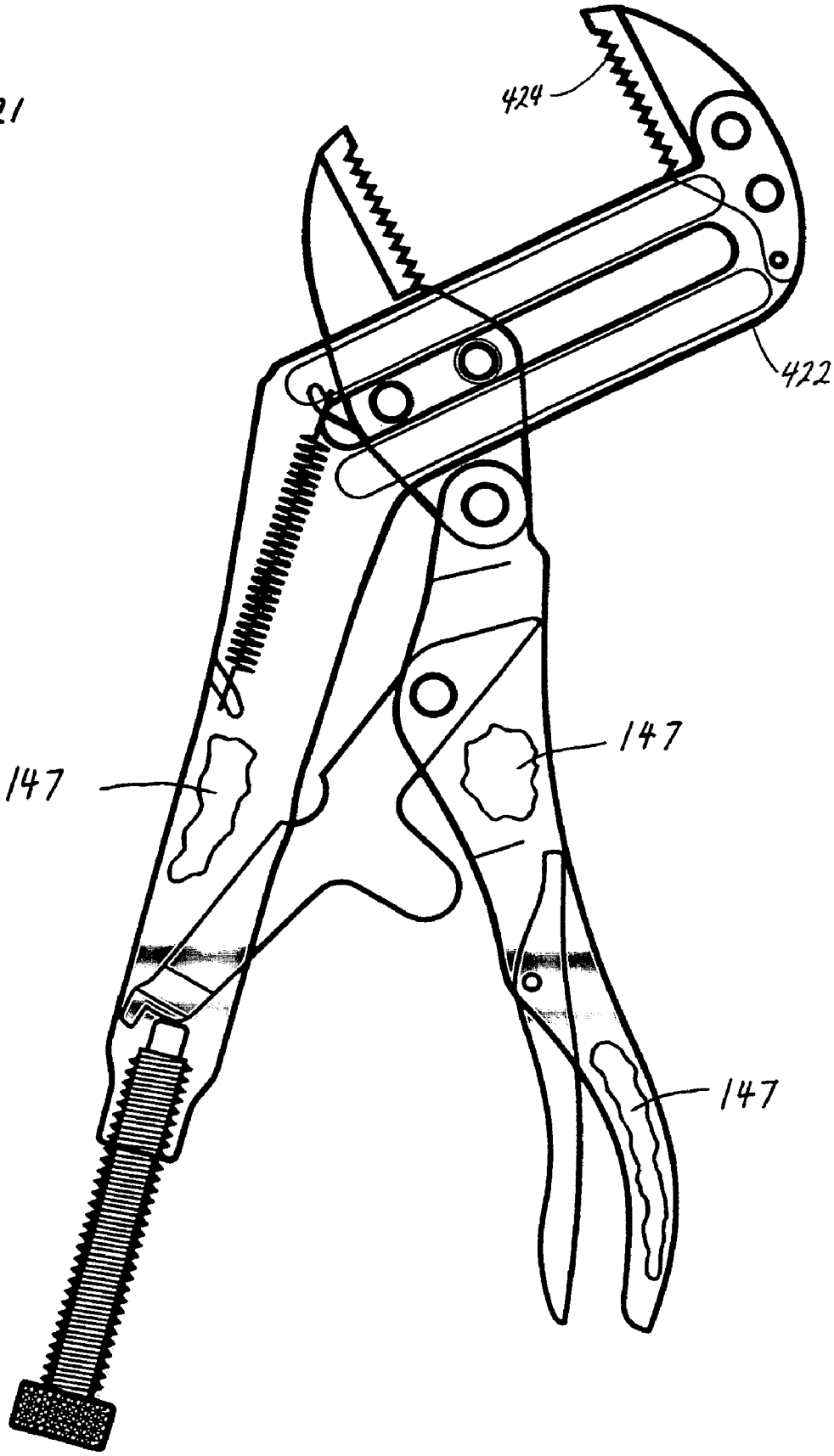

FIG. 121 - is a side view of an alternate design to FIG. 112 having fixed jaw member riveted to support member.

Figure 122:
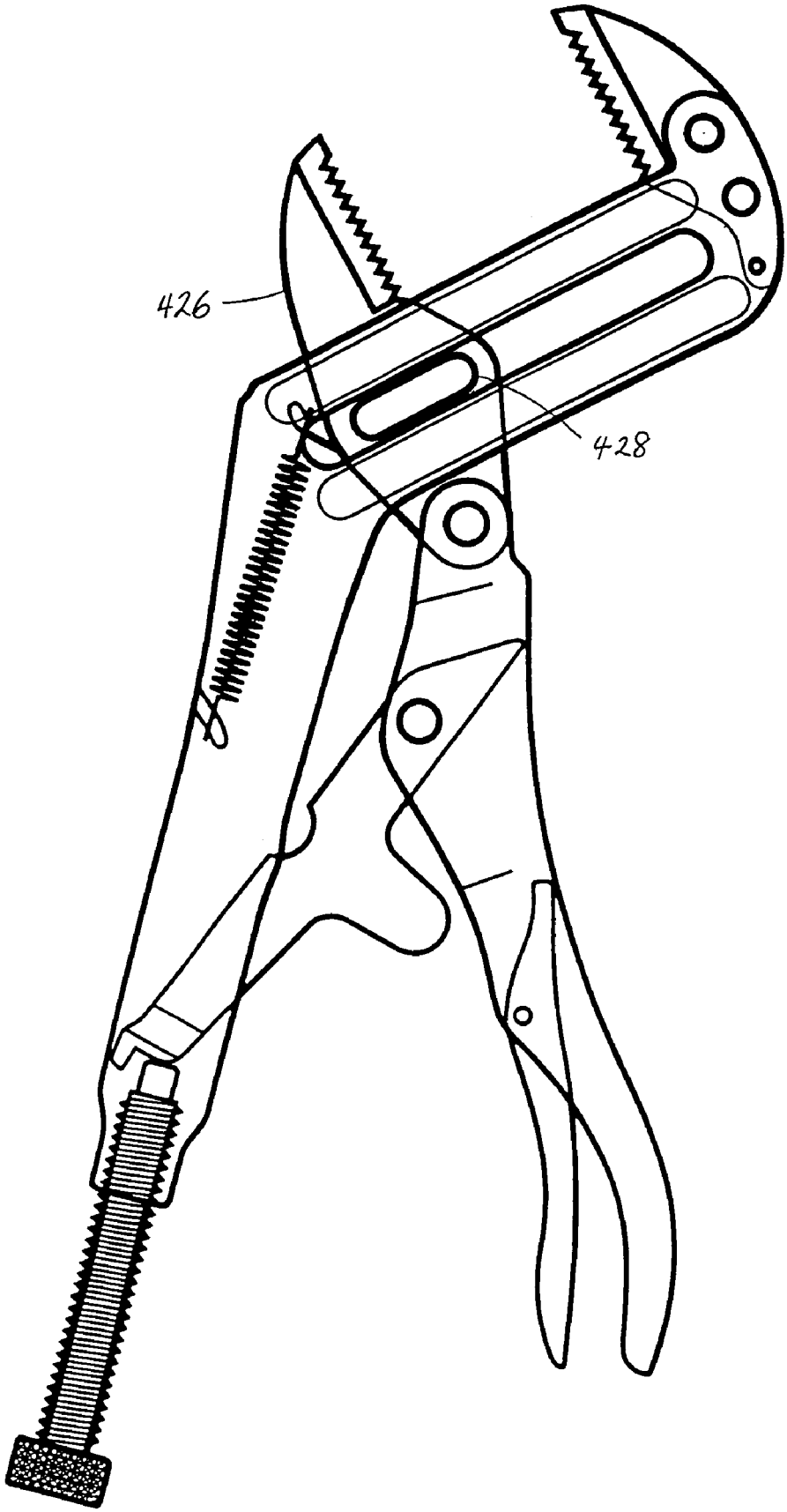

FIG. 122 - is a side view of an alternate design to FIG. 121 showing slidable jaw member having integrally formed projections.

Figure 123:
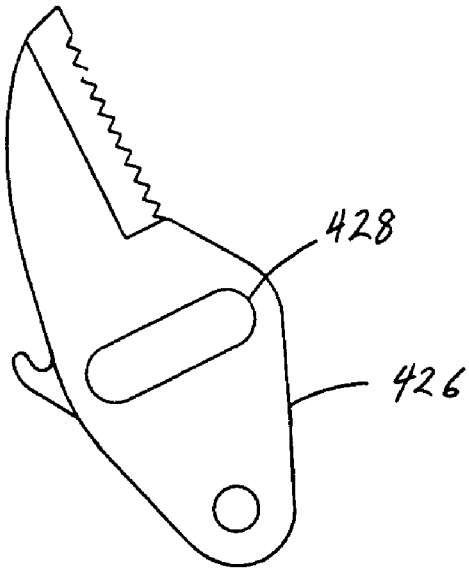
Figure 123:
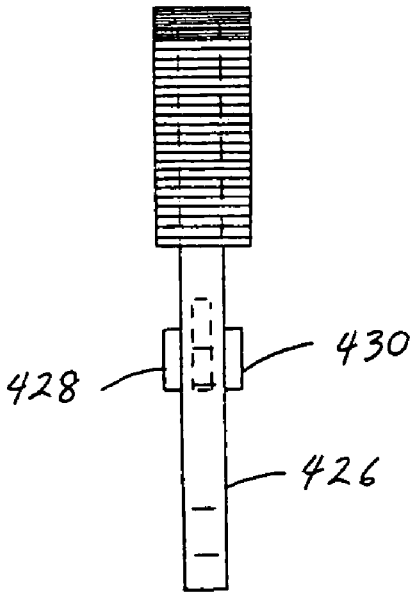

FIG. 123 - is a side and top view of slidable jaw member showing position of projections.

Figure 124:
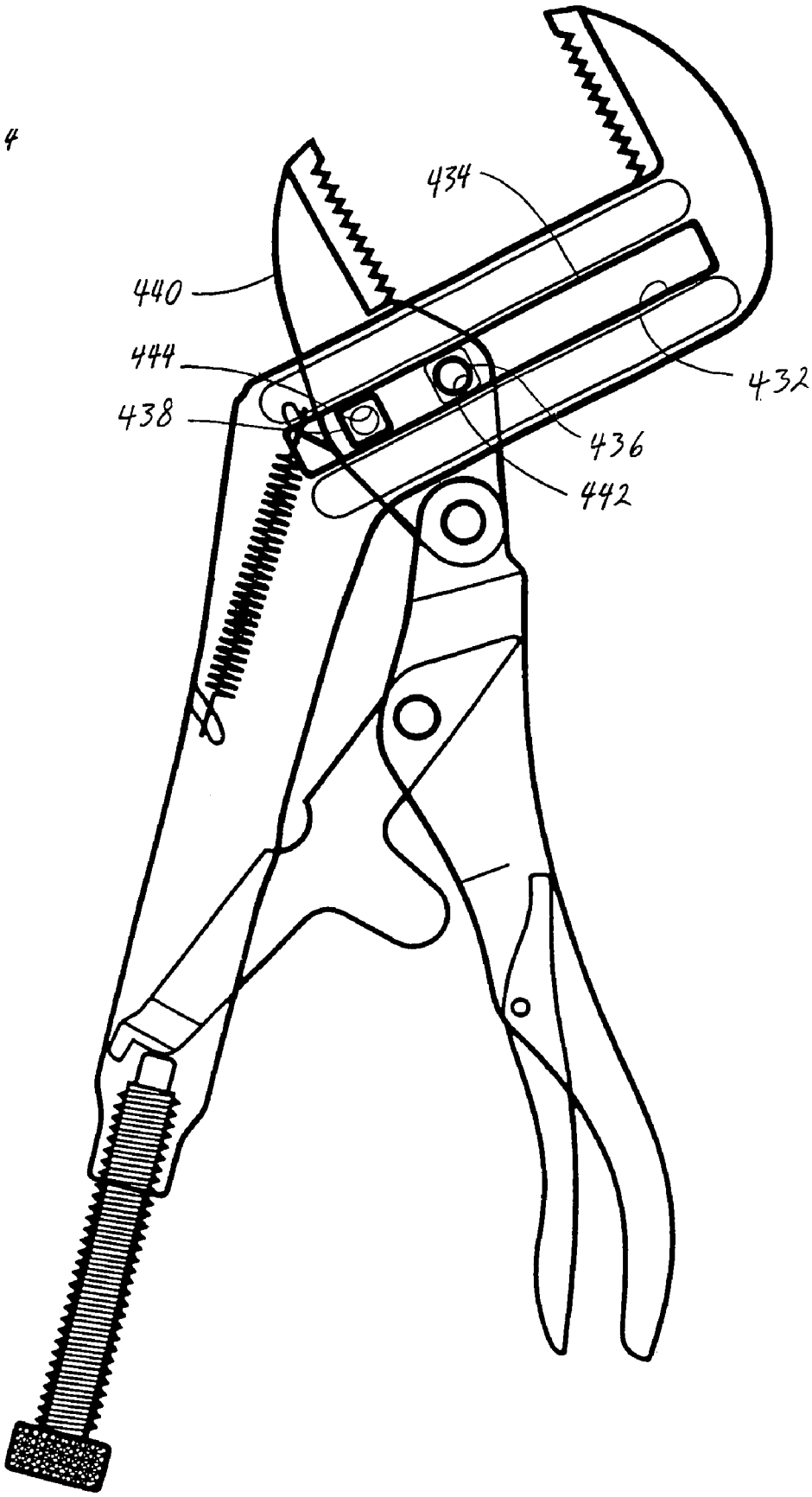

FIG. 124 - is a side view of an alternate design to FIG. 112 having mounted pins.

Figure 125:
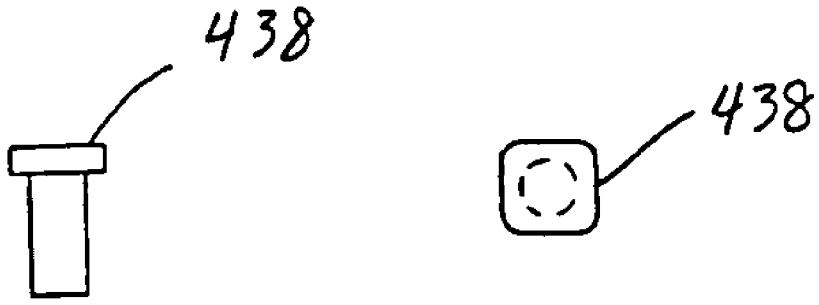

FIG. 125 - is a side and top view of an alternate design to FIG. 117 showing a substantially square head shape of slidable jaw member pin.

Figure 126:
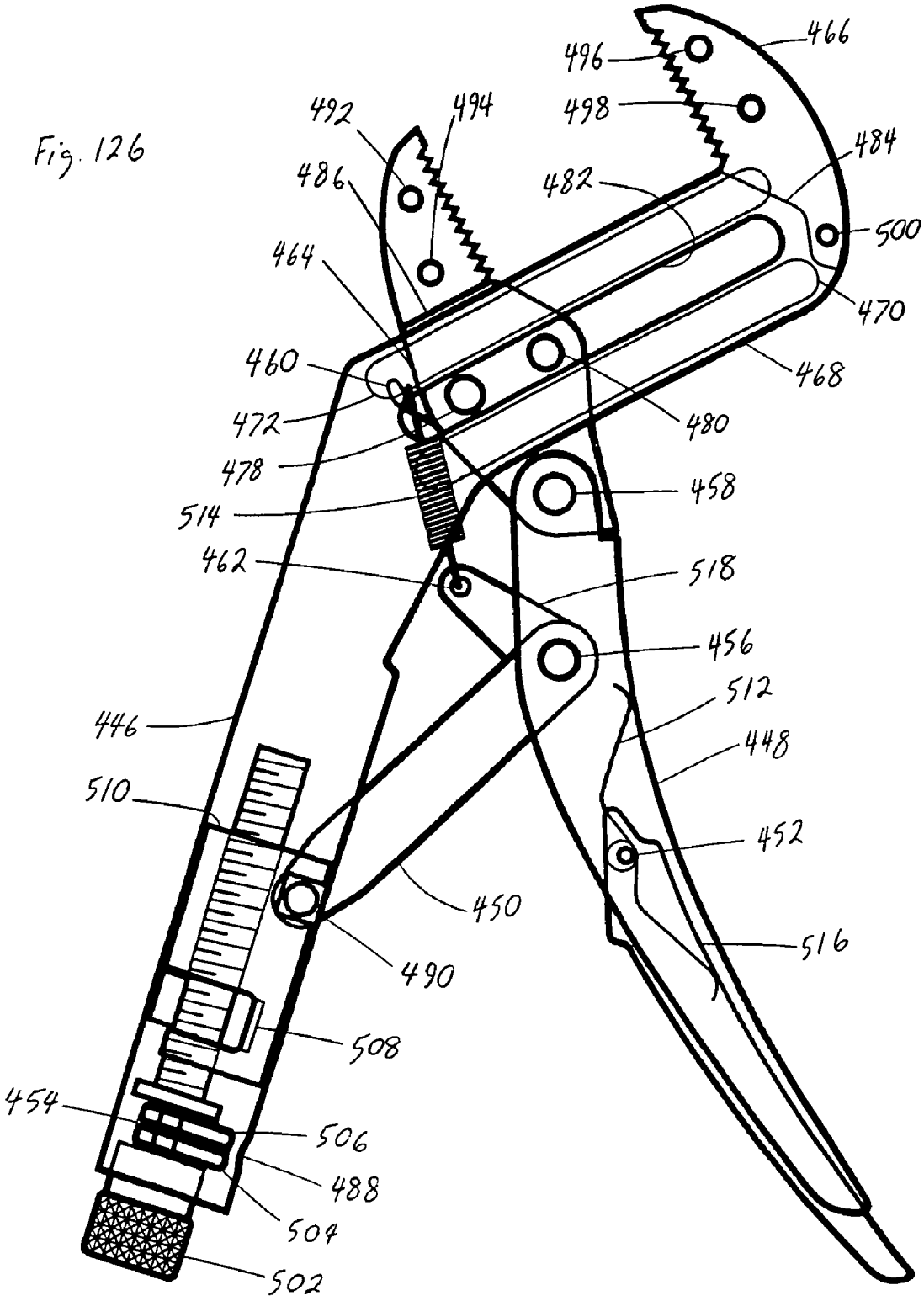

FIG. 126 - is a comprehensive side view showing overall dimensions of mechanisms in working relationship, with hidden mechanisms represented by thinner continuous lines. The depiction of FIG. 126 is simplified by omitting some details for purposes of conveying a better comprehension of related parts.

Figure 127:
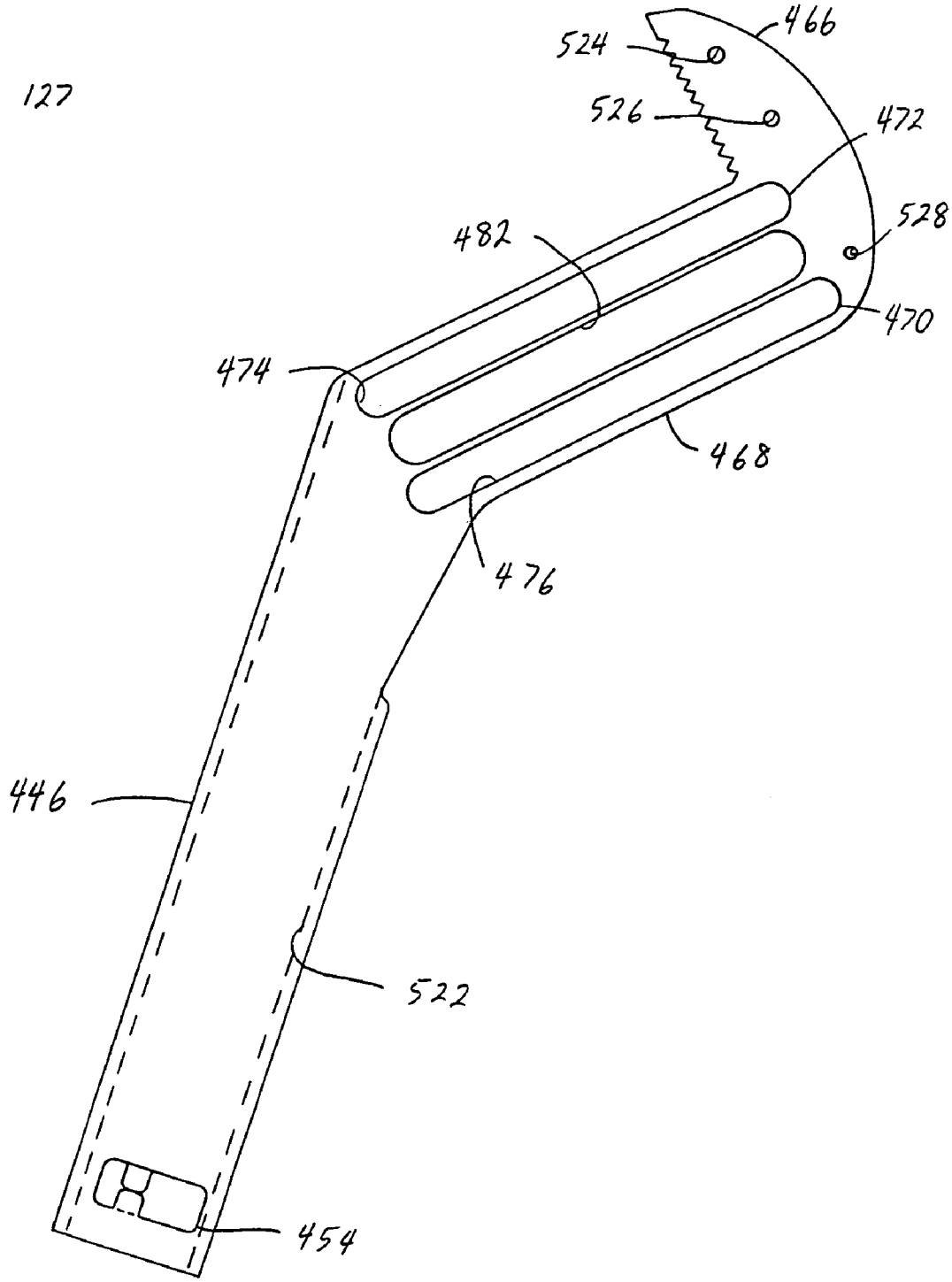

FIG. 127 - is a side view of lower handle with hidden dimensions shown by dashed lines, with rear housing slots formed rearwardly of support member center slots.

Figure 128:
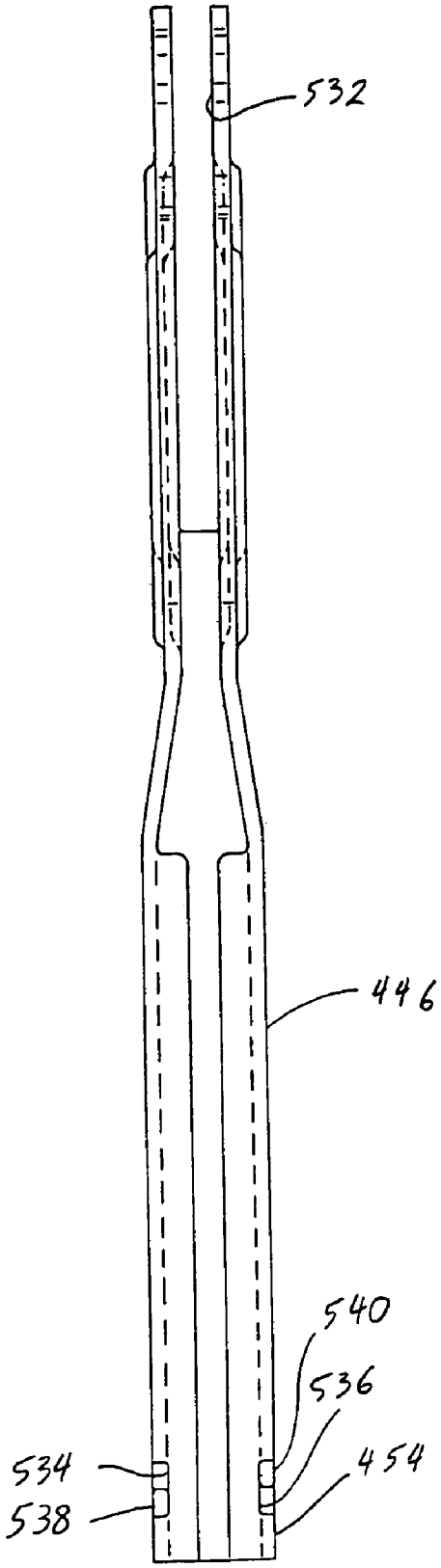

FIG. 128 - is a top view of lower handle showing integrally formed fixed jaw member plates being in a spaced relation.

Figure 129:
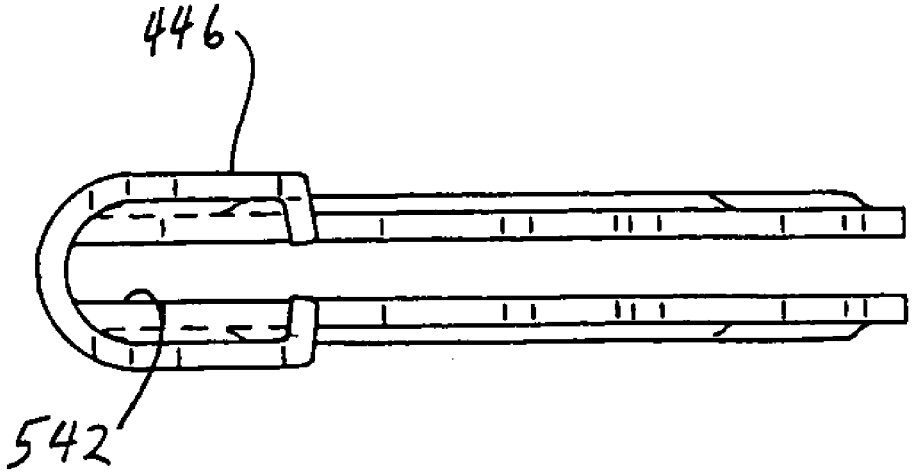

FIG. 129 - is a rear view of lower handle showing a rear housing opening.

Figure 130:
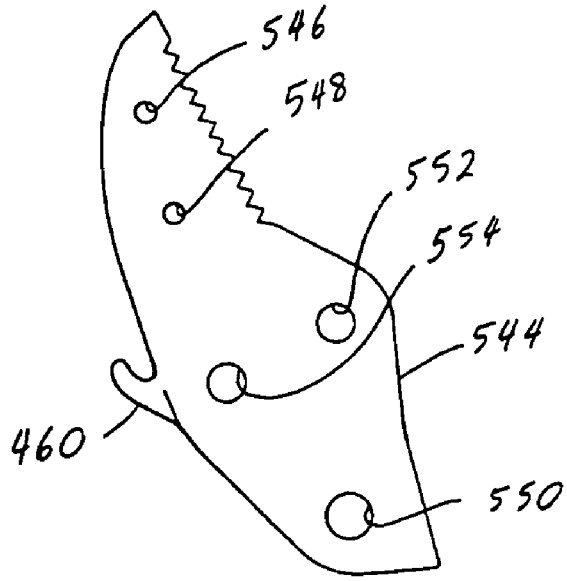
Figure 130:
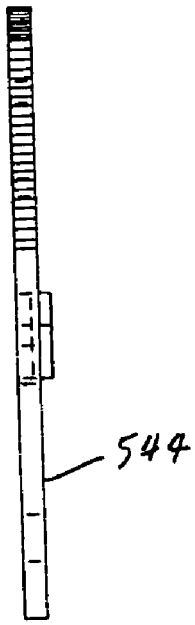

FIG. 130 - is a side and top view of slidable jaw member plate having rivet and pin holes and hook.

Figure 131:
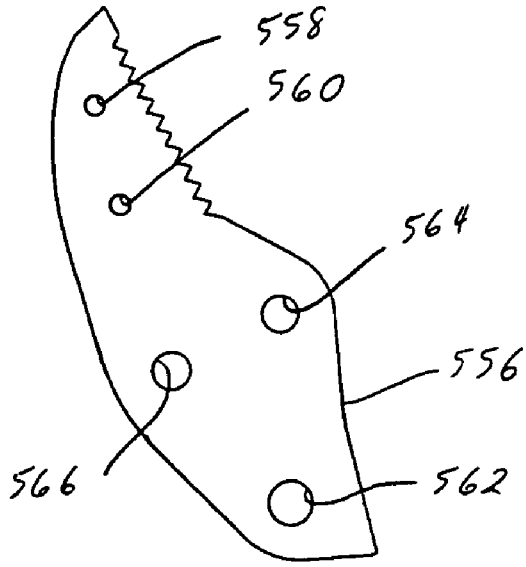
Figure 131:
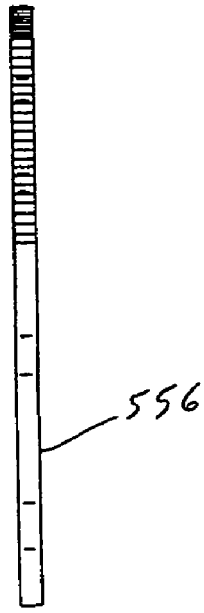

FIG. 131 - is a side and top view of slidable jaw member plate having rivet and pin holes.

Figure 132:
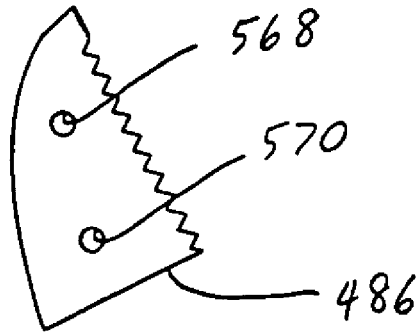
Figure 132:
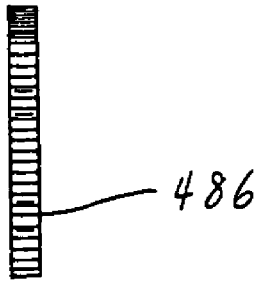

FIG. 132 - is a side and top view of slidable jaw member plate having rivet holes.

Figure 133:
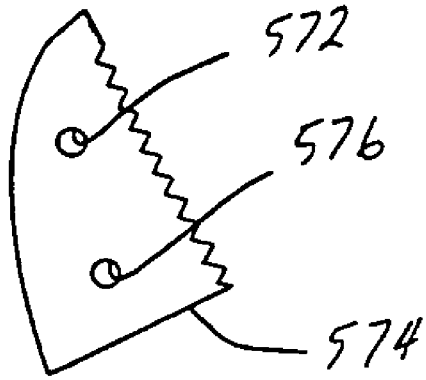
Figure 133:
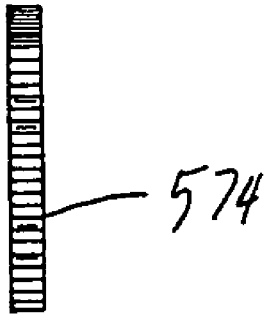

FIG. 133 - is a side and top view of slidable jaw member plate having rivet holes.

Figure 134:
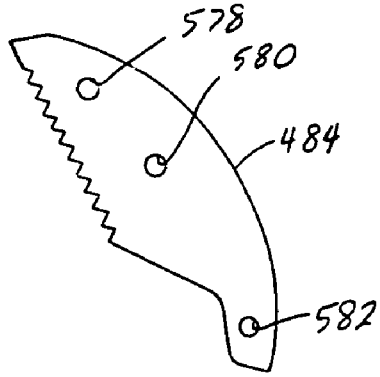
Figure 134:
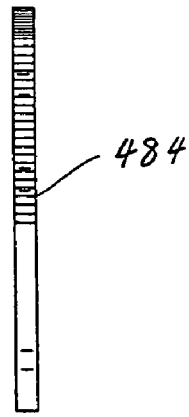

FIG. 134 - is a side and top view of fixed jaw member plate having rivet holes.

Figure 135:
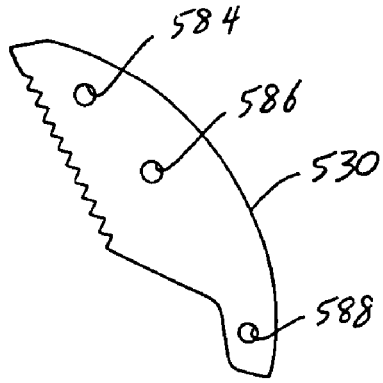
Figure 135:
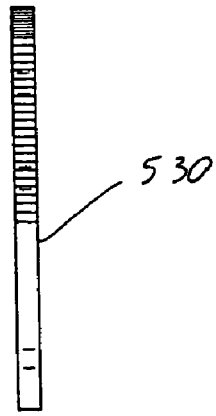

FIG. 135 - is a side and top view of fixed jaw member plate having rivet holes.

Figure 136:
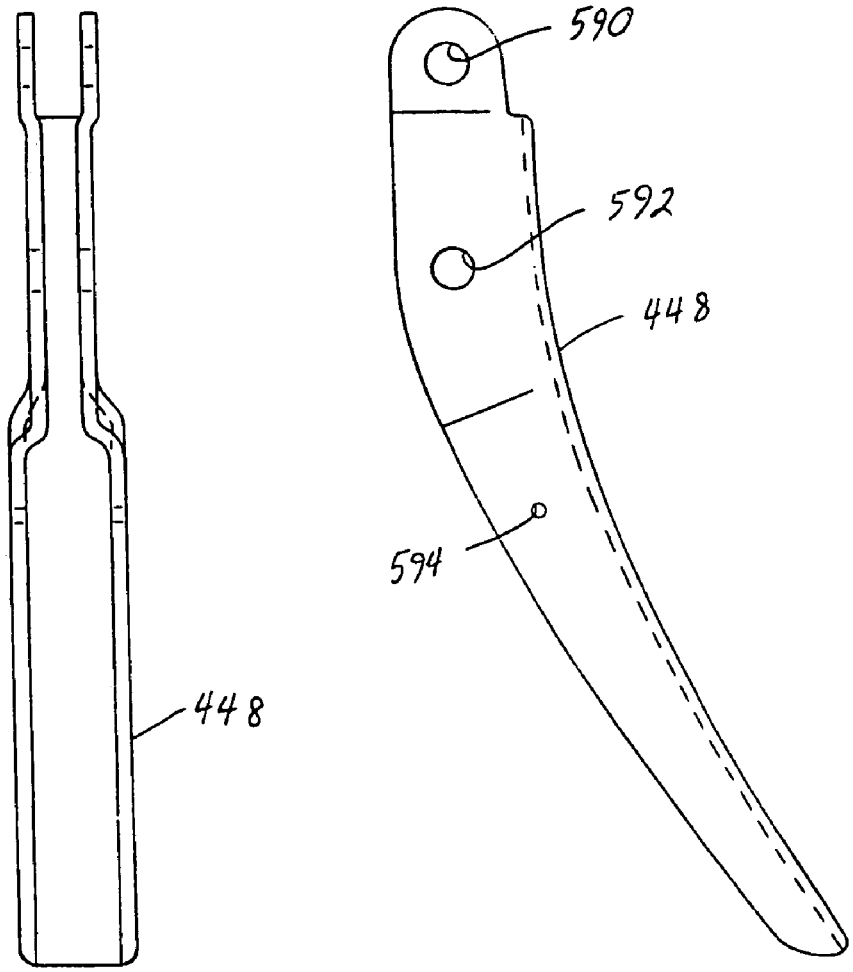

FIG. 136 - is a side and bottom view of upper handle having an substantially arced portion for hand grip.

Figure 137:
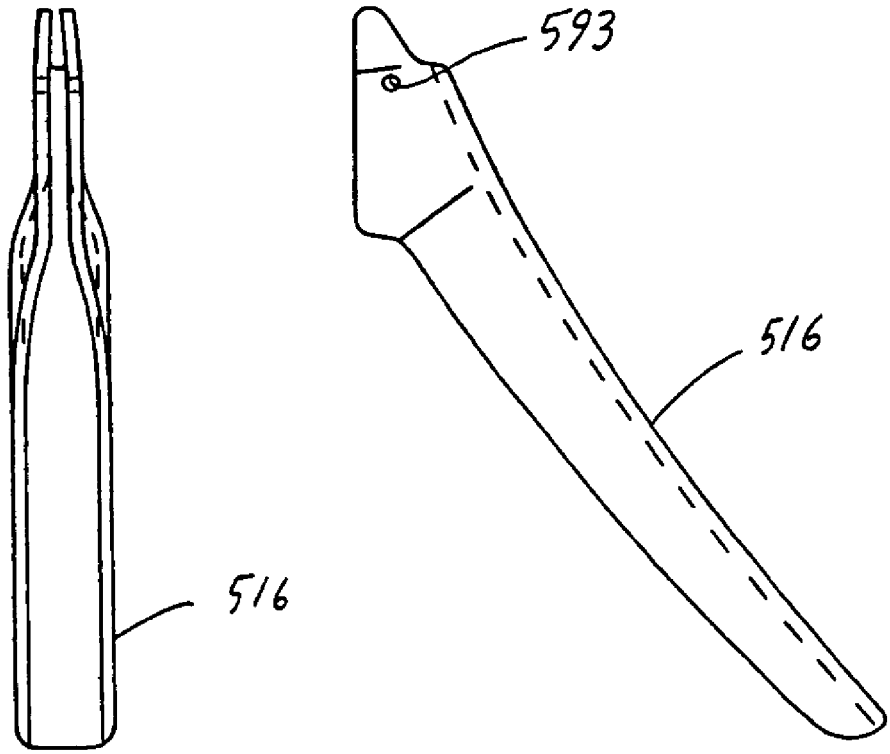

FIG. 137 - is a side and bottom view of release lever substantially formed with an arc shape.

Figure 138:
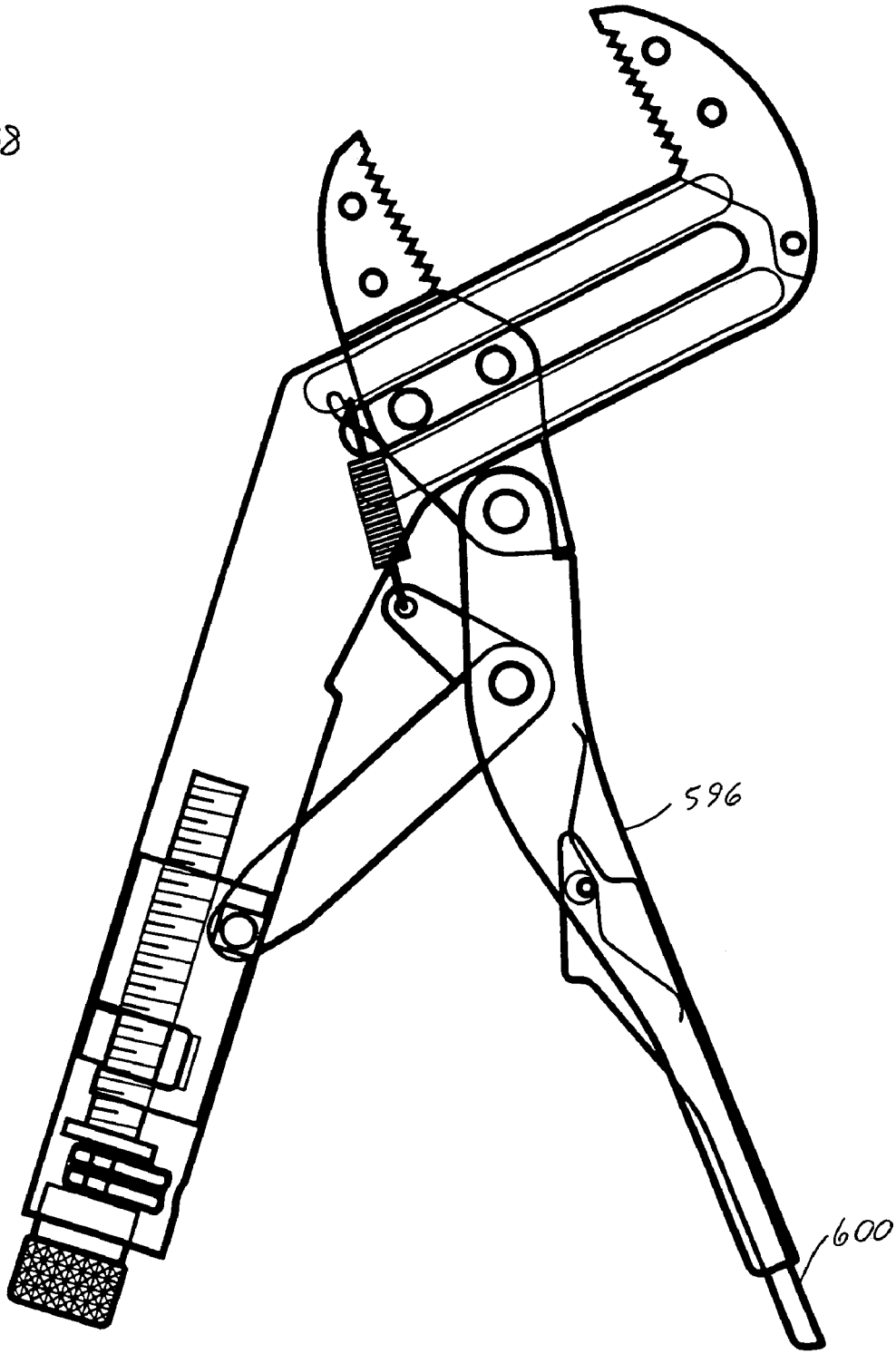

FIG. 138 - is a side view of an alternate design to FIG. 126.

Figure 139:
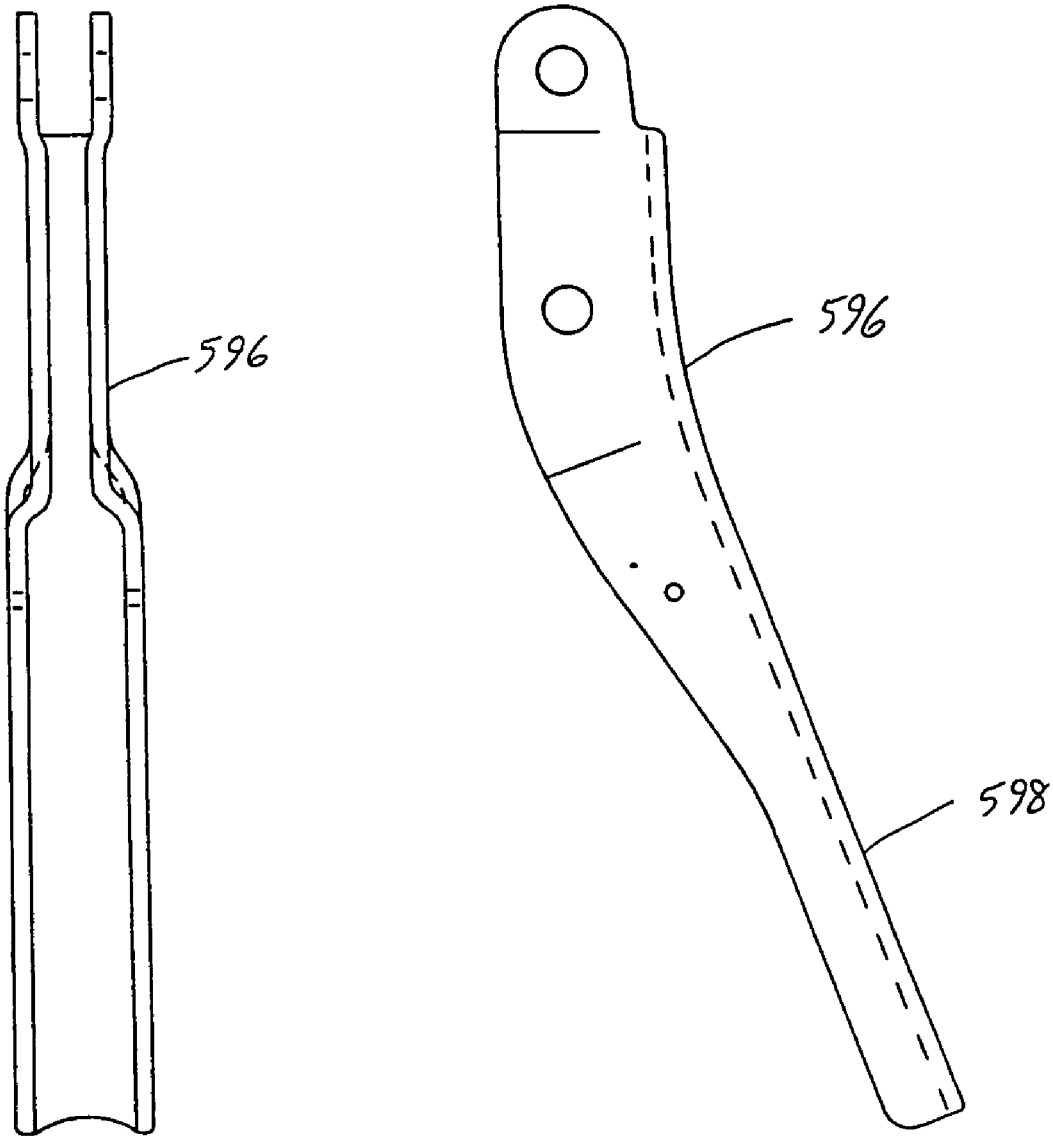

FIG. 139 - is a side and bottom view of upper handle having an arced section substantially formed to a substantially straight hand grip section.

Figure 140:
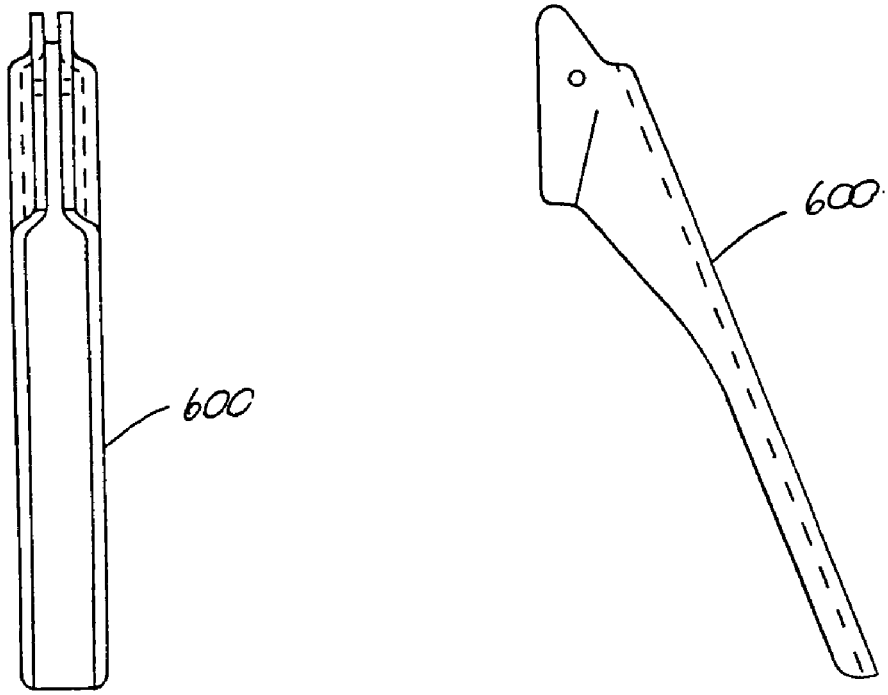

FIG. 140 - is a side and bottom view of release lever substantially formed with a straight shape.

Figure 141:
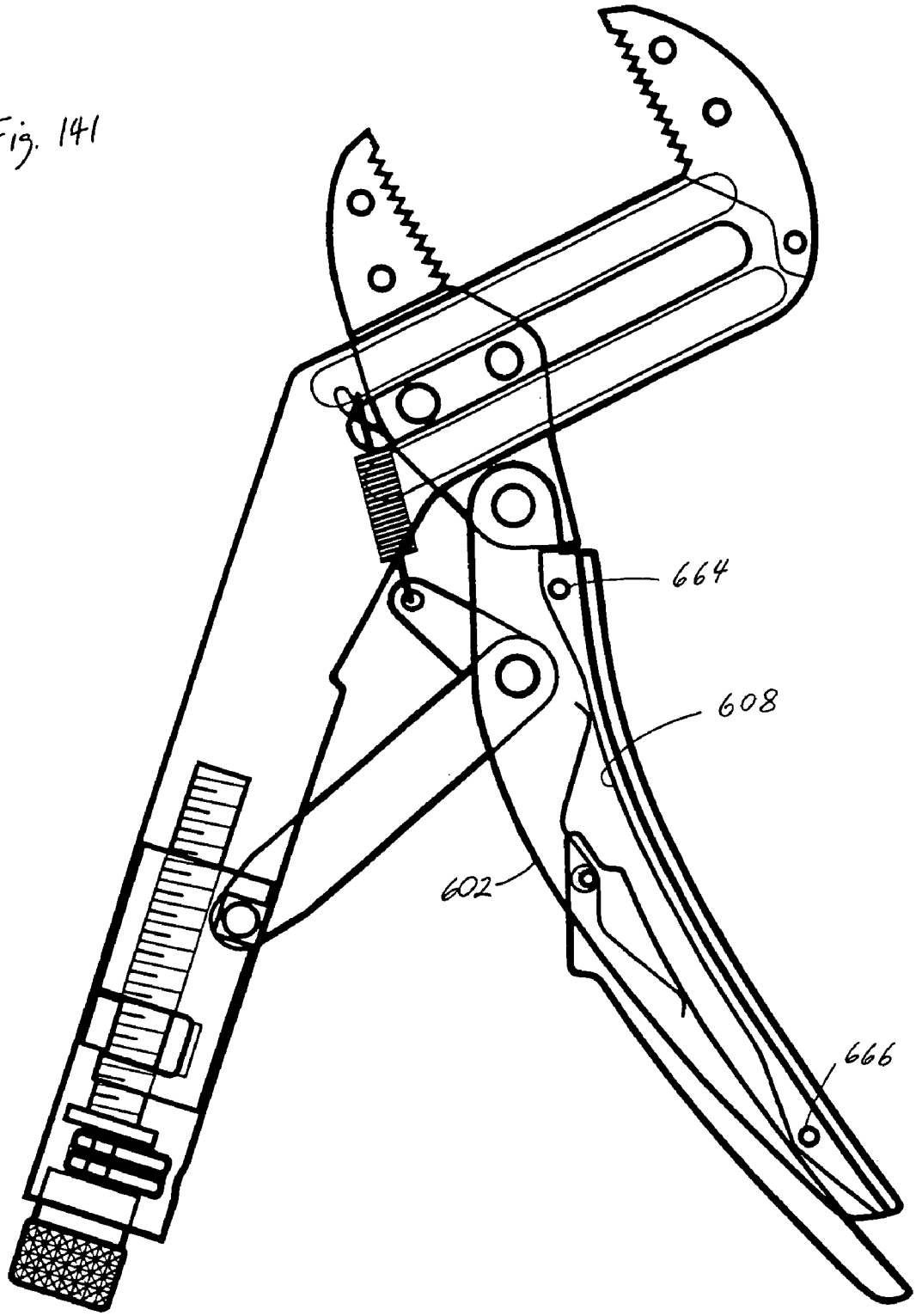

FIG. 141 - is a side view of an alternate design to FIG. 126.

Figure 142:
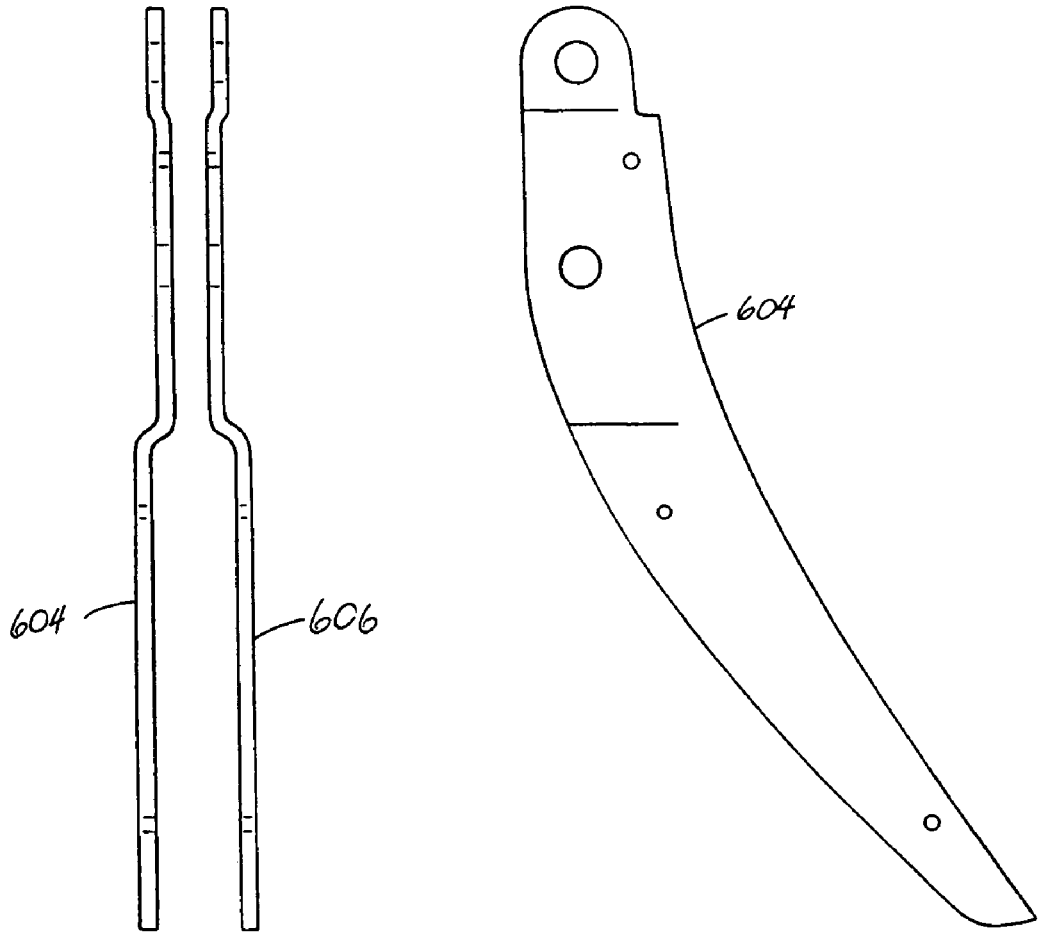

FIG. 142 - is a side and bottom view of upper handle plates being in a spaced relation.

Figure 143:
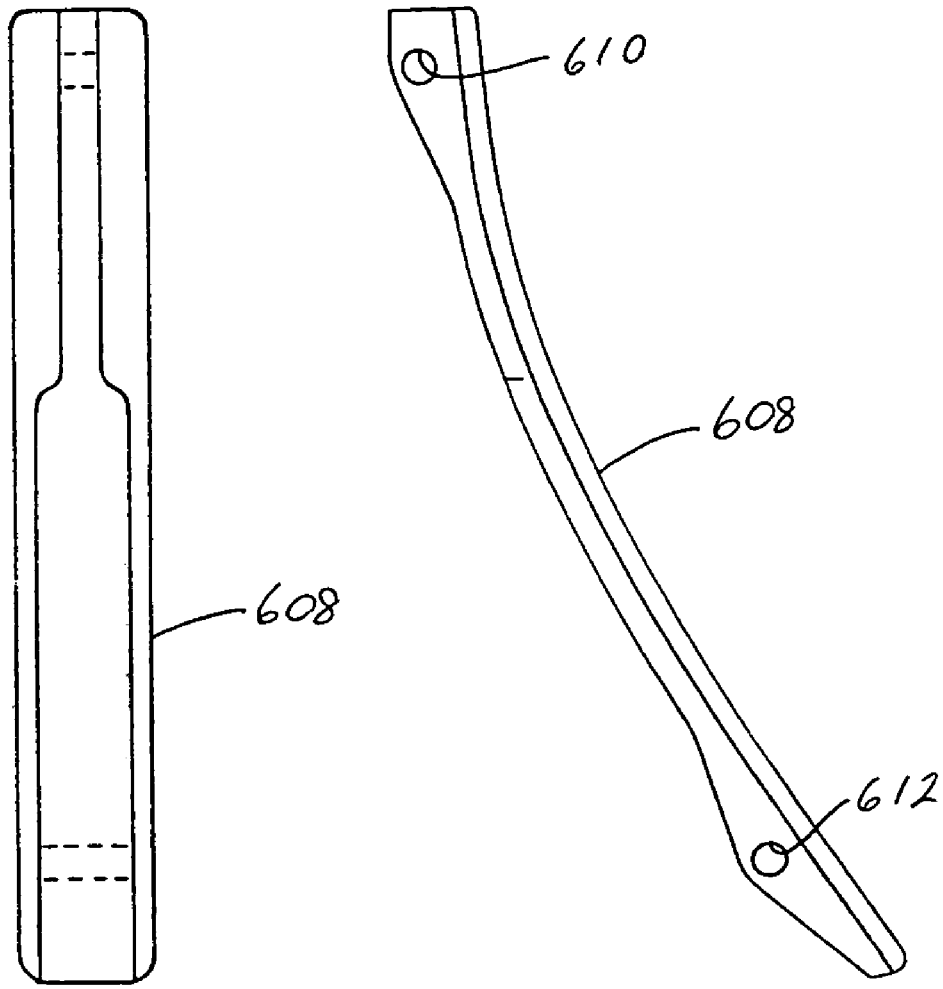

FIG. 143 - is a side and bottom view of upper handle spacer having a substantially arced hand grip section.

Figure 144:
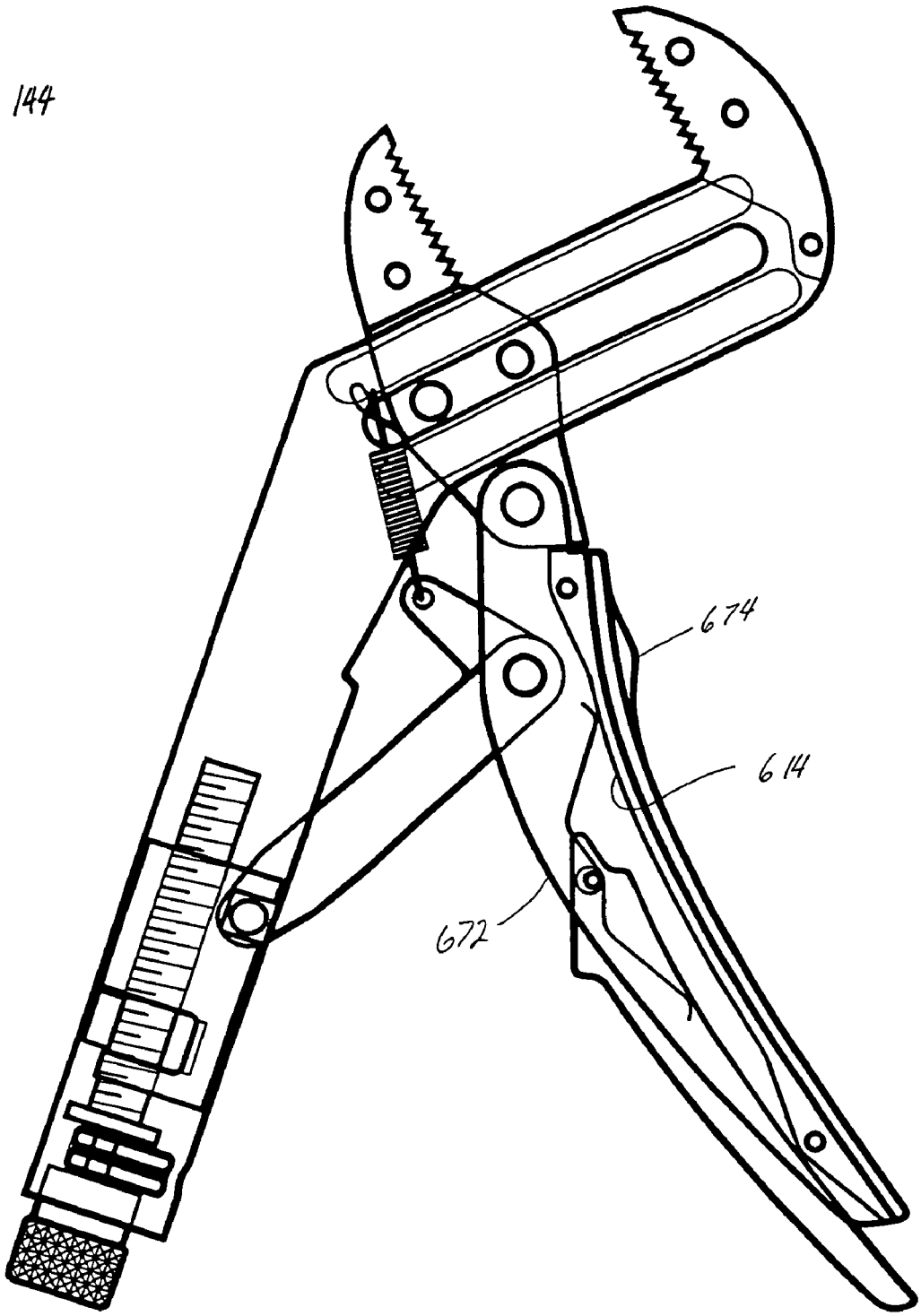

FIG. 144 - is a side view of an alternate design to FIG. 141.

Figure 145:
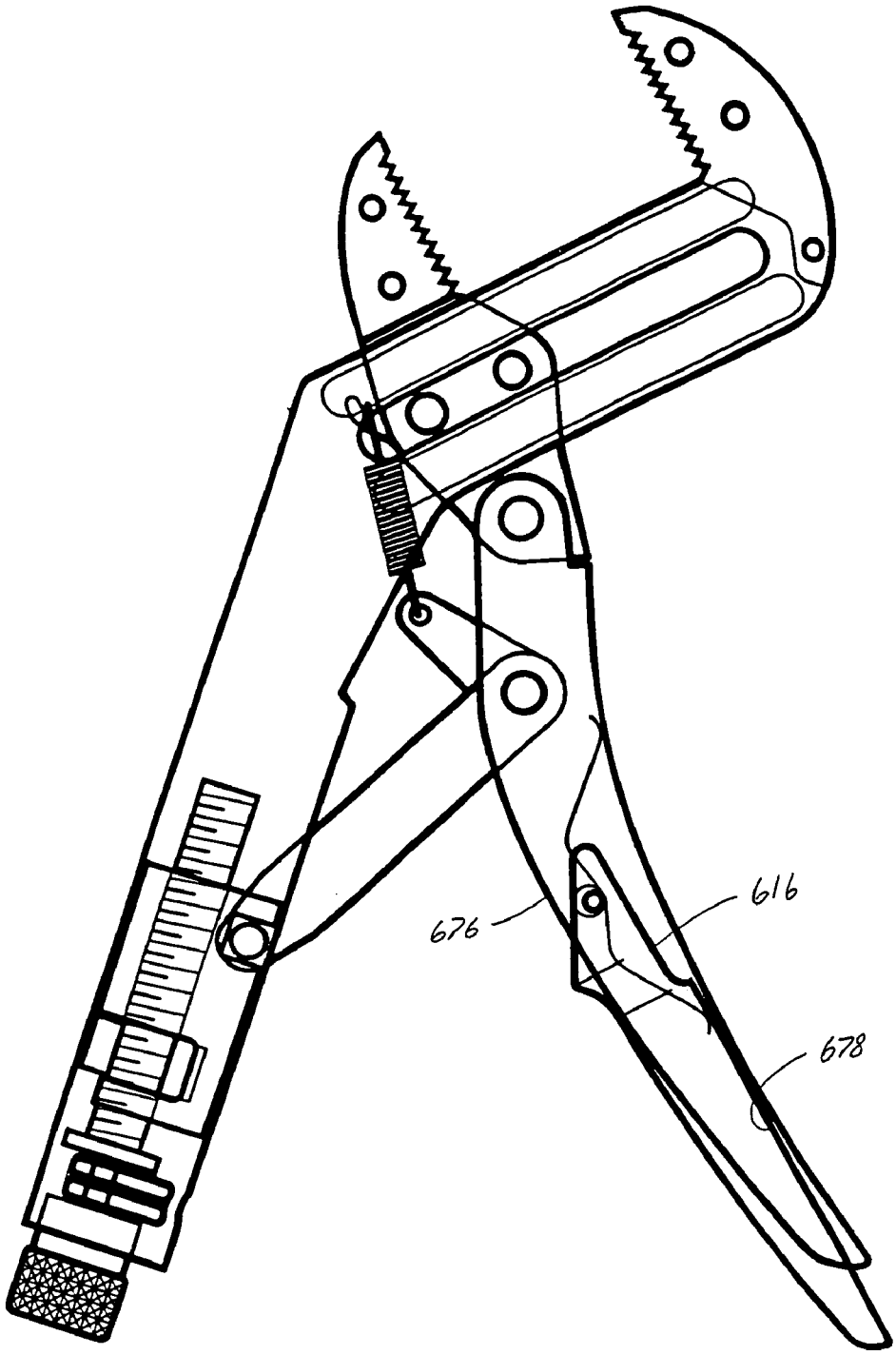

FIG. 145 - is a side view of an alternate design to FIG. 126.

Figure 146:
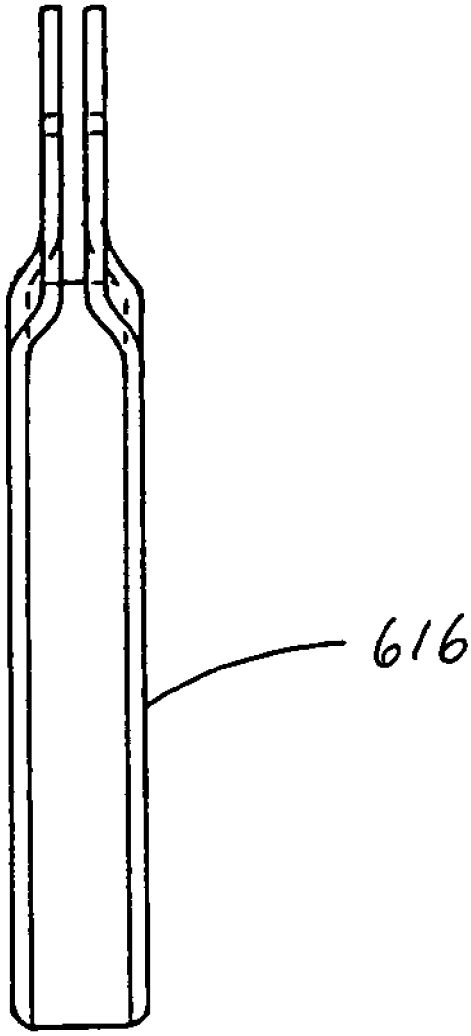

FIG. 146 - is a bottom view of an alternate design to FIG. 140.

Figure 147:
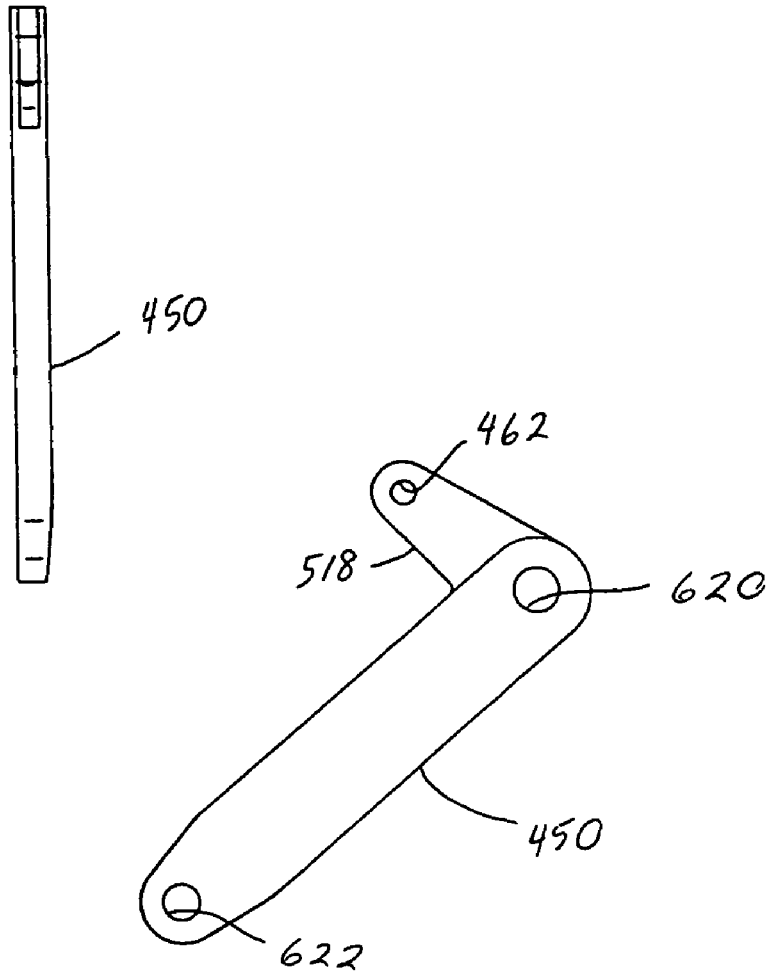

FIG. 147 - is a side and bottom view of toggle showing a width dimension of spring attachment member.

Figure 148:
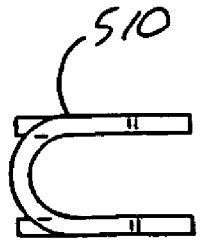
Figure 148:
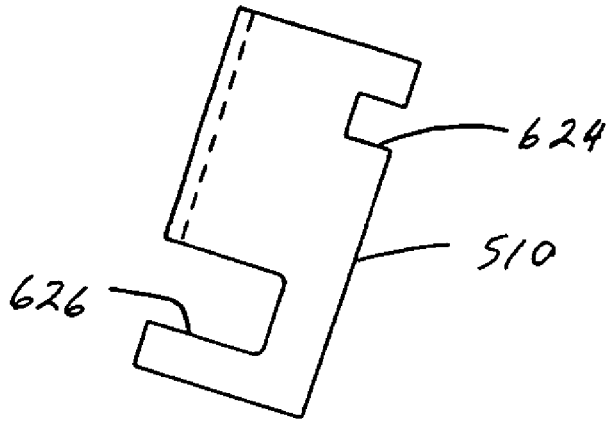

FIG. 148 - is a front and side view of slidable retainer showing hidden dimensions by dashed lines.

Figure 149:
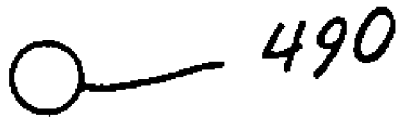
Figure 149:
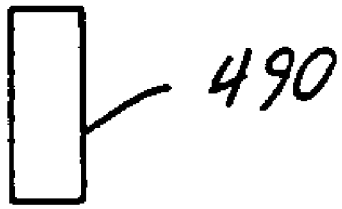

FIG. 149 - is a side and top view of toggle pin having width and length dimension being in a cooperating relation to slidable retainer.

Figure 150:
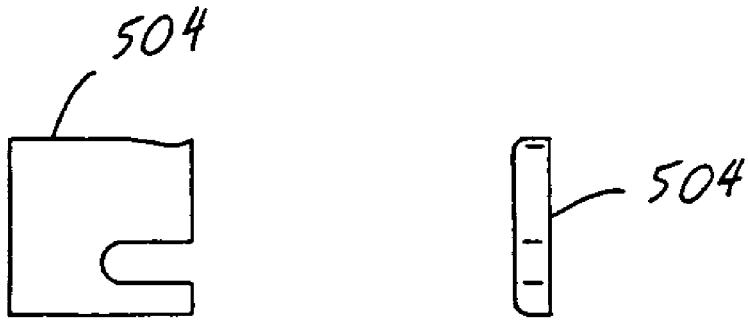

FIG. 150 - is side views of rear housing plate showing rear housing attachment dimensions.

Figure 151:
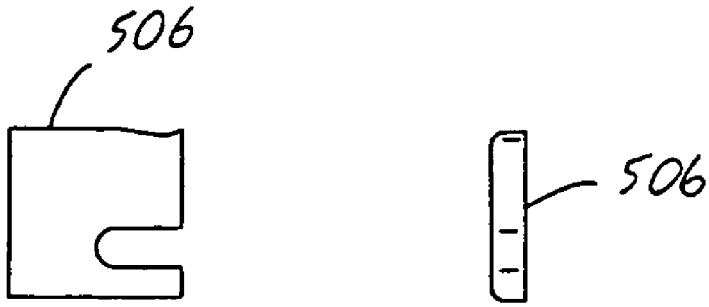

FIG. 151 - is side views of rear housing plate showing rear housing attachment dimensions.

Figure 152:
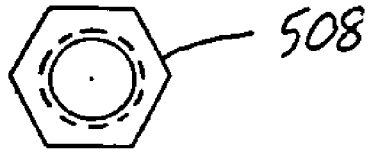
Figure 152:
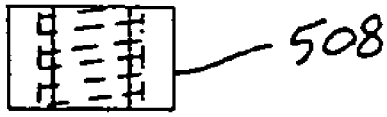

FIG. 152 - is a side and front view of rear housing fastener with hidden lines shown by dashed lines.

Figure 153:
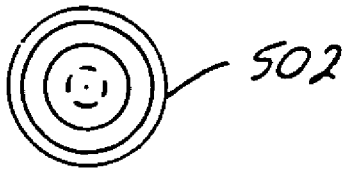
Figure 153:
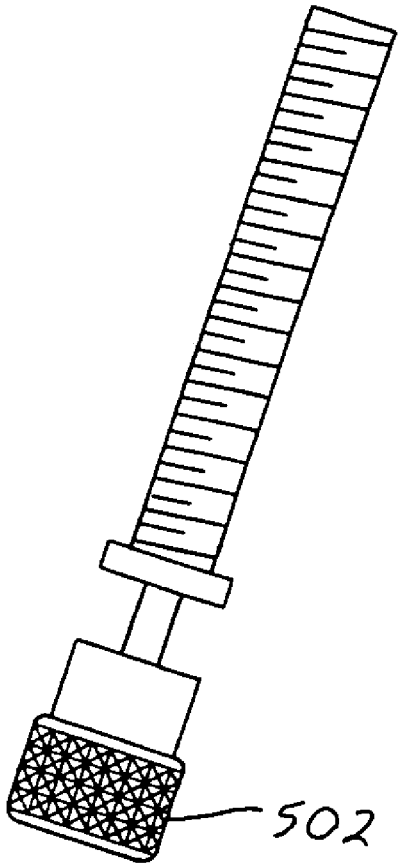

FIG. 153 - is a side and rear view of rotatable threaded member with threaded section represented by alternating slanted/dashed lines.

Figure 154:
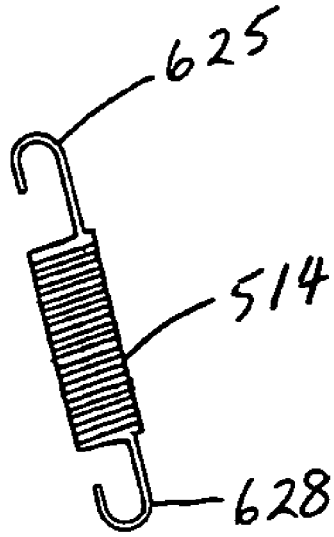

FIG. 154 - is a side view of spring showing hooked projections.

Figure 37:
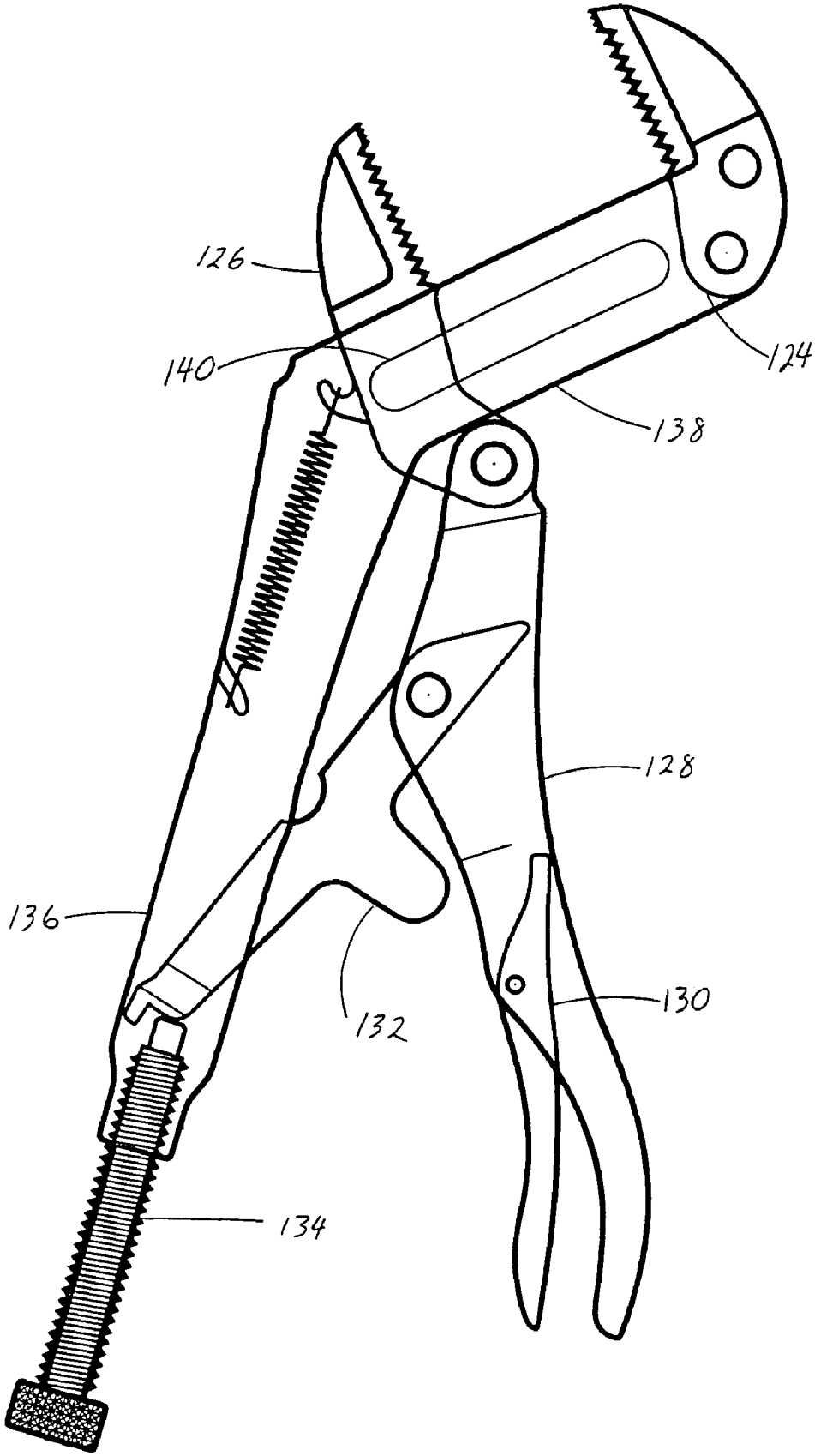
FIG. 37 - is a comprehensive side view showing overall dimensions of mechanisms in working relationship, with the thinnest lines representing metal formation, with hidden mechanisms represented by thicker continuous lines, with the outer dimensions represented by the thickest continuous lines.
Figure 155:
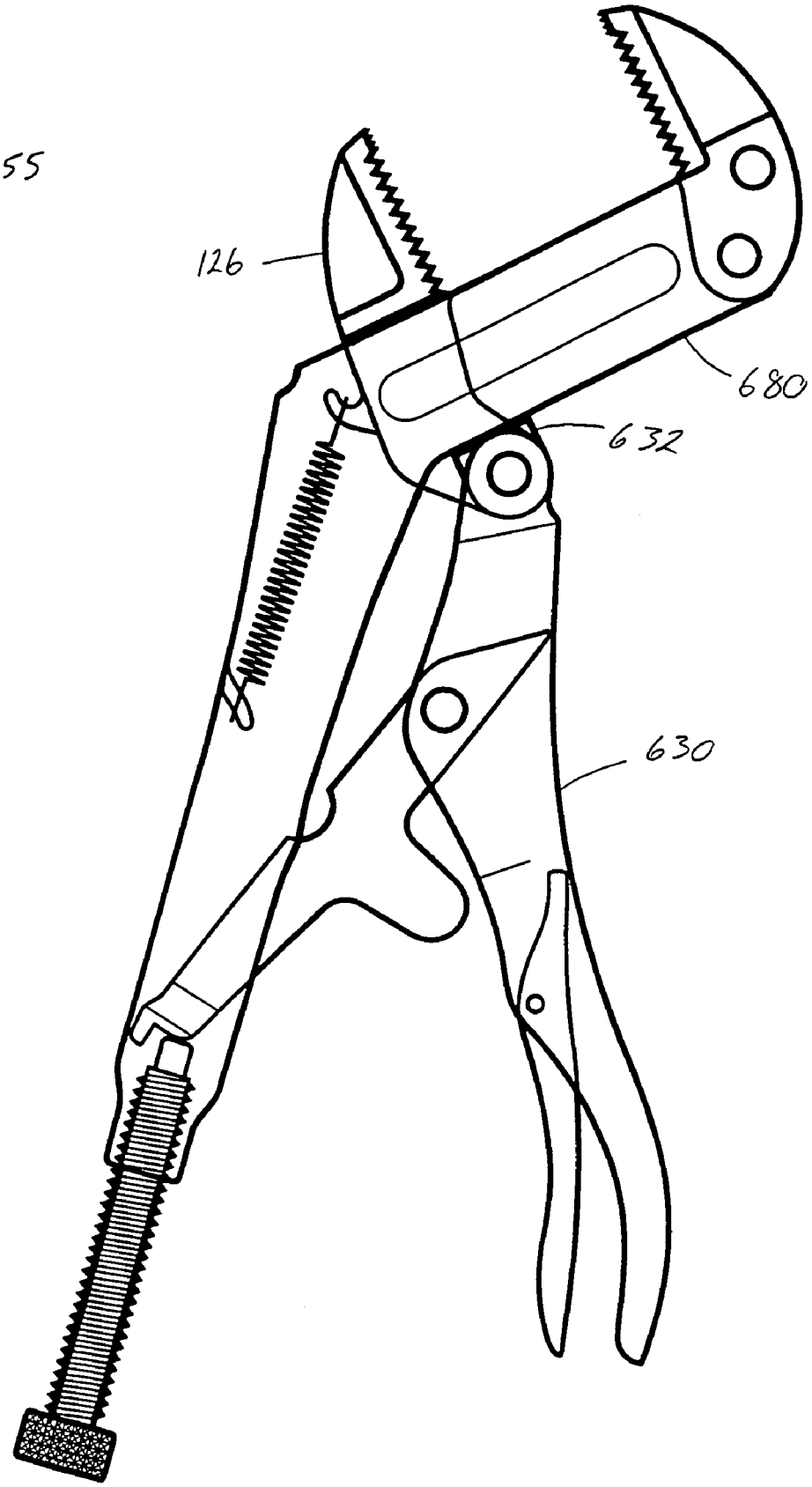

FIG. 155 - is a side view of an alternate design to FIG. 37 showing slidable jaw member having slidable/rotatable plate mechanisms being in working relationship to support member.

Figure 156:
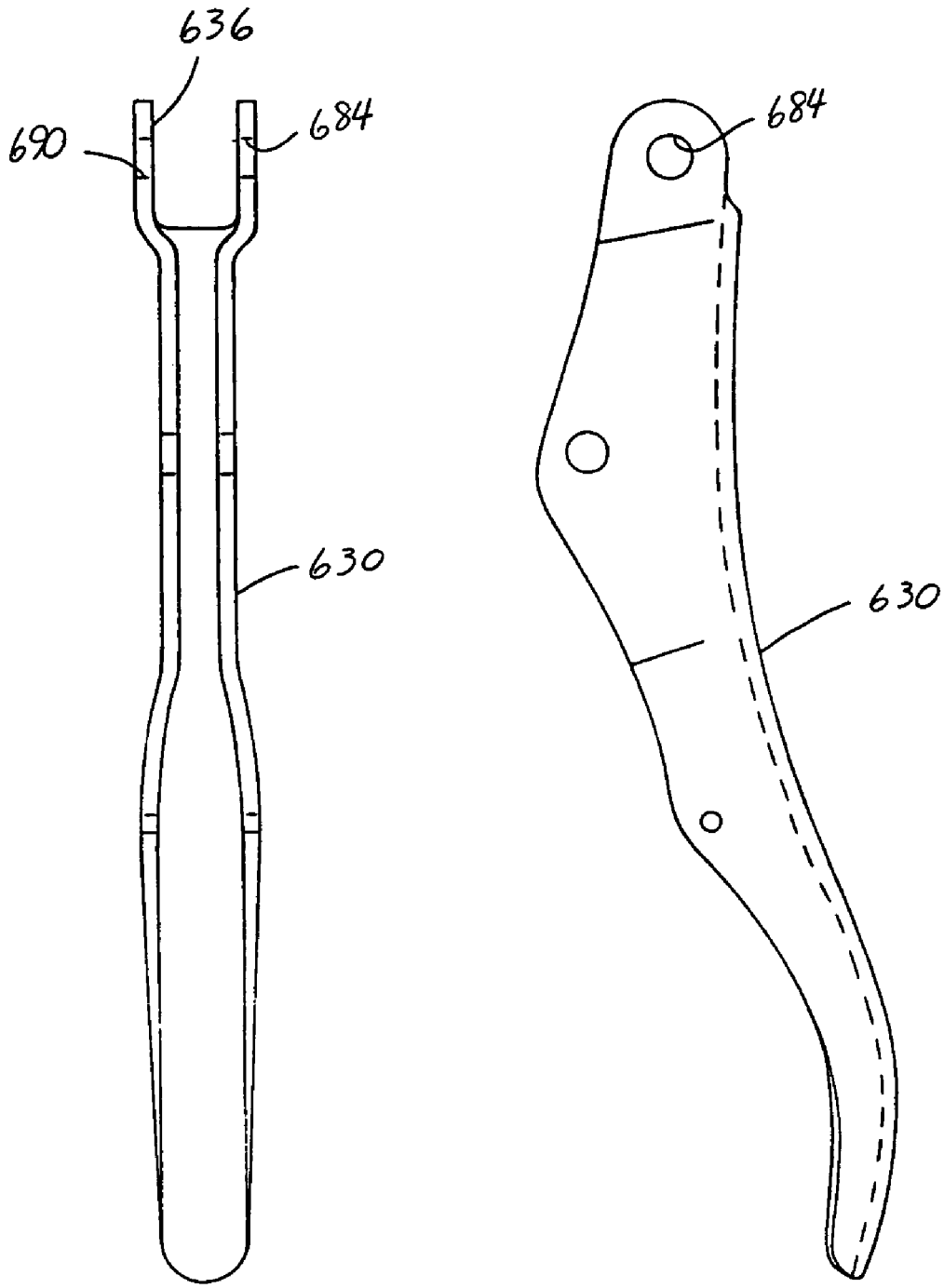

FIG. 156 - is a side and bottom view of upper handle showing width dimension of slidable jaw member housing.

Figure 157:
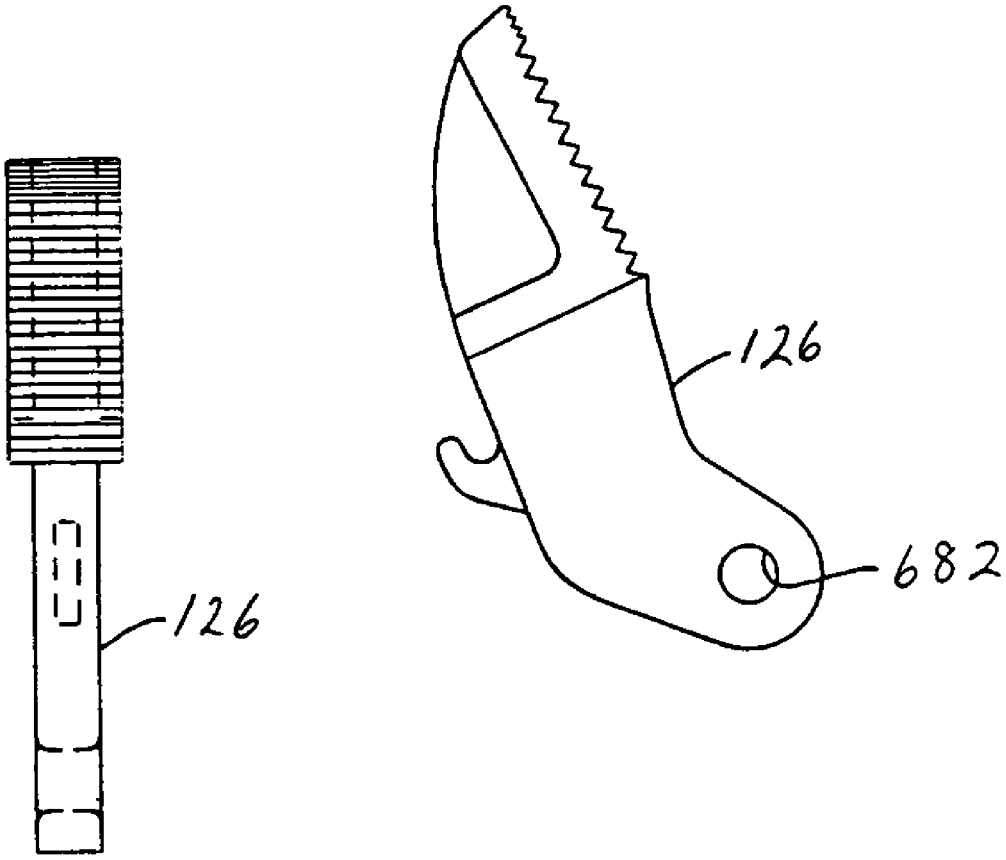

FIG. 157 - is a side and top view of slidable jaw member showing shape and position of rivet hole.

FIG. 158 - is a side view of rivet showing overall length and height dimension.

Figure 161:
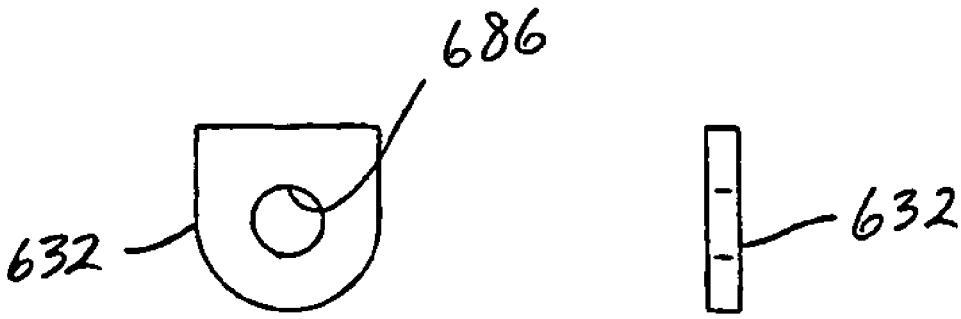

FIG. 159 - is a side view of rivet showing overall length and height dimension FIG. 160 - is a side view of roll pin showing overall length and width dimension FIG. 161 - is side views of slidable jaw member plate showing position of rivet hole.

Figure 162:
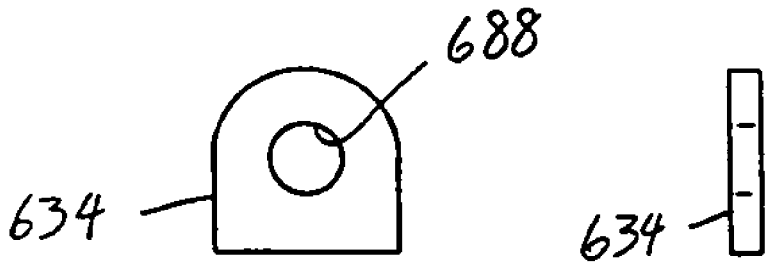

FIG. 162 - is side views of slidable jaw member plate showing position of rivet hole.

Figure 163:
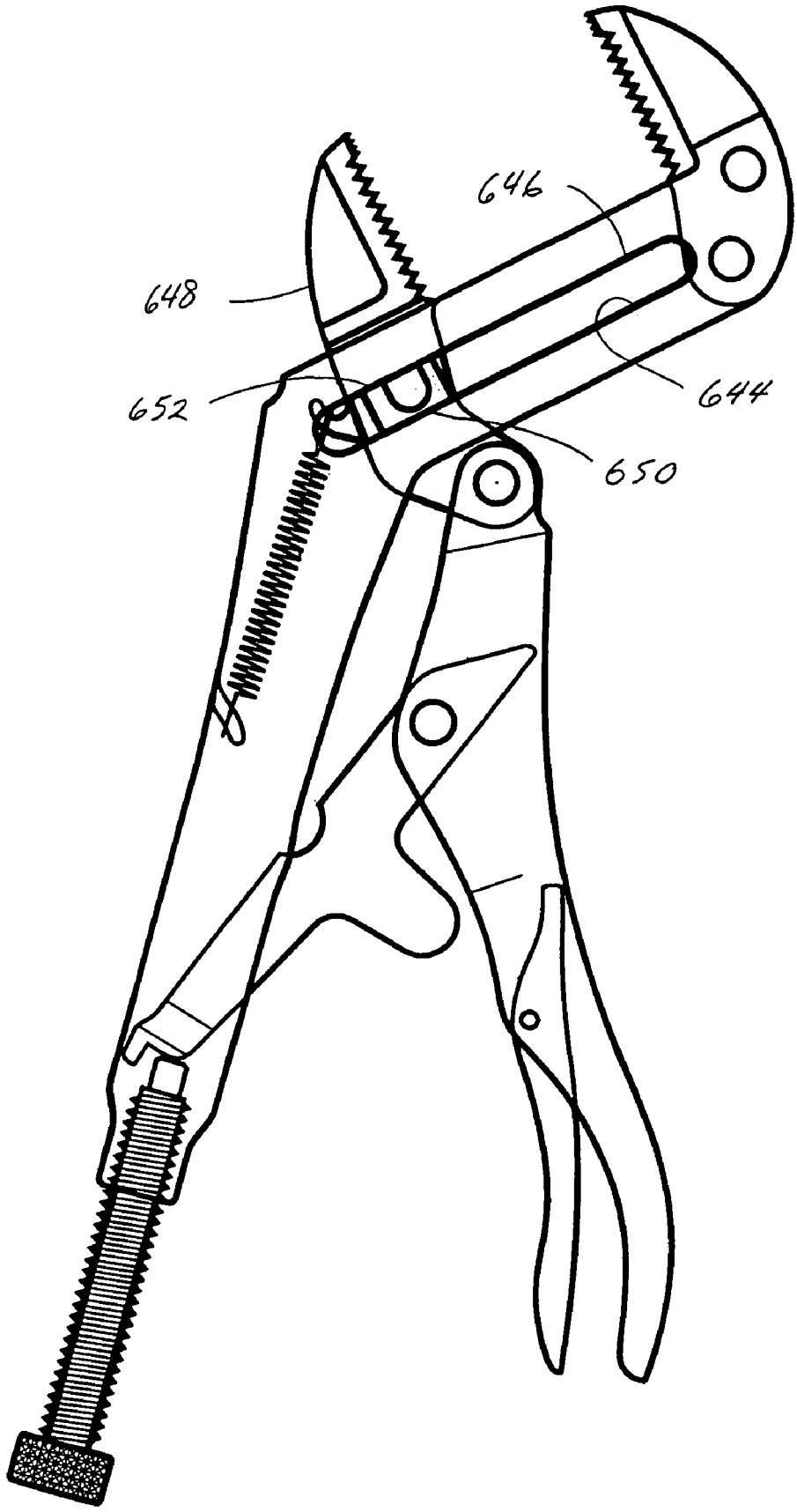

FIG. 163 - is a comprehensive side view showing overall dimensions of mechanisms in working relationship, with hidden mechanisms represented by thinner continuous lines. The thinnest lines of FIG. 163 represent the contours of part formation.

Figure 164:
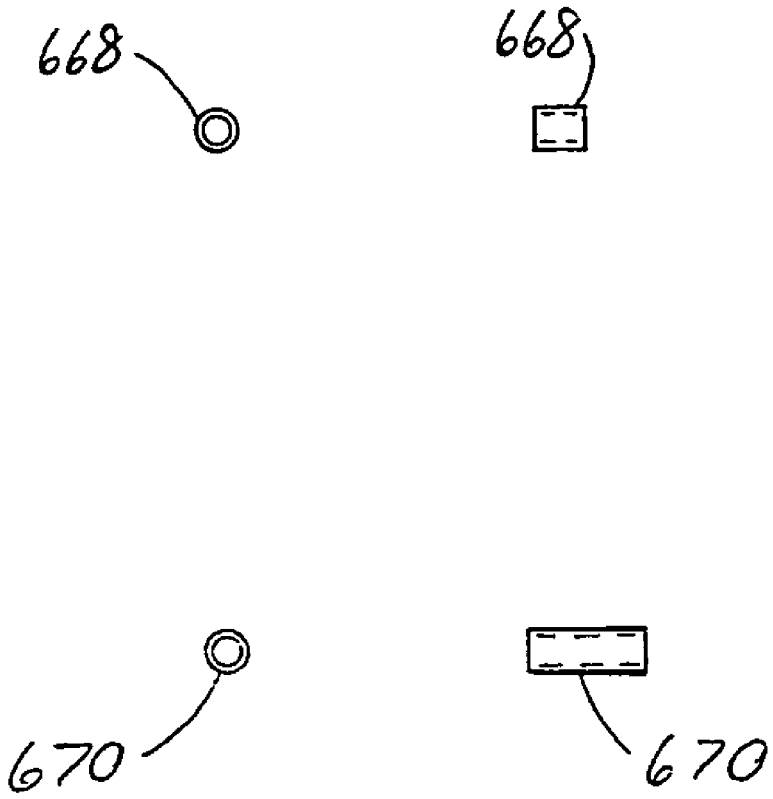

FIG. 164 - is side and top views of circular spacers with hidden dimensions represented by dashed lines.

Figure 165:
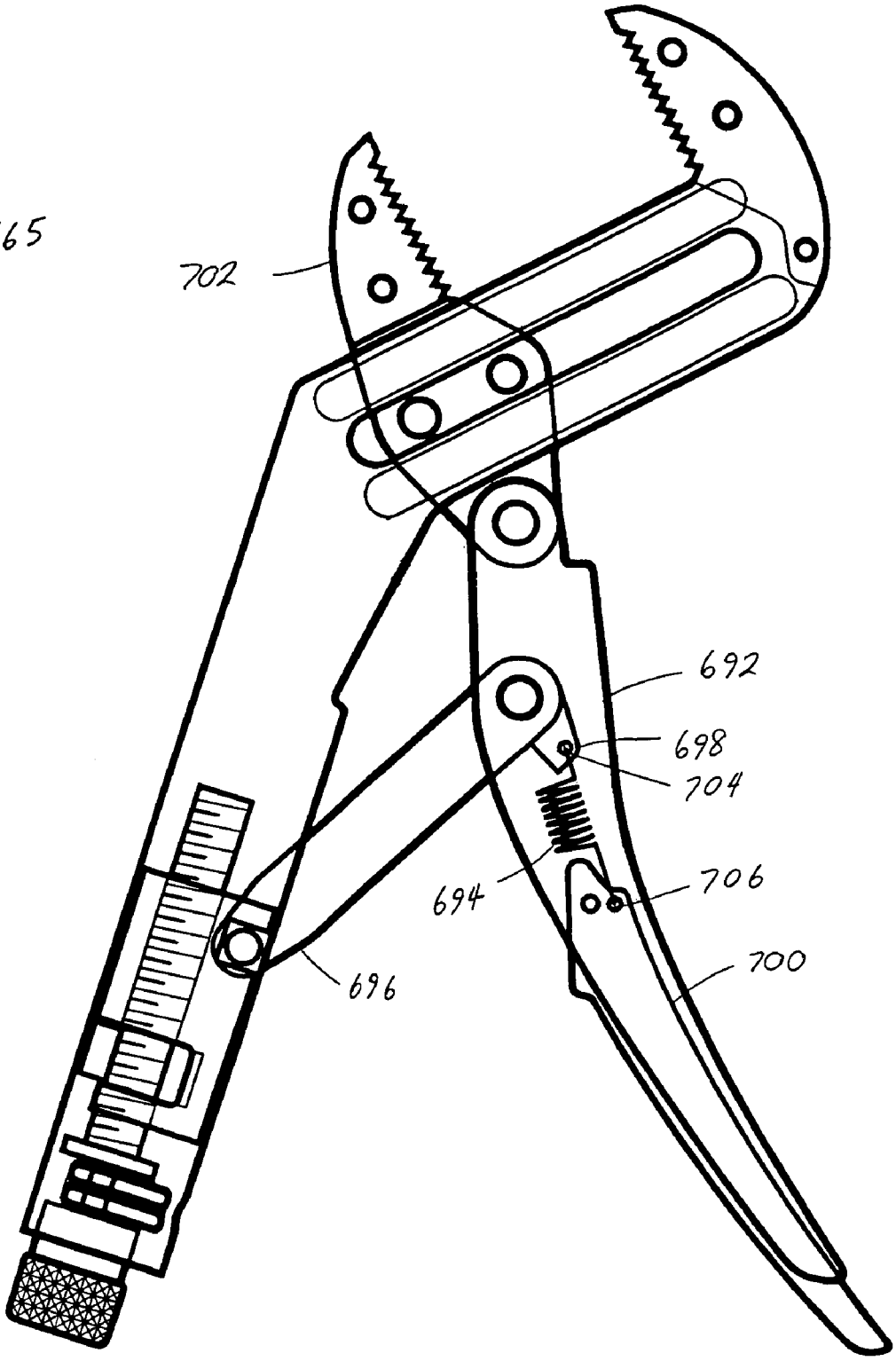

FIG. 165 - is a comprehensive side view showing overall dimensions of mechanisms in working relationship, with hidden mechanisms represented by thinner continuous lines. The thinnest lines of FIG. 163 represent the contours of part formation.

Figure 166:
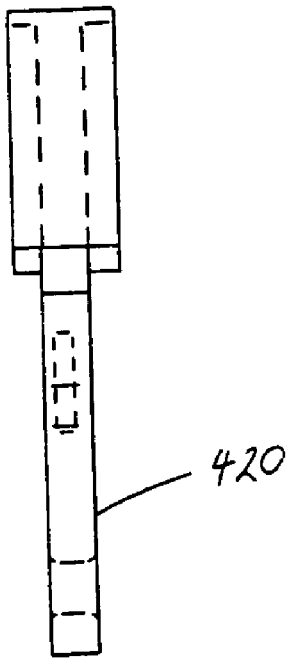

FIG. 166 - is a top view of slidable jaw member showing an extension extending from a flat compression surface.

Figure 167:
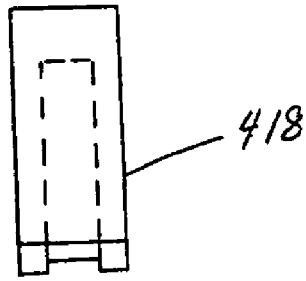

FIG. 167 - is a bottom view of fixed jaw member showing a spacing extending from a flat compression surface.

Figure 168:
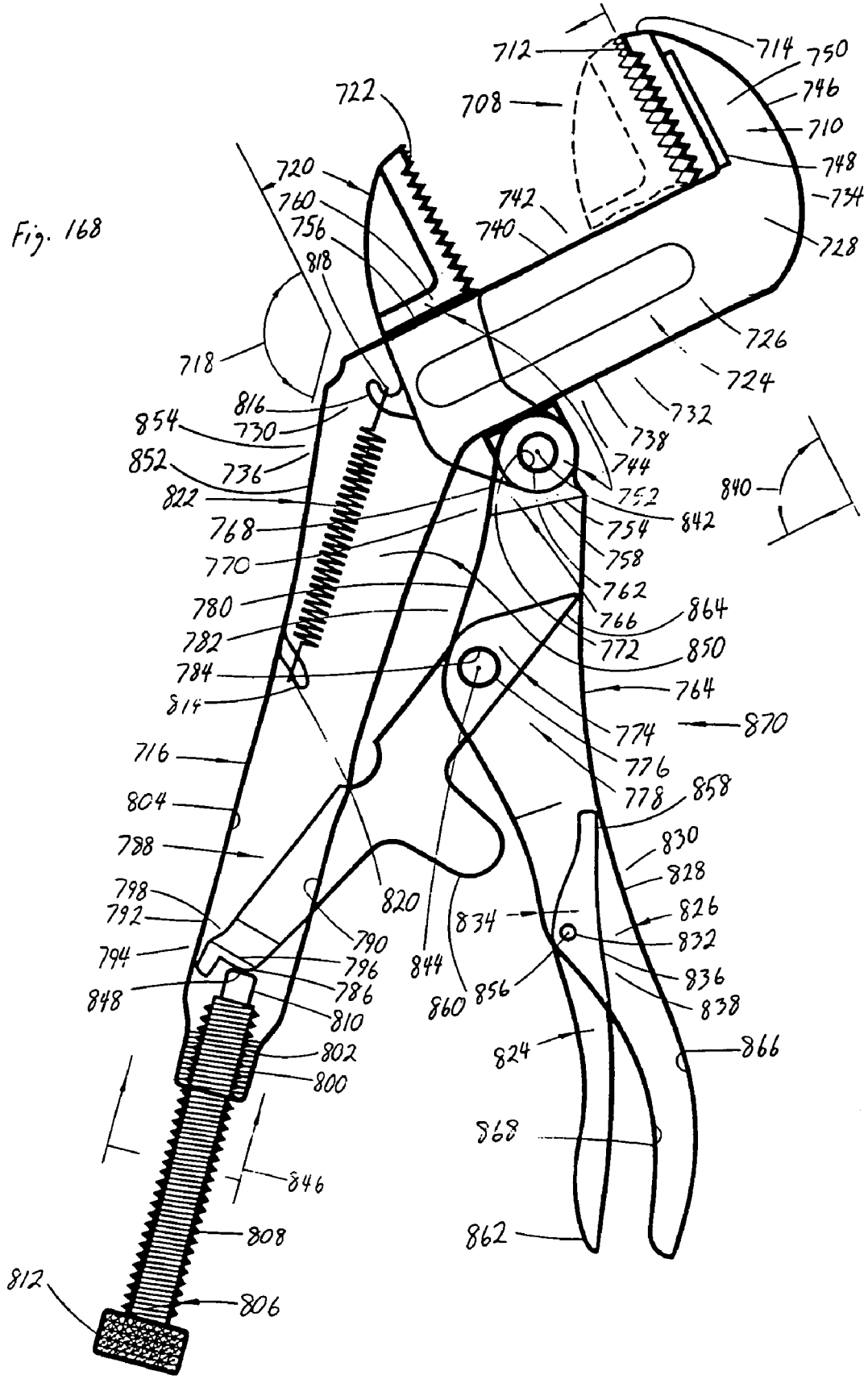

FIG. 168 - is a comprehensive side view showing overall dimensions of mechanisms in working relationship, with hidden mechanisms represented by thinner continuous lines. The thinnest lines of FIG. 168 represent the contours of part formation.

Figure 169:
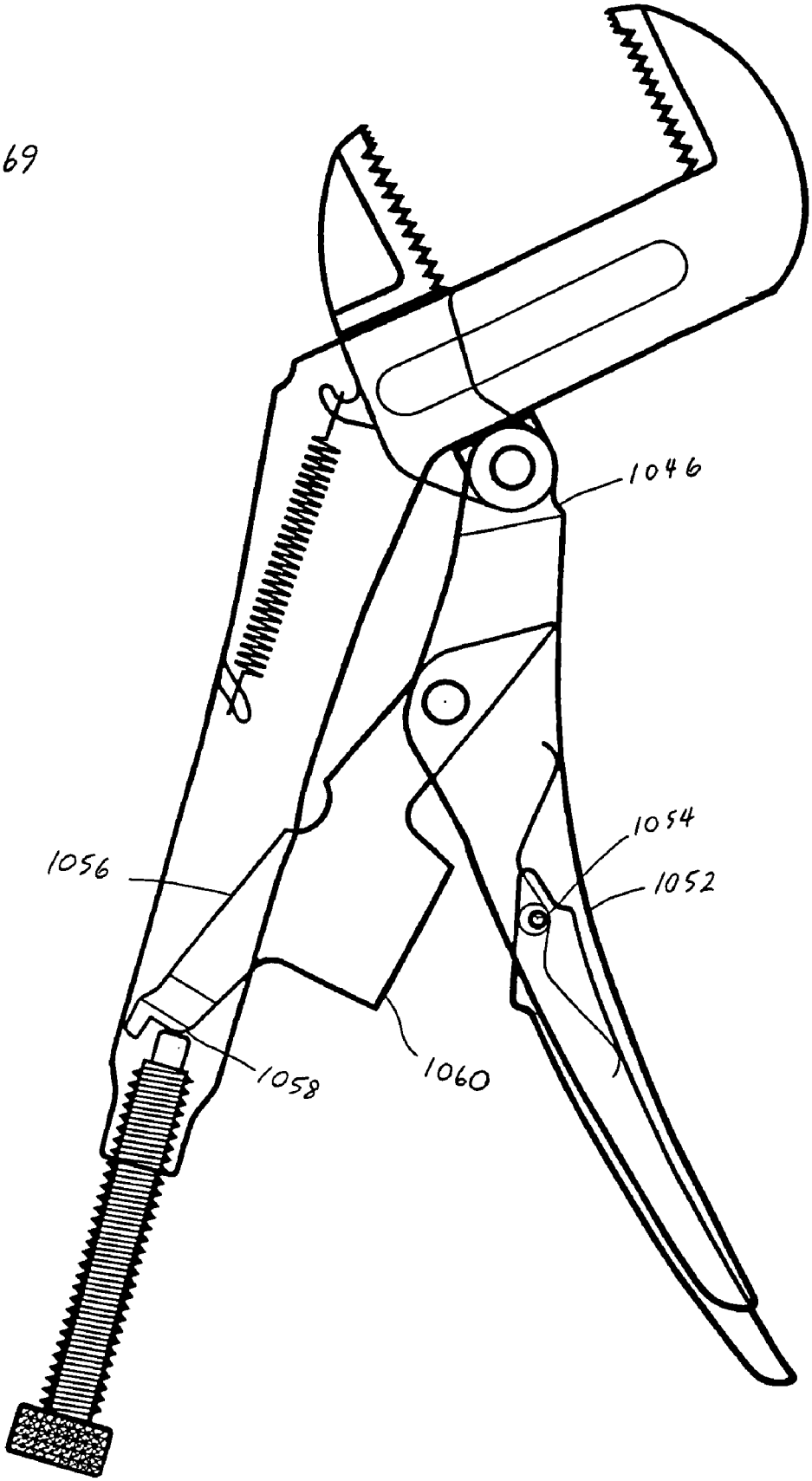

FIG. 169 - is a comprehensive side view showing overall dimensions of mechanisms in working relationship, with hidden mechanisms represented by thinner continuous lines. The thinnest lines of FIG. 169 represent the contours of part formation.

Figure 170:
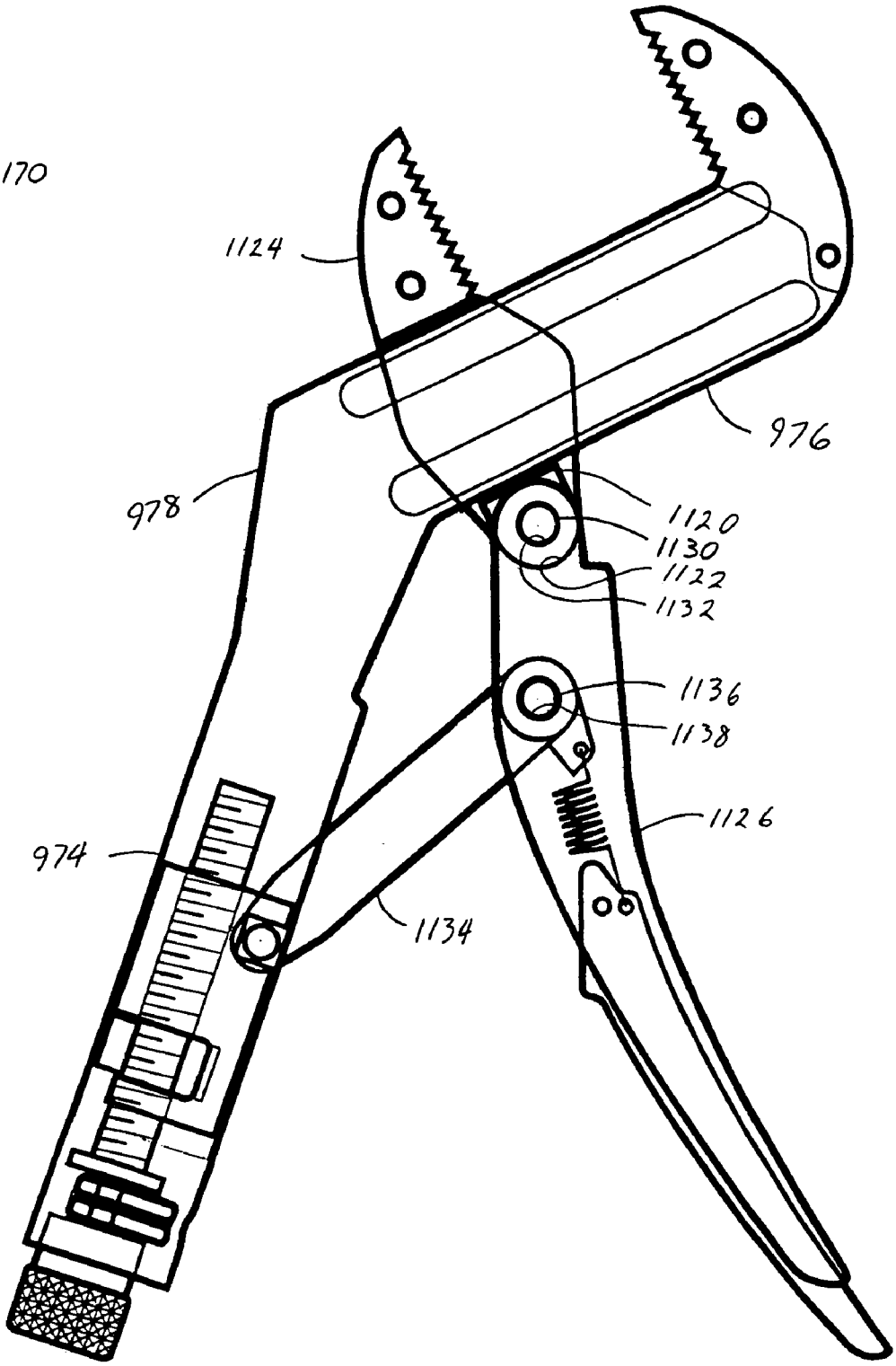

FIG. 170 - is a comprehensive side view showing overall dimensions of mechanisms in working relationship, with hidden mechanisms represented by thinner continuous lines. The thinnest lines of FIG. 170 represent the contours of part formation.

Figure 171:
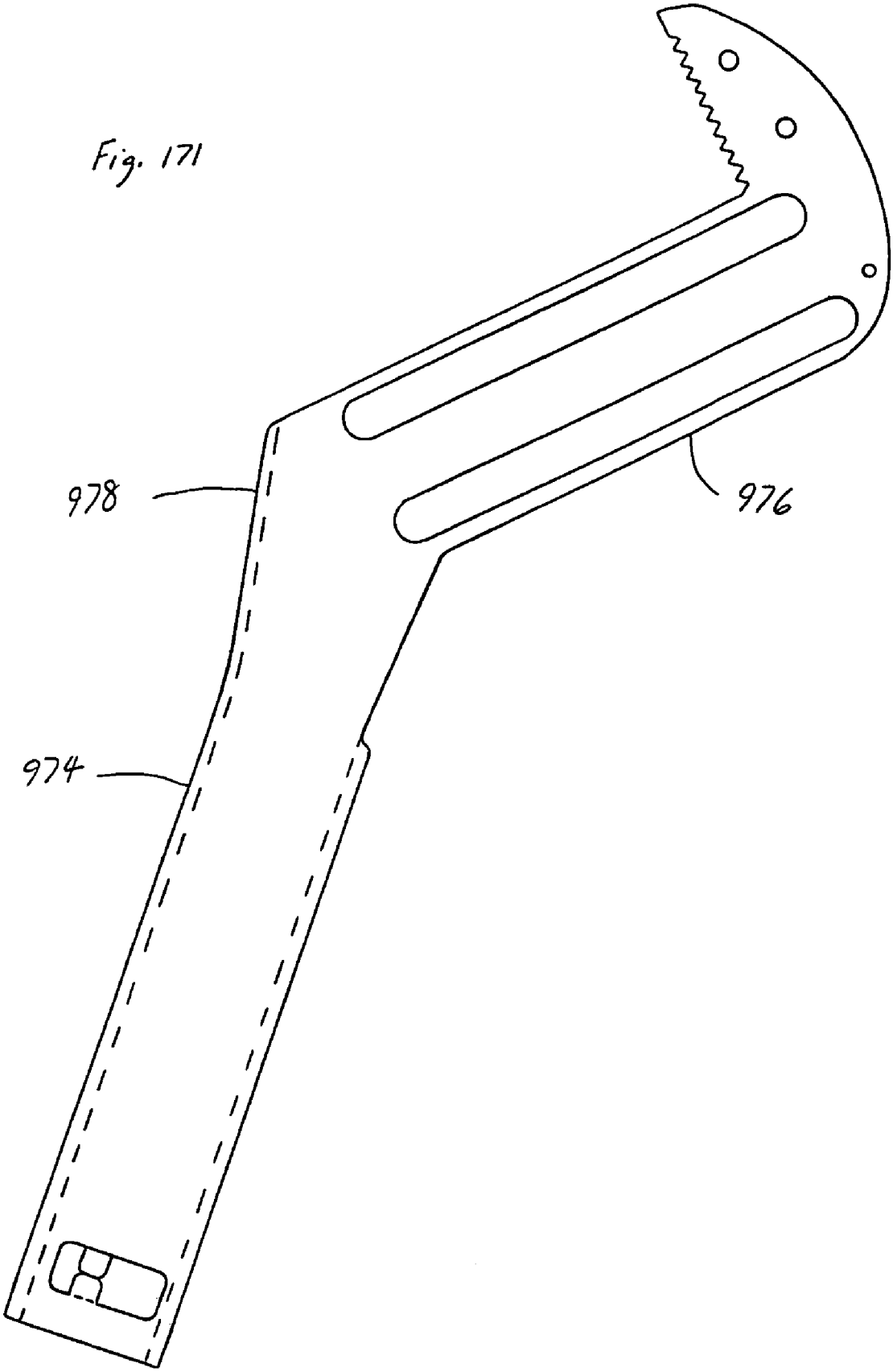

FIG. 171 - is a side view of lower handle without slots in the support member.

Figure 172:
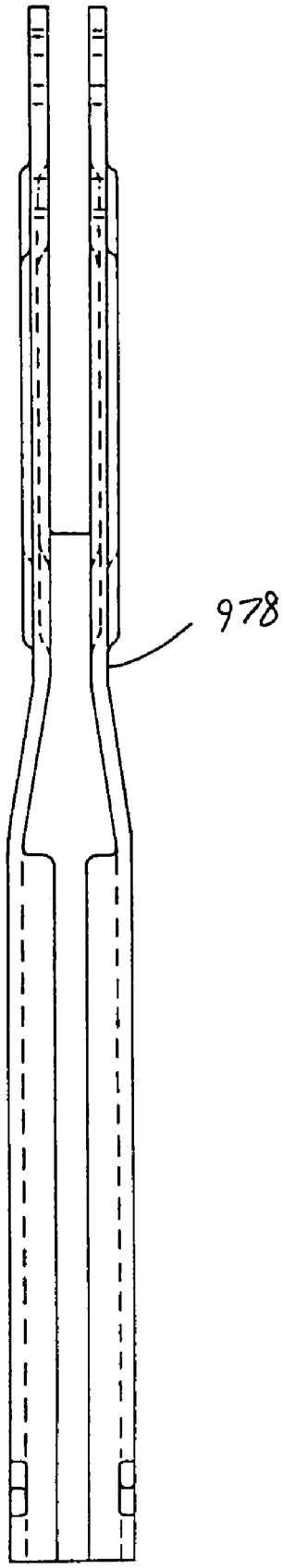

FIG. 172 - is a top view of lower handle without slots in the support member.

Figure 173:
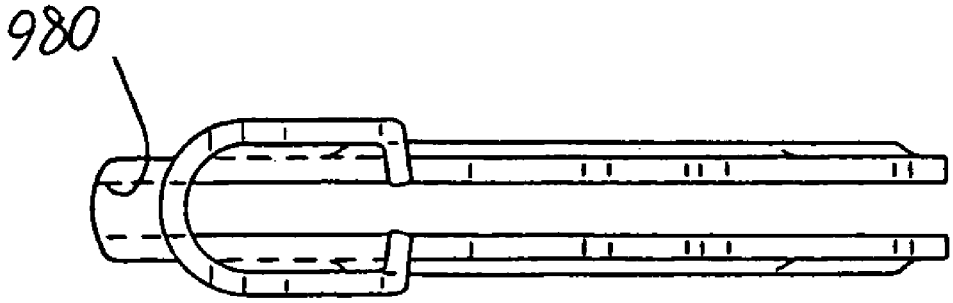

FIG. 173 - is a rear view of lower handle without slots in the support member.

Figure 174:
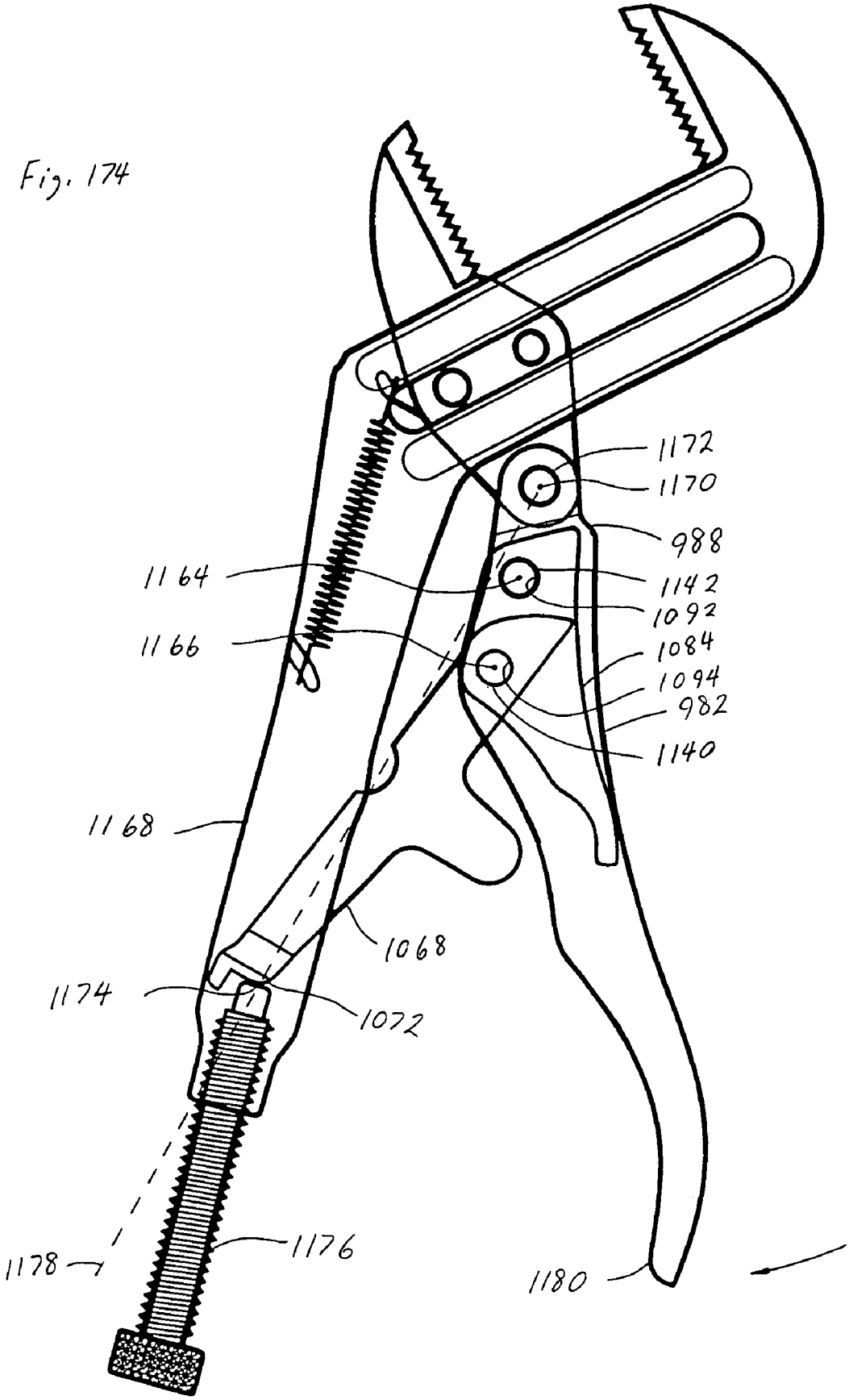

FIG. 174 - is a comprehensive side view showing overall dimensions of mechanisms in working relationship, with hidden mechanisms represented by thinner continuous lines. The thinnest lines of FIG. 174 represent the contours of part formation.

Figure 175A:
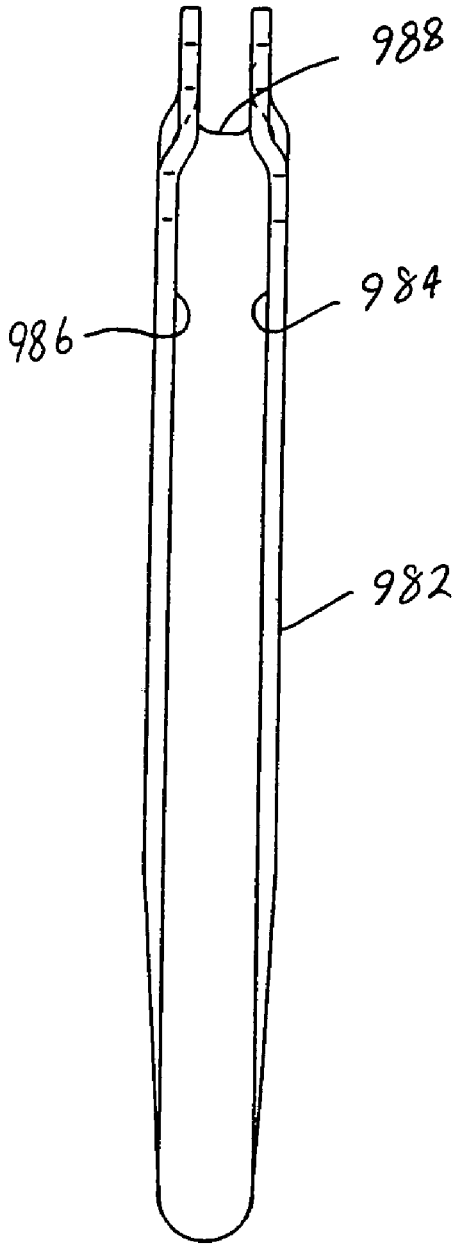
Figure 175:
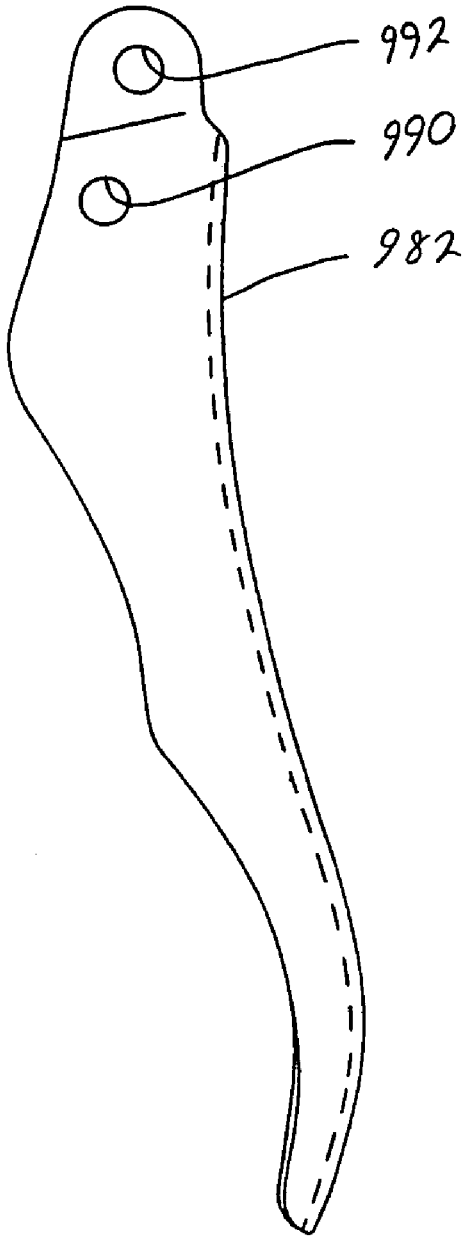

FIG. 175 - is a side view of upper handle showing a material thickness by dashed lines.

FIG. 175A - is a bottom view of upper handle showing the curved shape of a forward housing.

Figure 176:
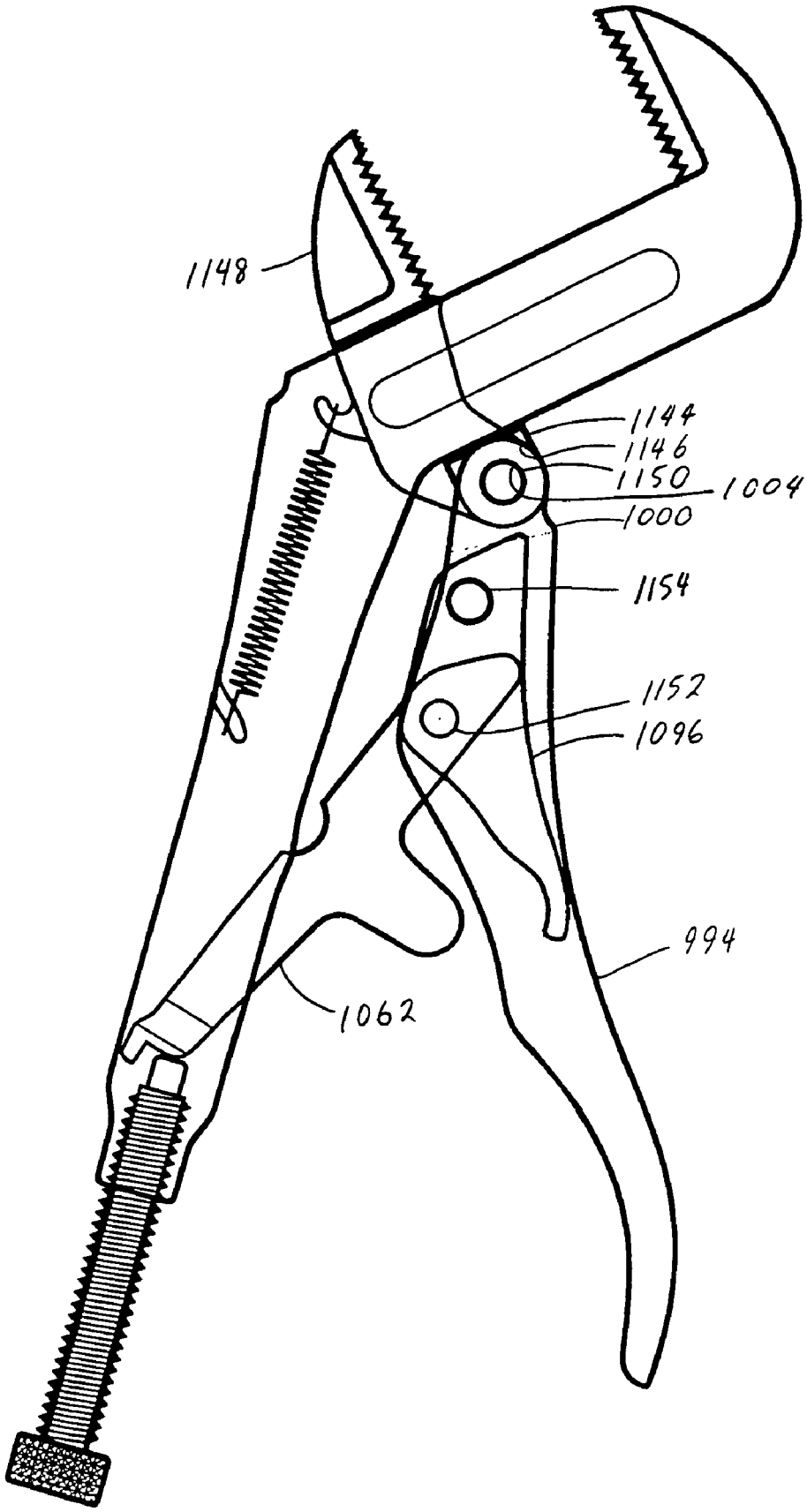

FIG. 176 - is a comprehensive side view showing overall dimensions of mechanisms in working relationship, with hidden mechanisms represented by thinner continuous lines. The thinnest lines of FIG. 176 represent the contours of part formation.

Figure 177:
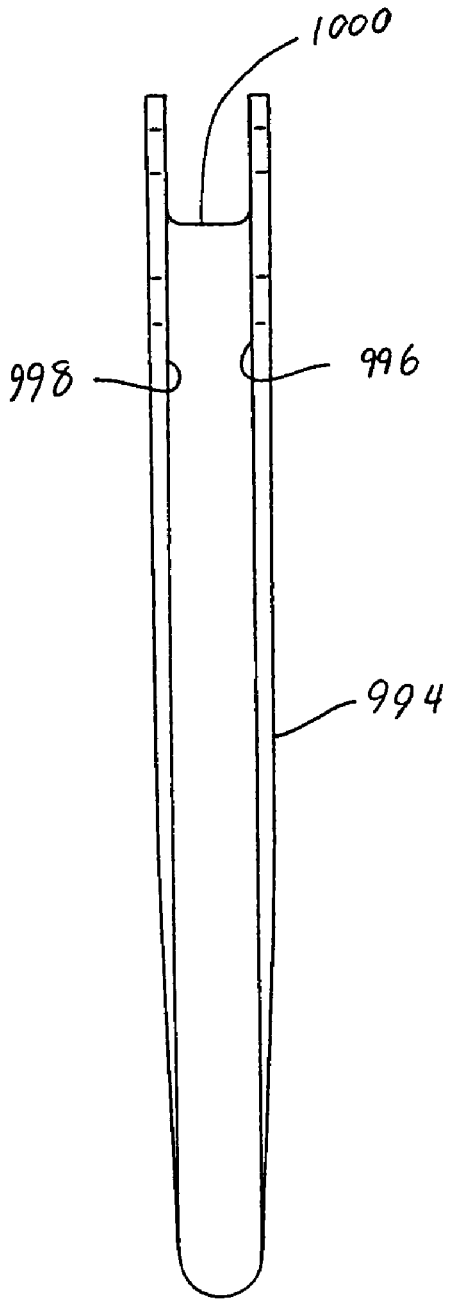

FIG. 177 - is a bottom view of upper handle having a spaced sidewalls.

Figure 178:
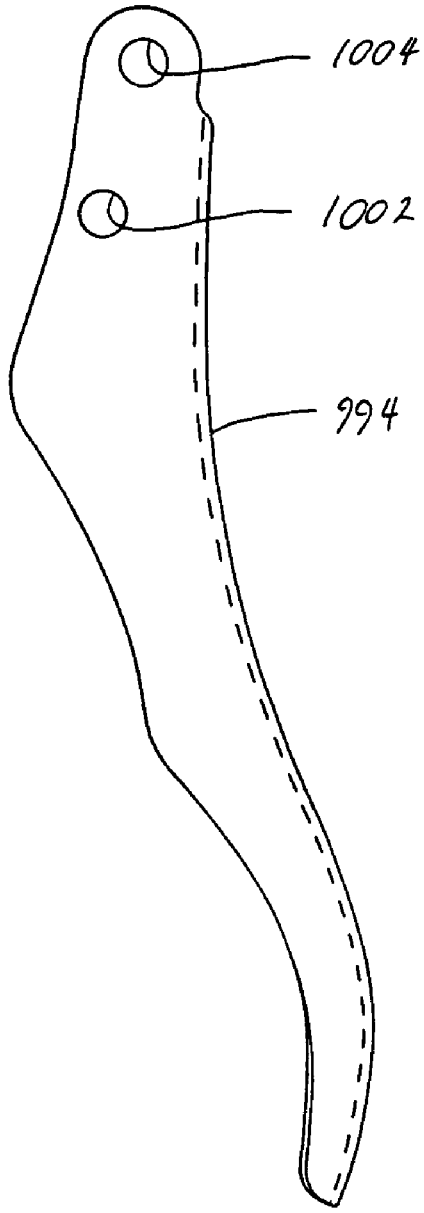

FIG. 178 - is a side view of upper handle showing material thickness by dashed lines.

Figure 179:
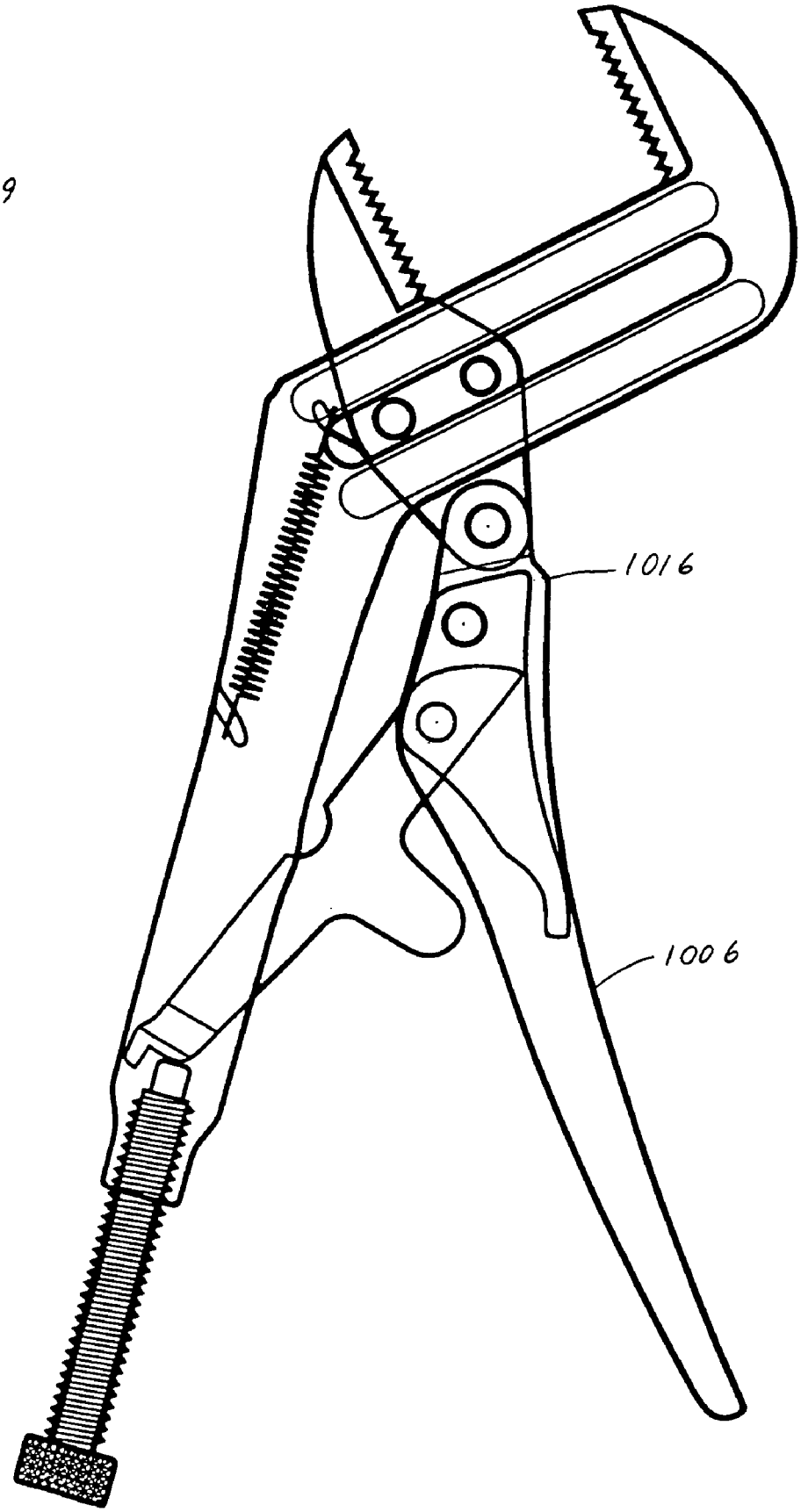

FIG. 179 - is a comprehensive side view showing overall dimensions of mechanisms in working relationship, with hidden mechanisms represented by thinner continuous lines. The thinnest lines of FIG. 179 represent the contours of part formation.

Figure 180:
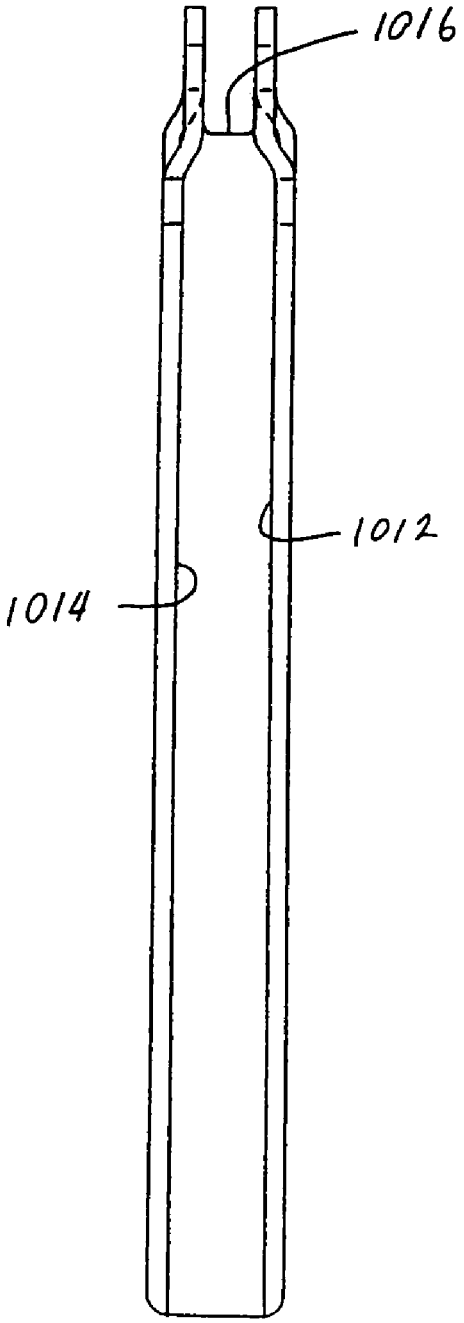

FIG. 180 - is a bottom view of upper handle having a curvature to spaced sidewalls.

Figure 181:
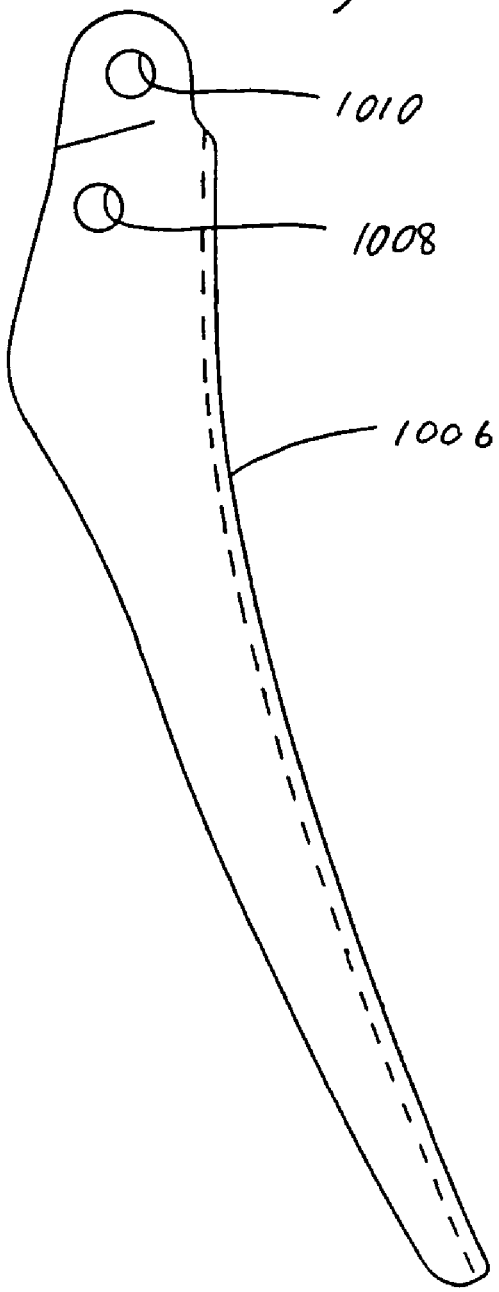

FIG. 181 - is a side view of upper handle showing material thickness by dashed lines.

Figure 182:
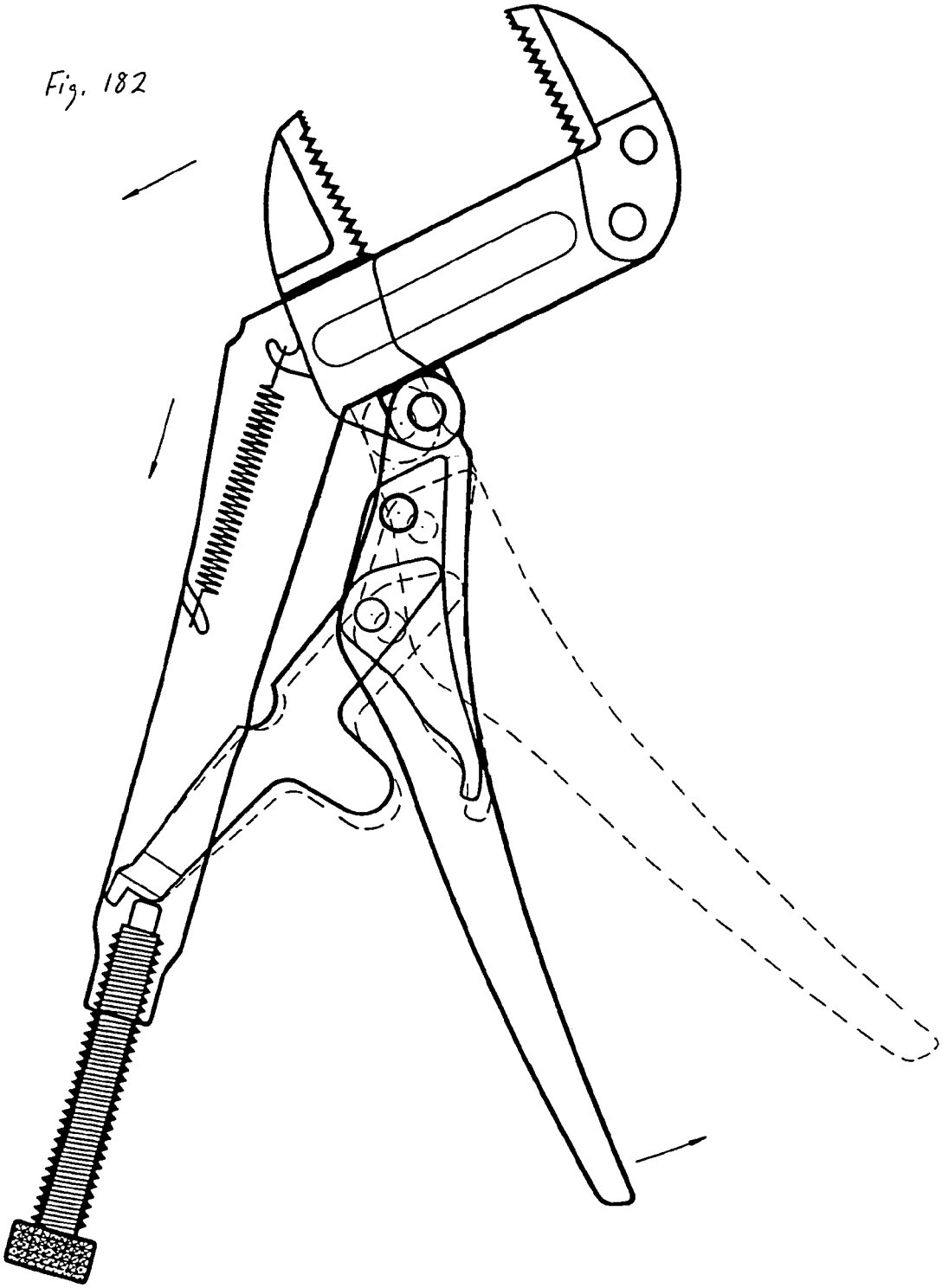

FIG. 182 - is a is a comprehensive side view showing overall dimensions of mechanisms in working relationship, with hidden mechanisms represented by thinner continuous lines. The thinnest lines of FIG. 182 represent the contours of part formation. The dashed lines of FIG. 182 represent part movement indicated by arrows.

Figure 183:
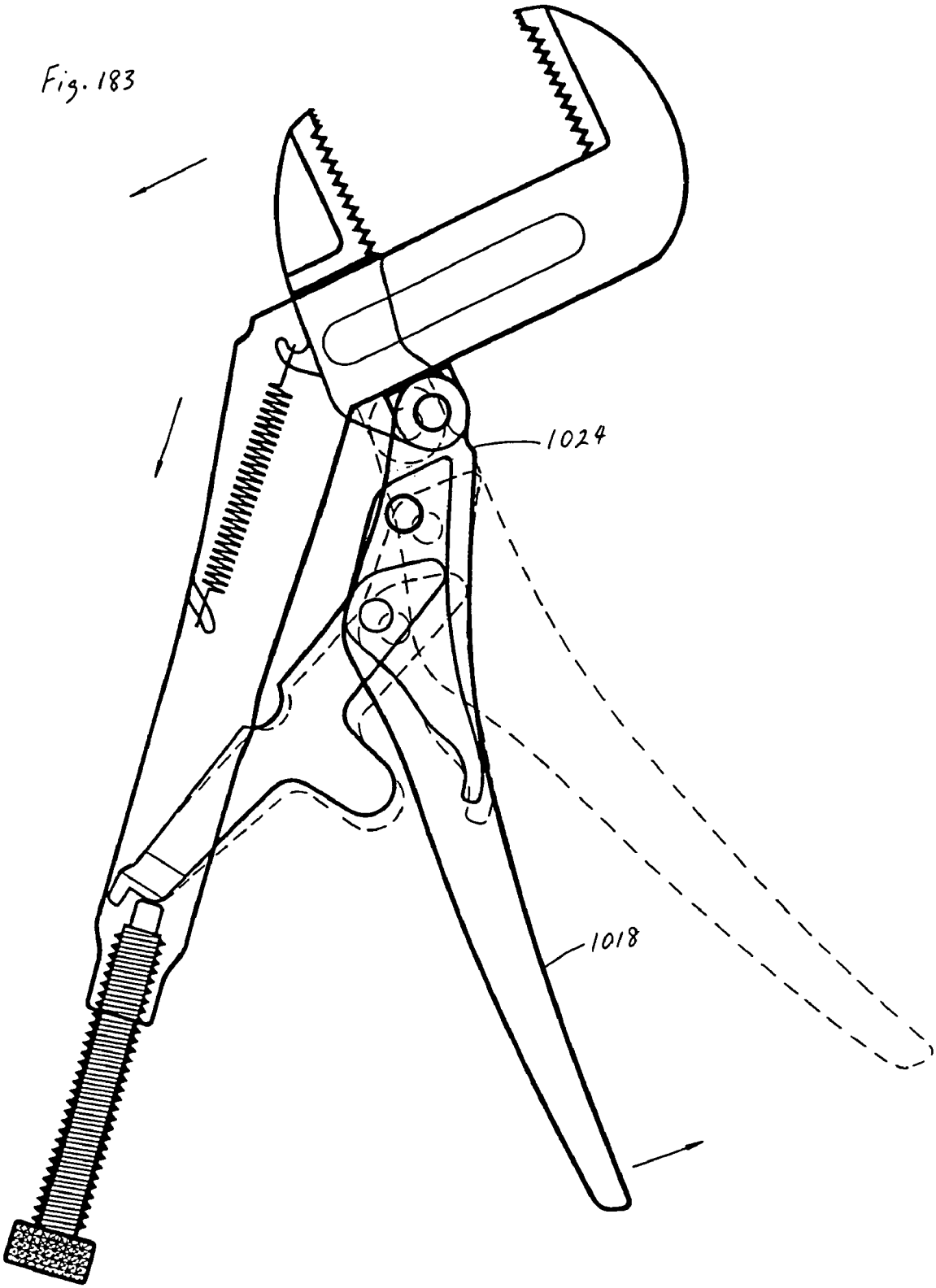

FIG. 183 - is a is a comprehensive side view showing overall dimensions of mechanisms in working relationship, with hidden mechanisms represented by thinner continuous lines. The thinnest lines of FIG. 183 represent the contours of part formation. The dashed lines of FIG. 183 represent part movement indicated by arrows.

Figure 184:
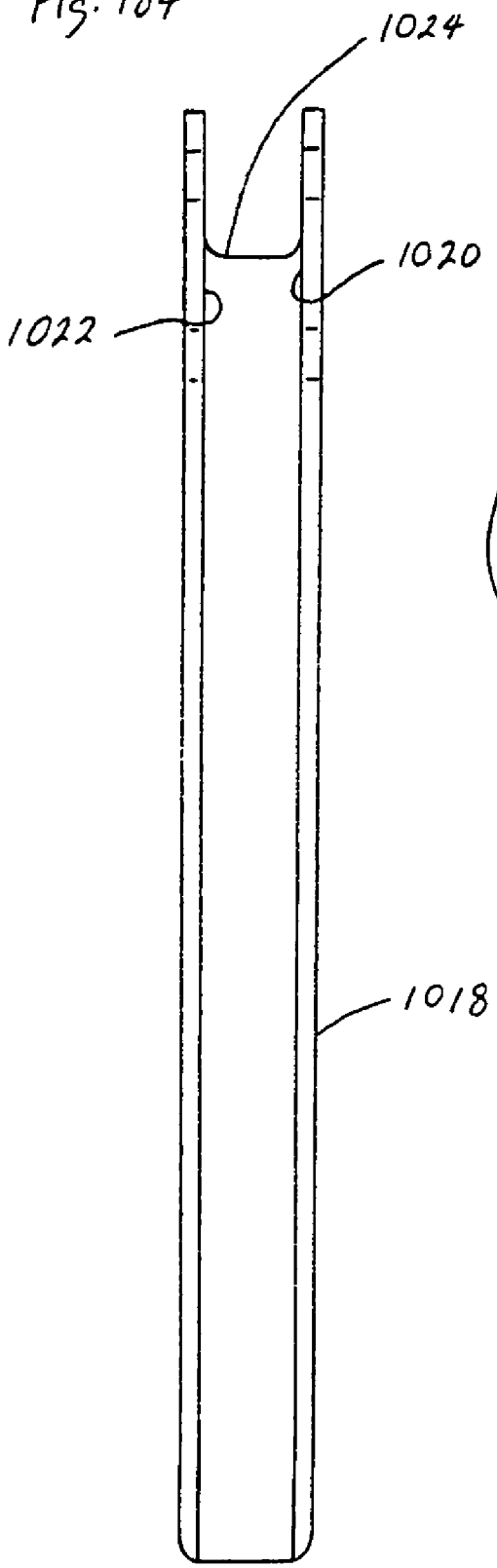

FIG. 184 - is a bottom view of upper handle having a straight spaced sidewalls.

Figure 185:
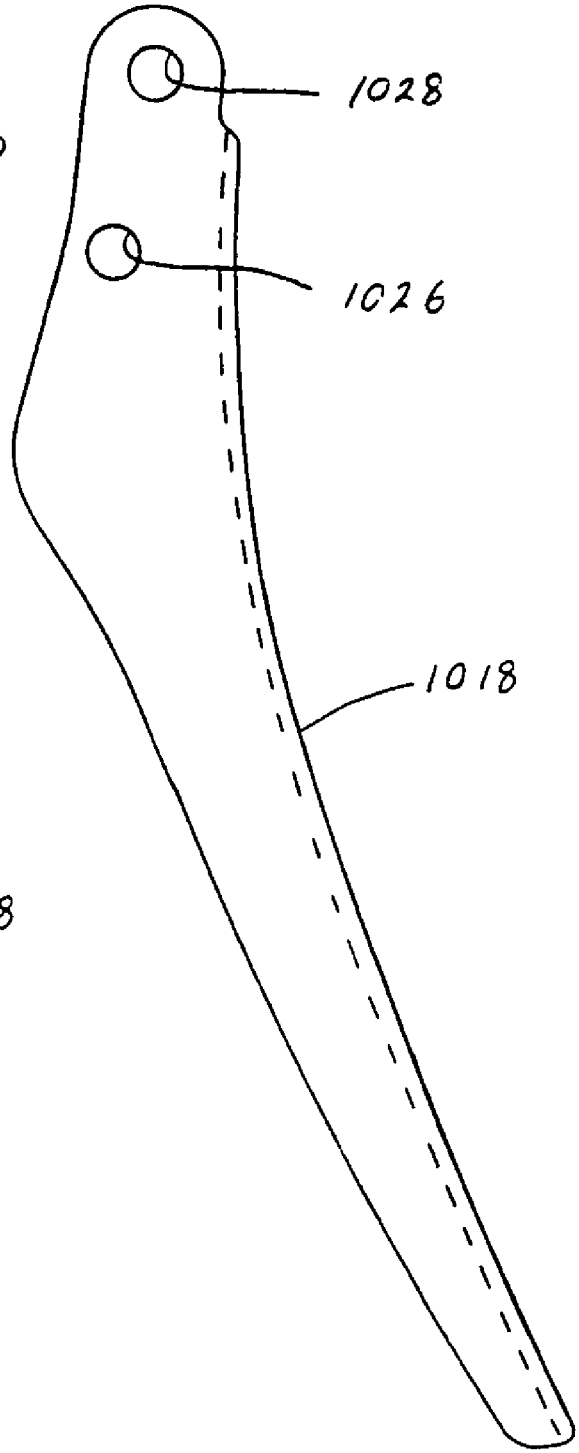

FIG. 185 - is a side view of upper handle showing material thickness by dashed lines.

Figure 186:
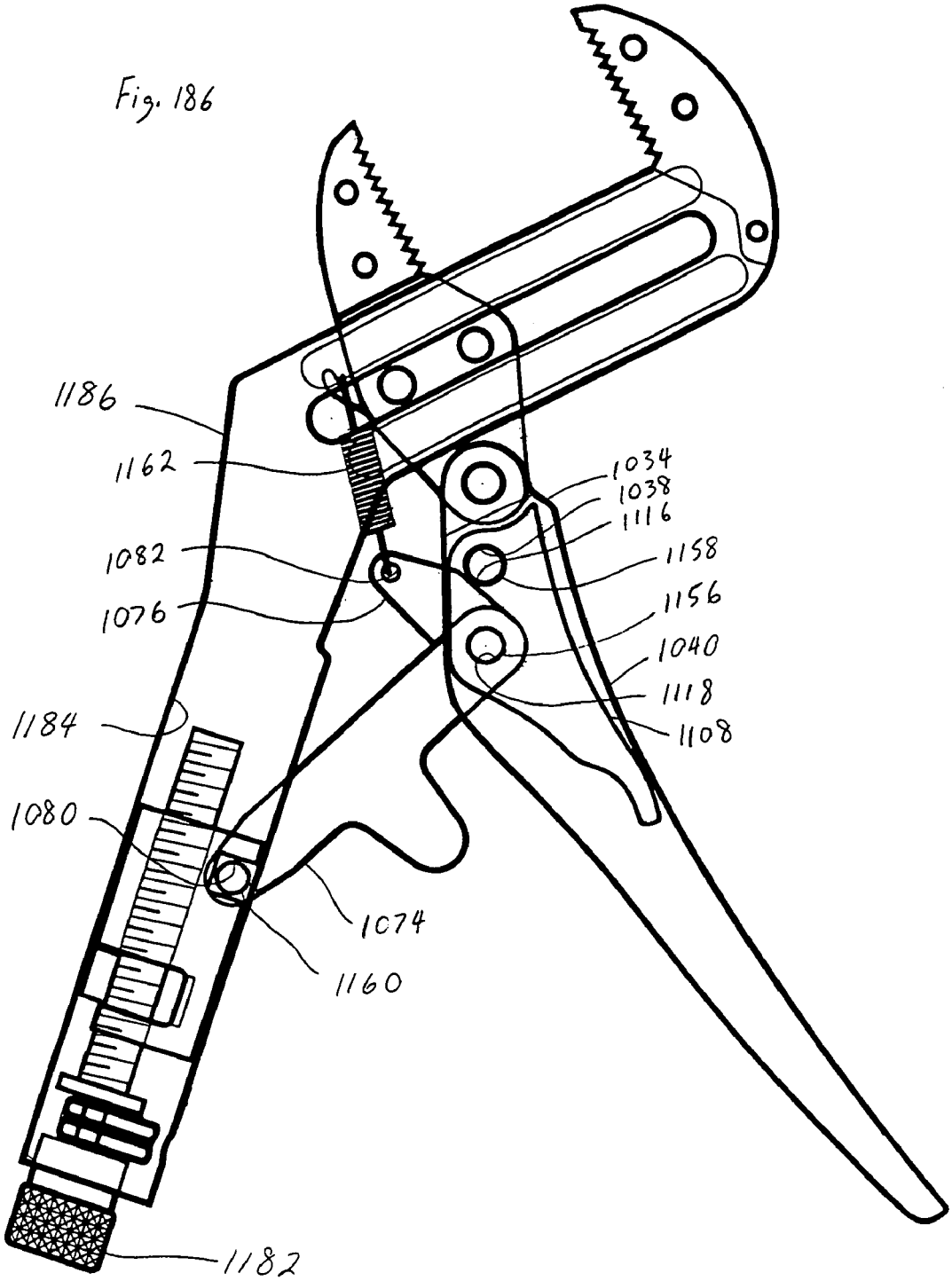

FIG. 186 - is a comprehensive side view showing overall dimensions of mechanisms in working relationship, with hidden mechanisms represented by thinner continuous lines. The thinnest lines of FIG. 184 represent the contours of part formation.

Figure 187:
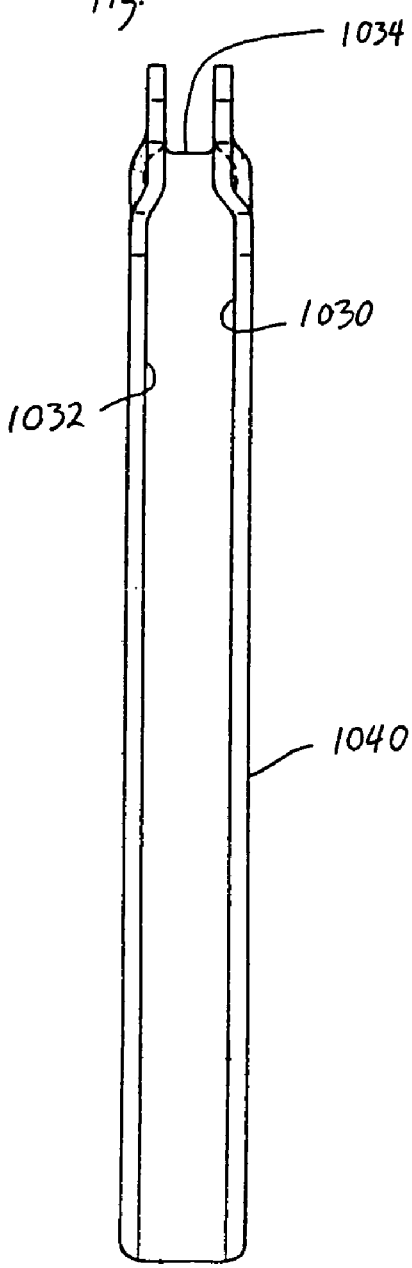

FIG. 187 - is a bottom view of upper handle having a curvature to spaced sidewalls.

Figure 188:
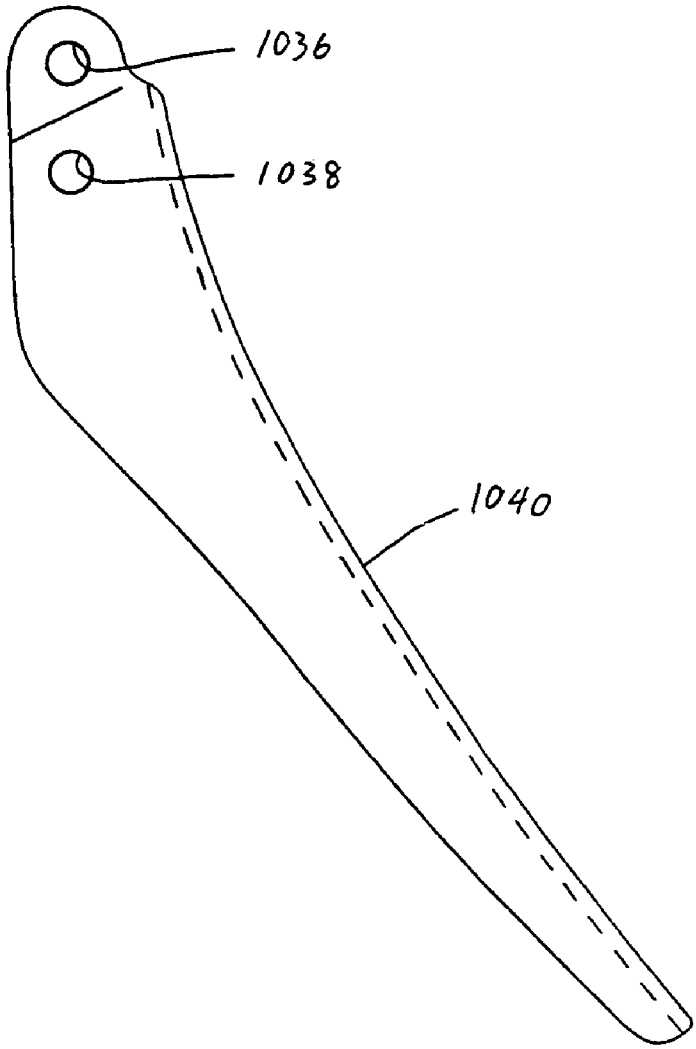

FIG. 188 - is a side view of upper handle showing material thickness by dashed lines.

Figure 189:
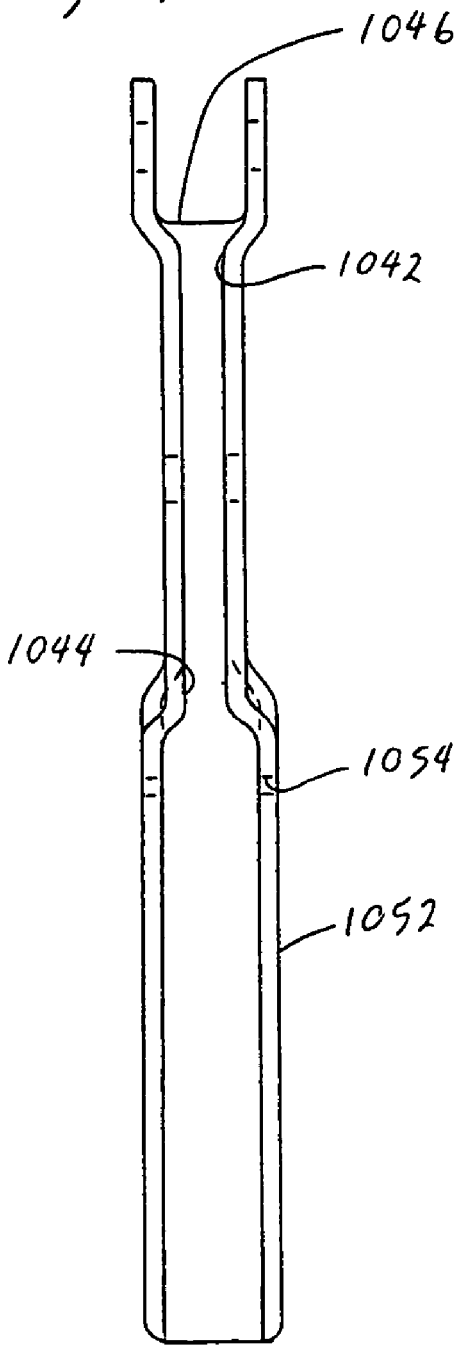

FIG. 189 - is a bottom view of upper handle (depicted in FIG. 169) having spaced sidewalls.

Figure 190:
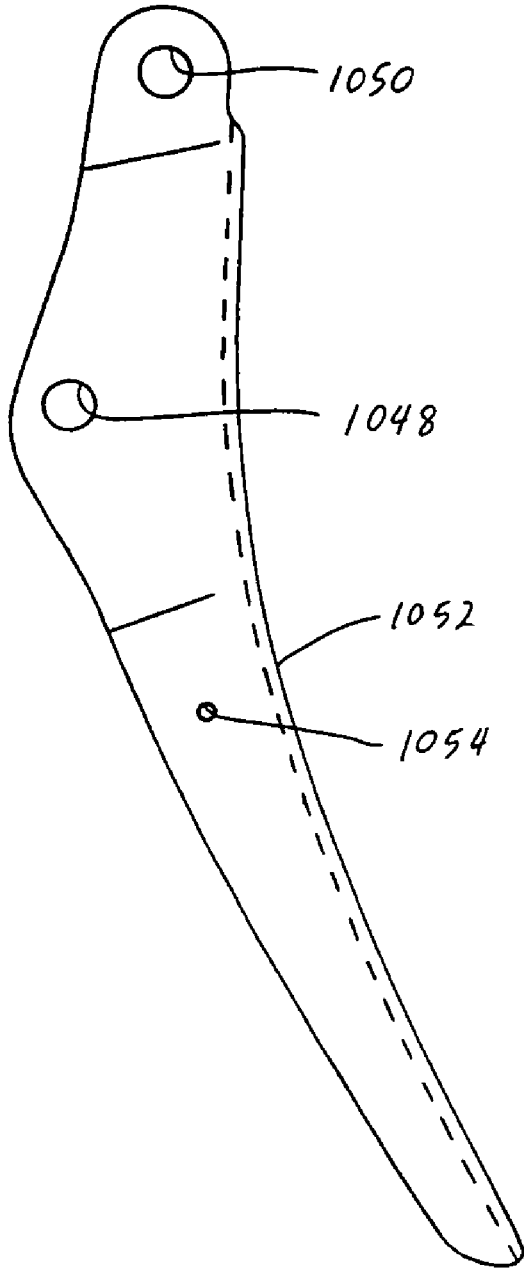

FIG. 190 - is a side view of upper handle (depicted in FIG. 169) showing material thickness by dashed lines.

Figure 191:
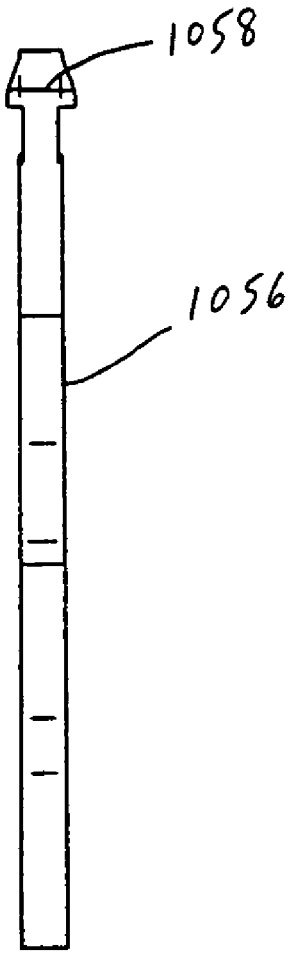

FIG. 191 - is a top view of toggle (depicted in FIG. 169) showing a widen width dimension to a pivot end.

Figure 192:
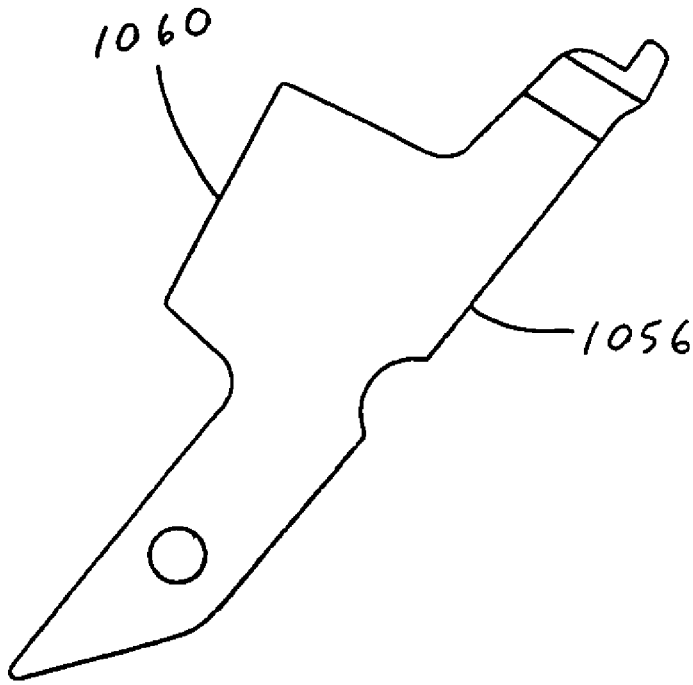

FIG. 192 - is a side of toggle (depicted in FIG. 169) having a flat release lever compression surface.

Figure 193:
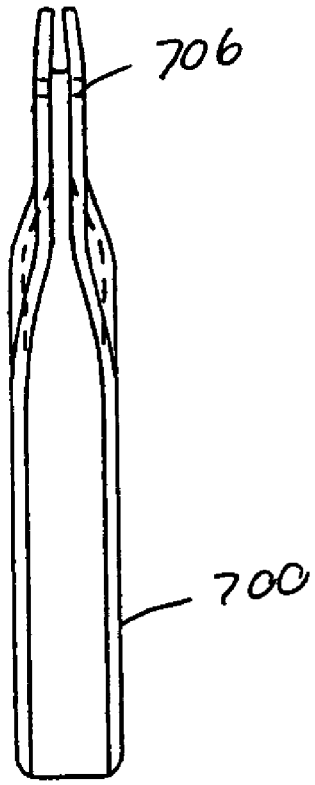

FIG. 193 - is a bottom view of release lever (depicted in FIG. 165) having curvature to spaced sidewalls.

Figure 194:
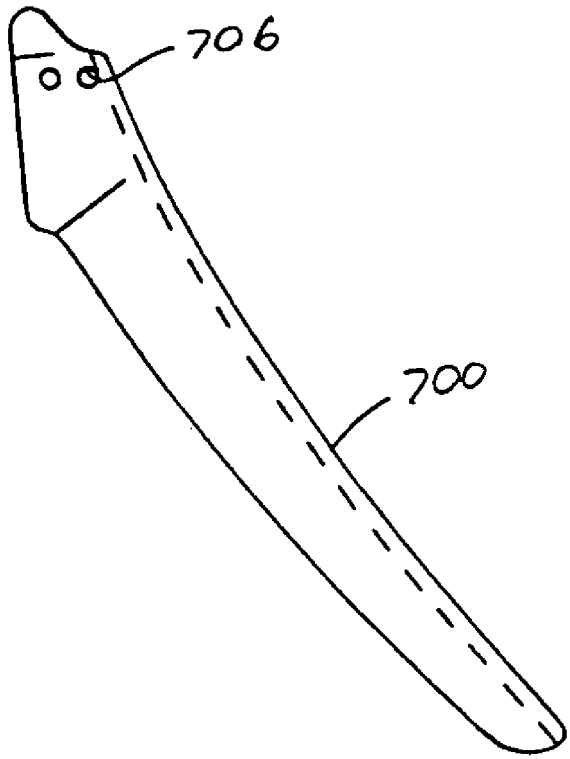

FIG. 194 - is a side view of release lever (depicted in FIG. 165) showing material thickness by dashed lines.

Figure 195:
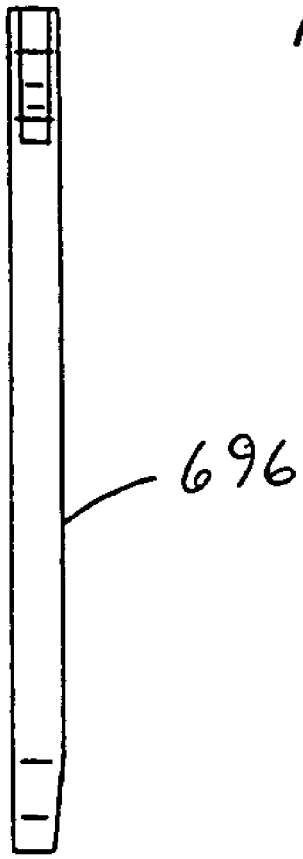

FIG. 195 - is a top view of toggle (depicted in FIG. 165) showing a width dimension to toggle extension.

Figure 196:
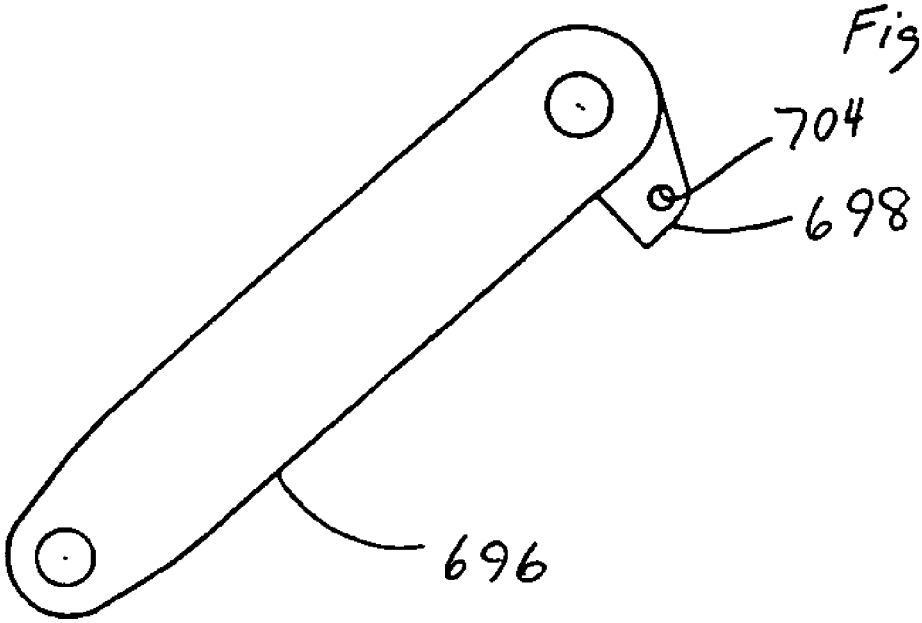

FIG. 196 - is a side view of toggle (depicted in FIG. 165) showing a height dimension of toggle extension.

Figure 197:
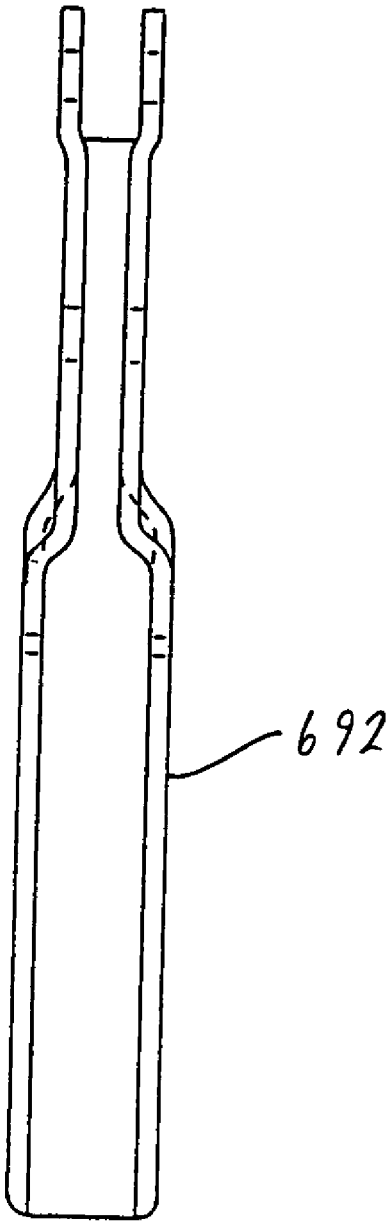

FIG. 197 - is a bottom view of upper handle (depicted in FIG. 165) having spaced sidewalls.

Figure 198:
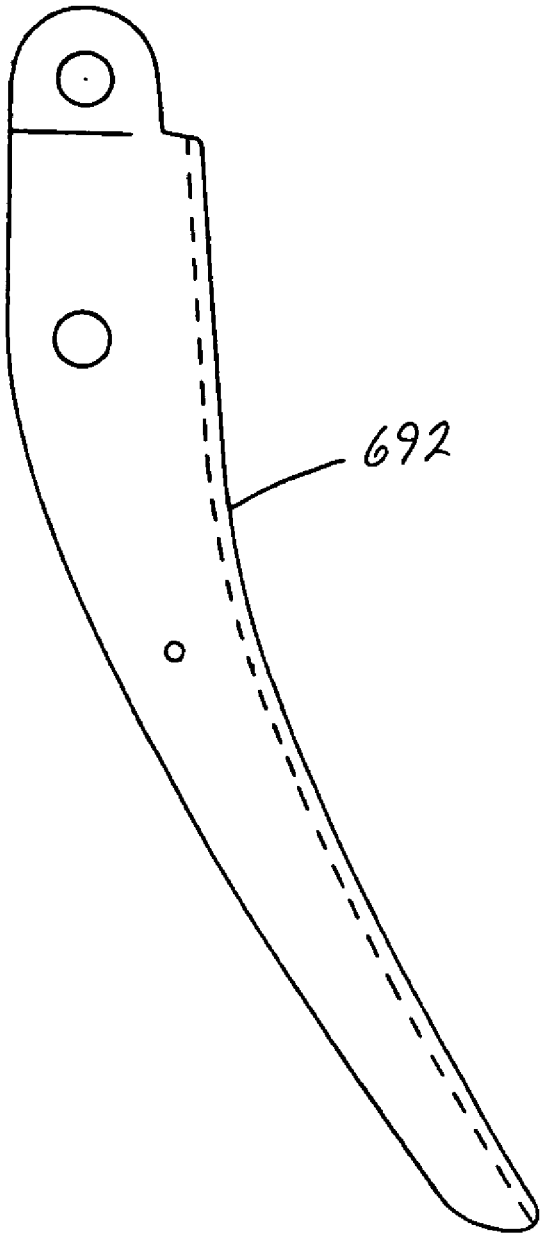

FIG. 198 - is a side view of upper handle (depicted in FIG. 165) showing material thickness by dashed lines.

Figure 199:
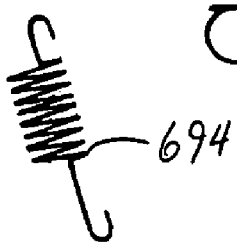

FIG. 199 - is a side view of spring (depicted in FIG. 165) showing hooks.

Figure 200:
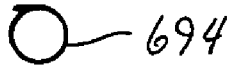

FIG. 200 - is a front view of spring (depicted in FIG. 165) showing a width dimension.

Figure 201:
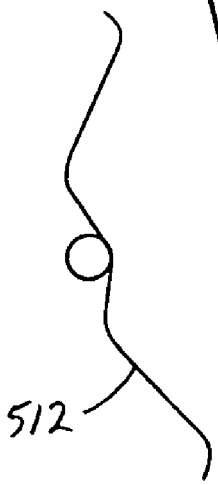

FIG. 201 - is a side view of spring (depicted in FIG. 126) showing a looped middle section.

Figure 202:
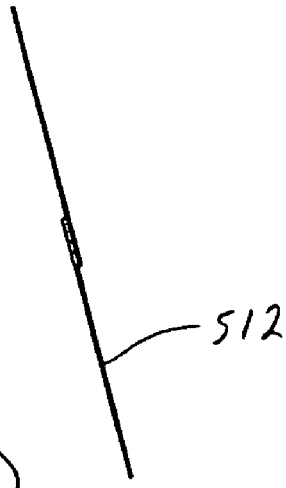

FIG. 202 - is a top view of spring (depicted in FIG. 126) showing a width dimension to a looped middle section.

FIG. 203 - is a side view of a slidable jaw member (depicted in FIG. 120) showing a flat compression surface.

FIG. 204 - is a side view of a fixed jaw insert (depicted in FIG. 120) showing a height dimension to an attachable extension.

Figure 205:
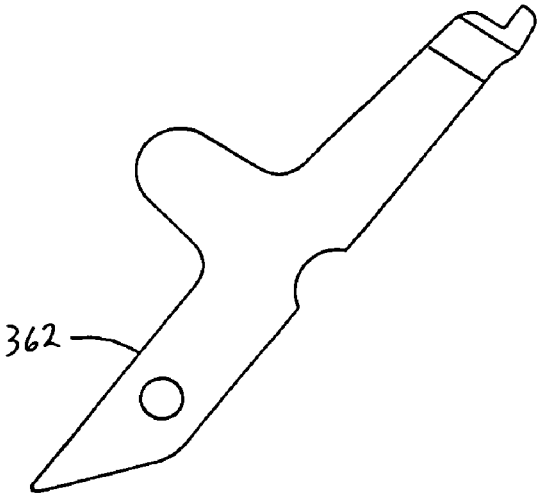

FIG. 205 - is a side view of toggle (depicted in FIG. 37) showing an overall length dimension.

Figure 206:
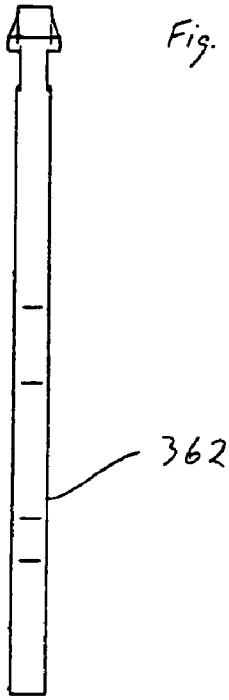

FIG. 206 - is a top view of toggle (depicted in FIG. 37) showing a widen width dimension to a pivot end.

Figure 207:
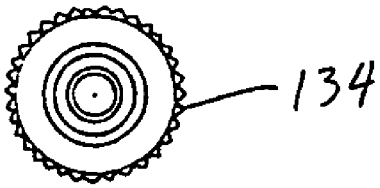

FIG. 207 - is a rear view of adjustment screw (depicted in FIG. 37) showing a circular knurled grip surface.

Figure 208:
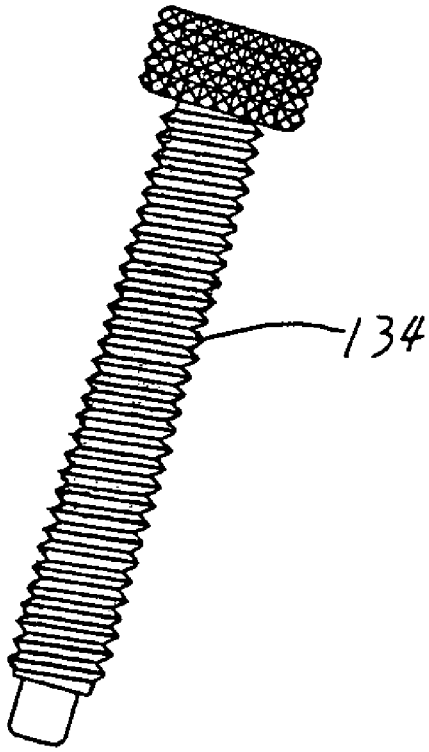

FIG. 208 - is a side view of adjustment screw (depicted in FIG. 37) showing an overall length dimension.

Figure 209:
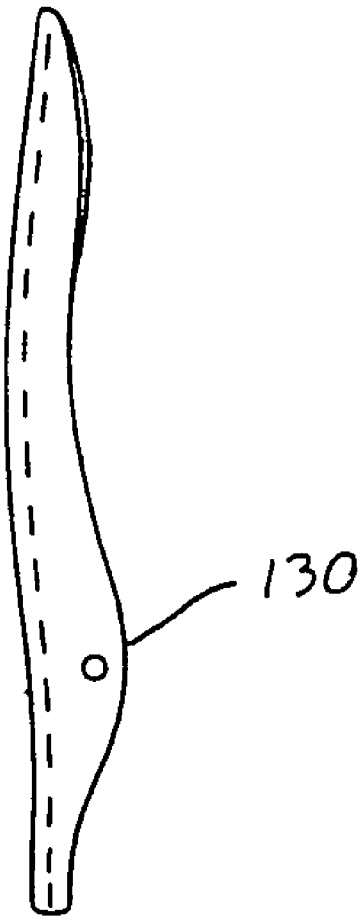

FIG. 209 - is a side view of release lever (depicted in FIG. 37) showing material thickness by dashed lines.

Figure 210:
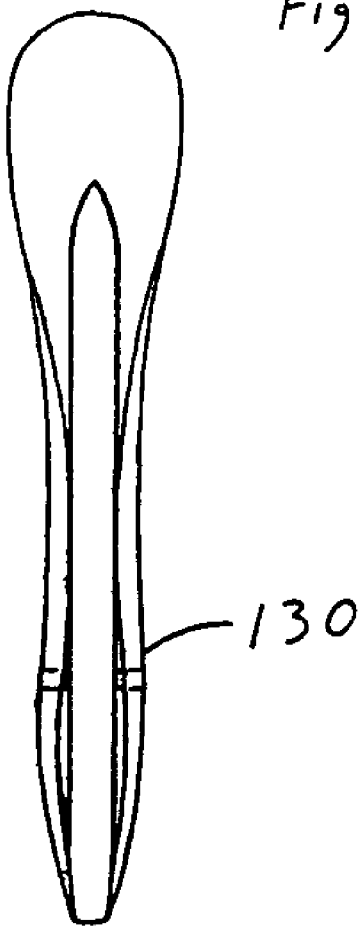

FIG. 210 - is a bottom view of release lever (depicted in FIG. 37) showing curvature to spaced sidewalls.

FIG. 211 - is a side view of toggle (depicted in FIG. 176) having a shortened overall length dimension.

FIG. 212 - is a top view of toggle (depicted in FIG. 176) showing a widen width dimension to a pivot end.

FIG. 213 - is a side view of toggle (depicted in FIG. 179) having a narrowed forward contact end.

FIG. 214 - is a top view of toggle (depicted in FIG. 179) showing a widen width dimension to a pivot end.

Figure 215:
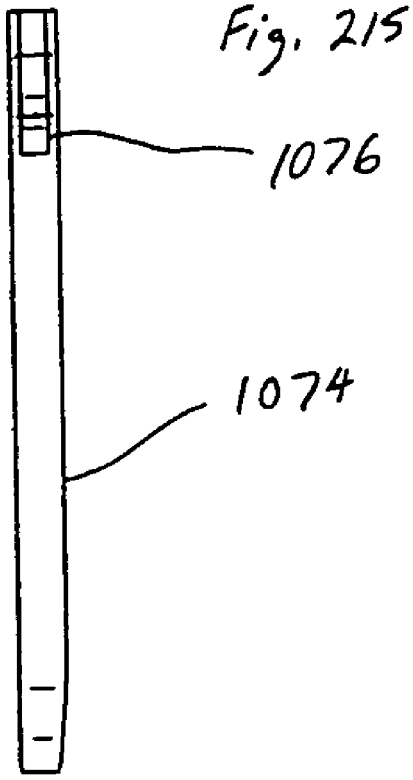

FIG. 215 - is a bottom view of toggle (depicted in FIG. 186) showing a width dimension to toggle extension.

Figure 216:
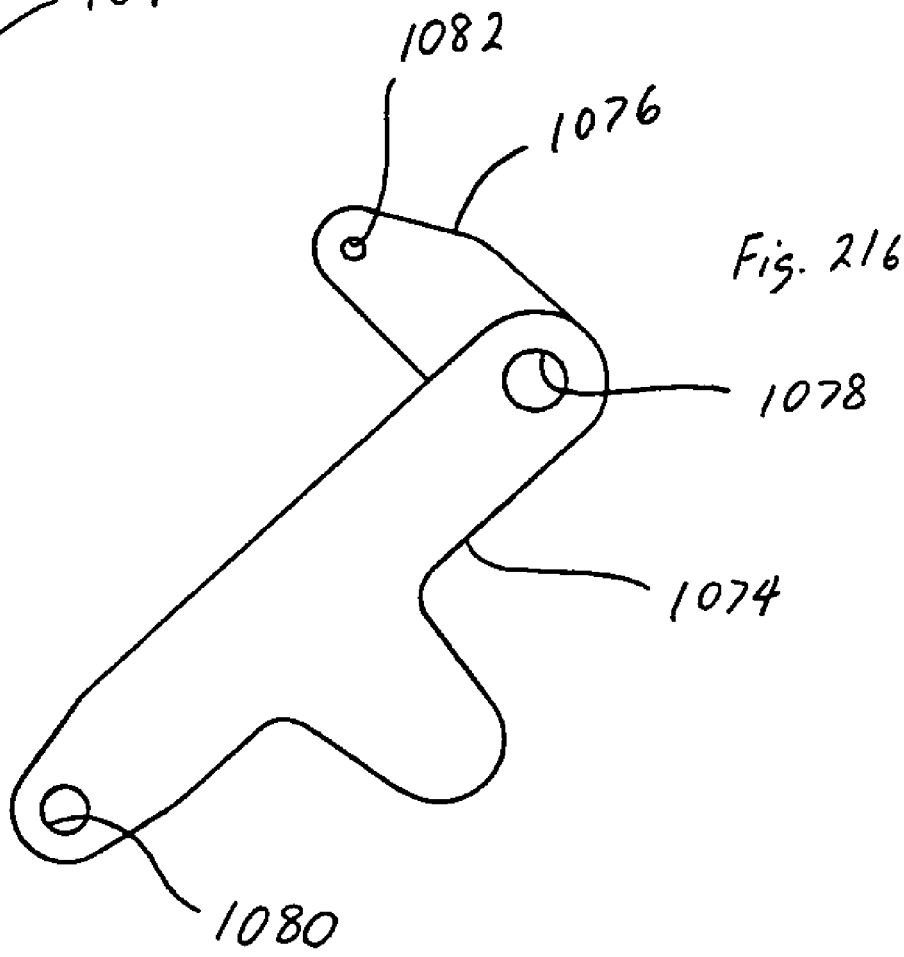

FIG. 216 - is a side view of toggle (depicted in FIG. 186) showing a height dimension to toggle extension.

Figure 217:
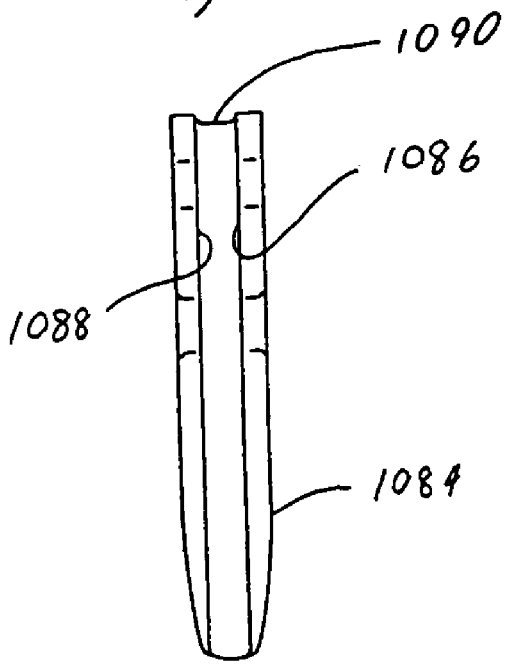

FIG. 217 - is a bottom view of toggle release link (depicted in FIG. 174) showing spaced straight sidewalls.

Figure 218:
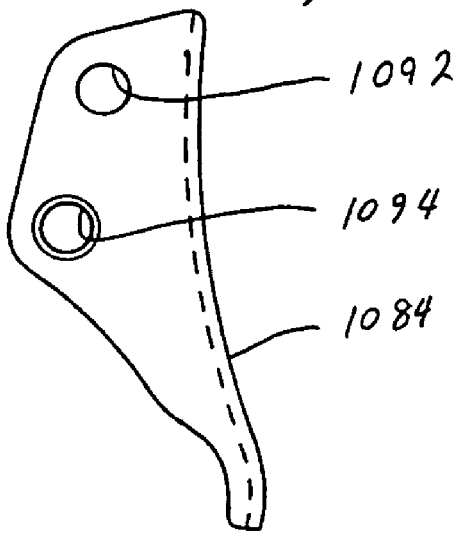

FIG. 218 - is a side view of toggle release link (depicted in FIG. 174) having a fluted recessed sections of a rearward rivet hole; and also this side view shows material thickness by dashed lines.

Figure 219:
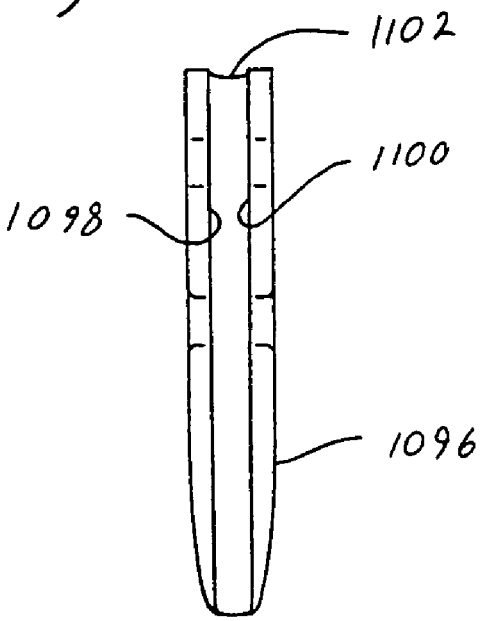

FIG. 219 - is a bottom view of toggle release link (depicted in FIG. 176) showing spaced straight sidewalls.

Figure 220:
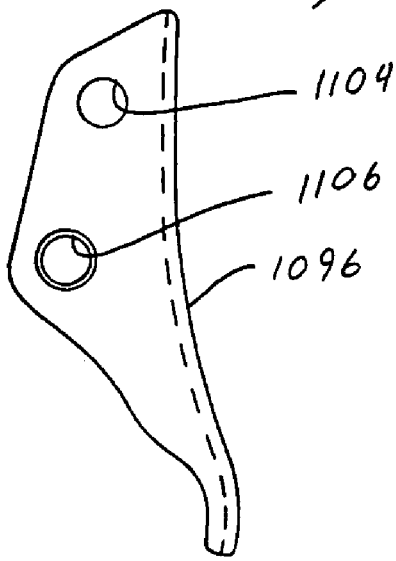

FIG. 220 - is a side view of toggle release link (depicted in FIG. 176) having a fluted recessed sections of a rearward rivet hole; and also this side view shows material thickness by dashed lines.

Figure 221:
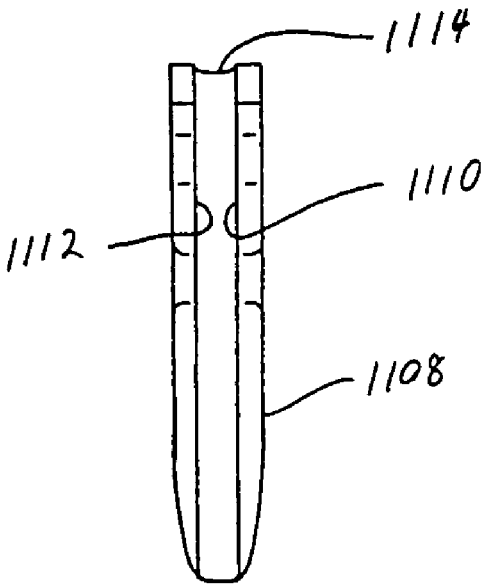

FIG. 221 - is a bottom view of toggle release link (depicted in FIG. 186) showing spaced straight sidewalls.

Figure 222:
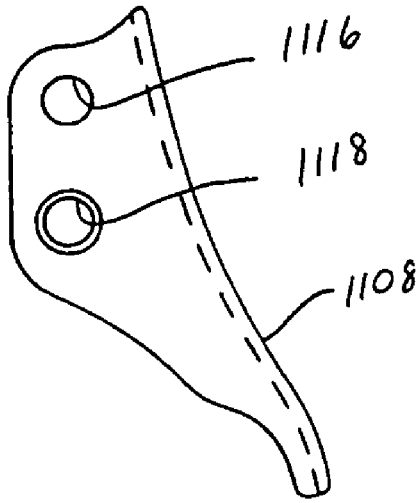

FIG. 222 - is a side view of toggle release link (depicted in FIG. 186) having a fluted recessed sections of a rearward rivet hole; and also this side view shows material thickness by dashed lines; and also this side view shows a curved forward section.

Figure 223:
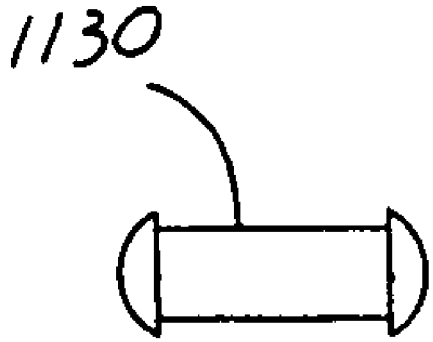

FIG. 223 - is a side view of rivet having a length that is workable with all designs herein that utilize a toggle release link and/or slidable plates.

Figure 224:
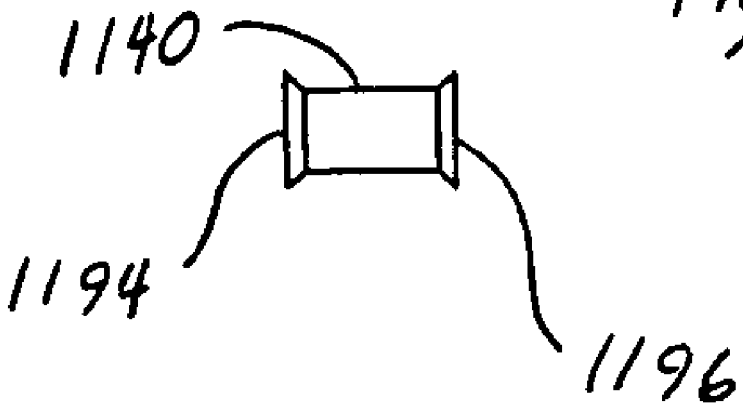

FIG. 224 - is side view of release link rivet having a length that is workable with all designs herein utilizing a toggle release link (rivet shown with countersunk heads).

Figure 225:
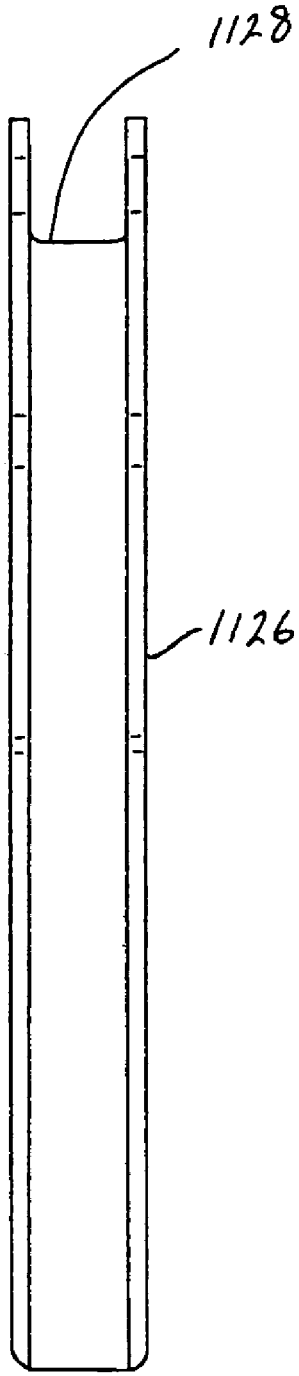

FIG. 225 - is a bottom of upper handle (depicted in FIG. 170) having straight sidewalls extending the entire length dimension.

Figure 226:
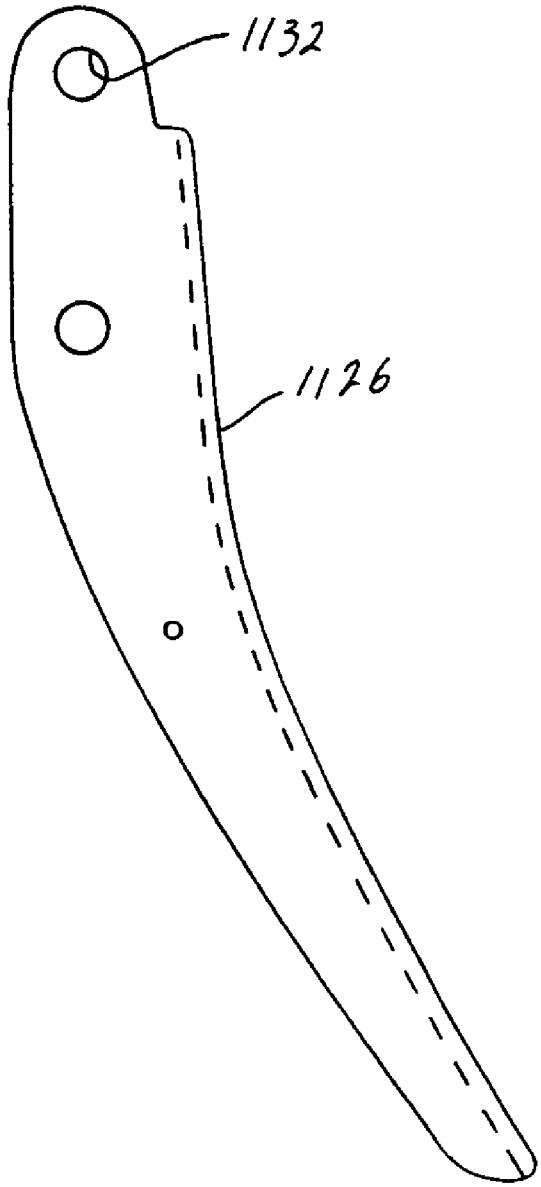

FIG. 226 - is a side view of upper handle showing a material thickness by dashed lines.

Figure 227:
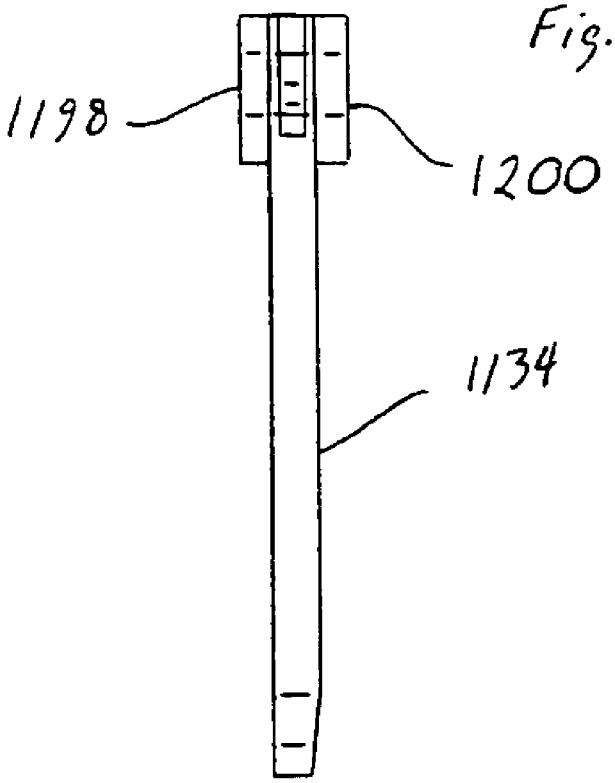

FIG. 227 - is a top view of toggle (depicted in FIG. 170) having a widen toggle extension section.

Figure 228:
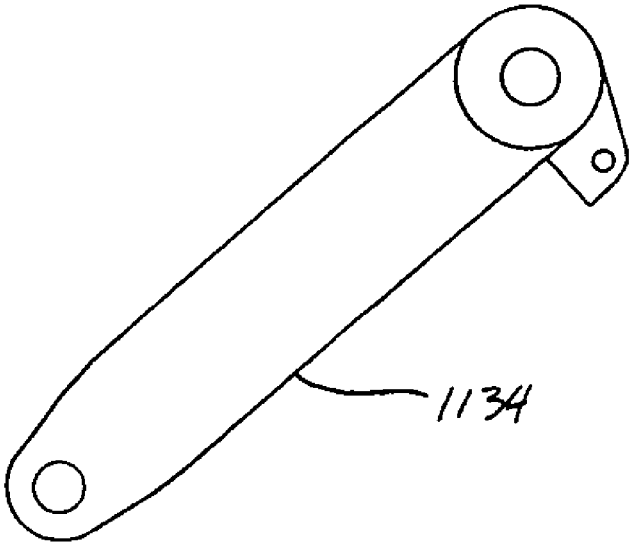

FIG. 228 - is a side view of toggle (depicted in FIG. 170) showing a round section on which a toggle extension is integral.

Figure 229:
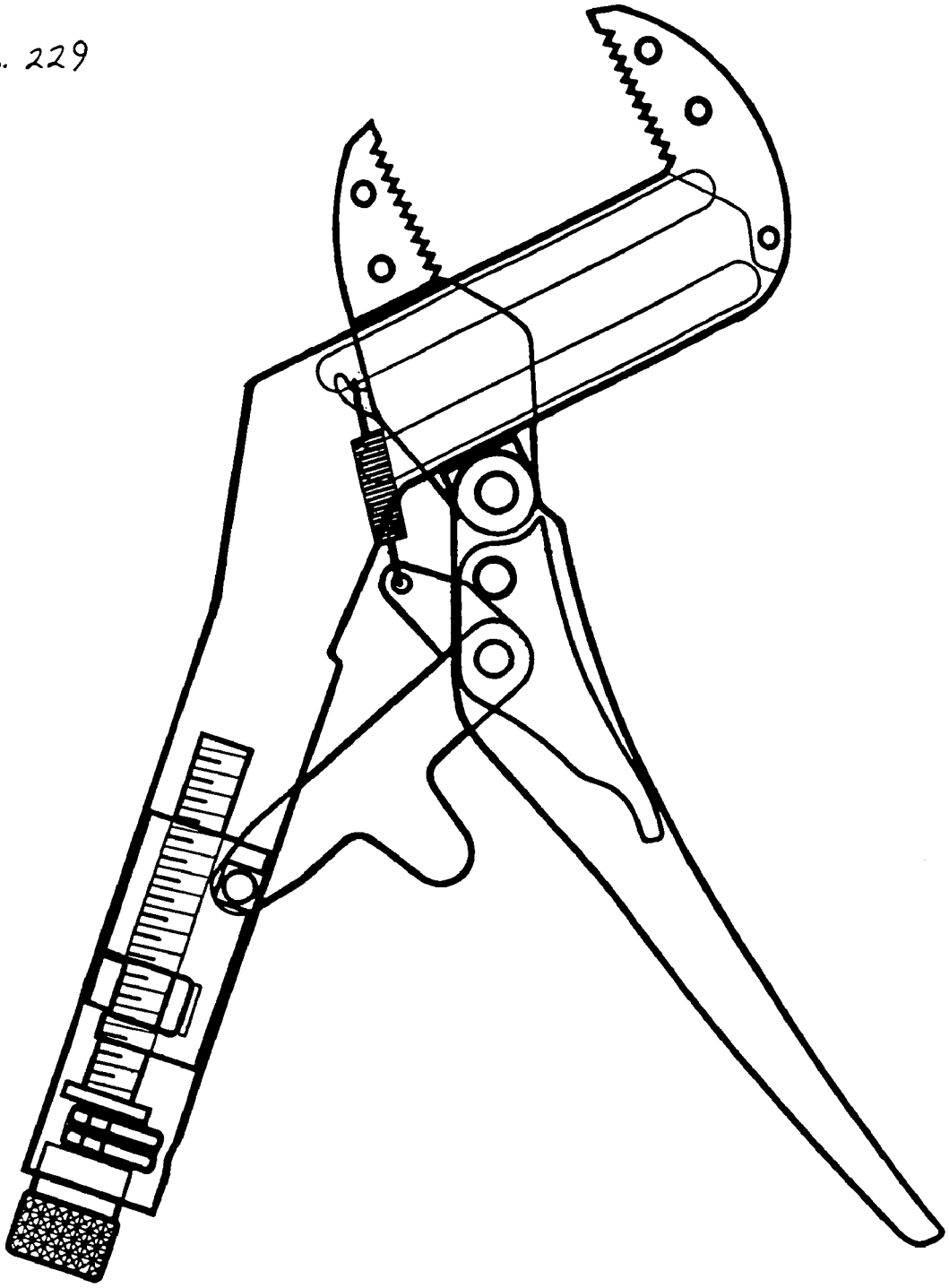

FIG. 229 - is a comprehensive side view showing overall dimensions of mechanisms in working relationship, with hidden mechanisms represented by thinner continuous lines. The thinnest lines of FIG. 229 represent the contours of part formation.

Figure 230:
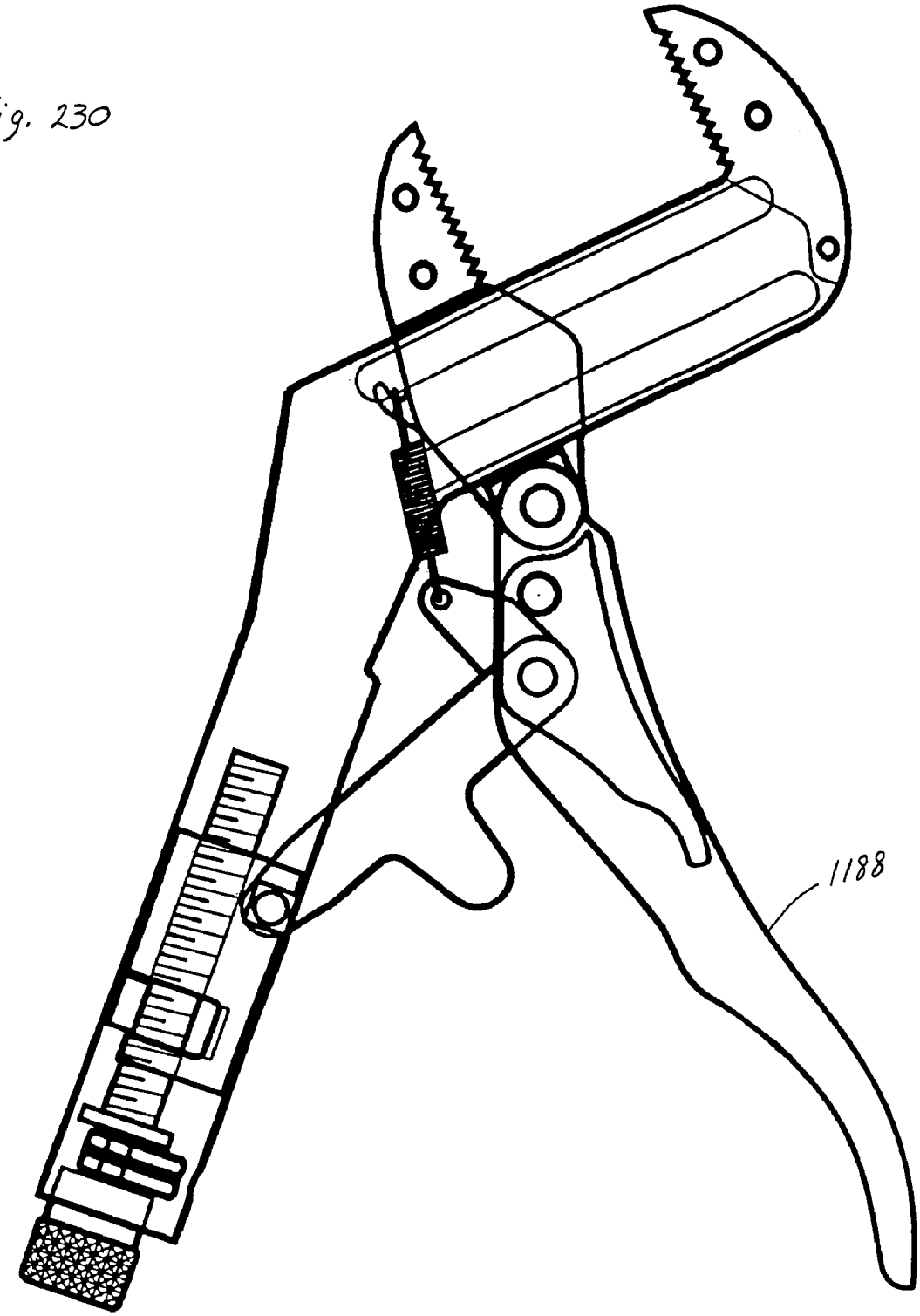

FIG. 230 - is a comprehensive side view showing overall dimensions of mechanisms in working relationship, with hidden mechanisms represented by thinner continuous lines. The thinnest lines of FIG. 230 represent the contours of part formation.

Figure 231:
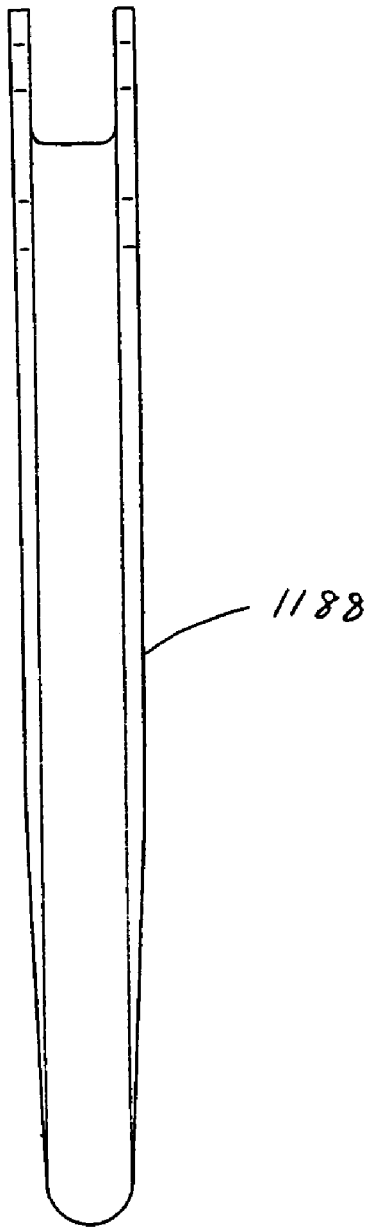

FIG. 231 - is a bottom view of upper handle showing the straight shape of a forward housing.

Figure 232:
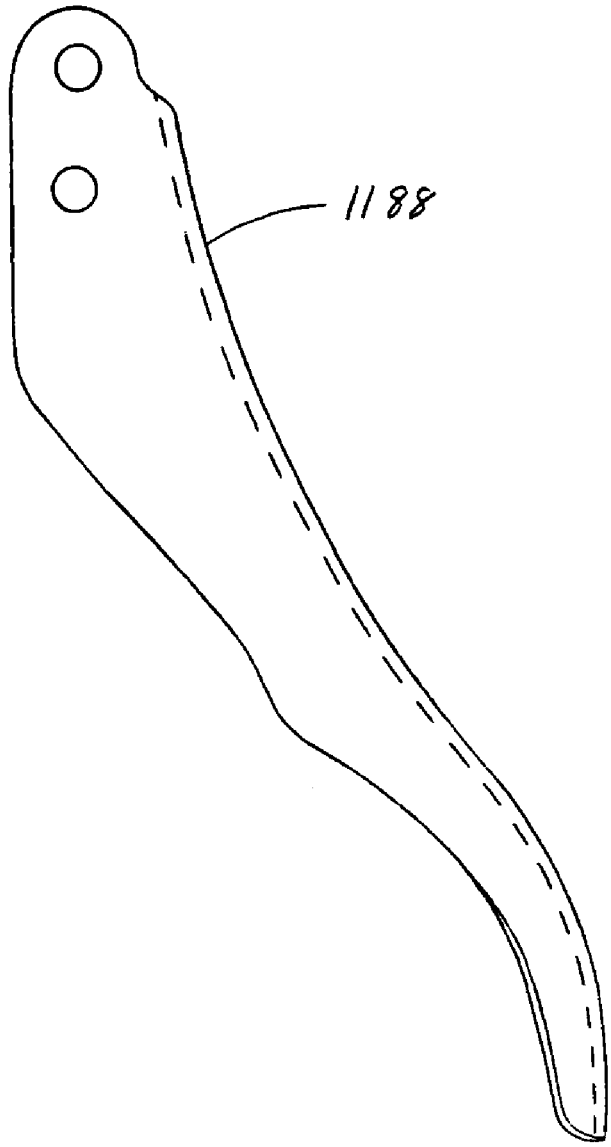

FIG. 232 - is a side view of upper handle showing a material thickness by dashed lines.

Figure 233:
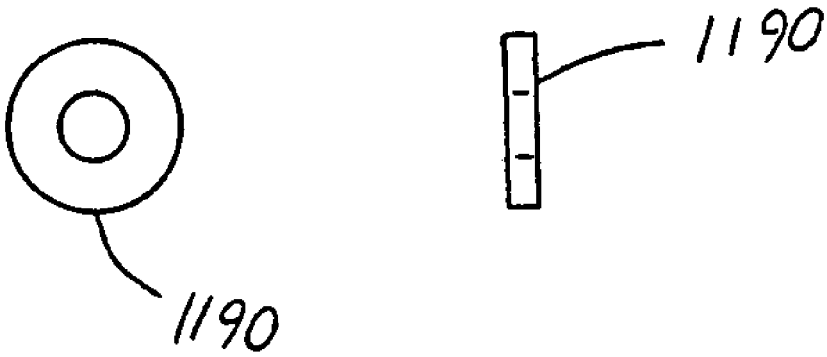

FIG. 233 - is side views of a rotatable plate showing a hole through.

Figure 234:
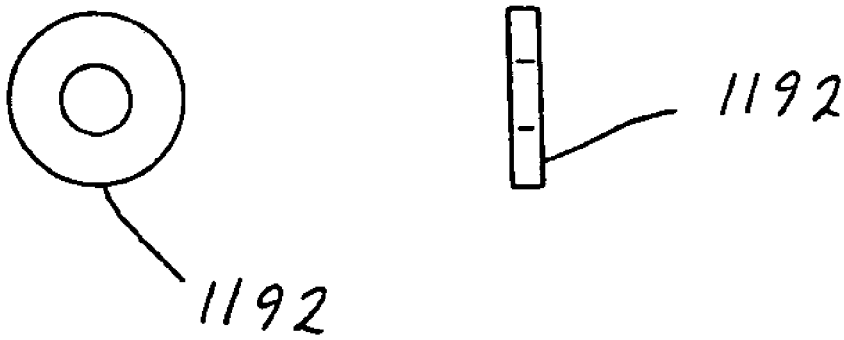

FIG. 234 - is side views of a rotatable plate showing a hole through.

Figure 235:
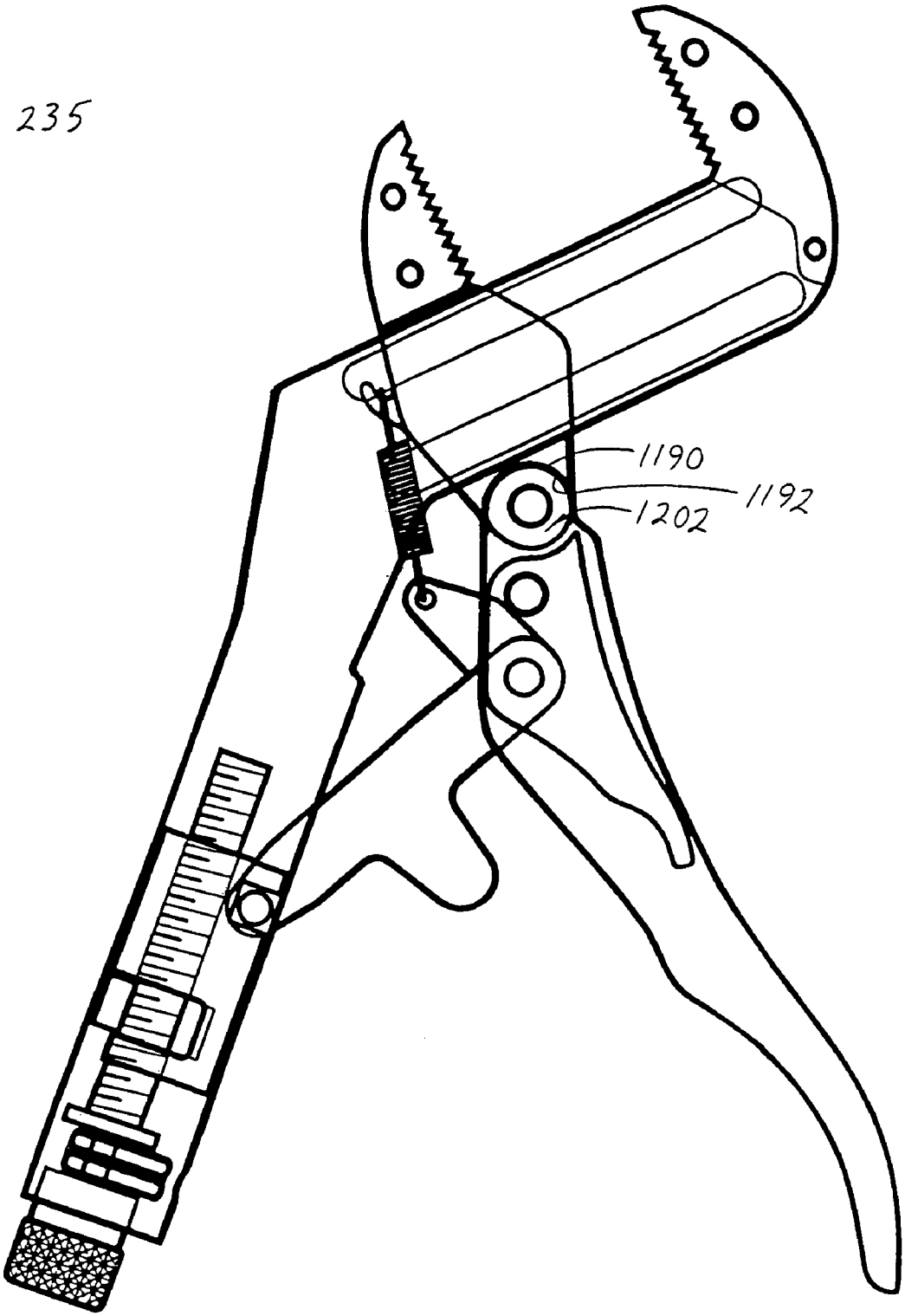

FIG. 235 - is a is a comprehensive side view showing overall dimensions of mechanisms in working relationship, with hidden mechanisms represented by thinner continuous lines. The thinnest lines of FIG. 235 represent the contours of part formation.

Figure 236:
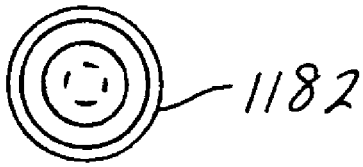
Figure 236:
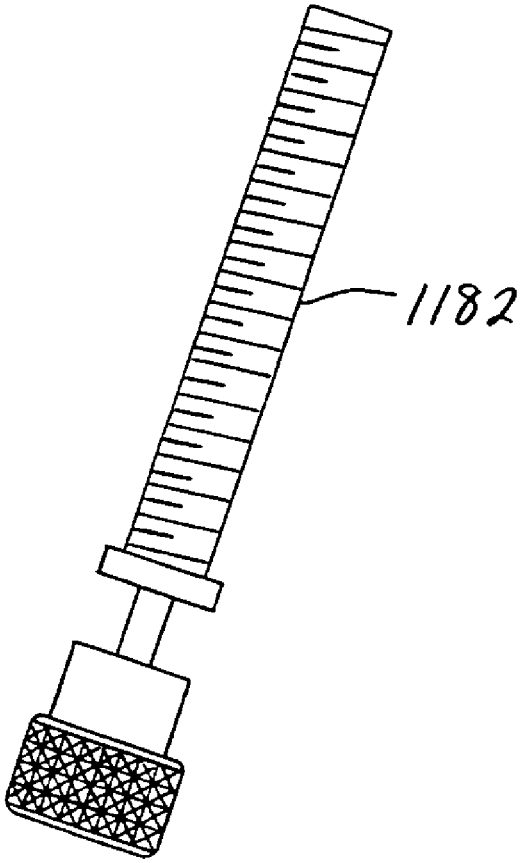

FIG. 236 - is a side and top view of an adjustable screw showing a comparatively longer threaded length section.

Figure 237:
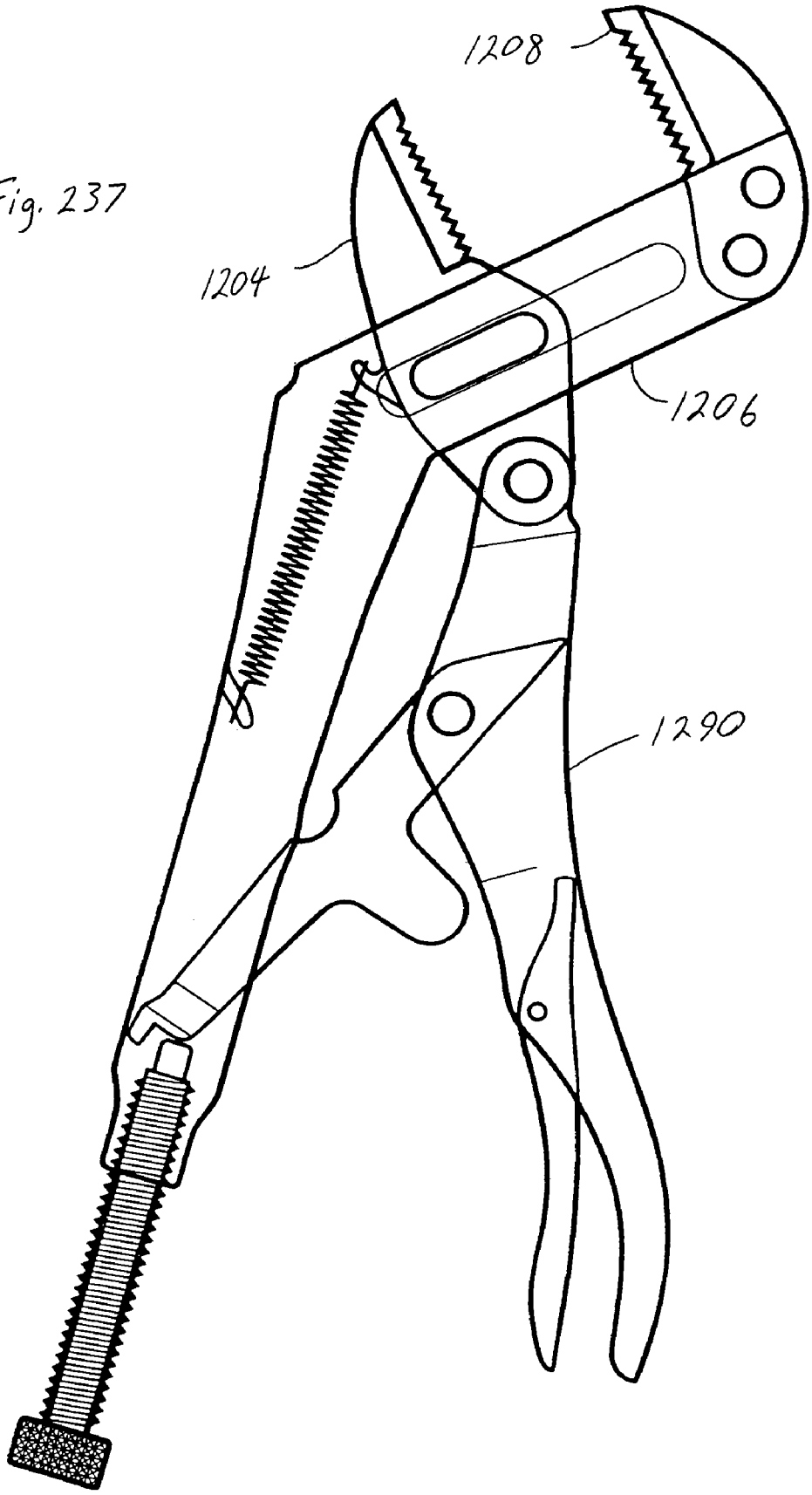

FIG. 237 is a comprehensive side view showing overall dimensions of mechanisms in working relationship, with hidden mechanisms represented by thinner continuous lines. The thinnest lines of FIG. 237 represent the contours of part formation.

Figure 238:
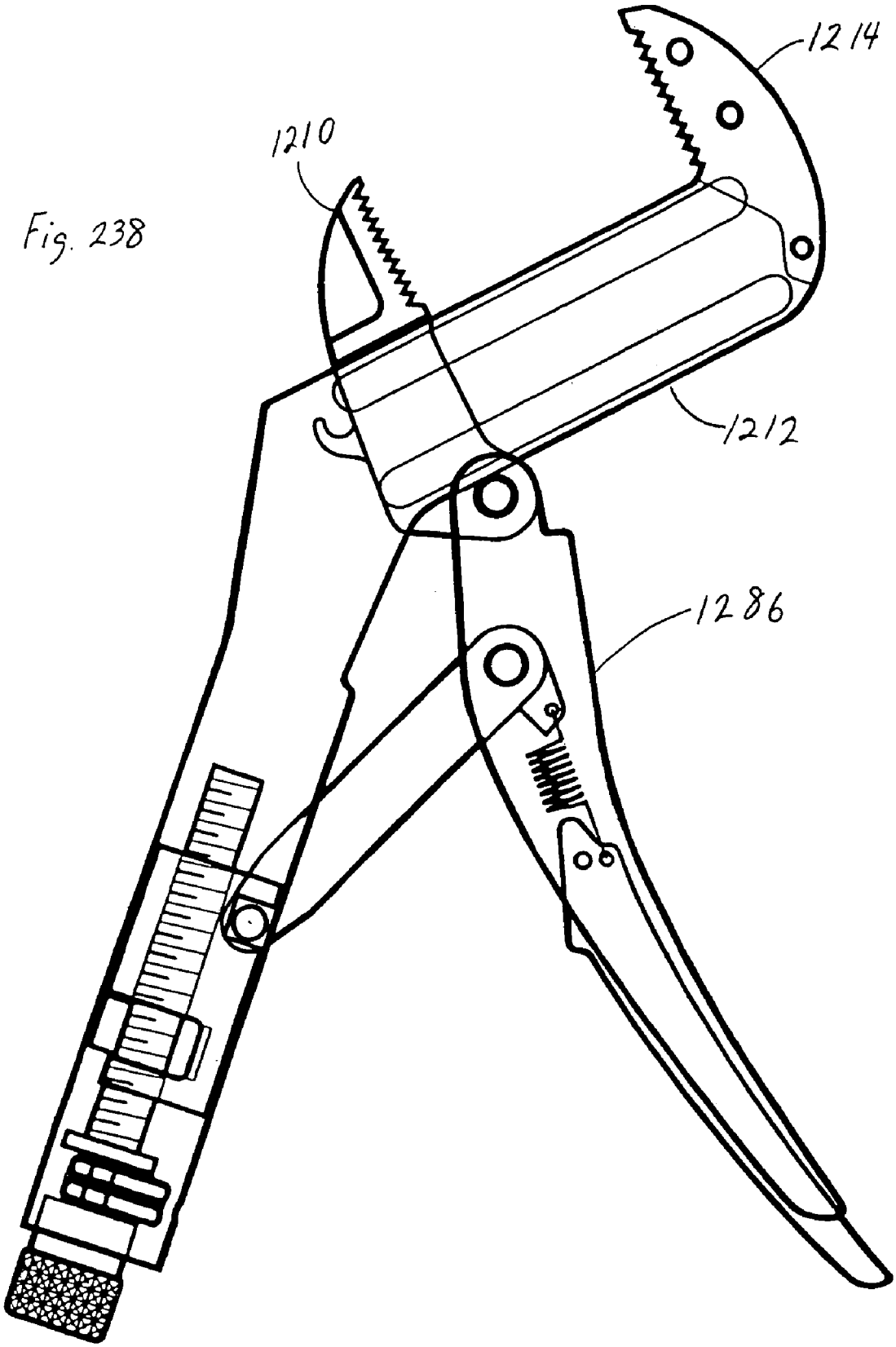

FIG. 238 is a comprehensive side view showing overall dimensions of mechanisms in working relationship, with hidden mechanisms represented by thinner continuous lines. The thinnest lines of FIG. 238 represent the contours of part formation.

Figure 239:
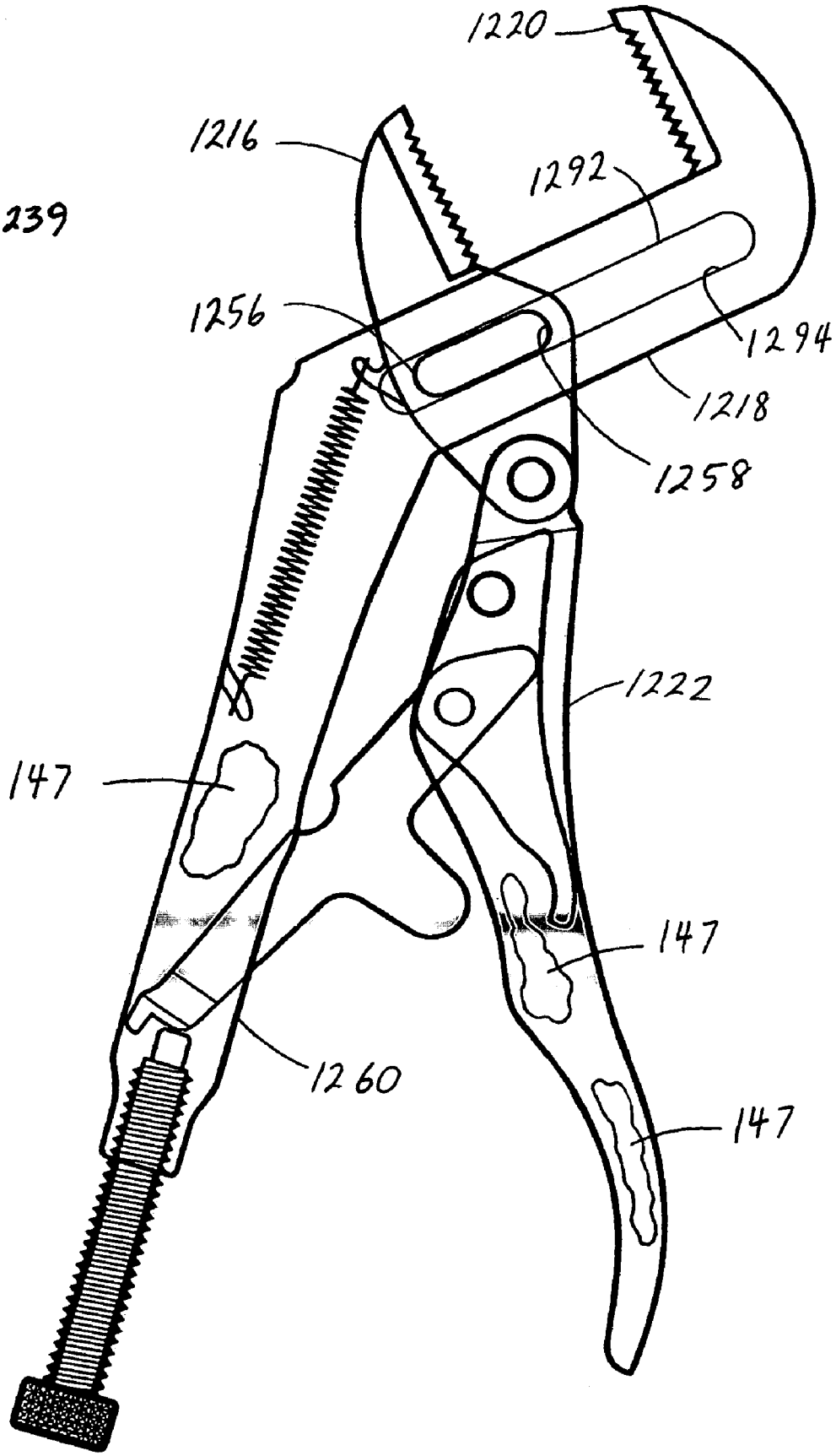

FIG. 239 is a comprehensive side view showing overall dimensions of mechanisms in working relationship, with hidden mechanisms represented by thinner continuous lines. The thinnest lines of FIG. 239 represent the contours of part formation.

Figure 240:
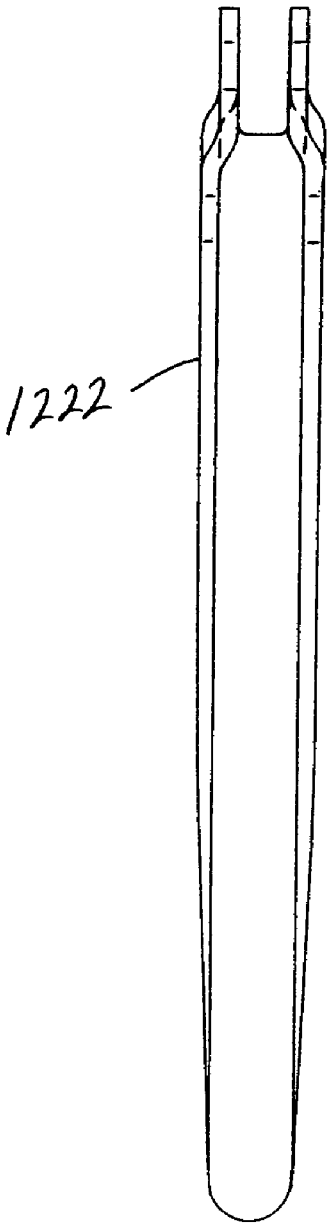

FIG. 240 is a bottom view of an upper handle (depicted in FIG. 239) showing curvature of a forward housing.

Figure 241:
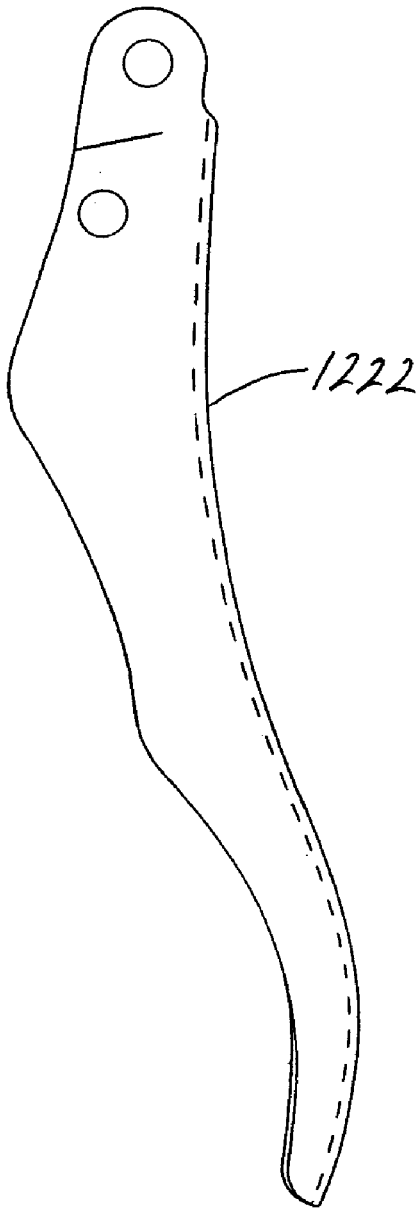

FIG. 241 is a side view of an upper handle (depicted in FIG. 239) showing an overall length dimension.

Figure 242:
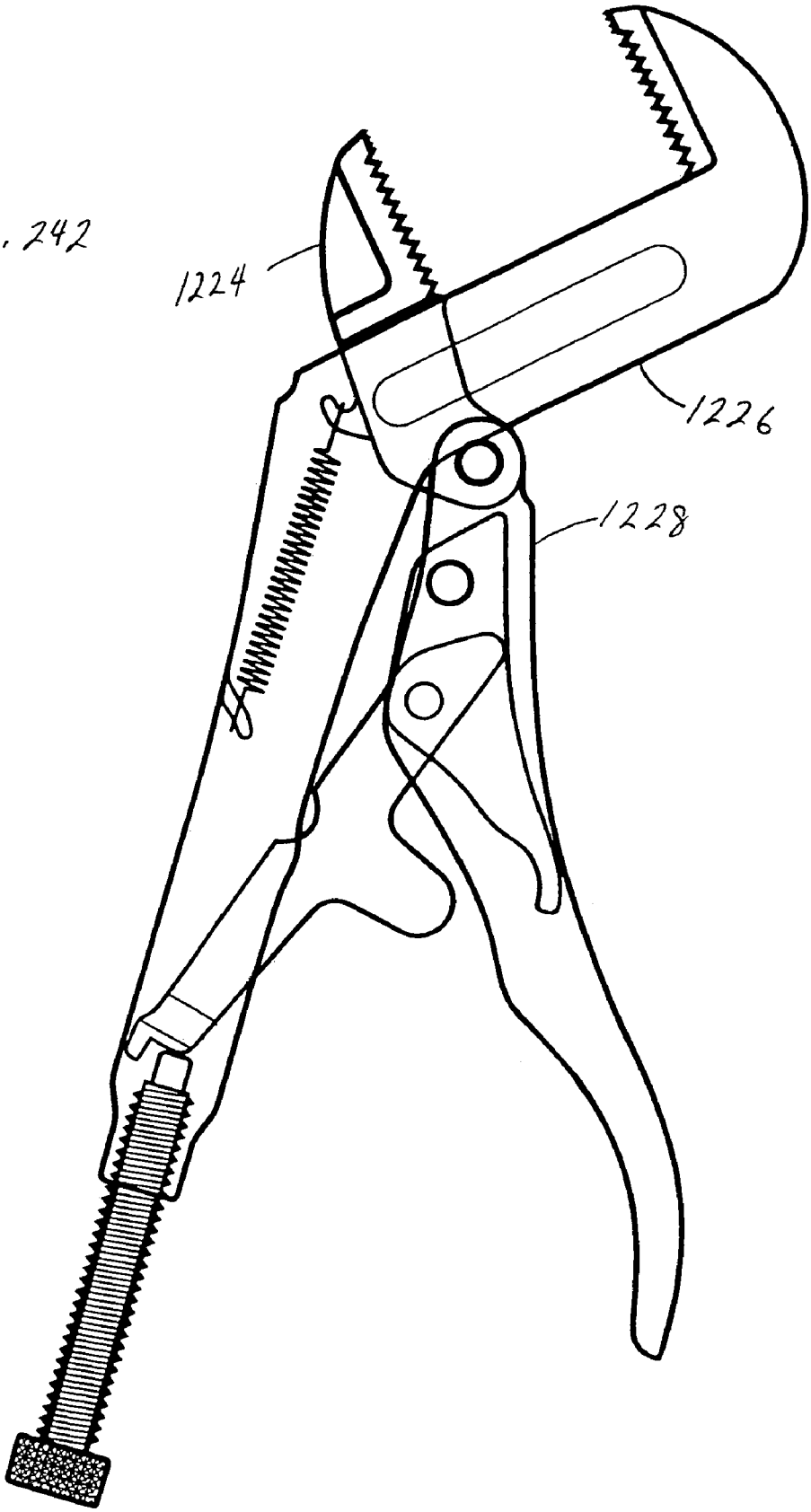

FIG. 242 is a comprehensive side view showing overall dimensions of mechanisms in working relationship, with hidden mechanisms represented by thinner continuous lines. The thinnest lines of FIG. 242 represent the contours of part formation.

Figure 243:
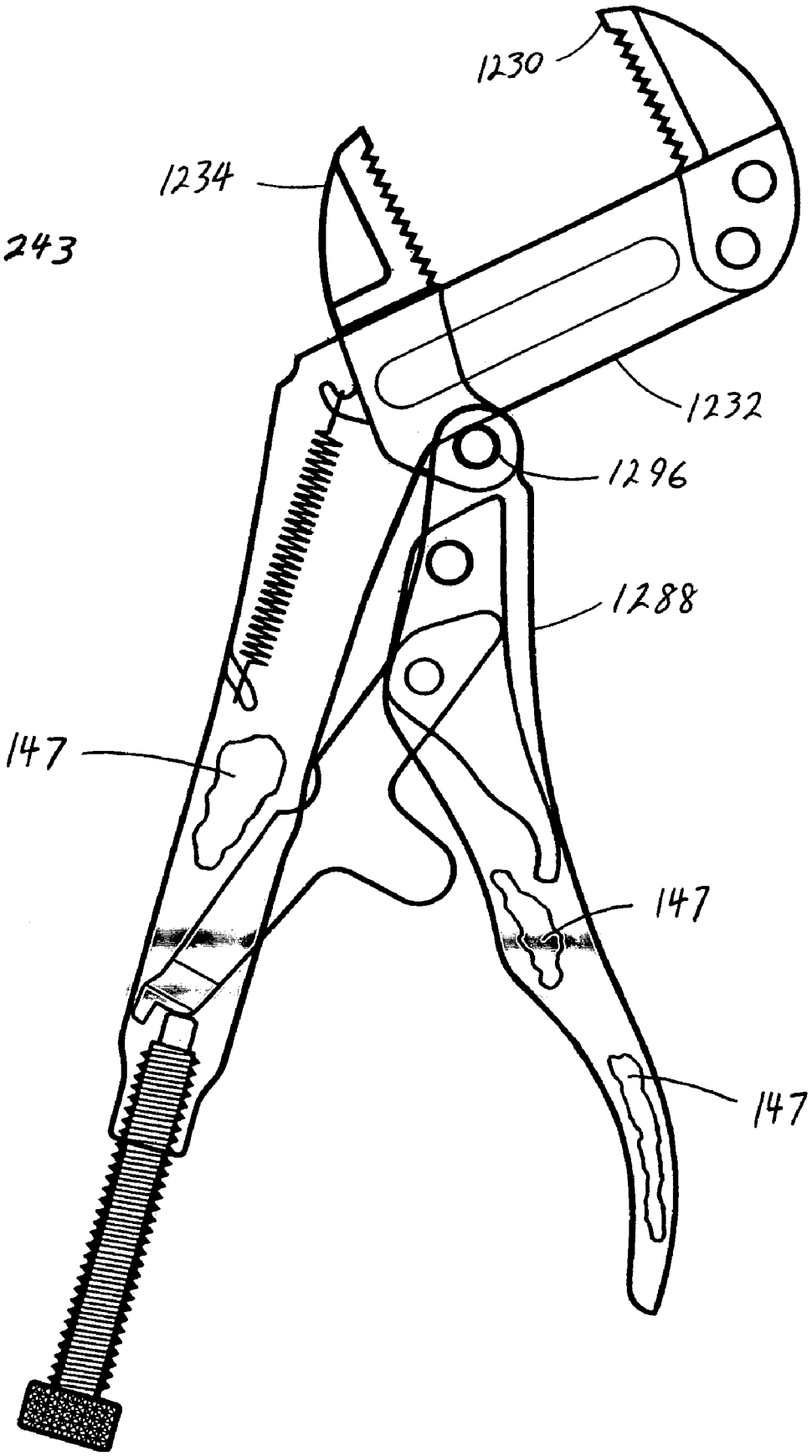

FIG. 243 is a comprehensive side view showing overall dimensions of mechanisms in working relationship, with hidden mechanisms represented by thinner continuous lines. The thinnest lines of FIG. 243 represent the contours of part formation.

Figure 244:
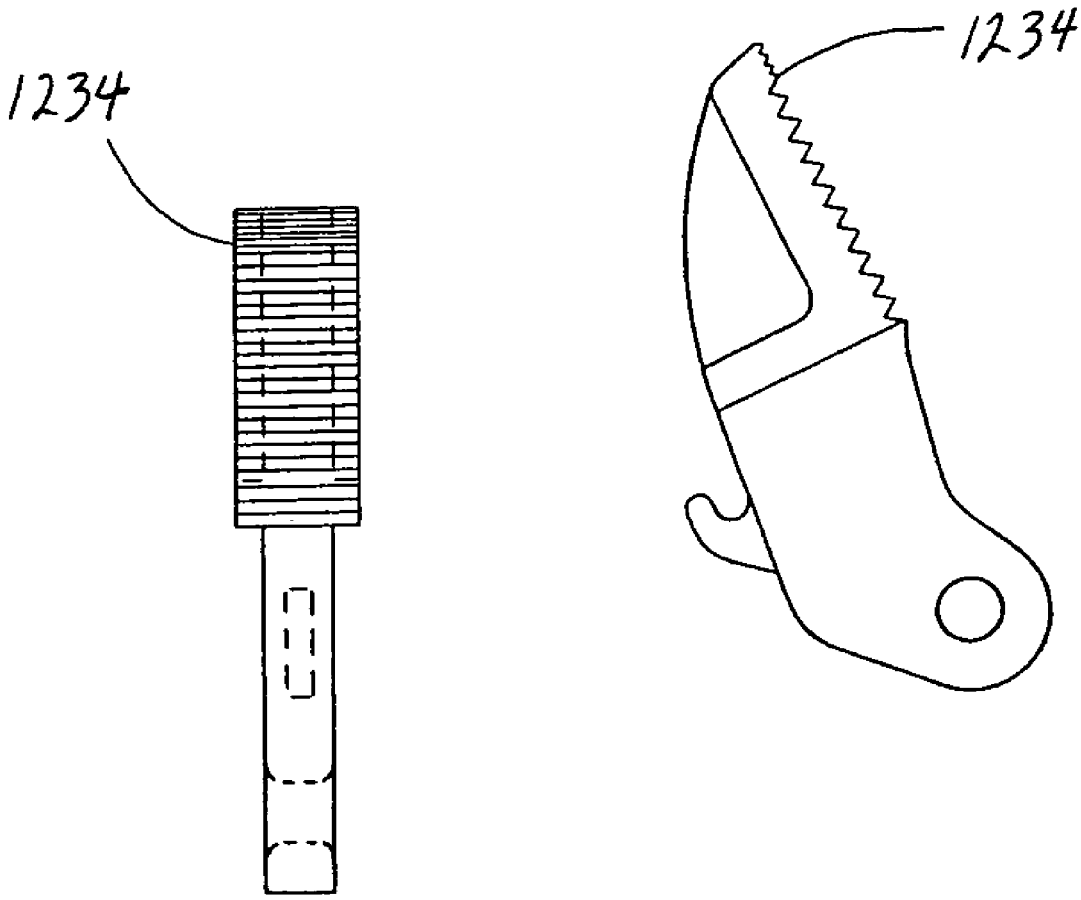

FIG. 244 is a side and top view of slidable jaw member (depicted in FIG. 242) showing shape and position of rivet hole; and showing a shortened overall length dimension when compared to the overall length dimension of slidable jaw member depicted in FIG. 157.

Figure 245:
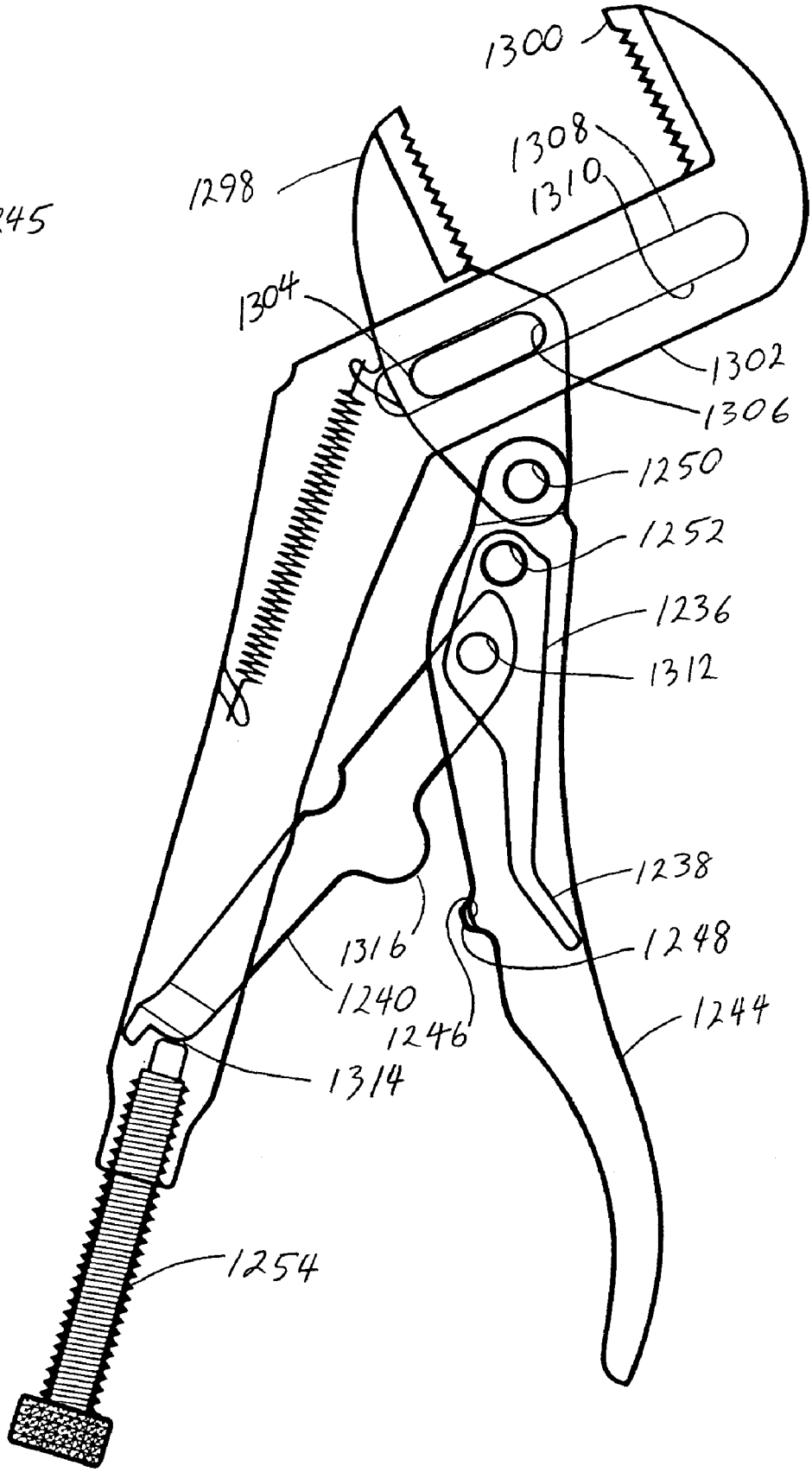

FIG. 245 is a comprehensive side view showing overall dimensions of mechanisms in working relationship, with hidden mechanisms represented by thinner continuous lines. The thinnest lines of FIG. 245 represent the contours of part formation.

Figure 246:
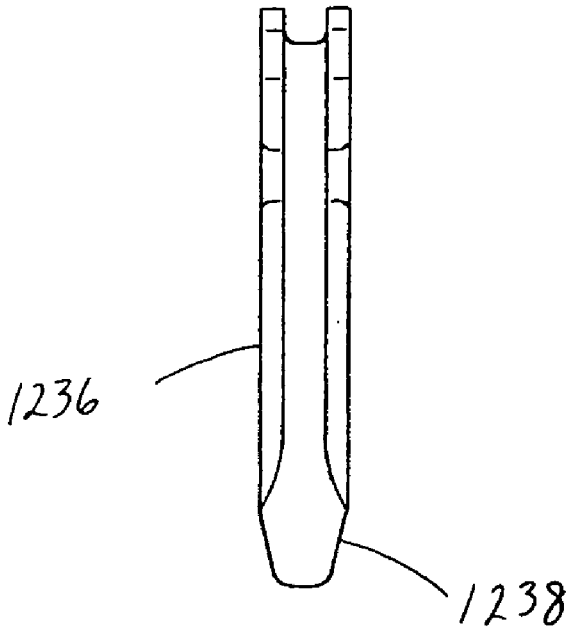

FIG. 246 is a bottom view of a compound toggle release link (depicted in FIG. 245) showing a flared rivet hole.

Figure 247:
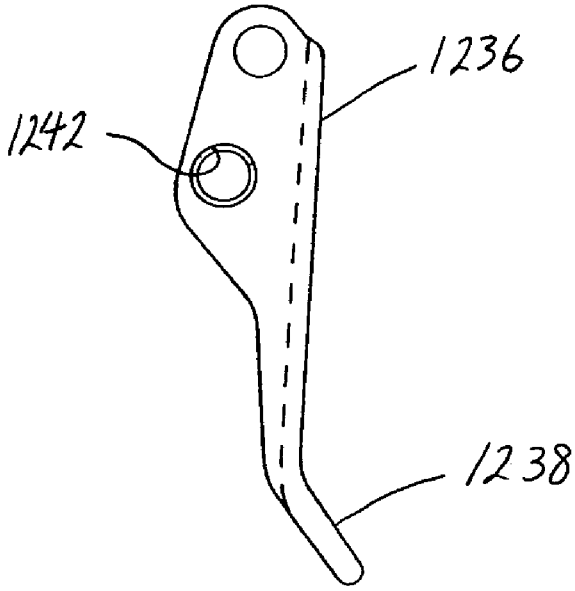

FIG. 247 is a side view of a compound toggle release link (depicted in FIG. 245) showing a bent portion at the contact point of toggle to compound toggle release link.

Figure 248:
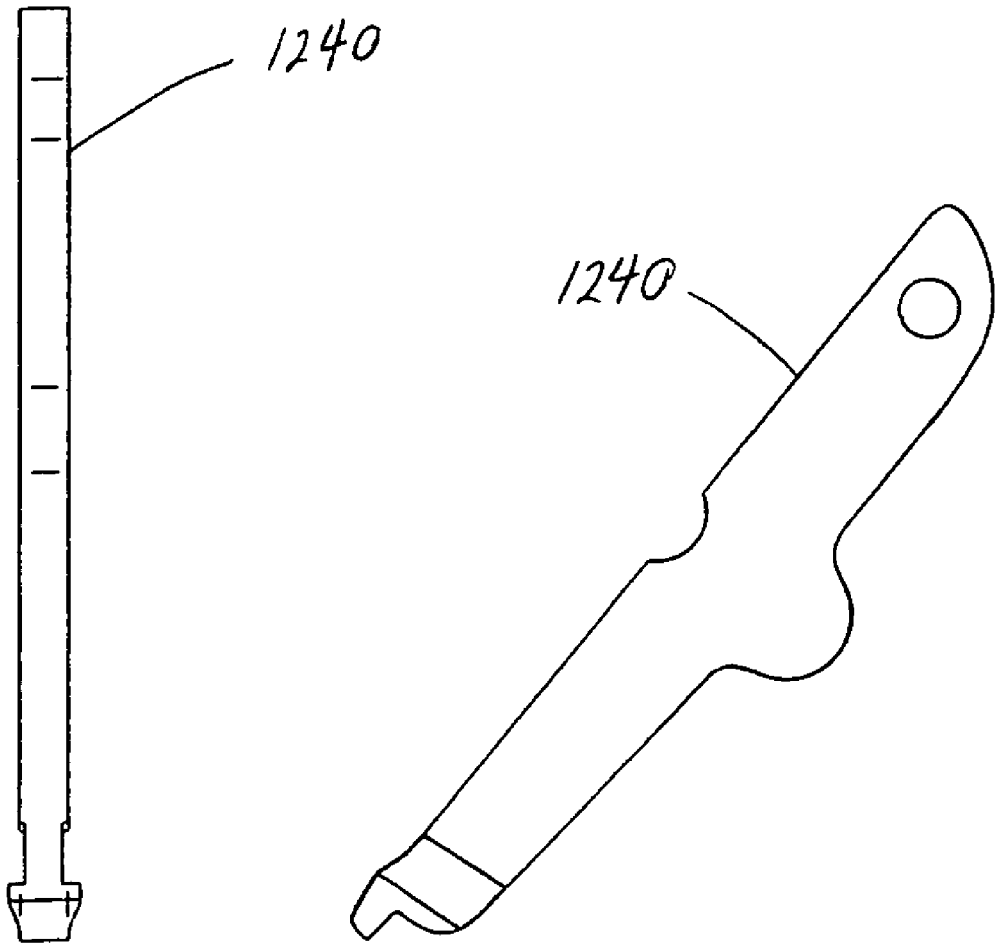

FIG. 248 is a top and side view of a toggle (depicted in FIG. 245) showing a greater overall length dimension as compared to the length dimension of toggle as shown in FIG. 211.

Figure 249:
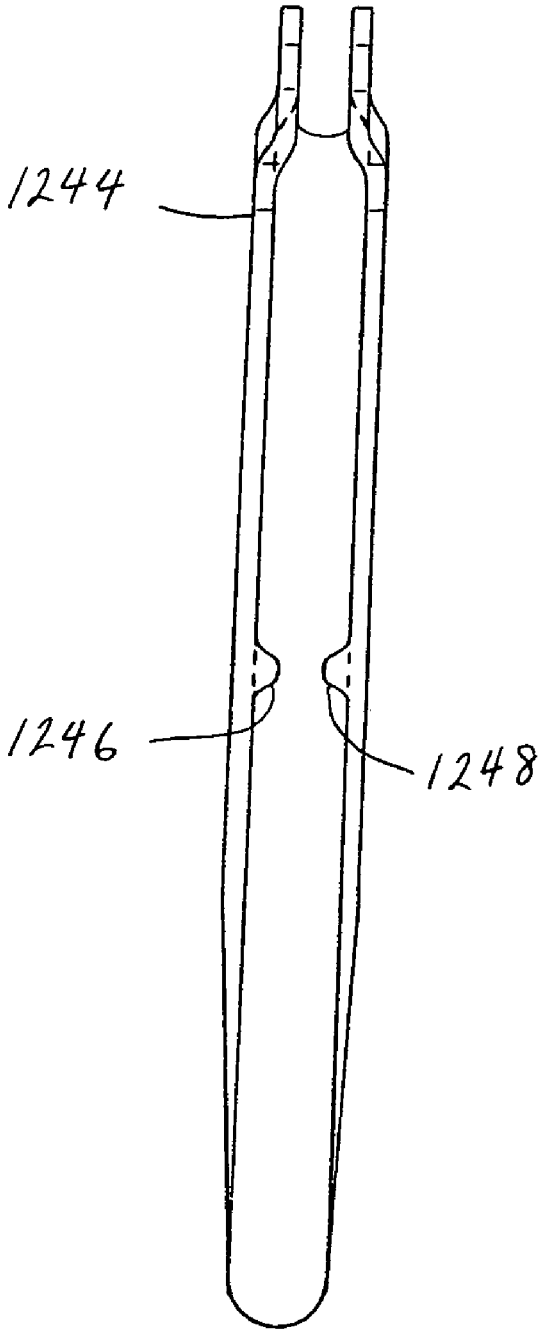

FIG. 249 is a bottom view of an upper handle (depicted in FIG. 245) showing a curvature to a forward housing.

Figure 250:
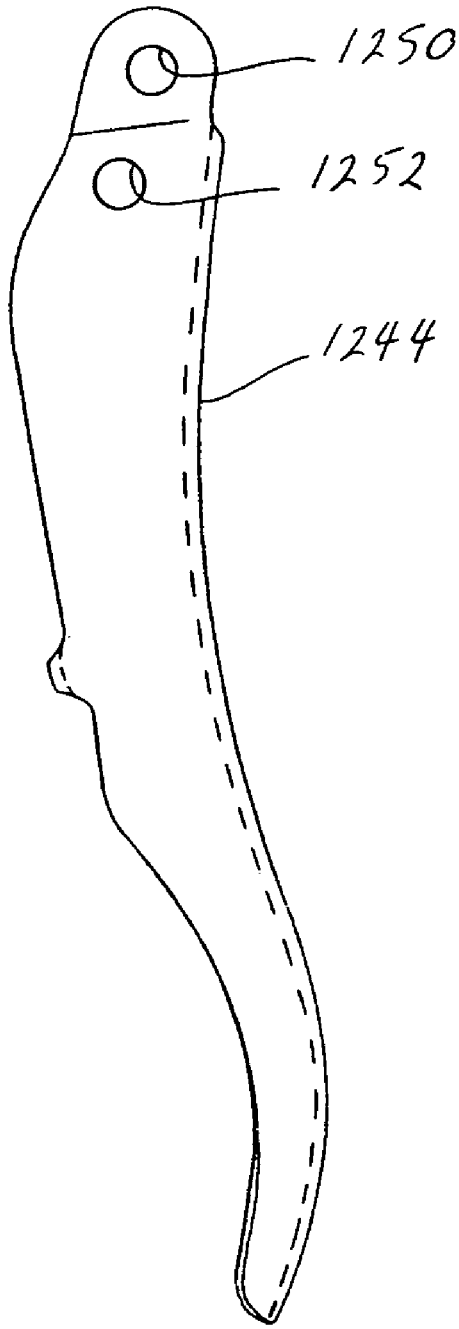

FIG. 250 is a side view of an upper handle showing a shape to toggle stop tabs.

Figure 251:
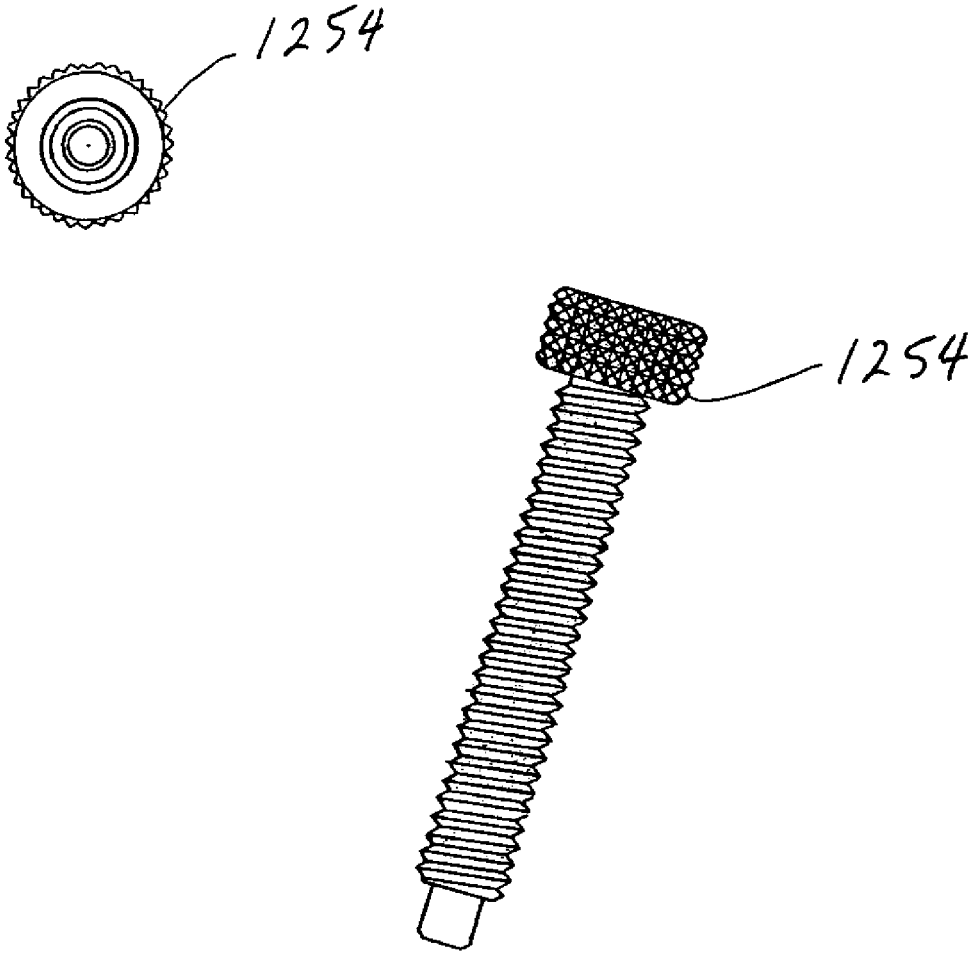

FIG. 251 is a rear and side view of an adjustment screw (depicted in FIG. 245) showing a reduced length dimension as compared to adjustment screw shown in FIG. 208.

Figure 252:
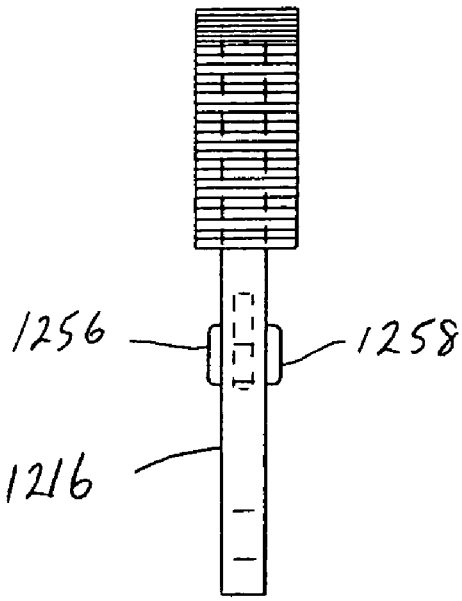

FIG. 252 is a top view of a slidable jaw member (depicted in FIG. 245) showing rounded edges to an extension.

Figure 253:
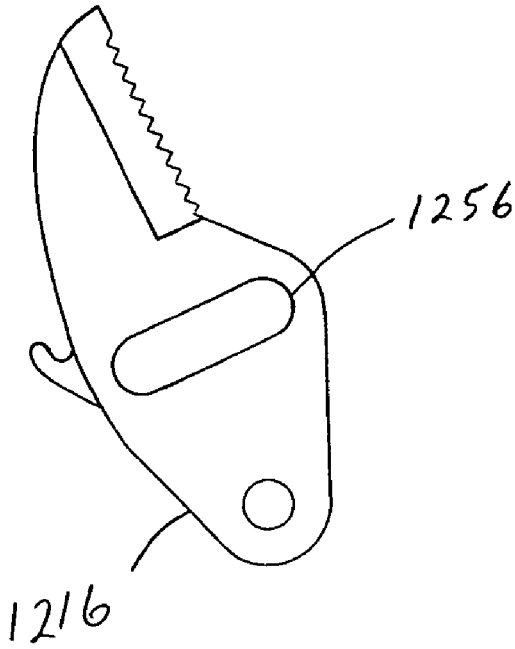

FIG. 253 is a side view of a slidable jaw member showing a reduced overall length dimension as compared to the length dimension of the slidable jaw member as shown in FIG. 123.

Figure 254:
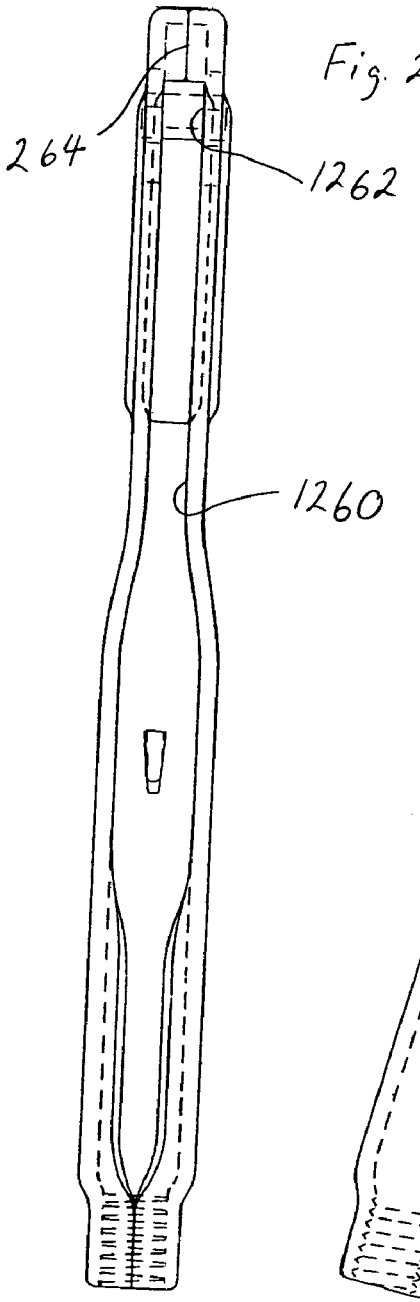

FIG. 254 is a top view of a lower handle (depicted in FIG. 245) showing an opening that allows for the travel of a slidable jaw member.

Figure 255:
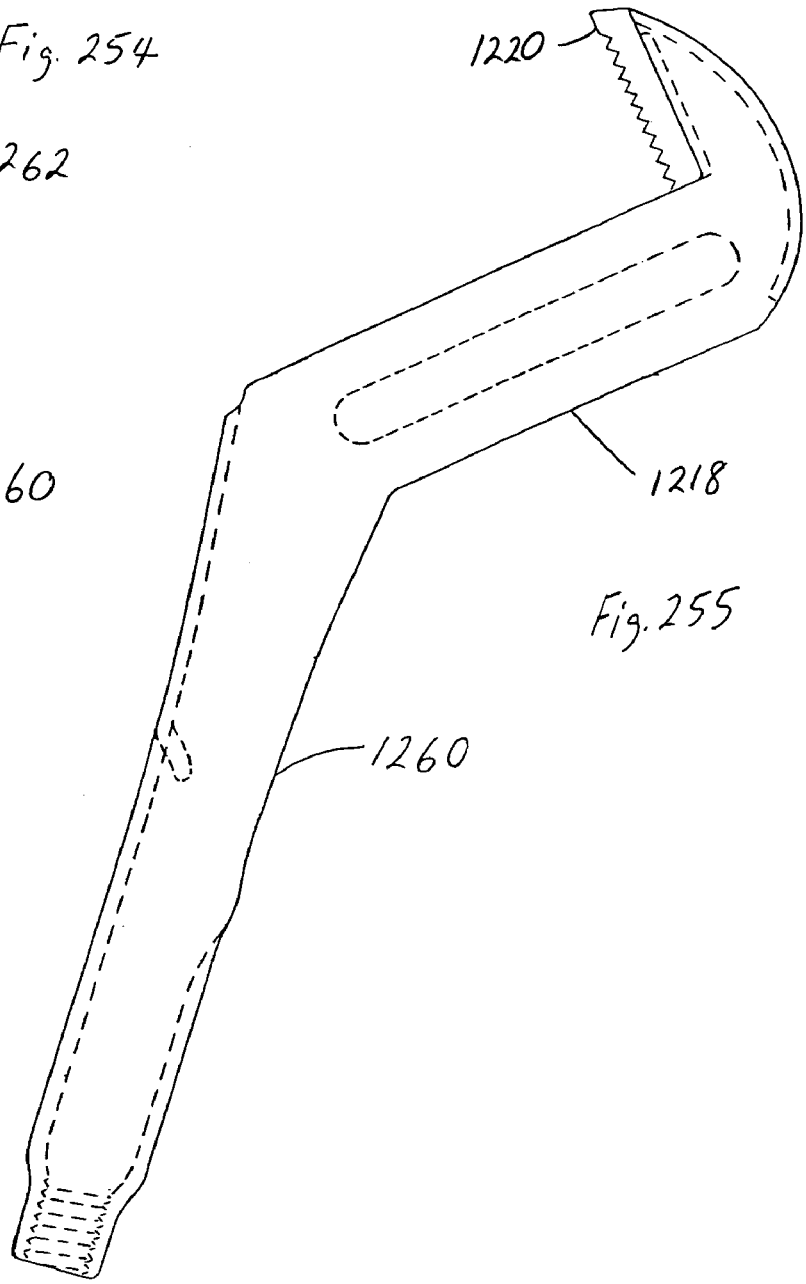

FIG. 255 is a side view of a lower handle showing internal void dimensions to strengthening ribs.

Figure 256:
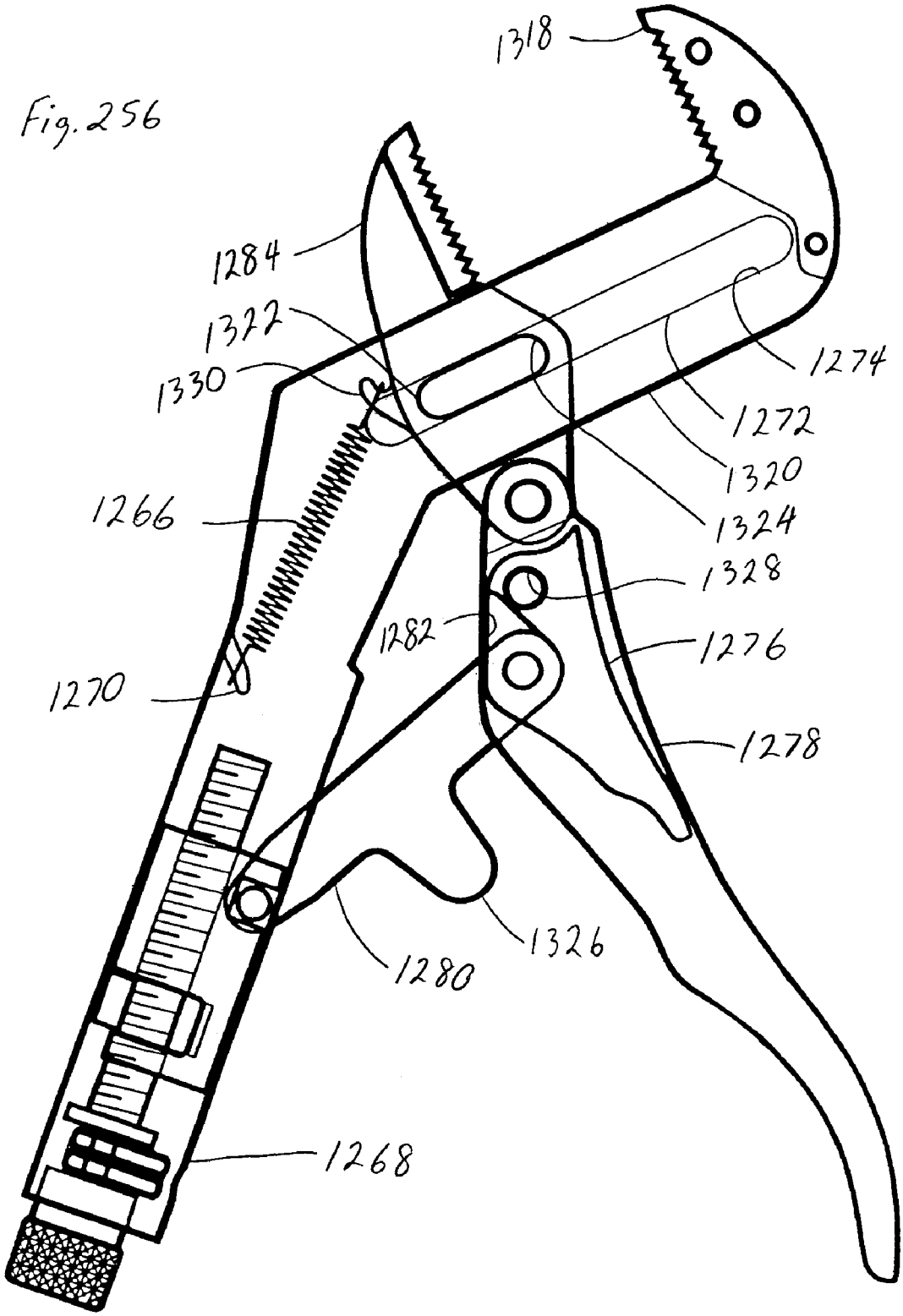

FIG. 256 is a comprehensive side view showing overall dimensions of mechanisms in working relationship, with hidden mechanisms represented by thinner continuous lines. The thinnest lines of FIG. 256 represent the contours of part formation.

Figure 257:
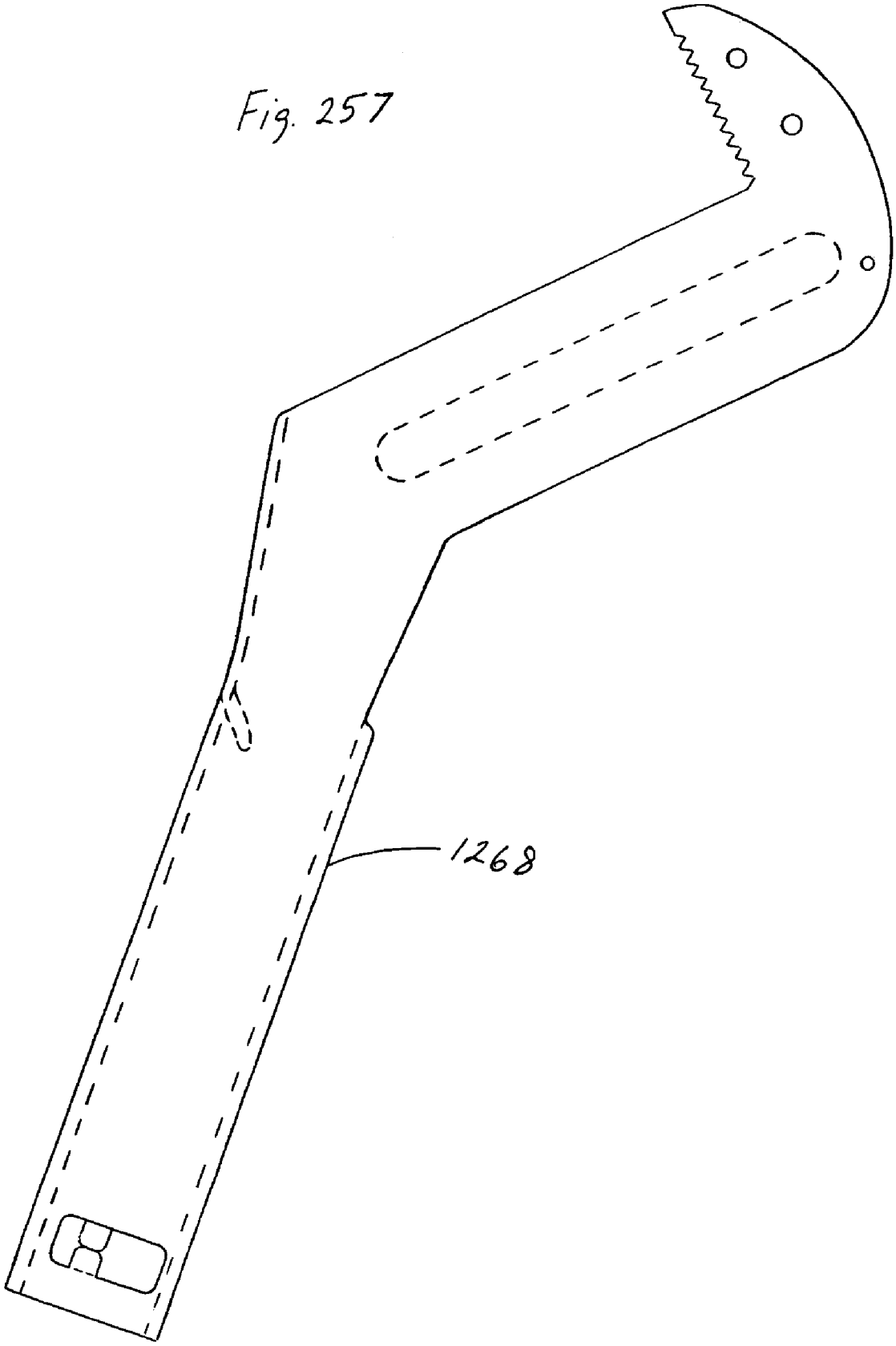

FIG. 257 is a side view of a lower handle (depicted in FIG. 256) showing a hook for an attachment point for a spring.

Figure 258:
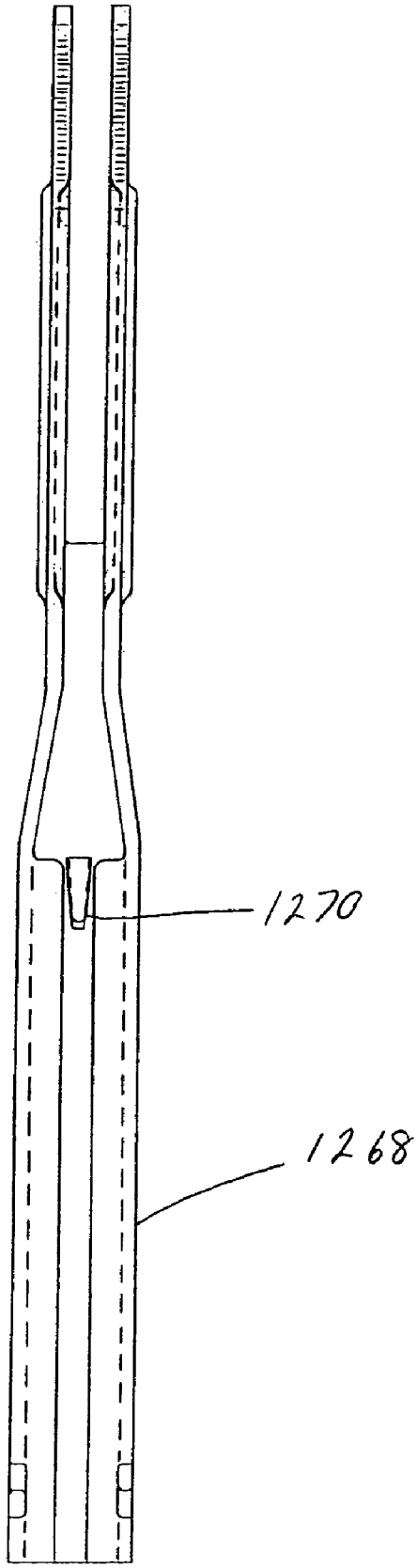

FIG. 258 is a top view of a lower handle showing a width dimension to strengthening ribs.

Figure 259:
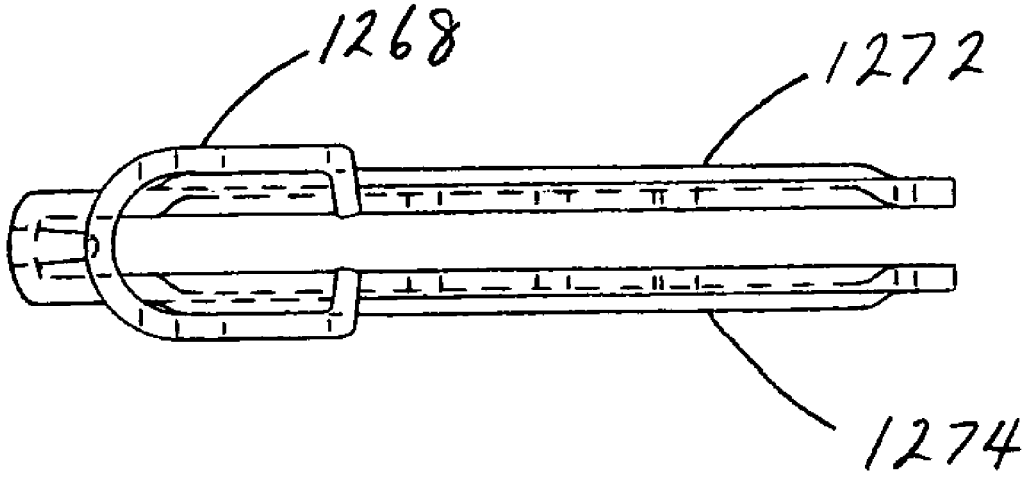

FIG. 259 is a rear view of a lower handle showing a width dimension to internal parallel voids.

Figure 260:
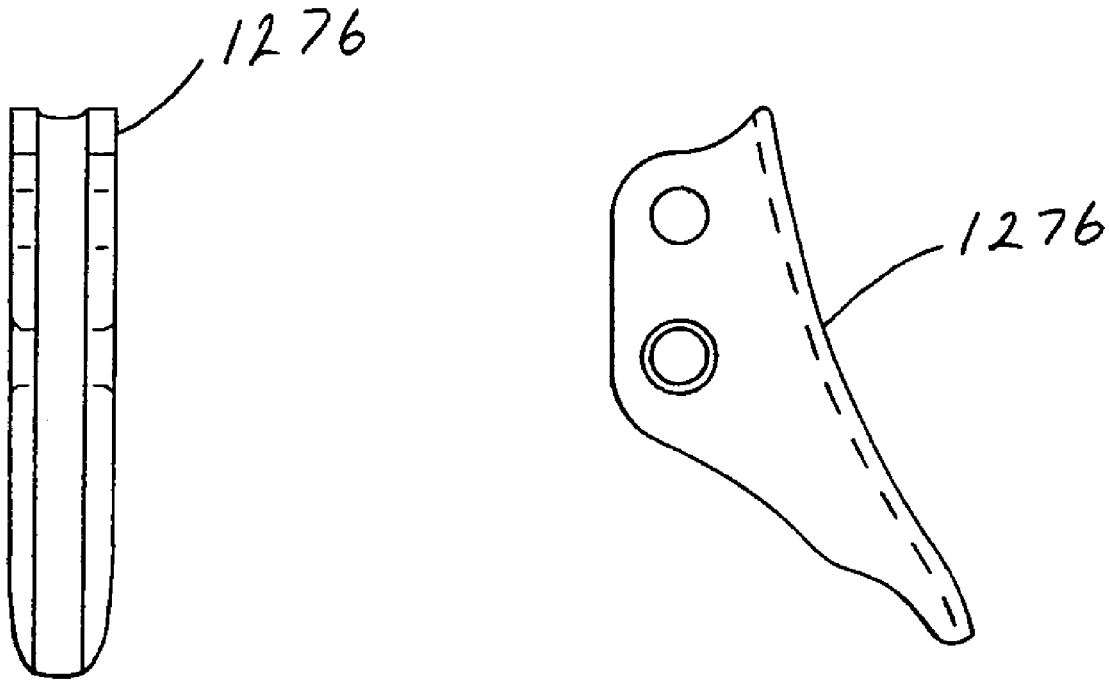

FIG. 260 is a bottom and side view of a toggle release link (depicted in FIG. 256) showing a reduced overall length dimension as compared to the length dimension of toggle release link shown in FIG. 222.

Figure 261:
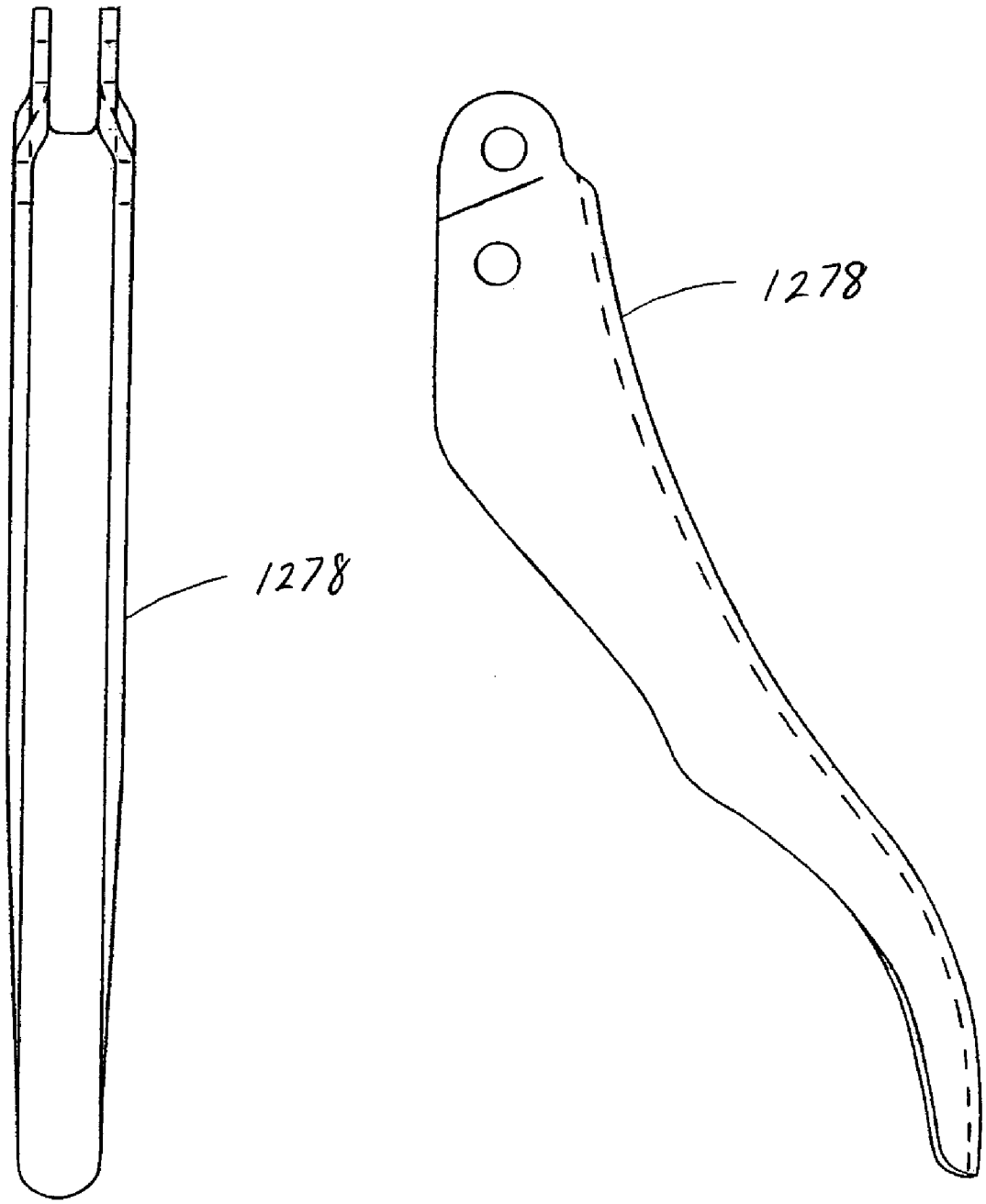

FIG. 261 is a bottom and side view of an upper handle (depicted in FIG. 256) showing a curvature to a forward housing section.

Figure 262:
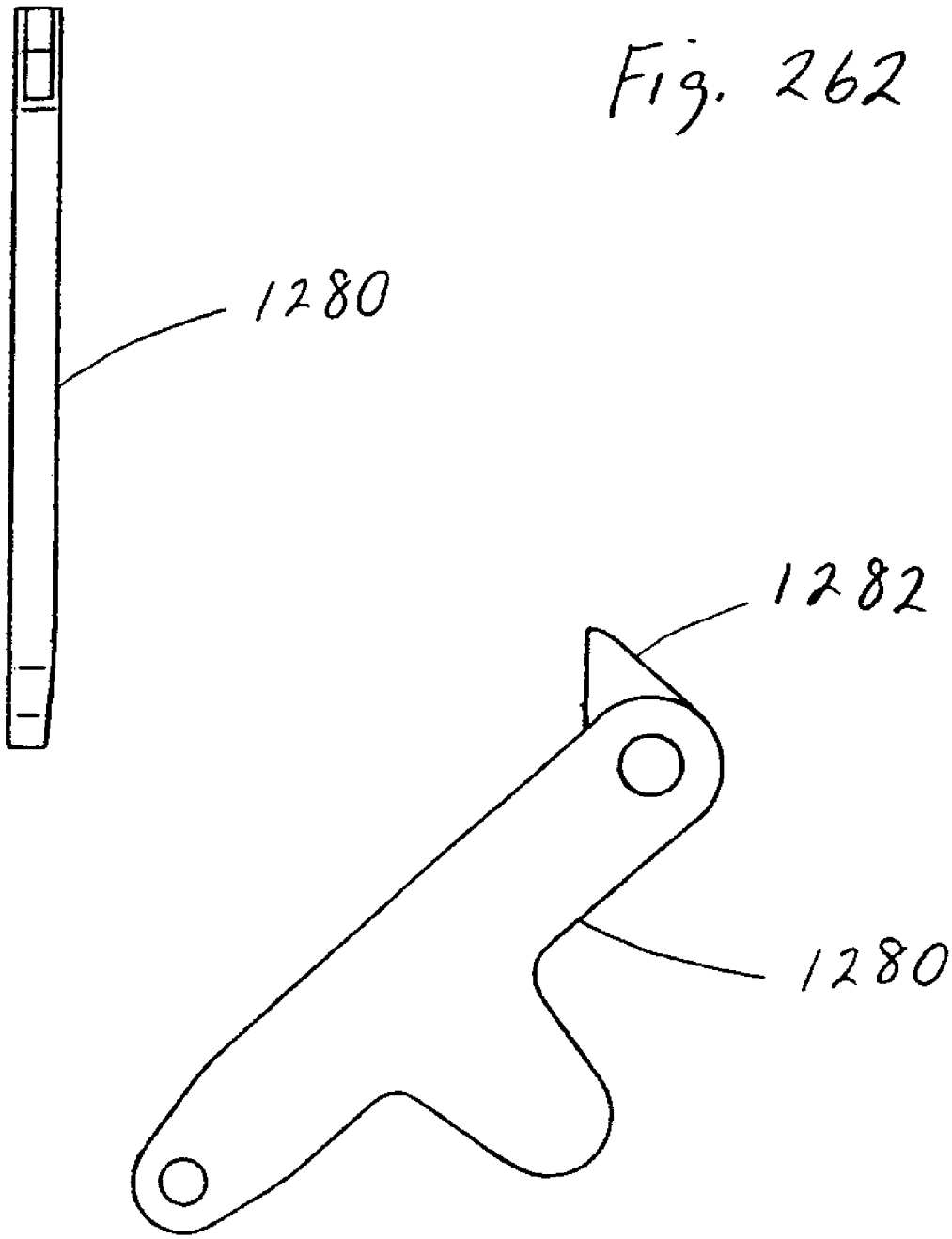

FIG. 262 is a bottom and side view of a toggle (depicted in FIG. 256) showing a toggle extension.

Figure 263:
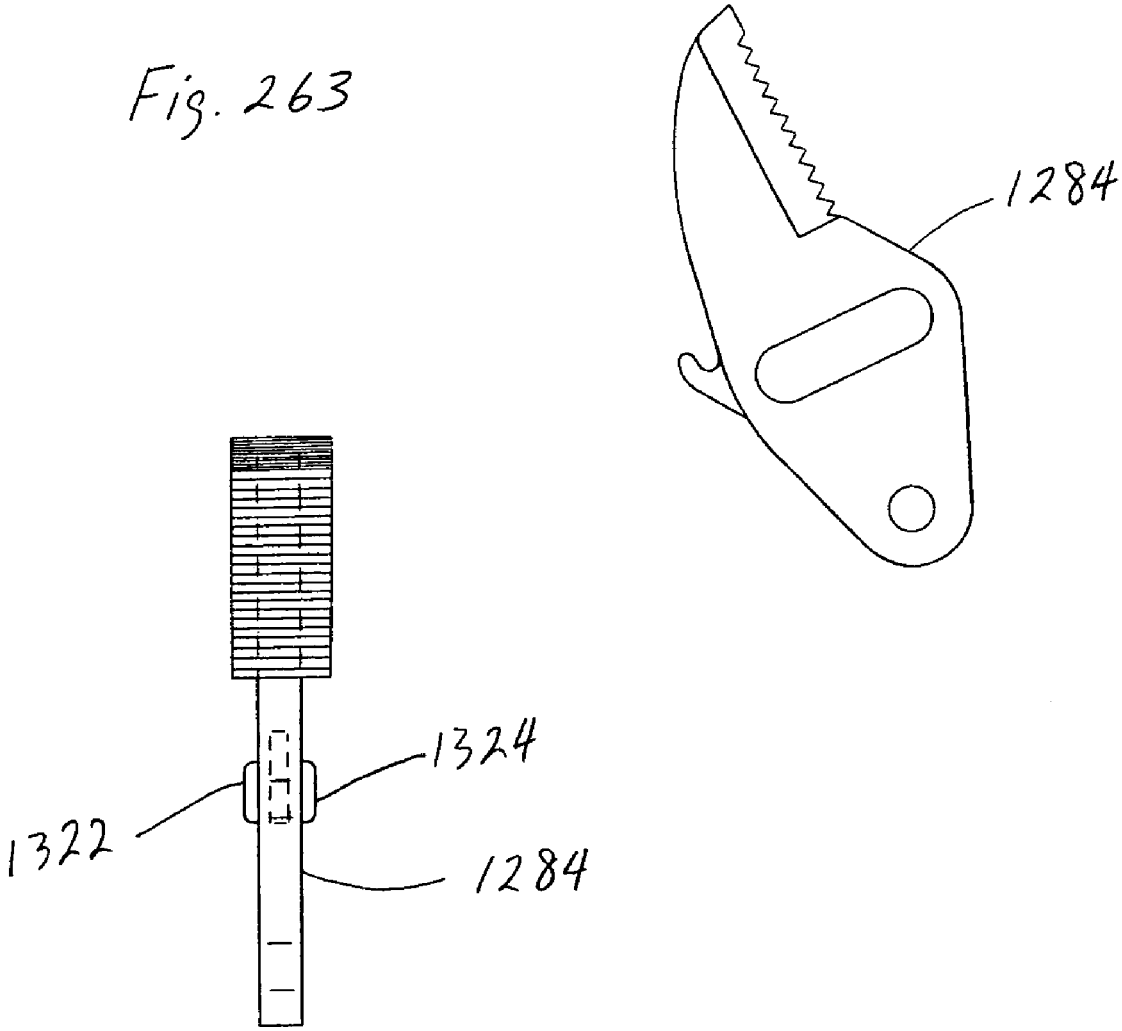

FIG. 263 is a slidable jaw member (depicted in FIG. 256) showing the same overall length dimension as the overall length dimension of slidable jaw member shown in FIG. 123.

Figure 264:
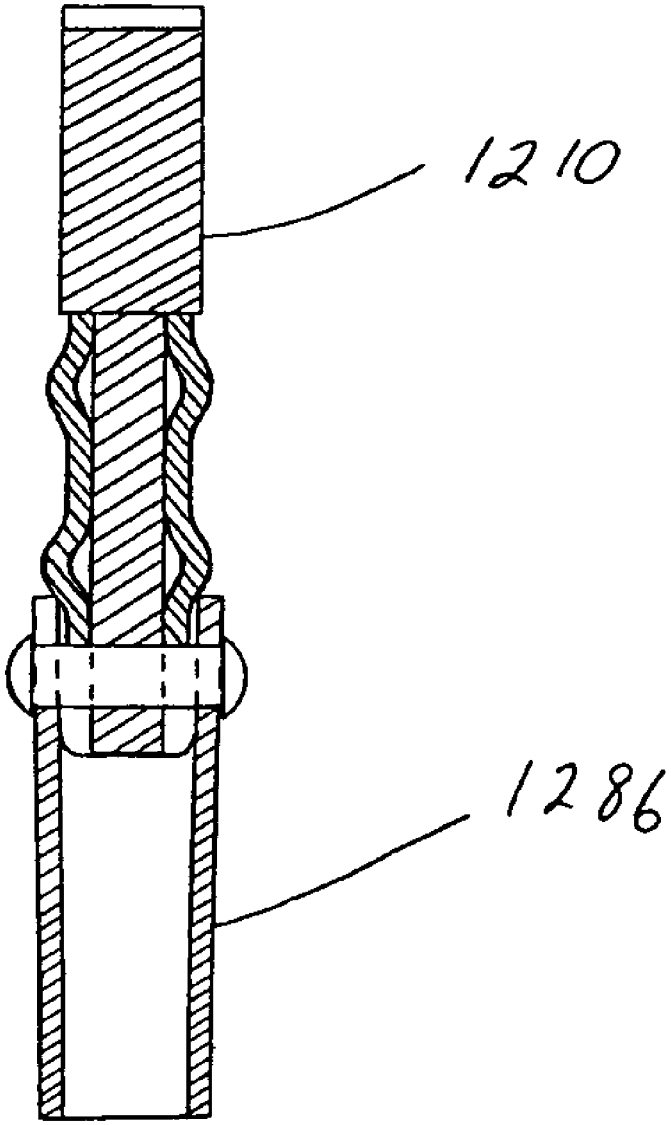

FIG. 264 is a cross-sectional view of an attachment point (depicted in FIG. 238) showing inner clearance dimensions of an upper handle attachable to a slidable jaw member (rivet not shown in cross-section).

Figure 265:
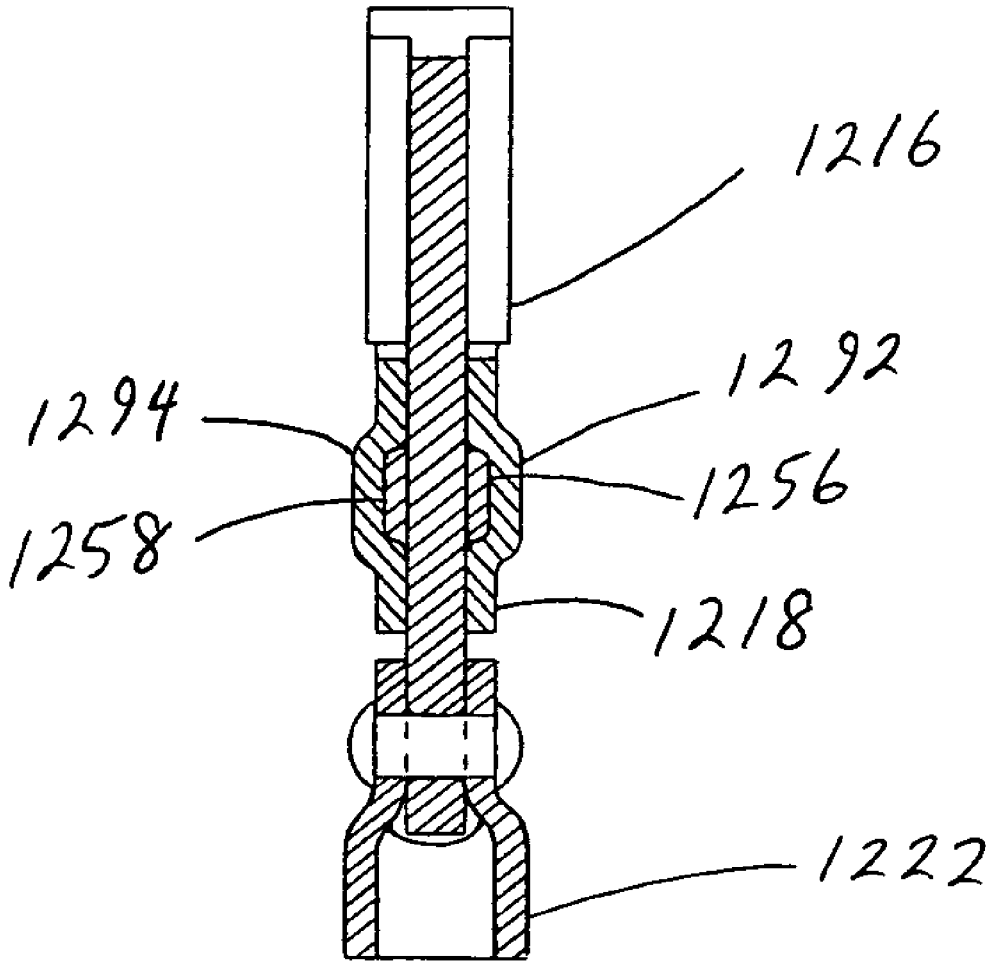

FIG. 265 is a cross-sectional view of an attachment point (depicted in FIG. 239) showing inner clearance dimensions of an upper handle attachable to a slidable jaw member (rivet not shown in cross-section).

Figure 266:
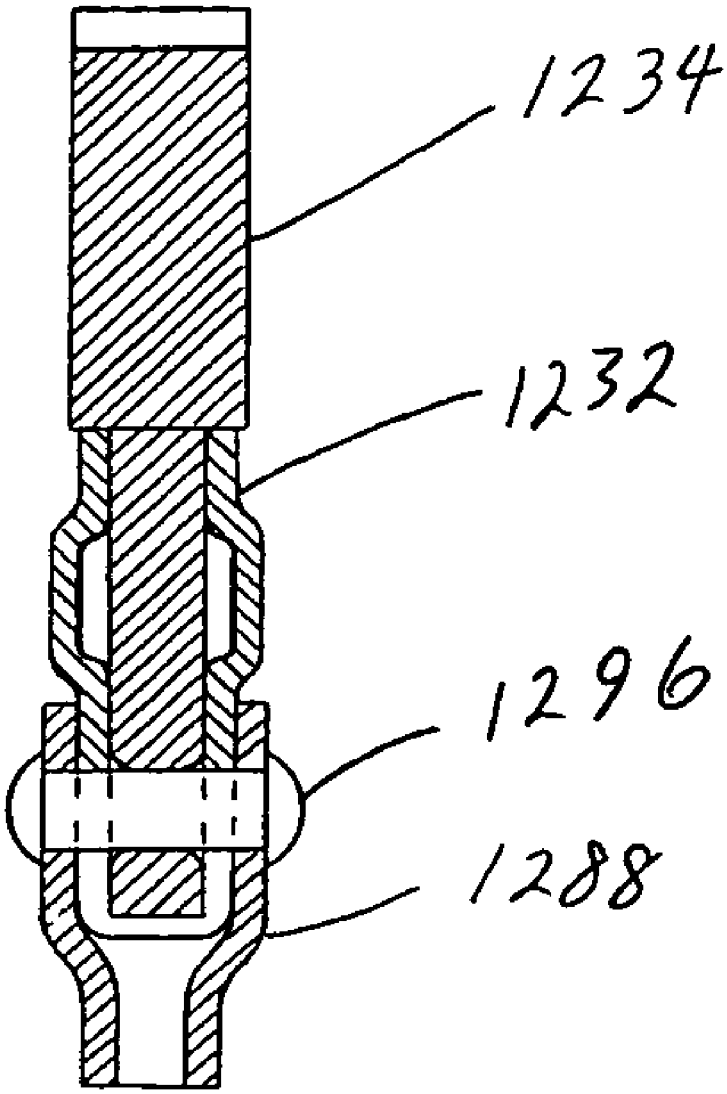

FIG. 266 is a cross-sectional view of an attachment point (depicted in FIG. 242) showing inner clearance dimensions of an upper handle attachable to a slidable jaw member (rivet not shown in cross-section).

Figure 267:
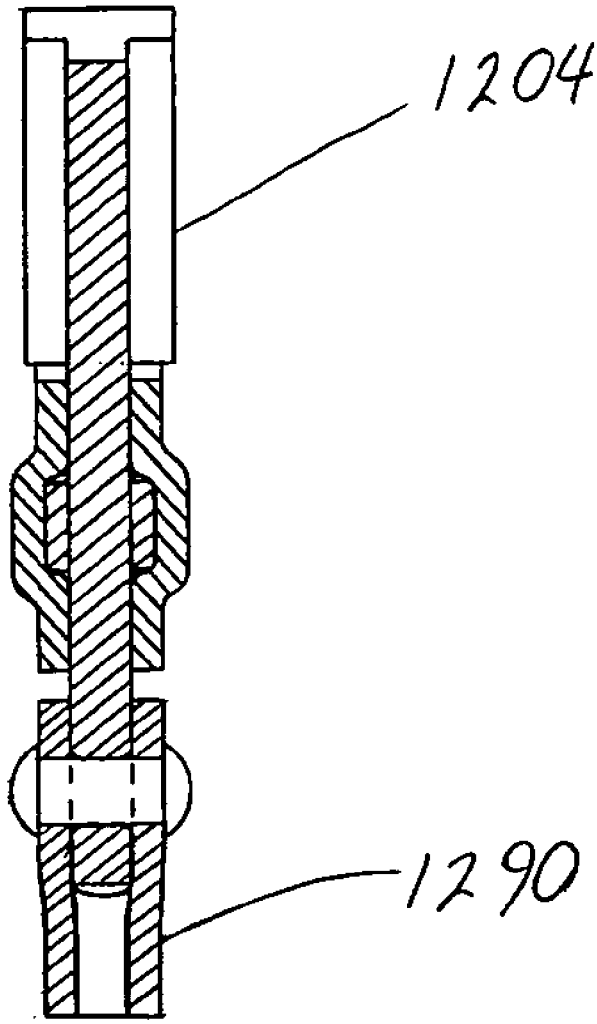

FIG. 267 is a cross-sectional view of support member (depicted in FIG. 237) showing inner clearance dimensions of extensions of a slidable jaw member (rivet not shown in cross-section) to internal parallel guide surfaces of strengthening ribs.

DETAILED DESCRIPTION

Figure 1:
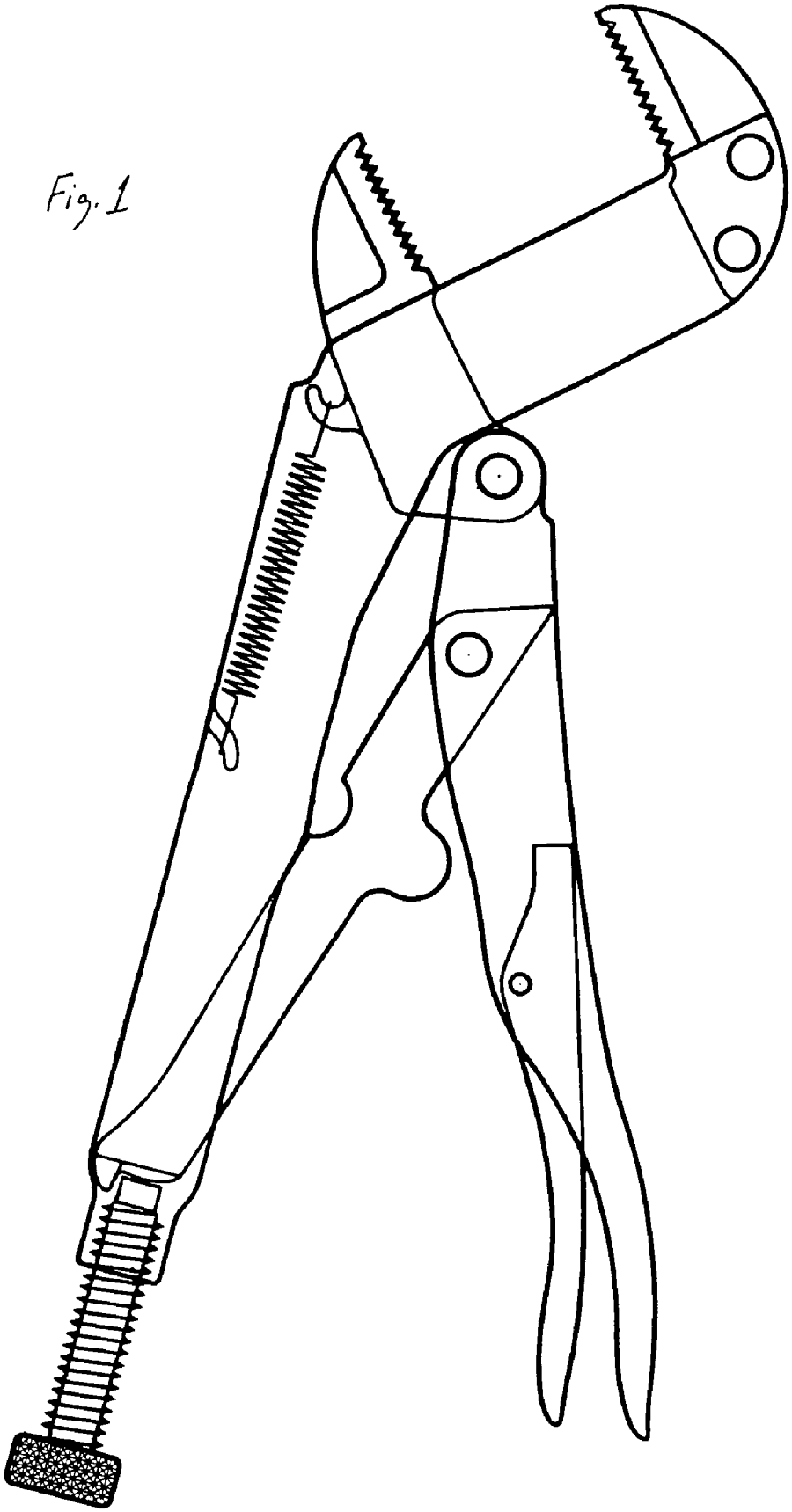
FIGS. 1 and 1A are comprehensive side views showing overall dimensions of mechanisms in working relationship, with hidden mechanisms represented by thinner continuous lines. The description of FIG. 1
Figure 1A:
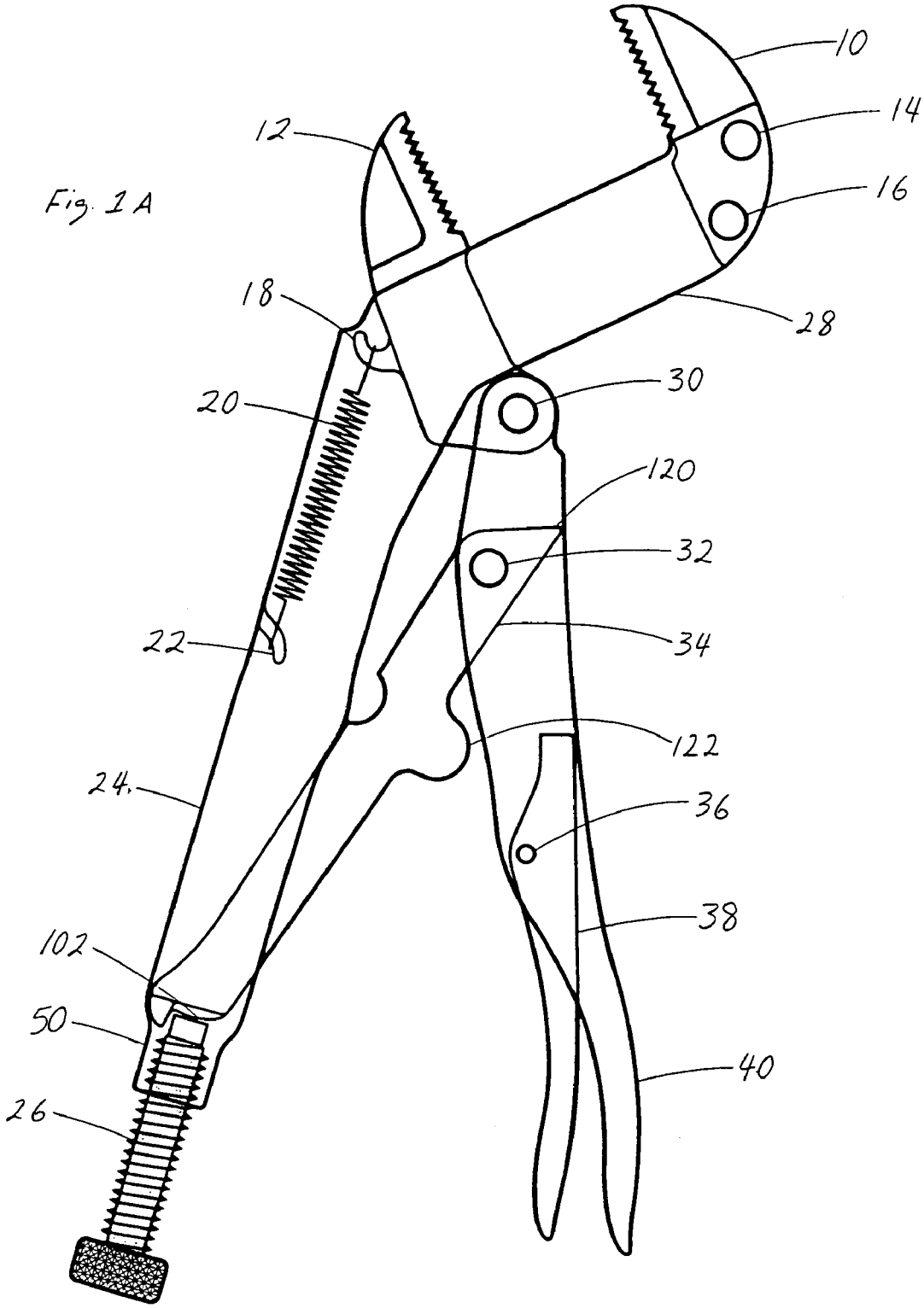

Description of the preferred embodiments:

As defined in this specification; part fabrication of the above - identified Invention is as follows:

FIG. 1 and FIG. 1A depict the working relationship of mechanisms (some details not shown) being under spring tension - with jaw members in the fully open position.

Figure 2:
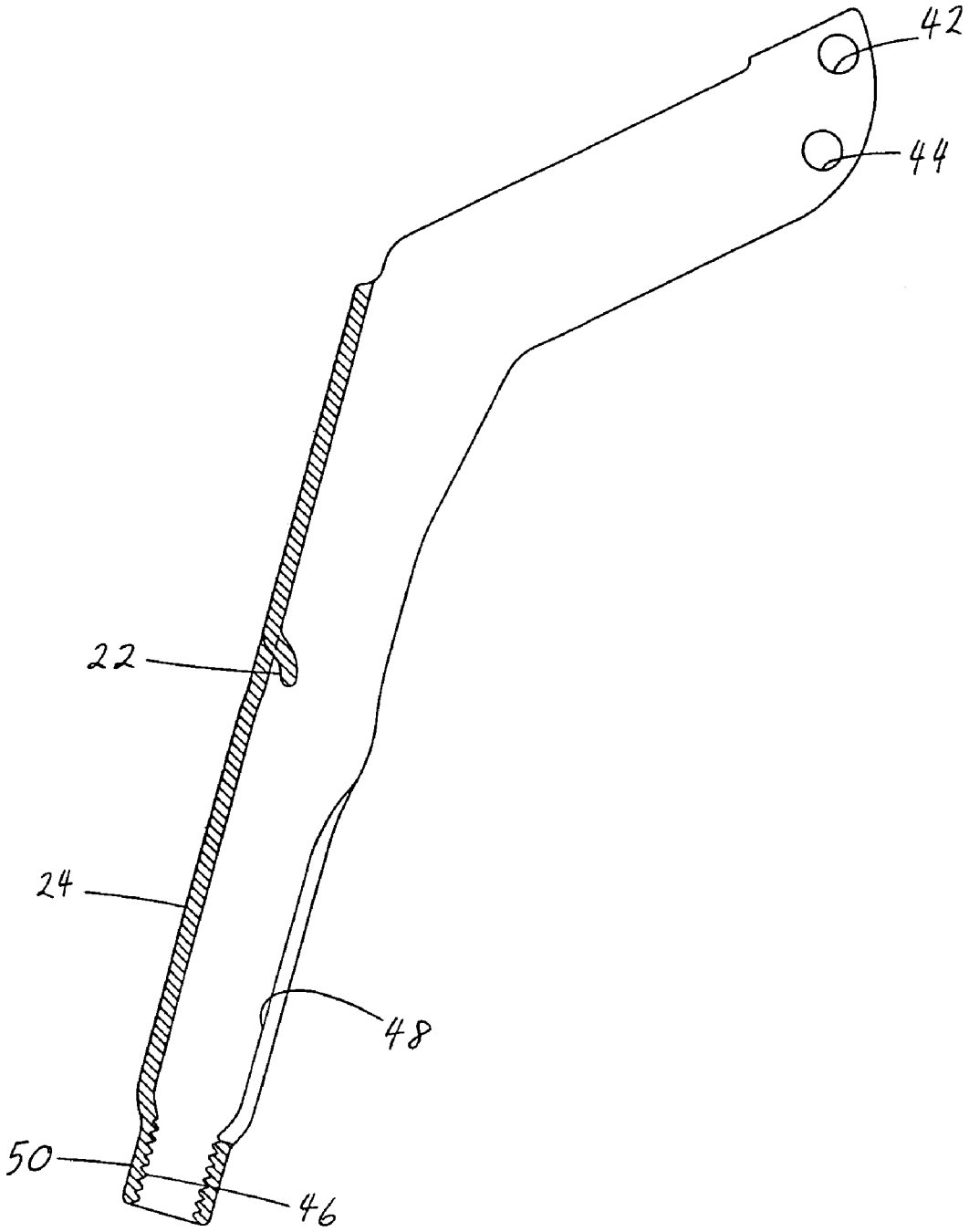
FIG. 2 - cross-sectional view of lower handle with rivet holes.

FIG. 2 is a cross-section of lower handle 24: Other cross-section of lower handle 24 is not shown. Both cross-sections of lower handle 24 have the same dimensions. Rivet holes 42 and 44 depicted in the specification, are formed into lower handle 24 by a pressing/shearing process or by drilling (or by mechanism known in the art). Hook 22 is formed by a pressing/shearing process (or by mechanism known in the art). In the rear housing; threads 46 are formed by a tapping procedure (or by mechanism known in the art) after (or during) the forming of rear channel 48 of lower handle 24.

The outer dimensions of lower handle 24 are formed into a flat pattern by a pressing/shearing process after heating the flat material (or by mechanism known in the art): The flat pattern of lower handle 24 is then formed to its final shape (while heated) - including the rear channel 48 and threaded housing 50, by a stamping process (or by mechanism known in the art). The threaded housing 50 is welded together from the heating process during its forming.

Figure 3:
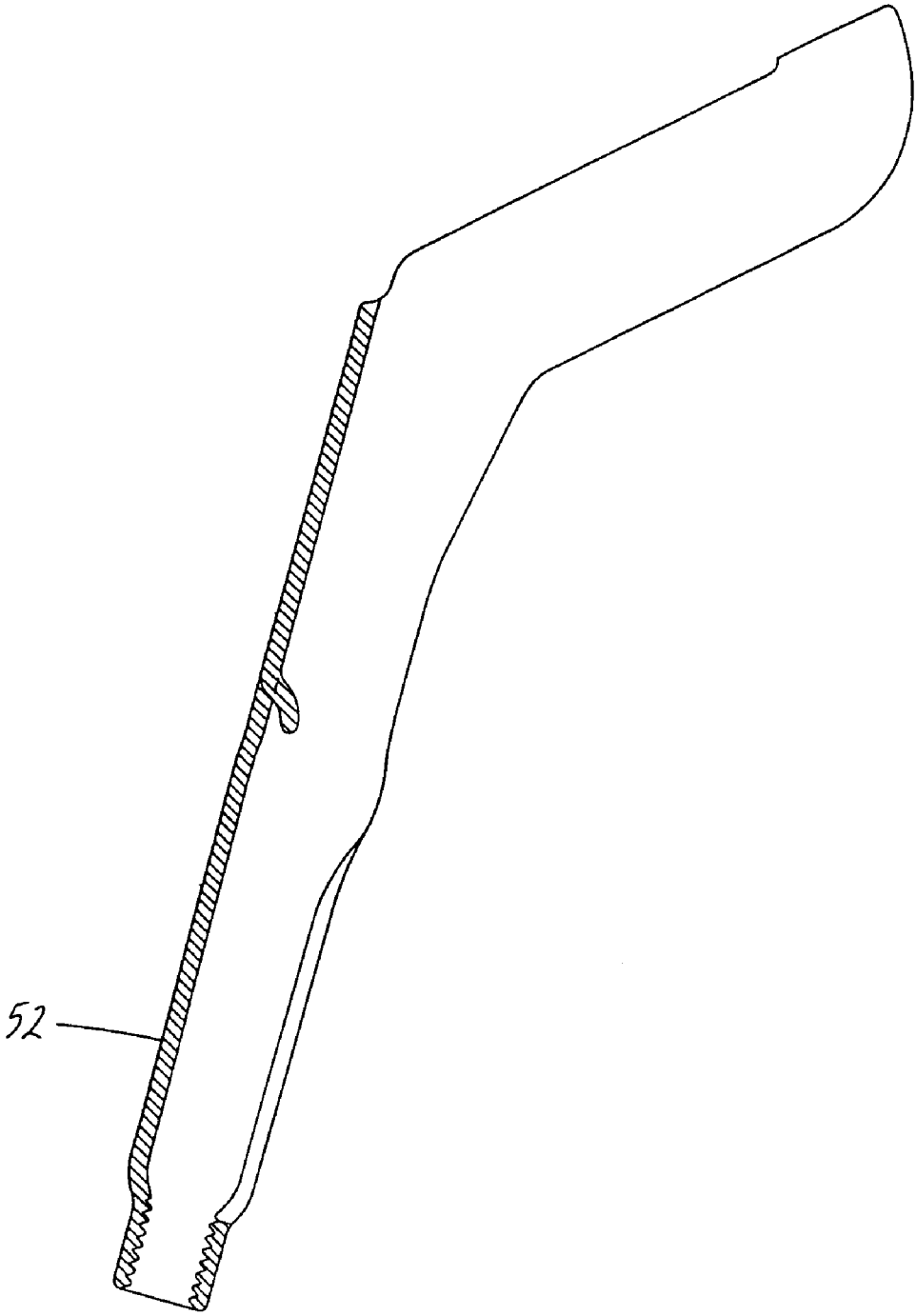
FIG. 3 - cross-sectional view of lower handle without rivet holes.

FIG. 3 depicts a cross-section of lower handle 52: Lower handle 52 is formed by the same procedures as lower handle 24; the design of lower handle 52 excludes rivet holes - rivet holes of the type shown in FIG. 2.

Figure 4:
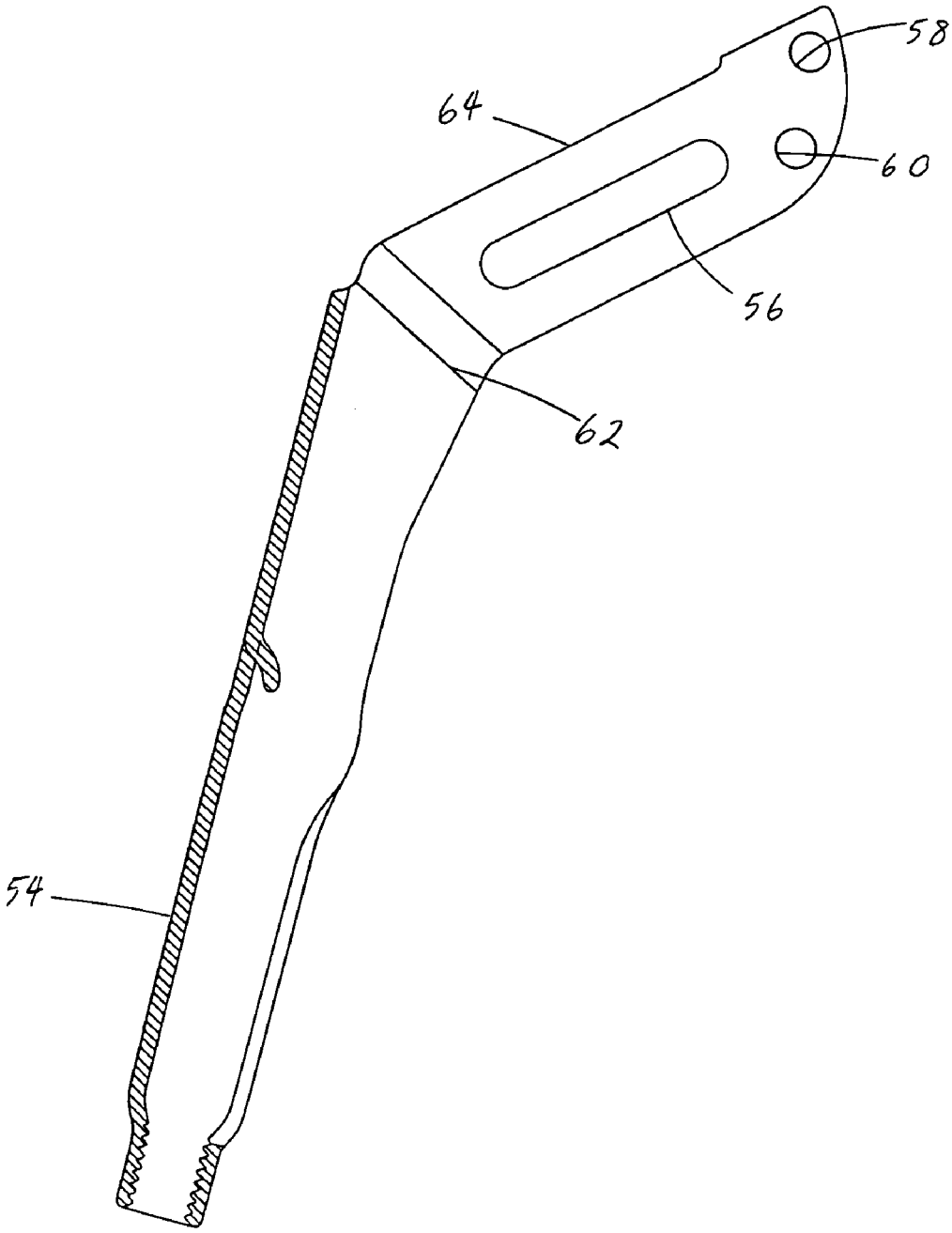
FIG. 4 - cross-sectional view of lower handle with support rib.

FIG. 4 depicts a cross-section of lower handle 54 with a strengthening rib 56. The rivet holes 60 and 58 are of the type shown in FIG. 2. Lower handles 24 and 52 have bends (bends not shown in FIGS. 1, 1*a*, 2, 3) with the same dimensions as bend 62 depicted in FIG. 4, and all bends in all lower handles are formed by the same procedures - as the procedures are described in this specification or are known in the art. Strengthening rib 56 is stamped into the flat pattern form of support member 64.

Figure 5:
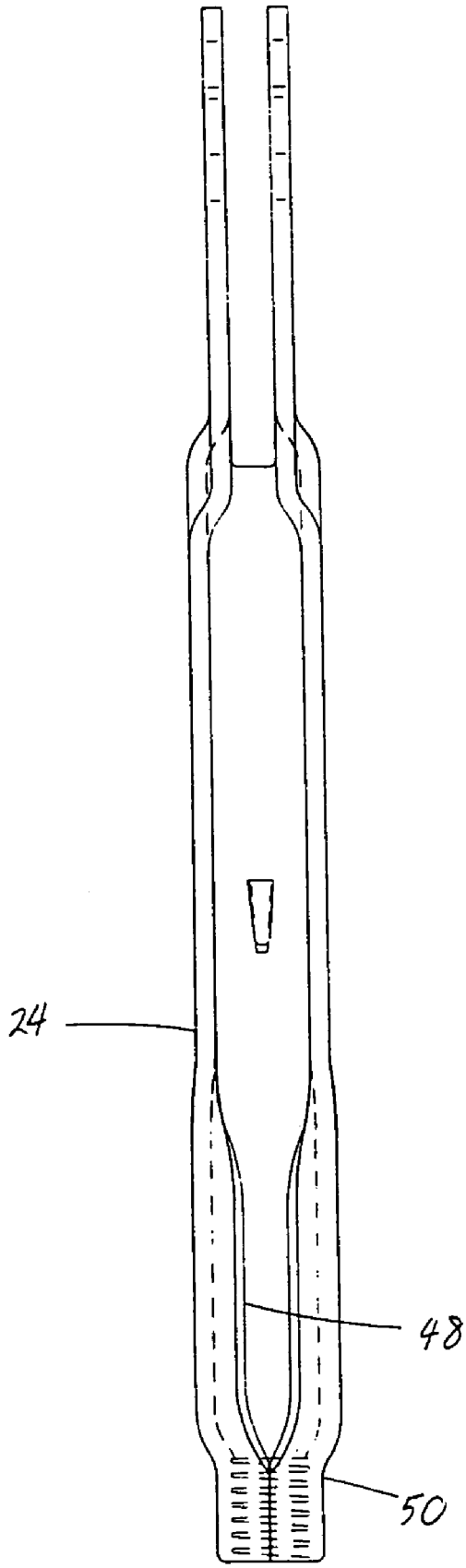
FIG. 5 - top view of lower handle with rivet holes.

FIG. 5 is lower handle 24 showing rear channel 48 formed into threaded housing 50.

Figure 6:
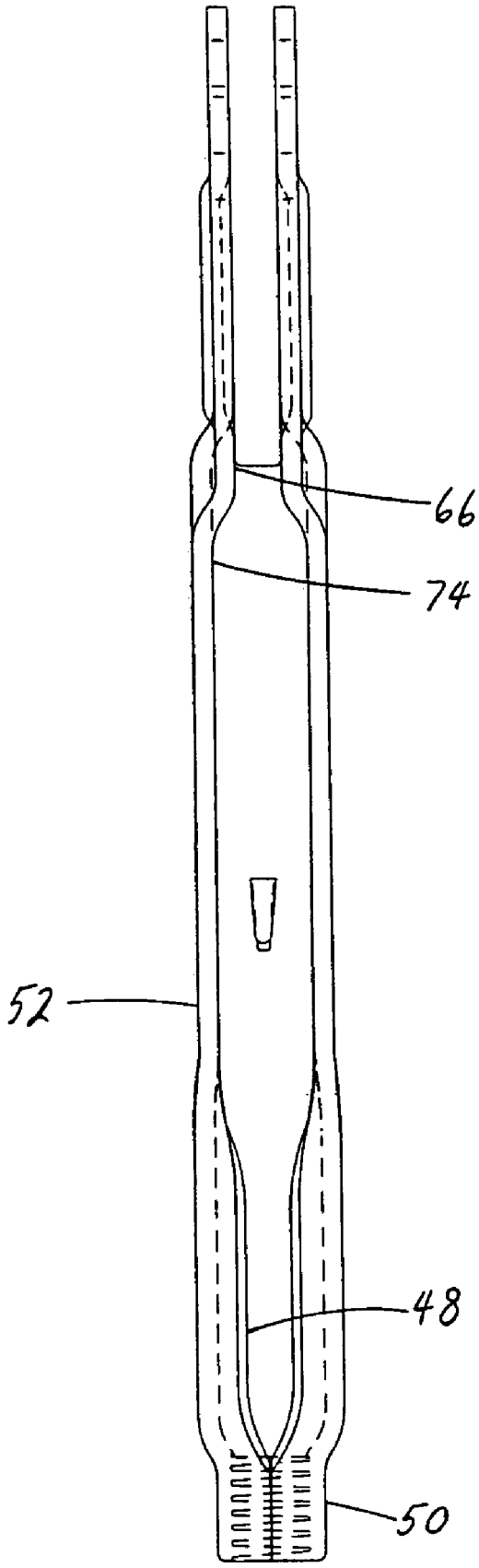
FIG. 6 - top view of lower handle without rivet holes.

FIG. 6 is lower handle 52 showing forward channel 66 formed into housing 74 of lower handle 52.

Figure 7:
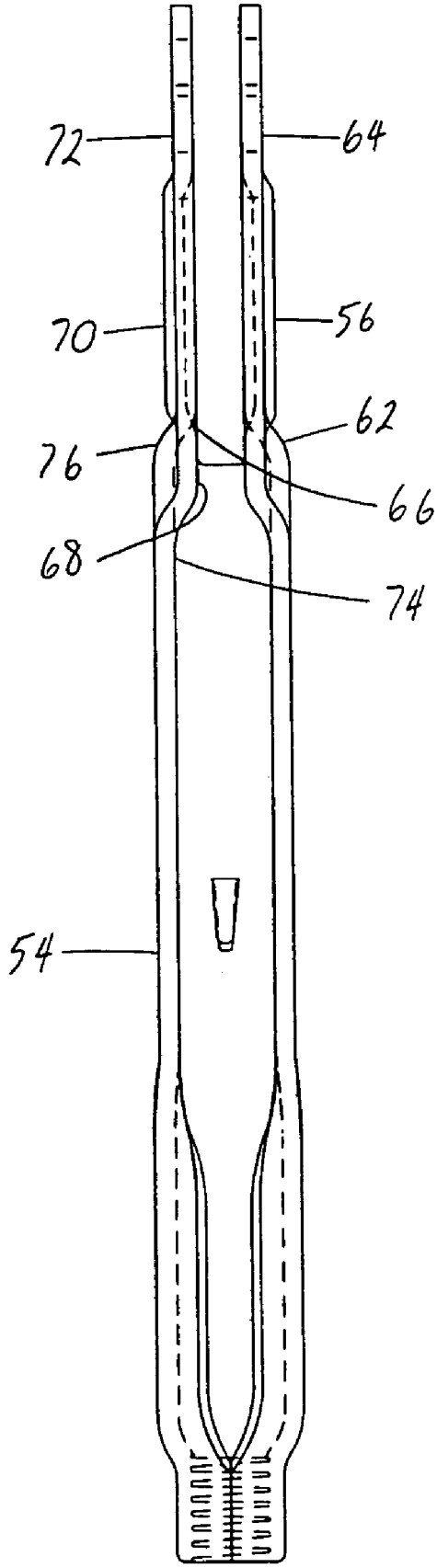
FIG. 7 - top view of lower handle with support ribs.

FIG. 7 is lower handle 54 showing strengthening ribs 56 and 70 formed outwardly from support members 64 and 72. Bends 62 and 76 are depicted in FIG. 7; formed into housing 68.

Figure 8:
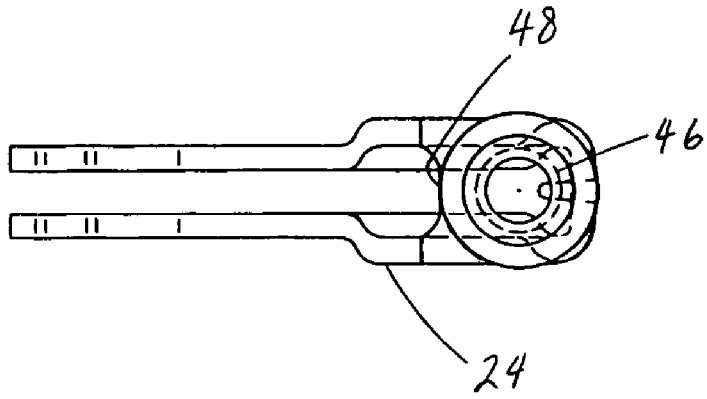
FIG. 8 - rear view of lower handle with rivet holes.

FIG. 8 is lower handle 24 showing the spatial relation of threads 46 to rear channel 48.

Figure 9:
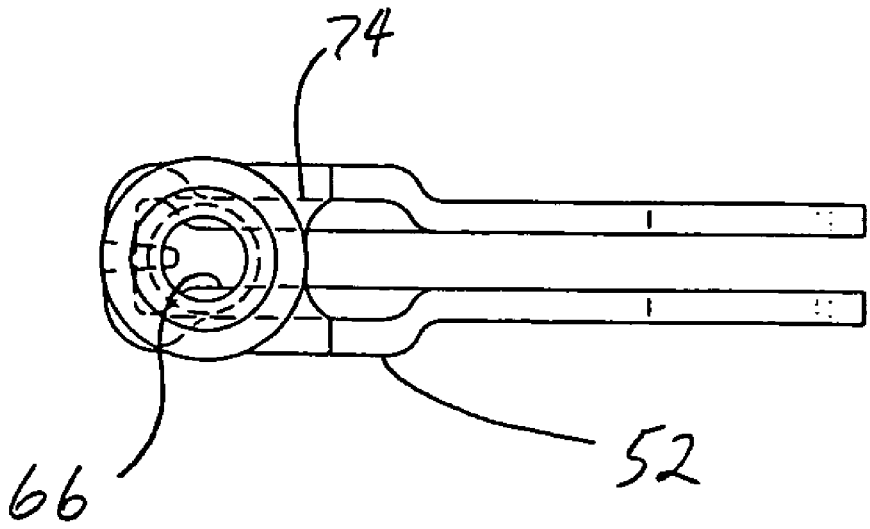
FIG. 9 - rear view of lower handle without rivet holes.

FIG. 9 is lower handle 52 showing the width dimension of housing 74 in relation to the width dimension of forward channel 66.

It is understood one having ordinary skill in the art would have no difficulty in engineering the each lower handle with the different described design features and construction techniques: including designing lower handle 54 with no rivet holes; including designing lower handles 24 and 52 with strengthening ribs.

Figure 10:
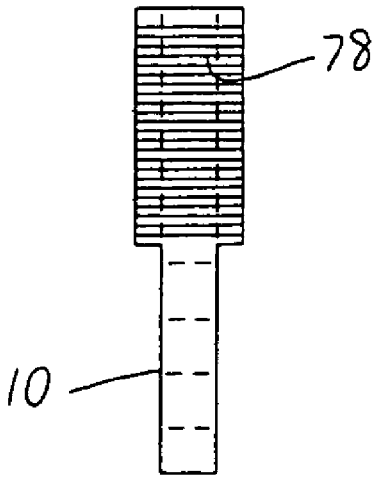
FIG. 10 - bottom view of fixed jaw member with rivet holes.

FIG. 10 is fixed jaw member 10 showing the width dimension of toothed member 78.

Figure 11:
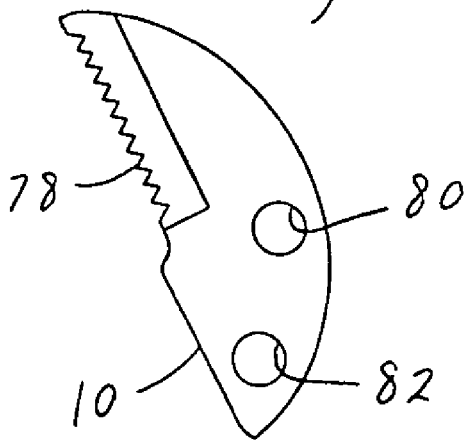
FIG. 11 - side view of fixed jaw member with rivet holes.
Figure 111:
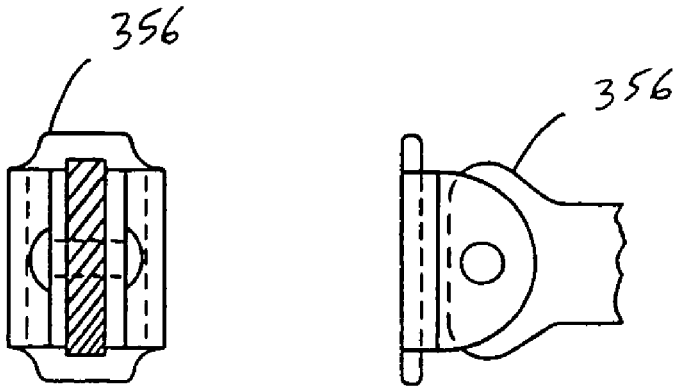
FIG. 111 - is a side and cross-sectional view of swivel pads being of an alternate design, being integral to "C" clamp or locking bar type.

FIG. 11 is fixed jaw member 10 having rivet holes 80 and 82. Rivet holes 80 and 82 are in line with rivet holes 60 and 58 when fixed jaw member 10 is placed on or into support members 64 and 72. FIG. 111 shows length dimension of toothed member 78.

As needed for construction (by a riveting procedure); the dimensions (as described in the specification) of all rivet holes in all fixed jaw members will line up with all corresponding rivet holes in all support members: Jaw member 10 is placed into (or on one side of) the support members of lower handle 24.

Figure 12:
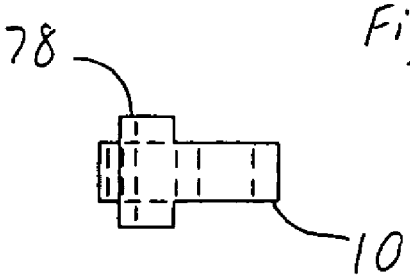
FIG. 12 - front view of fixed jaw member with rivet holes.

FIG. 12 is fixed jaw member 10 showing the height dimension of toothed member 78.

Figure 13:
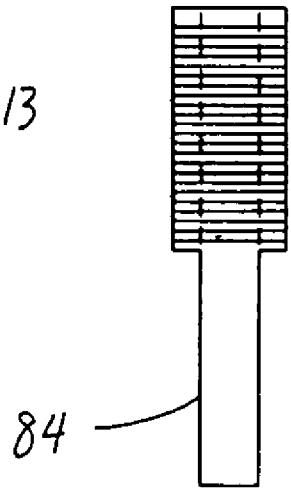
FIG. 13 - bottom view of fixed jaw member without rivet holes.

FIG. 13 is fixed jaw member 84 showing the same dimensions (excluded are rivet hole dimensions) as fixed jaw member 10.

Figure 14:
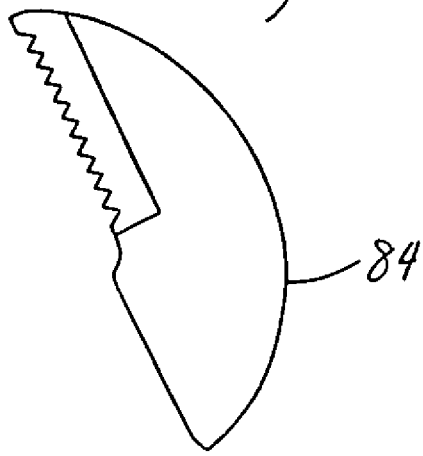
FIG. 14 - side view of fixed jaw member without rivet holes.

FIG. 14 is fixed jaw member 84 showing the same dimensions (excluded are rivet hole dimensions) as fixed jaw member 10.

Figure 15:
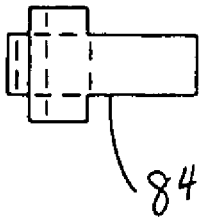
FIG. 15 - front view of fixed jaw member without rivet holes.

FIG. 15 is fixed jaw member 84 showing the same dimensions (excluded are rivet hole dimensions) as fixed jaw member 10.

Fixed jaw members 10 and 84 are forged and constructed with materials, and by manufacturing techniques known in the art: As needed for construction (by a welding procedure); the dimensions (as described in the specification) of all fixed jaw members without rivet holes - will correspond with all of the dimensions of all support members without rivet holes:

Jaw member 84 is placed into (or on one side of) the support members of lower handle 52. Fixed jaw member 84 is formed (welded; by mechanism known to the art) to each support member by a wire feed welding method, or by the heat generated (into each support member) during forming process of lower handle 52.

It is understood one having ordinary skill in the art would have no difficulty in engineering each fixed jaw member and each support member (with or without rivet holes) with the different described design features and construction techniques: including designing lower handle 54 with support members capable of accepting fixed jaw member 84.

Figure 16:
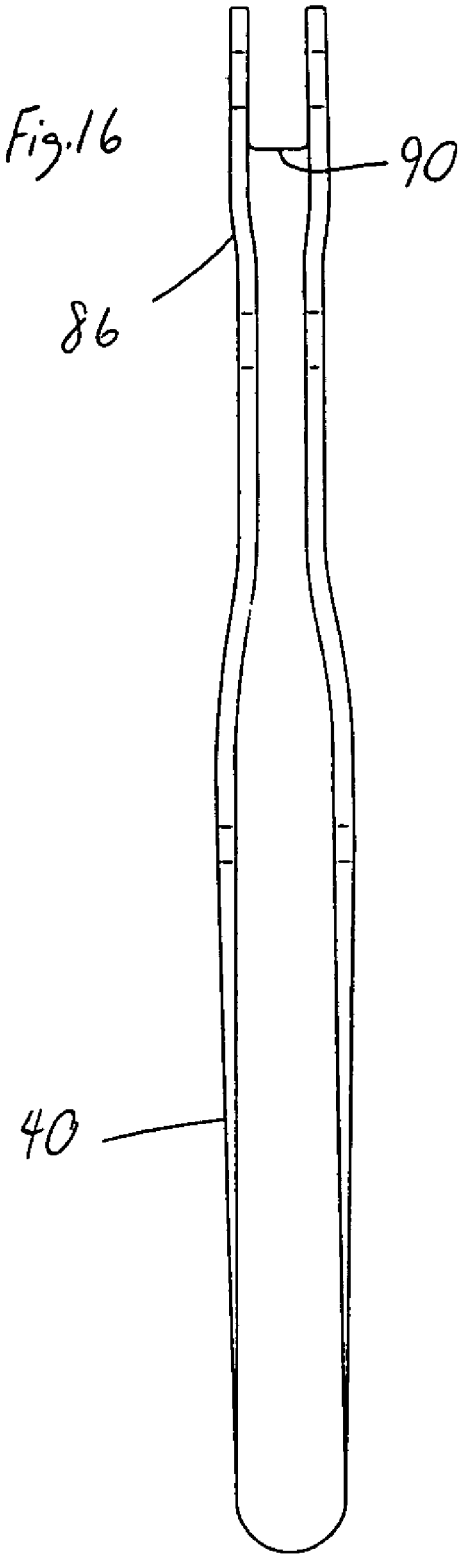
FIG. 16 - bottom view of upper handle showing position of rivet holes and position of roll pin holes by dashed lines.

FIG. 16 is upper handle 40 with bend 86 (having working dimensions known in the art) formed to forward channel 90 - as described in the specification.

Figure 17:
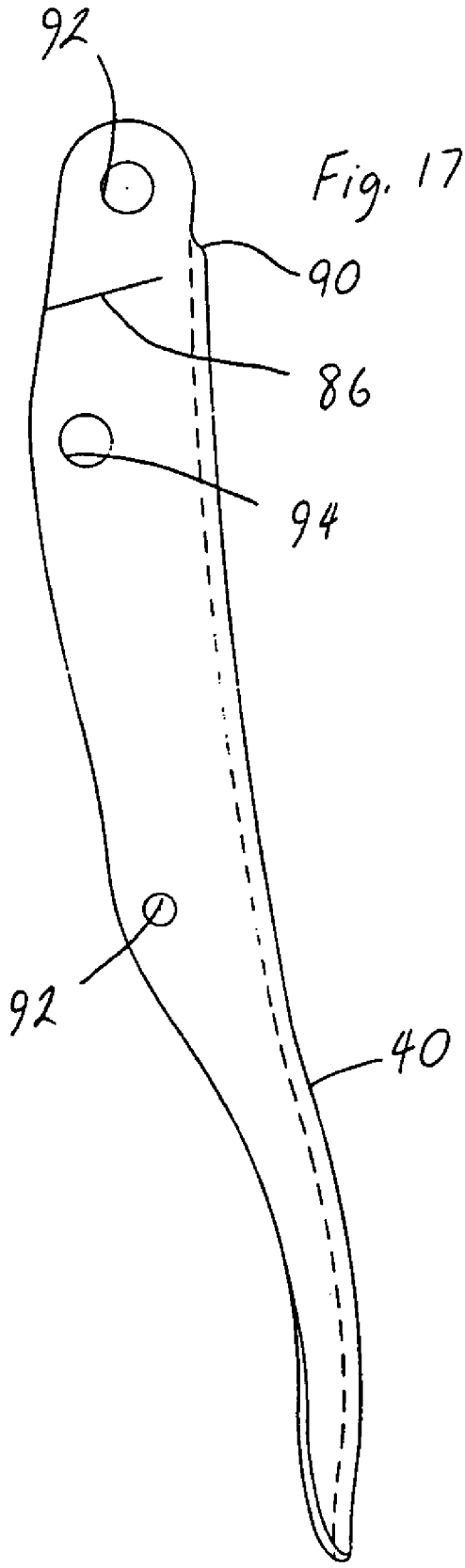
FIG. 17 - side view of upper handle showing material thickness by dashed line.

FIG. 17 is upper handle 40 showing bend 86 formed with a slight taper integral to forward channel 90.

Rivet holes 94 and 96 and roll pin hole 92 depicted in the specification (FIG. 17), are formed into upper handle 40 by a pressing/shearing process or by drilling (or by mechanism known in the art).

The outer dimensions of upper handle 40 are formed into a flat pattern by a pressing/shearing process after heating the flat material (or by mechanism known in the art): The flat pattern of upper handle 40 is then formed to its final shape (while heated) - including the forward channel 90 and bend 86, by a stamping process (or by mechanism known in the art).

Figure 18:
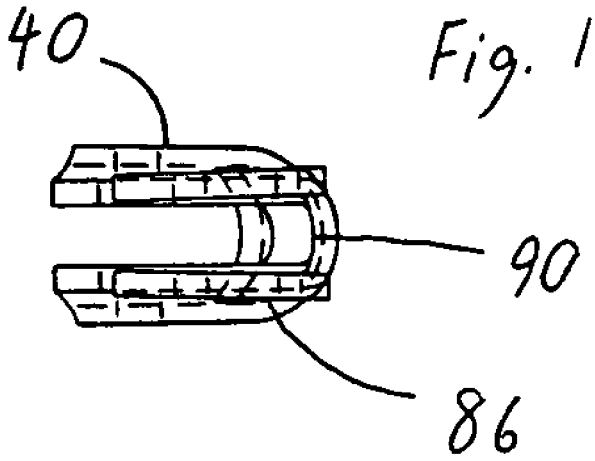
FIG. 18 - front view of upper handle with hidden dimensions shown by dashed lines.

FIG. 18 is upper handle 40 showing the spatial relation of forward channel 90 and bend 86.

Figure 19:
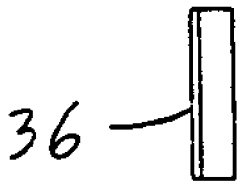
FIG. 19 - side view of roll pin showing the roll line of material.

FIG. 19 shows length dimension of roll pin 36.

Figure 20:
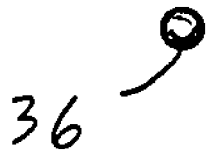
FIG. 20 - top view of roll pin showing the spiral roll of material.

FIG. 20 shows diameter dimension of roll pin 36. Roll pin 36 is formed by mechanism known in the art.

Figure 21:
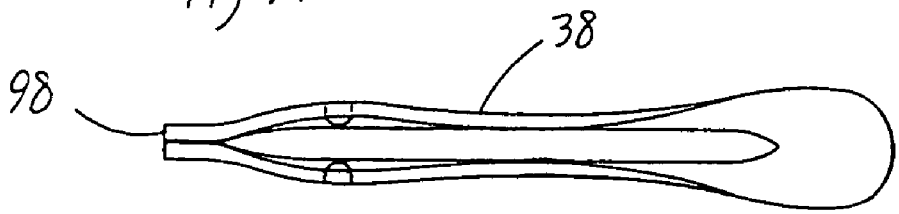
FIG. 21 - bottom view of release lever showing holes for roll pin.

FIG. 21 is release lever 38 with the outer dimensions formed into a flat pattern by a pressing/shearing process after heating the flat material (or by mechanism known in the art): The flat pattern of release lever 38 is then formed to its final shape (while heated) - including folded section 98, by a stamping/pressing process (or by mechanism known in the art).

Figure 22:
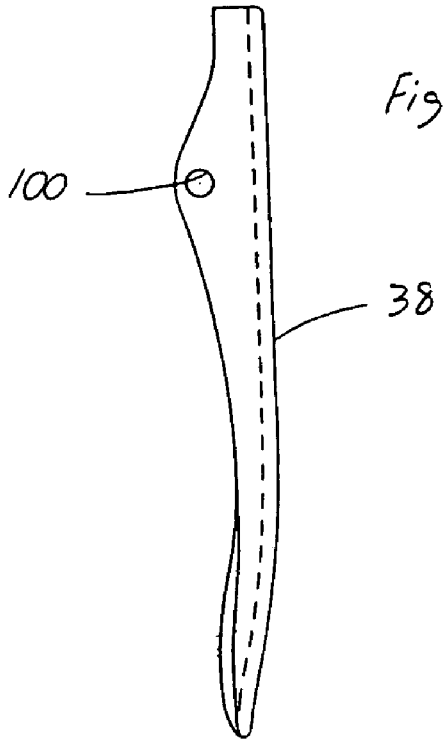
FIG. 22 - side view of release lever showing material thickness by dashed line.

FIG. 22 is release lever 38 having roll pin hole 100 formed by a pressing/shearing process or by drilling (or by mechanism known in the art).

Figure 23:
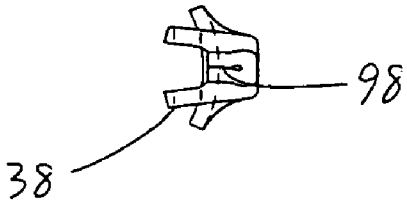
FIG. 23 - front view of release lever with hidden dimensions shown by dashed lines.

FIG. 23 is release lever 38 showing folded section 98 formed integral to the body of release lever 38.

FIG. 24 is toggle 34 with the outer dimensions formed into a flat pattern by a pressing/shearing process after heating the flat material (or by mechanism known in the art): The rear section 102 is formed from the flat pattern (while heated) by a stamping/pressing process (or by mechanism known in the art). In FIG. 24, rivet hole 104 is formed by a pressing/shearing process or by drilling (or by mechanism known in the art).

FIG. 25 is toggle 34 with taper 106 formed integral rear section 102.

FIG. 26 is toggle 34 showing the width dimension of the taper 106.

FIG. 27 is slidable jaw member 12 showing position of hook 18.

FIG. 28 is slidable jaw member 12 showing: rivet hole 110; and height dimension of contact edge 108.

FIG. 29 is slidable jaw member 12 showing width dimension of toothed member 112. Slidable jaw member 12 is a forging constructed; with materials, and by manufacturing techniques known in the art: As needed for construction; the rivet hole 110 is cast or drilled (or by a combination of casting and drilling; or by mechanism known in the art) into slidable jaw member 12.

Figure 30:
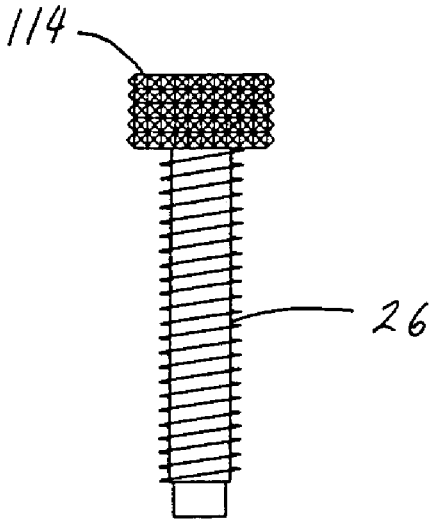
FIG. 30 - side view of adjustment screw showing threaded surface.

FIG. 30 is adjustment screw 26 showing the width dimension of knurled knob 114.

Figure 31:
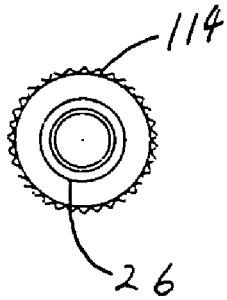
FIG. 31 - front view of adjustment screw showing knurled surface.

FIG. 31 is adjustment screw 26 showing the diameter of knurled knob 114.

Adjustment screw 26 is constructed; with materials, and by manufacturing techniques known in the art.

Figure 32:
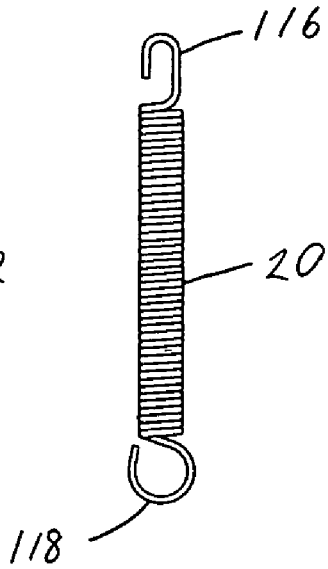
FIG. 32 - side view of spring shown without tension.

FIG. 32 is spring 20 (showing hooks 116 and 118) constructed; with materials, and by manufacturing techniques known in the art.

Figure 33:
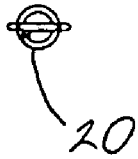
FIG. 33 - front view of spring showing positions of hooks.

FIG. 33 is spring 20 depicting its diameter.

Figure 34:
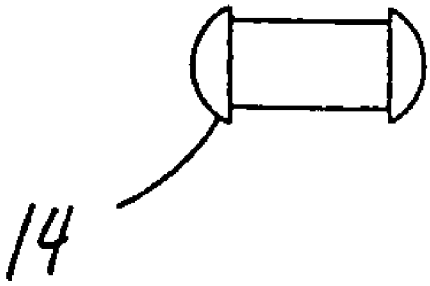
FIG. 34 - side view of rivet for stationary jaw member.

FIG. 34 is rivet 14 showing its length dimension. Rivet 16 is not shown a length dimension.

Figure 35:
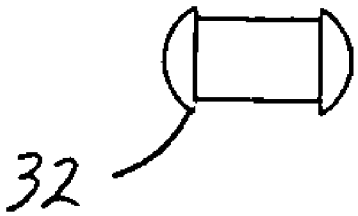
FIG. 35 - side view of rivet for toggle.

FIG. 35 is rivet 32 showing its length dimension.

Figure 36:
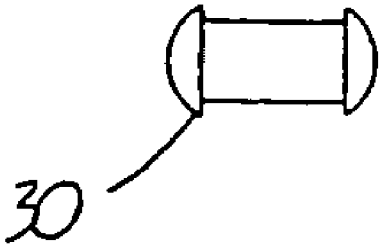
FIG. 36 - side view of rivet for slidable jaw member.

FIG. 36 is rivet 30 showing its length dimension.

Rivets 14 and 16 (each having the same dimensions as the other) are constructed; with materials, and by manufacturing techniques known in the art.

Rivets 30 and 32 are constructed; with materials, and by manufacturing techniques known in the art.

All rivets are injected into all holes (while heated or cold) and then are pressed (while heated or cold) to the final shape (or are placed into and pressed by mechanism known in the art).

FIG. 37 has fixed jaw member 124 and slidable jaw member 126 being slightly greater in length when compared to fixed jaw member 10; with upper handle 128 (being formed similar to that of upper handle 40) shorter in length and greater in width than upper handle 40; with release lever 130 formed by mechanism known to the art; with toggle 132 having slightly lengthened upper handle and release lever contact points - toggle 132 formed by mechanism known to the art; with adjustment screw 134 being longer than adjustment screw 26 - adjustment screw 134 being formed by mechanism known in the art; with lower handle 136 having part of the housing section (section which secures spring, toggle, adjustment screw) being formed by mechanism known in the art; with support member 138 being formed integral to the housing section of lower handle 136; with strengthening rib 140 being stamped integral to support member 138.

Figure 38:
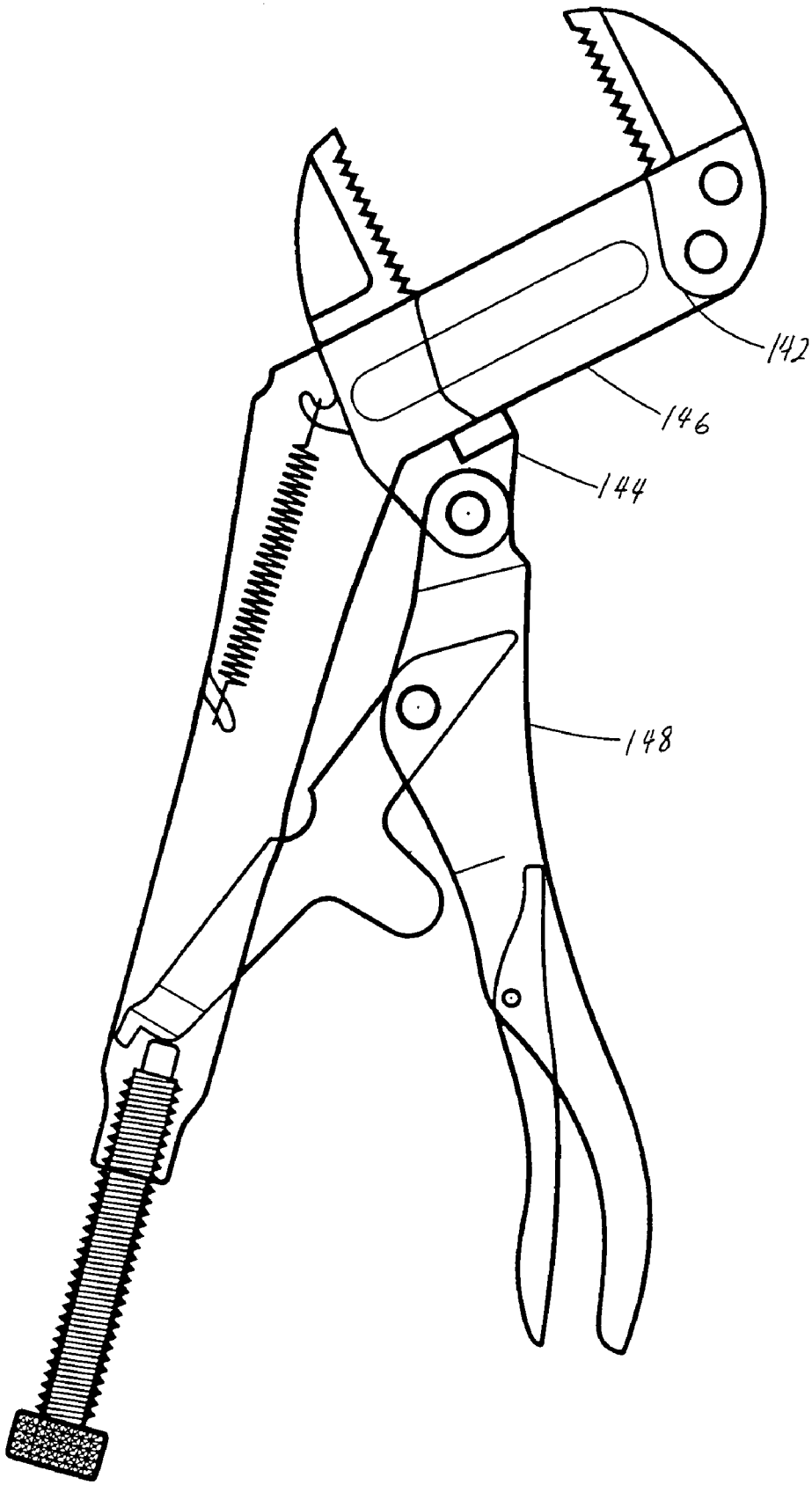
FIG. 38 - is a side view showing an alternate design to FIG. 37.

FIG. 38 has fixed jaw member 142 and slidable jaw member 144 - having a smaller tooth section when compared to fixed jaw member 124 and slidable jaw member 126; with slidable jaw member 144 constructed to provide a greater perpendicular relationship to support member 146 - when compared to the perpendicular relationship of slidable jaw member 126 to support member 138; with upper handle 148 being shorter in length than upper handle 128; with support member 146 formed to provide slidable jaw member 144 a slidable width dimension at the attachment area of fixed jaw member 142 to support member 146. The remaining mechanisms of FIG. 38 (comparable to FIG. 37) - being formed by the techniques as taught by FIG. 37 and: it is known one having ordinary skill in the field would have no problem in engineering the tooth sections shown herein for each of the fixed or slidable jaw members.

Figure 39:
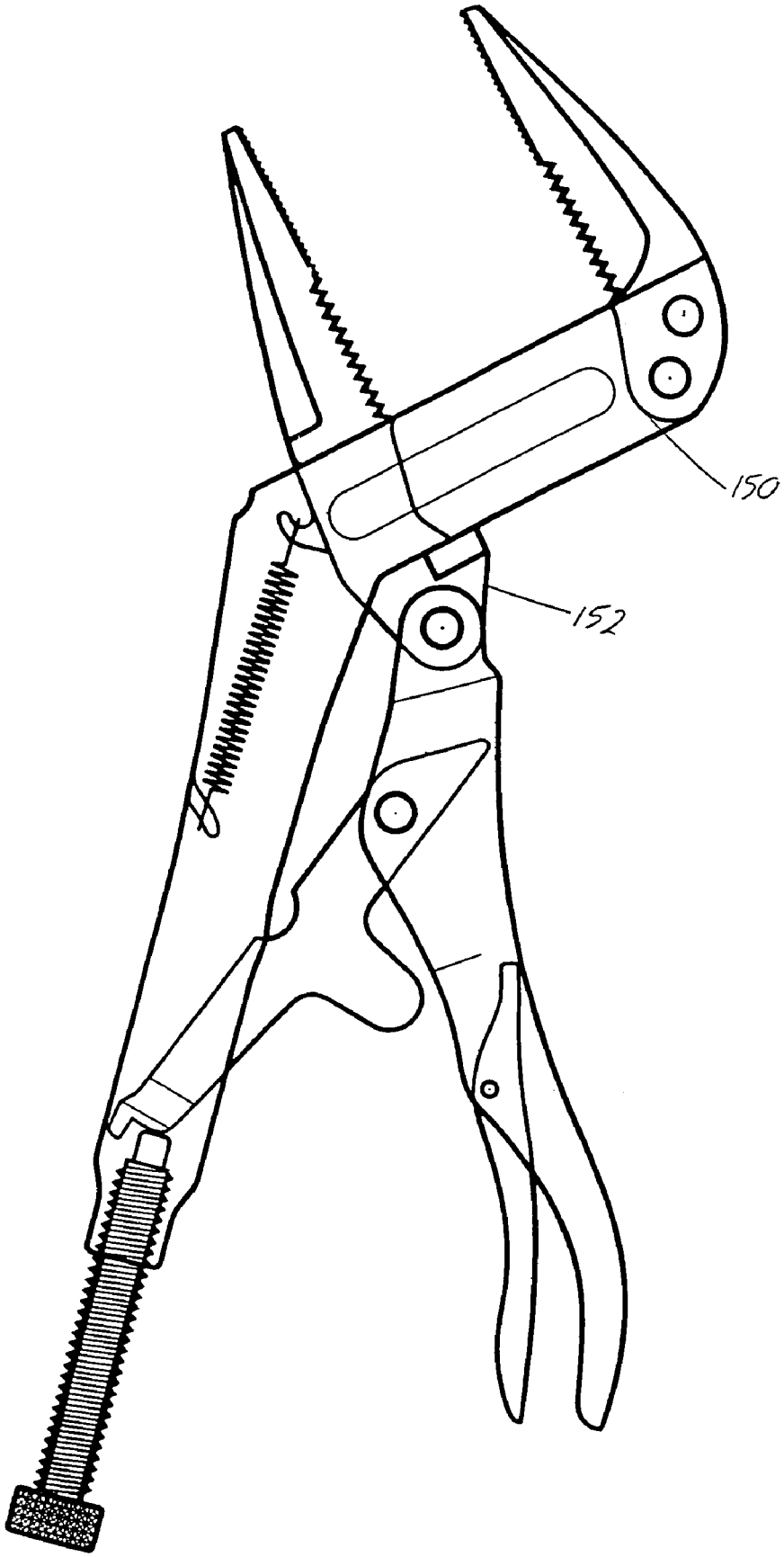
FIG. 39 - is a side view of the long nose design of the alternate design shown in FIG. 38.

FIG. 39 has fixed long nose jaw member 150 and slidable long nose jaw member 152 having mechanisms (comparable to FIG. 38) - being formed by techniques as taught by FIG. 38. It is known one having ordinary skill in the field would have no problem in engineering slidable long nose jaw member 152 with a support member contact points to that of slidable jaw member 126.

Figure 40:
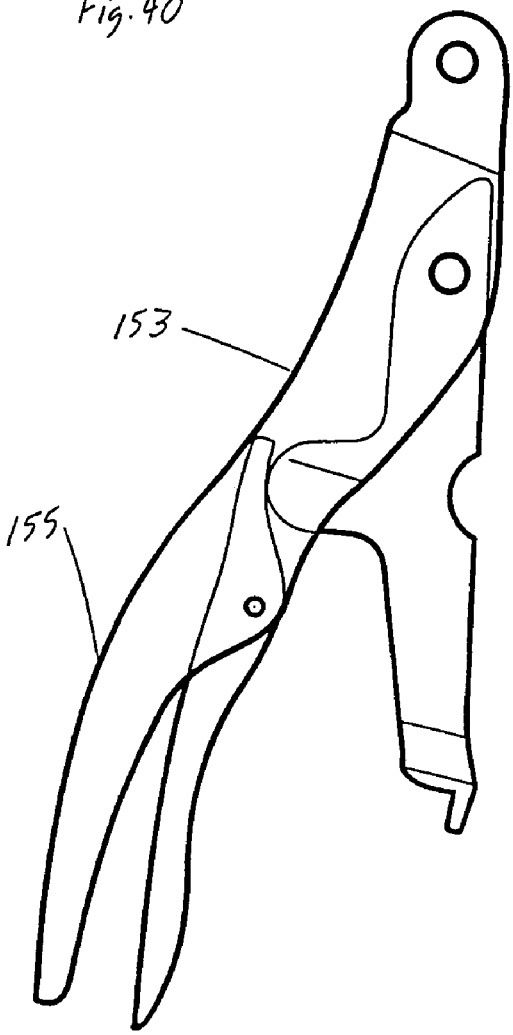
FIG. 40 - is a side view of an ergonomic handle design.

FIG. 40 is ergonomic handle 153 with an ergonomic designed finger grip arc 155 - formed by techniques known in the art.

Figure 41:
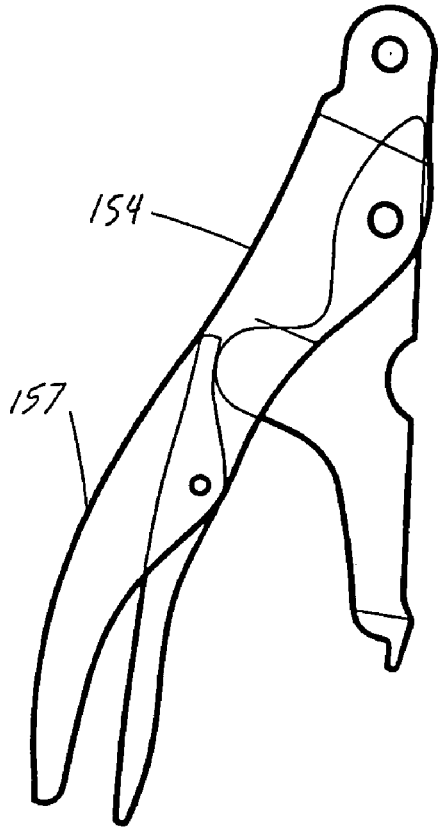
FIG. 41 - is a side view of an ergonomic handle design.

FIG. 41 is ergonomic handle 154 with an ergonomic designed finger grip arc 157 - formed by techniques known in the art.

Figure 42:
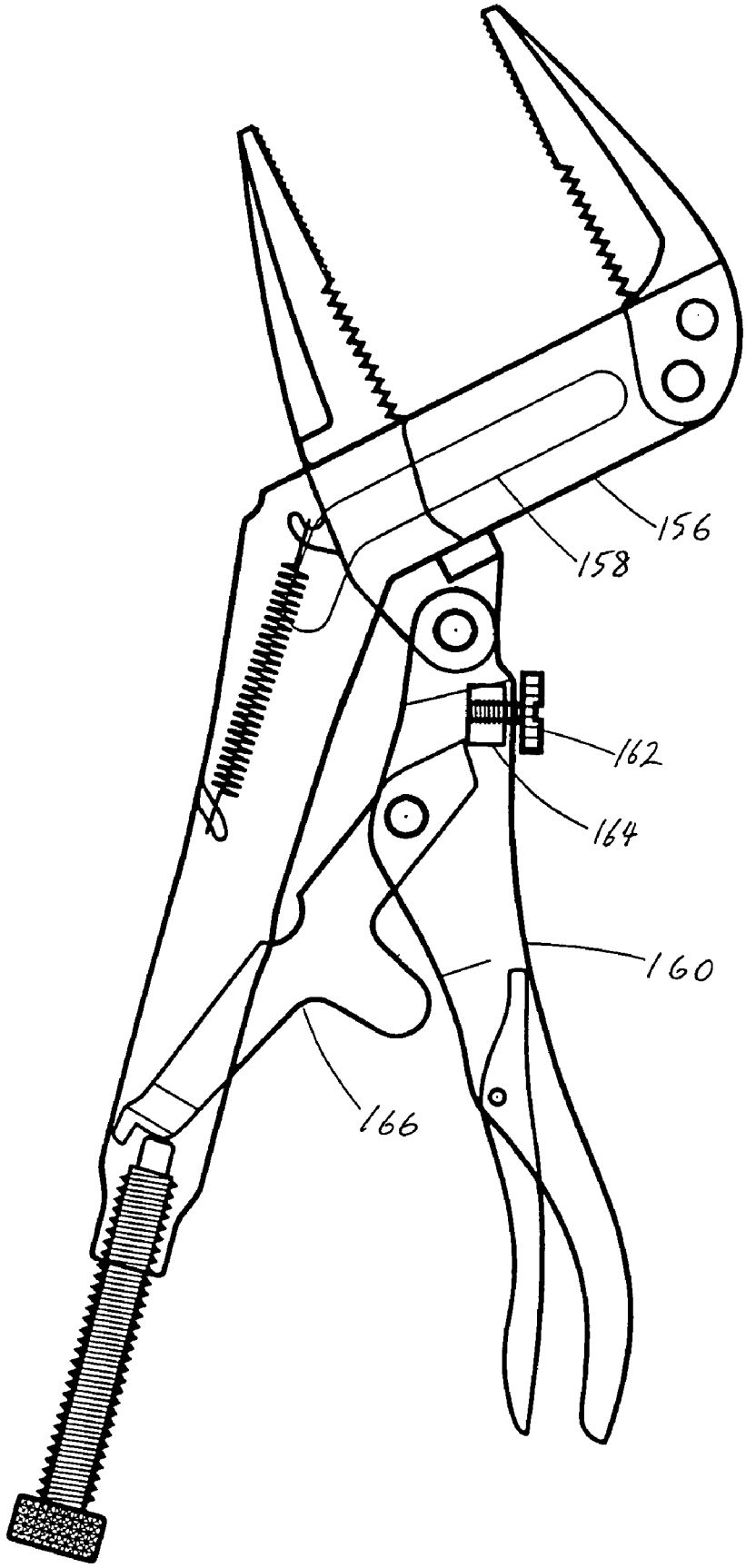
FIG. 42 - is an alternate design to the design shown in FIG. 39.

FIG. 42 has strengthening rib 158 as being formed (stamped) integral to support member 156; with upper handle 160 having toggle angle adjustment mechanisms (threaded knurled toggle stop screw 162, rectangular toggle stop 164) formed by techniques known in the art; with upper handle 160 slotted to accept threaded knurled toggle stop screw 162; with toggle 166 length dimension shortened as compared to toggle 132.

It is understood one having ordinary skill in the field would have no difficulty in engineering: upper handles 128 or 148 and toggle 132 to accept (in a workable relationship) the toggle angle adjustment mechanisms - threaded knurled toggle stop screw 162 and rectangular toggle stop 164; and to have support members 138 or 146 formed with a strengthening rib to that of the strengthening rib 158.

Figure 43:
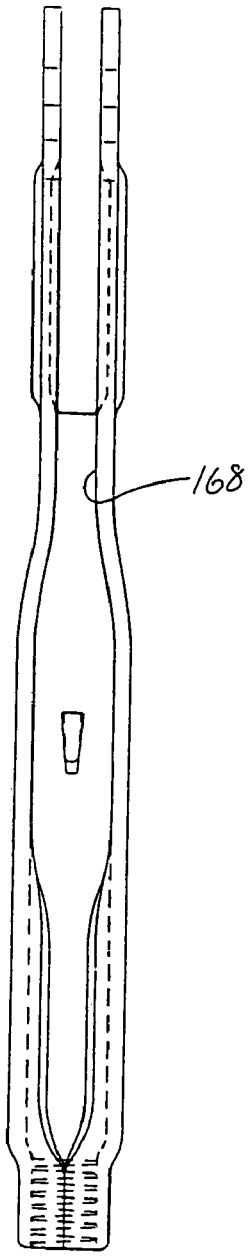
FIG. 43 - top view of lower handle with a shortened length and narrowed housing.

FIG. 43 shows narrowed housing 168 as being formed by techniques known in the art.

Figure 44:
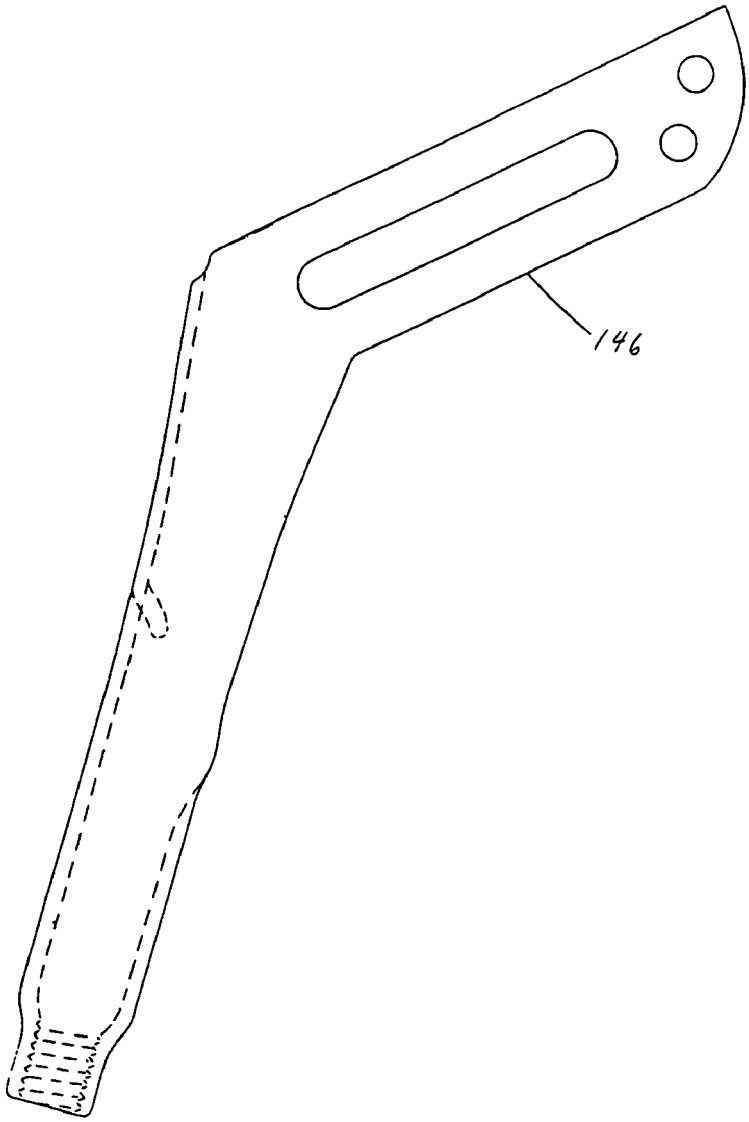
FIG. 44 - side view of lower handle with support rib.

FIG. 44 shows support member 146 as formed having a parallel width relationship—when seen from the side view.

Figure 45:
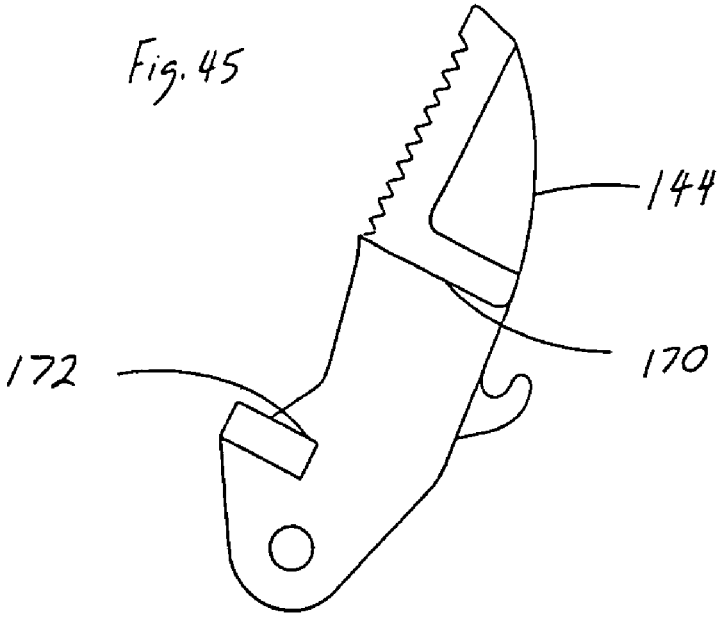
FIG. 45 - side view of slidable jaw member showing contact edge (edge which slides along support member of lower handle).

FIG. 45 shows slidable jaw member 144 having side contact members 170 and 172 as formed having a parallel width relationship.

Figure 46:
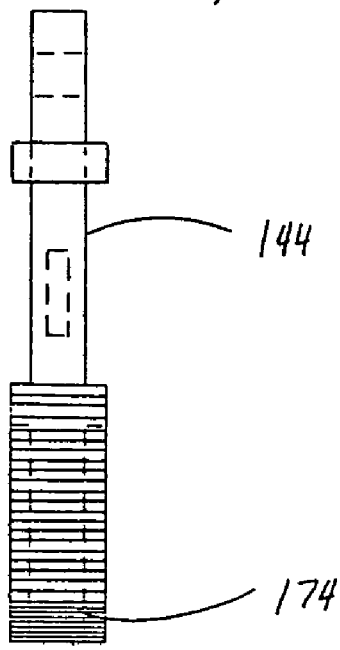
FIG. 46 - top view of slidable jaw member showing position of rivet hole by dashed lines.

FIG. 46 shows slidable jaw member 144 with integrally formed tooth section 174.

Figure 47:
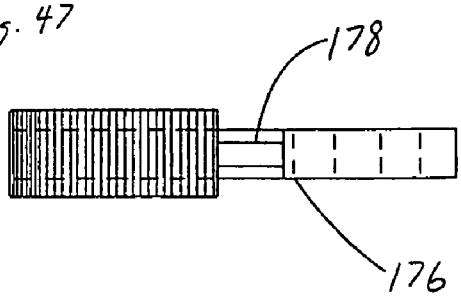
FIG. 47 - bottom view of slidable jaw member with wire cutter.

FIG. 47 has fixed jaw member 176 with integrally formed wire cutter 178.

Figure 48:
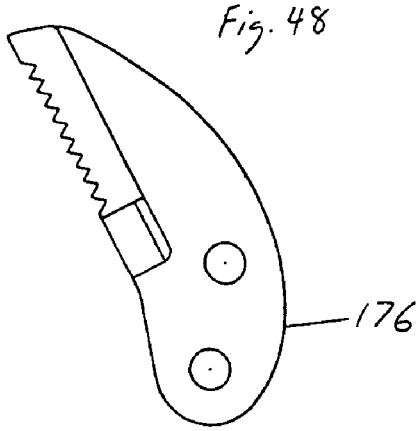
FIG. 48 - side view of fixed jaw member with wire cutter.

FIG. 48 shows fixed jaw member 176 having a greater length dimension than fixed jaw member 142.

Figure 49:
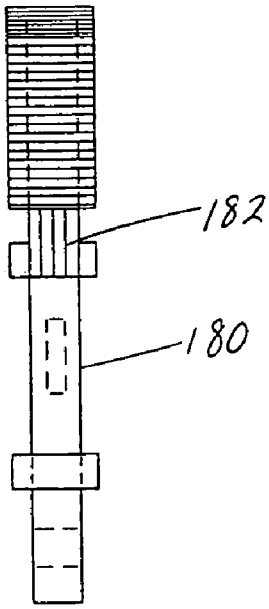
FIG. 49 - is a top view showing an alternate design to FIG. 45.

FIG. 49 has slidable jaw member 180 with integrally formed wire cutter 182.

Figure 50:
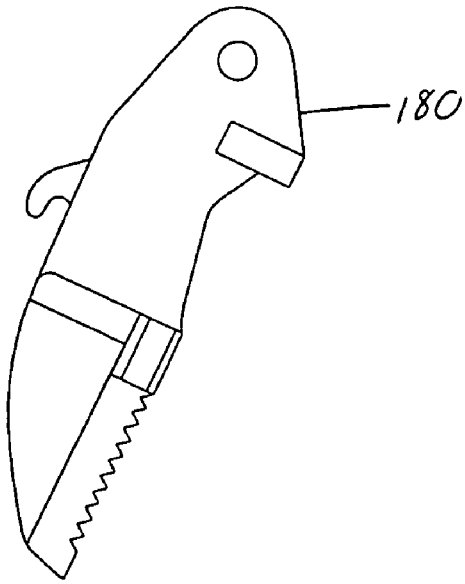
FIG. 50 - is a side view showing an alternate design to FIG. 46.

FIG. 50 has slidable jaw member 180 having a greater length dimension than slidable jaw member 144.

It is understood one having ordinary skill in the field would have no difficulty in engineering: any jaw members as depicted herein with the described wire cutting apparatus.

Figure 51:
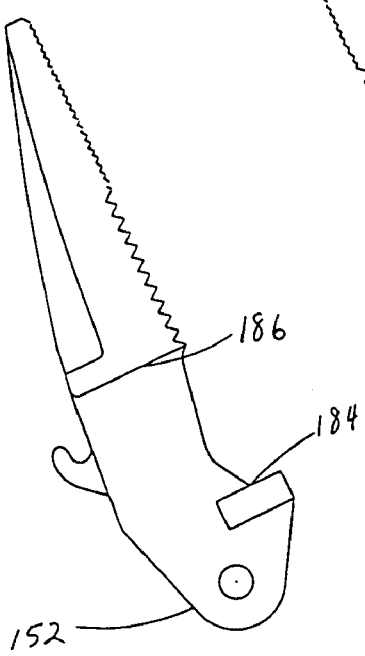
FIG. 51 - is a side view of the long nose design of FIG. 45.

FIG. 51 slidable long nose jaw member 152 having side contact members 184 and 186 as formed having a parallel width relationship.

Figure 52:
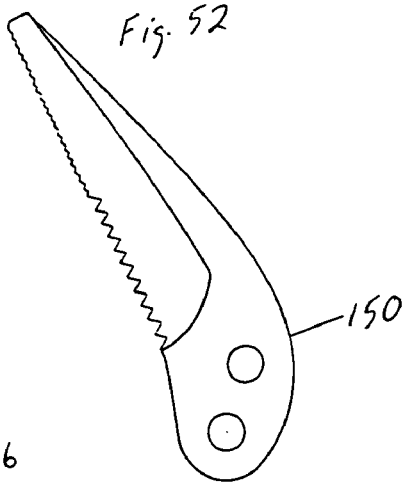
FIG. 52 - is a side view of the long nose design of FIG. 11.

FIG. 52 shows fixed long nose jaw member 150 as being formed by mechanism known in the art.

Figure 53:
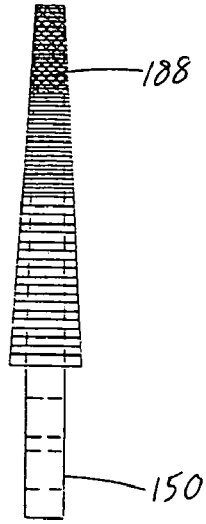
FIG. 53 - bottom view of the long nose design showing position of rivet holes by dashed lines.

FIG. 53 has fixed long nose jaw member 150 with integrally formed tooth section 188.

Figure 54:
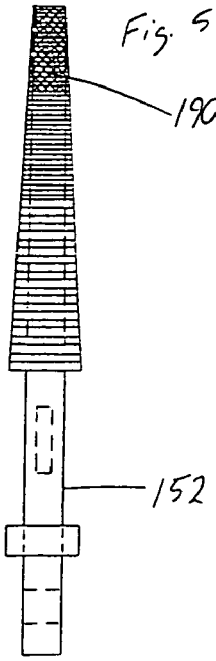
FIG. 54 - top view of the long nose design showing position of rivet hole by dashed lines.

FIG. 54 slidable long nose jaw member 152 with integrally formed tooth section 190.

Figure 55:
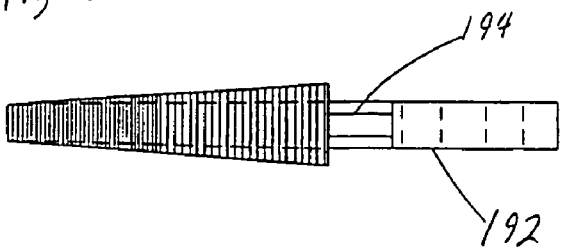
FIG. 55 - bottom view of long nose fixed jaw member with wire cutter.

FIG. 55 has fixed long nose jaw member 192 with integrally formed wire cutter 194.

Figure 56:
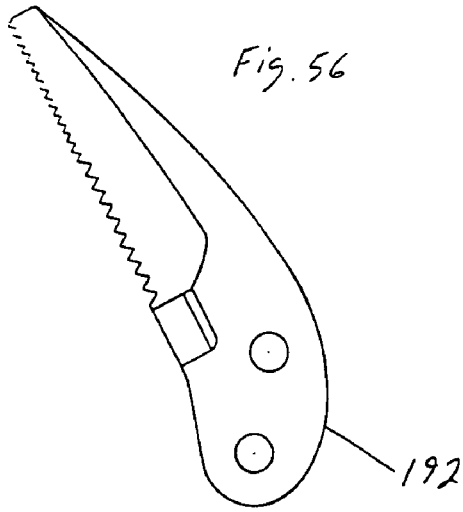
FIG. 56 - side view of long nose fixed jaw member with wire cutter.

FIG. 56 shows fixed long nose jaw member 192 having a greater length dimension than fixed long nose jaw member 150.

Figure 57:
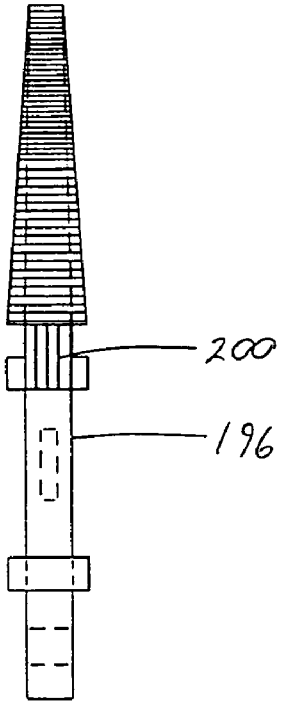
FIG. 57 - top view of long nose slidable jaw member with wire cutter.

FIG. 57 has sidable long nose jaw member 196 with integrally formed wire cutter 200.

Figure 58:
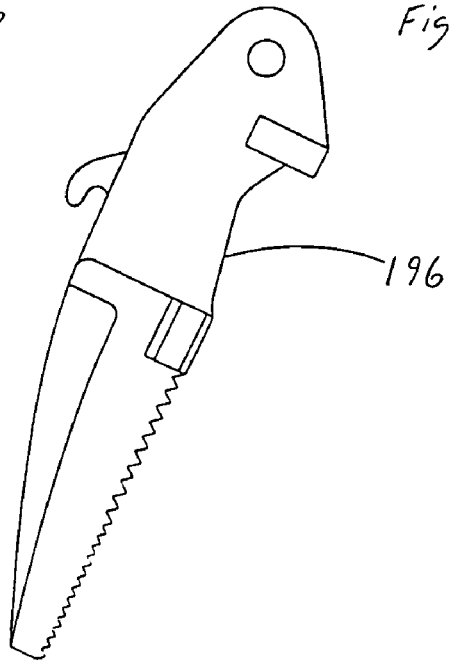
FIG. 58 - side view of long nose slidable jaw member with wire cutter.

FIG. 58 has slidable long nose jaw member 196 having a greater length dimension than slidable long nose jaw member 152.

Figure 59:
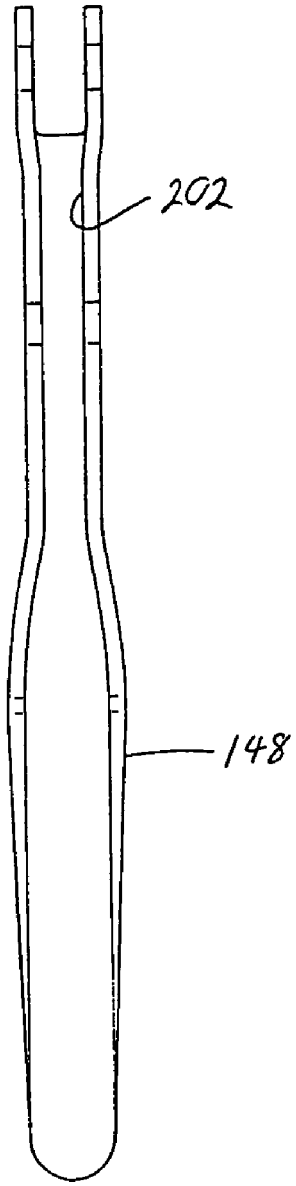
FIG. 59 - bottom view of upper handle showing the position of rivet holes and roll pin holes by dashed lines.

FIG. 59 is upper handle 148 with a housing section 202 formed by mechanism known in the art.

Figure 60:
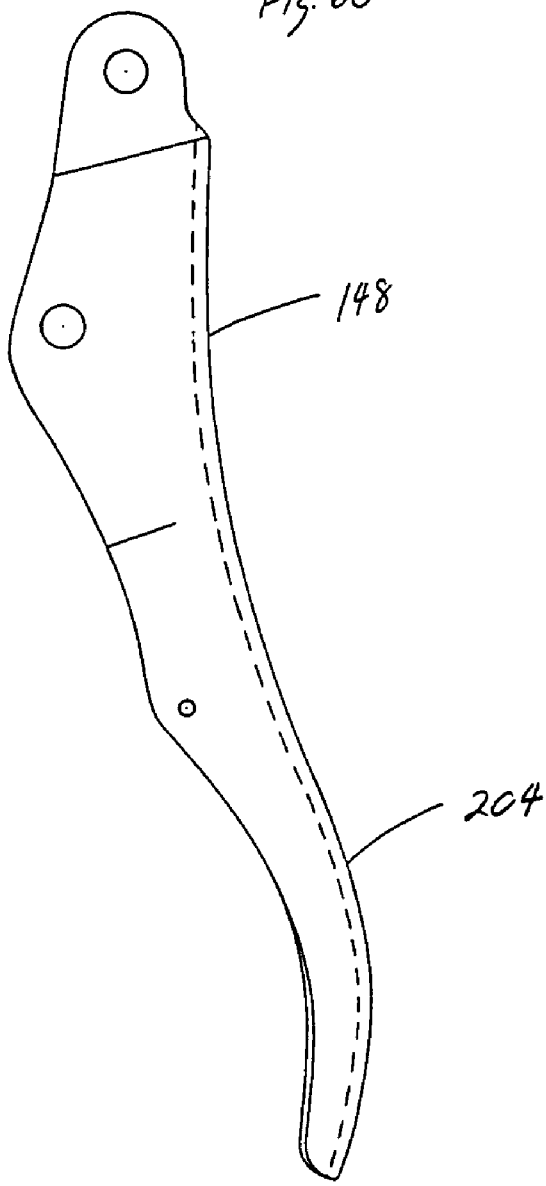
FIG. 60 - side view of upper handle showing material thickness by dashed lines.

FIG. 60 is upper handle 148 with an integrally formed - ergonomic palm rest arc 204.

Figure 61:
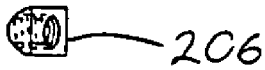
FIG. 61 - front view of angled toggle stop.

FIG. 61 is angled toggle stop 206 formed by mechanism known in the art.

Figure 62:
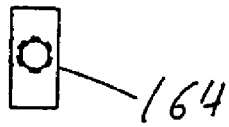
FIG. 62 - top view of rectangular toggle stop.

FIG. 62 is rectangular toggle stop 164 formed by mechanism known in the art.

Figure 63:
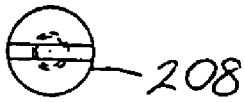
FIG. 63 - bottom view of threaded toggle stop screw.

FIG. 63 is threaded toggle stop screw 208 formed by mechanism known in the art.

Figure 64:
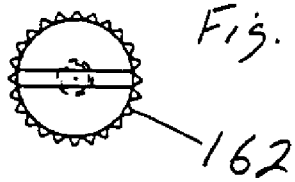
FIG. 64 - top view of threaded knurled toggle stop screw.

FIG. 64 is threaded knurled toggle stop screw 162 formed by mechanism known in the art.

Figure 65:
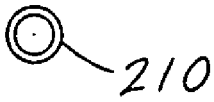
FIG. 65 - top or bottom view of toggle stop screw washer.

FIG. 65 is toggle stop screw washer 210 formed by mechanism known in the art.

Figure 66:
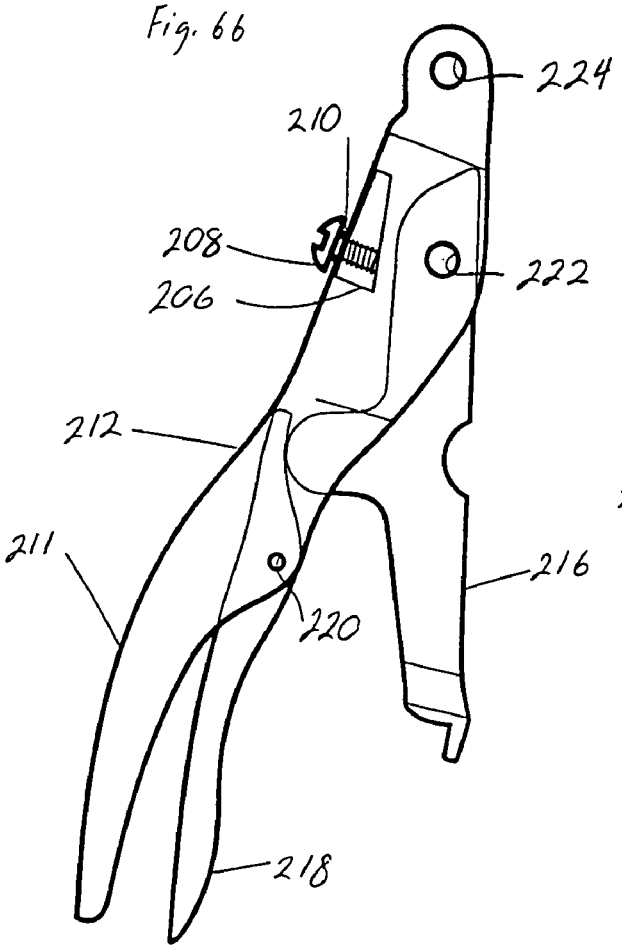
FIG. 66 - side view of an ergonomic handle design with angled toggle stop.

FIG. 66 has ergonomic handle 212 - with an integrally formed ergonomic designed finger grip arc 211; with housing to accept (in a workable relationship) the toggle angle adjustment mechanisms - angled toggle stop 206, threaded toggle stop screw 208, and toggle stop screw washer 210; with toggle 216 formed to contact toggle stop 206; with release lever 218, rivet holes 222 and 224, roll pin hole 220 - formed by mechanism known in the art. It is known that one having ordinary skill in the art would have no difficulty in engineering rivets and a roll pin for ergonomic handle 212.

Figure 67:
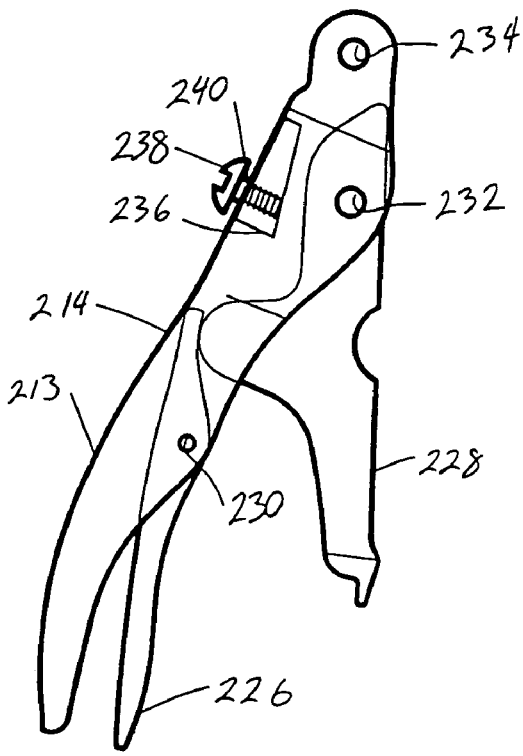
FIG. 67 - side view of an ergonomic handle design with angled toggle stop.

FIG. 67 has ergonomic handle 214 as being shorter in length than ergonomic handle 212 - with an integrally formed ergonomic designed finger grip arc 213 - formed by mechanism known in the art; with toggle 228 formed to contact angled toggle stop 236; with release lever 226, rivet holes 232 and 234, roll pin hole 230, threaded toggle stop screw 238, and toggle stop screw washer 240 - formed by mechanism known in the art.

It is understood that one having ordinary skill in the art would have no difficulty in engineering rivets and a roll pin for ergonomic handle 214.

Figure 68:
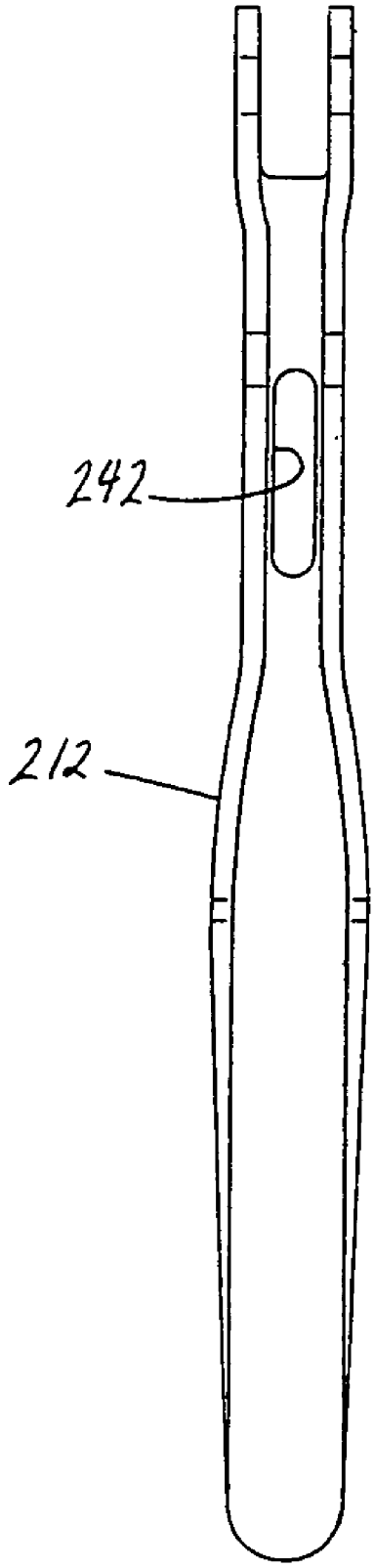
FIG. 68 - is a top view of the ergonomic handle design shown in FIG. 66.

FIG. 68 has ergonomic handle 212 with slotted housing 242 - to accept (in a workable relationship) the toggle angle mechanisms (in FIG. 66) described herein.

Figure 70:
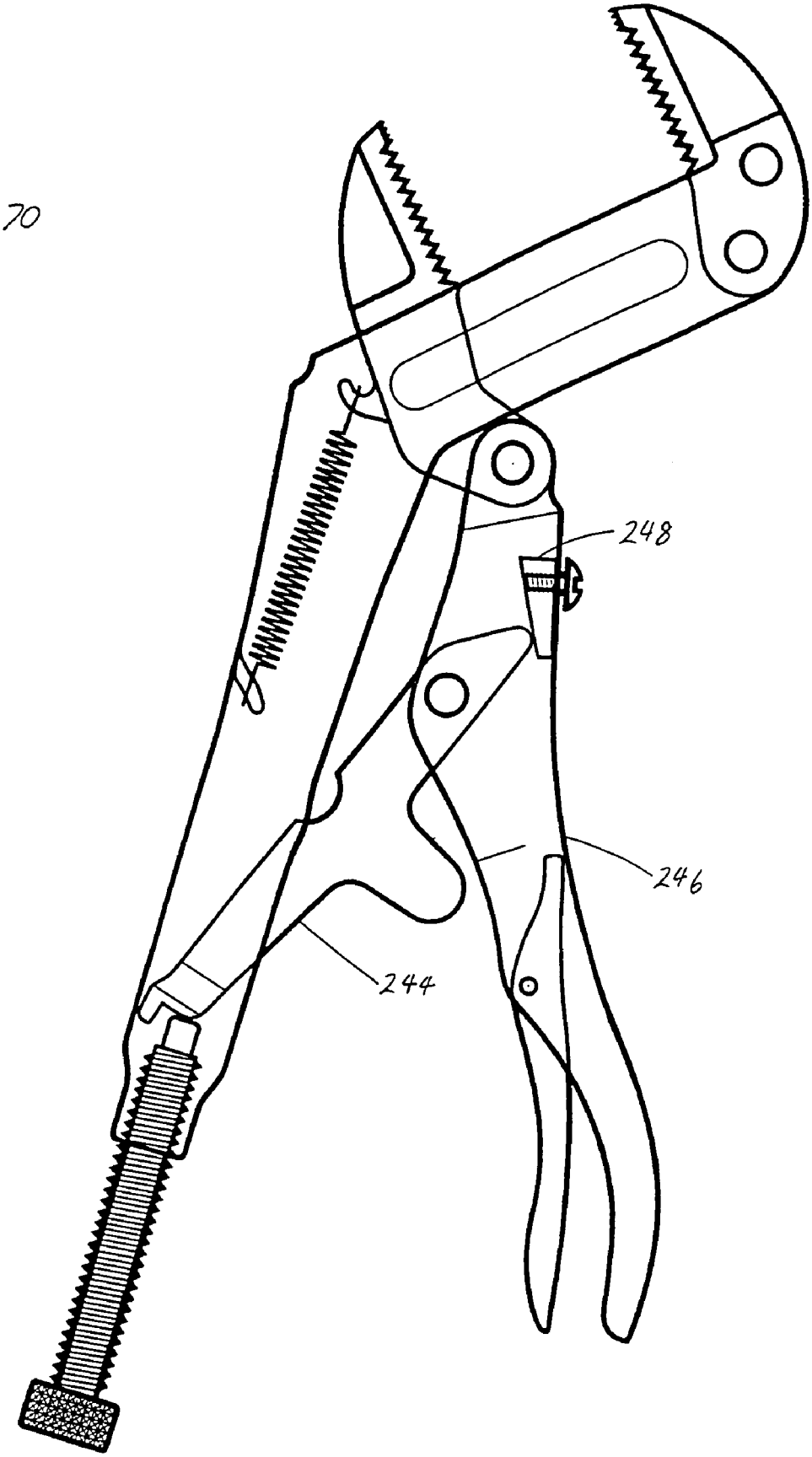
FIG. 70 - is a side view of the pliers type shown in FIG. 37 - designed with angled toggle stop.

FIG. 70 is formed by the techniques as taught herein - and/or in combination with the formation (fabrication) techniques known in the art.

As defined in this specification; construction of parts for the above-identified invention is as follows (FIG. 1): Upper handle 40 opposes lower handle 24. Slidable jaw member 12 is positioned between the support members of lower handle 24, before upper handle 40 is rotatable and attached to slidable jaw member 12 by rivet 30. Toggle 34 is positioned in the housing of upper handle 40, before being rotatable and attached to upper handle 40 by rivet 32. Release lever 38 is positioned in the housing of upper handle 40, before being rotatable and attached to upper handle 40 by roll pin 36. Fixed jaw member 10 is riveted to the support members of lower handle 24 by rivets 14 and 16.

Adjustment screw 26 is screwed into threaded housing 50. After the construction of slidable jaw member 12 into lower handle 24, and after the construction of upper handle 40 to slidable jaw member 12: Is upper handle 40 first rotated away from lower handle 24 - allowing for spring 20 to be attached to hooks 22 and 18; then slidable jaw member 12 is slid into contact with fixed jaw member 10 while under the tension of spring 20; and lastly, upper handle 40 and toggle 34 are rotated towards lower handle 24 allowing for rear section 102 to pivotally contact adjustment screw 26.

When comparable mechanisms are taken into consideration as defined above - alternative construction is as follows (FIG. 38):

Slidable jaw member 144 is positioned to slide (down the entire length of the already formed parallel inner sides of support member 146) by contacting (with clearance) each inner side of support member 146 - before the attachment of jaw member 142 to support member 146.

When comparable mechanisms are taken into consideration as defined above - alternative construction is as follows (FIGS. 42, 66, 67, 70):

In general, the comparable toggle stop mechanisms of each handle described herein - are constructed using similar techniques; wherein FIGS. 42 and 66 are given for examples:

FIG. 42: Rectangular toggle stop 164 is placed into the housing of handle 160. Threaded knurled toggle stop screw 162 is then placed through the slot of handle 160 and is lastly screwed into rectangular toggle stop 164.

FIG. 66: Angled toggle stop 206 is placed into the slotted housing 242 of handle 212. Toggle stop screw washer 210 is inserted over the threads of toggle stop screw 208. With toggle stop screw washer 210 in place; toggle stop screw 208 is then placed through the slot of the slotted housing 242 of handle 212 and, toggle stop screw 208 is lastly screwed into angled toggle stop 206.

The operation description of the alternative embodiments - FIGS. 37, 38, 39, 40, 41, 42, 66, 67, 70, and 71 - are described by referring back to FIGS. 1–1A, when the mechanisms of FIGS. 37, 38, 39, 40, 41, 42, 66, 67, 70, and 71 perform the same function as the mechanisms in FIGS. 1–1A. As defined in this specification; operation of the preferred embodiments is as follows: FIG. 1: Slidable jaw member 12 is urged towards fixed jaw member 10 when handle 40 is compressed towards lower handle 24. Handles 40 and 24 transmit leverage to a slidable jaw member 12 and toggle 34 during handle compression. The rotation of upper handle 40 and toggle 34 - leverage slidable jaw member 12 towards fixed jaw member 10. Toggle 34 is prevented from traveling backwards by contacting adjustment screw 26. Upper handle 40, toggle 34, and slidable jaw member 12 are moved towards (or away from) fixed jaw member 10 when adjustment screw 26 is turned. Clamping pressure applied to an object (or objects) between fixed jaw member 10 and slidable jaw member 12 is adjusted by turning adjustment screw 26.

The contact edges of slidable jaw member 12, in conjunction with the rivet attachment point of upper handle 40 and slidable jaw member 12 - prevent slidable jaw member 12 from sliding out of the support members of lower handle 24. The support members of lower handle 24 provide a guide mechanism for slidable jaw member 12.

Spring 20 is expanded when slidable jaw member 12 is moved towards fixed jaw member 10. Spring 20 travels between the support members of lower handle 24. Upper handle 40 is held in the fully open position from the force exerted by spring 20 on hooks 18 and 20. Edge 120 (being integral to toggle 34) contacts the housing of upper handle 40 to stop upper handle 40 at an easily operatable arc.

The force exerted by spring 20 in working relationship with and the length and width design of rear section 102 - hold a portion of toggle 34 in the housing of lower handle 24. Toggle 34 travels (slides forwards or backwards depending on toggle adjustment) in the channel provided by the housing of lower handle 24.

Release lever 38 contacts mid section 122 when upper handle 40 is compressed into the lock position. Release lever 38 is compressed to unlock upper handle 40. Roll pin 36 operates by mechanism known in the art.

Rivets 30 and 32 operate by mechanism known in the art.

When comparable mechanisms are taken into consideration as defined in the preceding - alternative operation is as follows (FIG. 38):

Side contact members 170 and 172 guide slidable jaw member 144 in a greater parallel relationship along support member 146 - offering a greater degree of strength and accuracy to slidable jaw member 144 (through more readily machinable/forgeable structures) - as compared to upper handle 128 utilizing a stamping which contacts support member 138.

When comparable mechanisms are taken into consideration as defined in the preceding and as defined in the art - alternative operation is as follows (FIG. 40):

Ergonomic handle 153 has finger grip arc 155 being of a shape which offers the user a greater degree of grip (while the opposing handle of ergonomic handle 153 is adjusted for a maximum degree of clamping pressure) by providing a parallel (or more parallel) relationship between the finger ends and thumb end - as compared to the handle arrangement of conventional toggle locking pliers resulting in a greater degree of finger slippage due to a lesser or no parallel relationship between handles when adjusted for maximum clamping pressure.

When comparable mechanisms are taken into consideration as defined in the preceding - alternative operation is as follows (FIG. 42):

Threaded knurled toggle stop screw 162 and rectangular toggle stop 164 are loosened by hand or with a screwdriver and then are slid lengthwise along upper handle 160 - with the result of changing the position (toggle angle) of toggle 166. The threaded knurled toggle stop screw 162 and rectangular toggle stop 164 are lastly tightened by hand or with a screwdriver - when the desired position (toggle angle) of toggle 166 is determined. The toggle angle of toggle 166 determines the clamping pressure.

When comparable mechanisms are taken into consideration as defined in the preceding and more particularly relating to the description of the operation of FIG. 40 - alternative operation is as follows (FIG. 66): Toggle stop screw 208, toggle stop screw washer 210, and angled toggle stop 206 are loosened by a screwdriver and then are slid lengthwise in slotted housing 242, along ergonomic handle 212 - with the result of changing the position (toggle angle) of toggle 216. Toggle stop screw 208, toggle stop screw washer 210, and angled toggle stop 206 are lastly tightened by hand or with a screwdriver - when the desired position (toggle angle) of toggle 216 is determined. The toggle angle of toggle 216 determines the clamping pressure.

When comparable mechanisms are taken into consideration as defined in the preceding and more particularly relating to the description of the operation of FIGS. 42 and 66 - alternative operation is as follows (FIG. 70): The toggle angle positioning mechanisms secured in the slotted housing of upper handle 246 provide adjustment for toggle 244. The angular feature of angled toggle stop 248 (as compared to a greater toggle stop angle than what is depicted or to the rectangular dimensions of rectangular toggle stop 164) - results in eliminating the possibility of unwanted lengthwise angled toggle stop 248 movement along upper handle 246 - during the toggle releasing procedure (especially during the release of maximum clamping pressure - when the toggle stop contact point of toggle 244 forcefully contacts angled toggle stop 248).

The statement "obvious at the time the invention was made to a person having ordinary skill in the art" is meant herein to be construed as meaning: The information for which patent is sought anticipates art (designs) by others modifying the Invention under (A) through (Z) herein, because it is taught herein and under (A) through (Z) that the Invention is made constructible by:

(A) Any material coating (coating 147 herein and in the Drawing Figures) design (including rubber or vinyl) of upper and/or lower handles, for the purpose of providing a degree of grip during handle operation - being known in the art.

(B) Any forming or machining design (including knurling) of upper and/or lower handles, for the purpose of providing a degree grip during handle operation - being known in the art.

(C) Any material design of part fabrication (including high strength spring steel and/or chrome vanadium steel) - being known in the art.

(D) Any ergonomic design of upper and/or lower handles - being known in the art; and/or including an upper and/or lower handle design being elongated and/or widened to accommodate for a larger jaw capacity (particularly when such design incorporates in a workable relation - the toggle angle adjustment mechanisms as described herein).

(E) Any construction design of part fabrication utilizing the building up of parallel plates (secured together by rivets or by welding) forming jaw members and/or upper and/or lower handles - being known in the art.

(F) Any composite material design of upper and/or lower handles - being known in the art.

(G) any jaw design of fixed jaw members and slidable jaw members; including having flat surfaces (jaw members designed without teeth - contacting object or objects being clamped as taught by toggle wrench designs in the art), long nose - with or without wire cutter, curved jaw - with or without wire cutter, welding clamp, sheet metal, pinch-off, pipe clamp, needle nose, locking bar clamp - with or without swivel pads, "C" clamp - with or without swivel pads, bent long nose with or without wire cutter, and straight jaw - with wire cutter; being known in the art.

(H) Any design having an adjustment screw rotatable and mounted (but not threaded) in the rear housing (with the knurled knob (of the adjustment screw) located behind and out of the back of the rear housing) of an opposing handle - with a nut threaded onto the adjustment screw - with the nut and a toggle pin (attached to a toggle) secured by a slidable securing member - with the slidable securing member contained slidable in the rear housing - being known in the art.

(I) Any design having a handle with its curvature (constructed of a single arc (the single arc contacted by hand) curving away from the other opposing handle) extending the length of the handle - with a release lever contained in the curved rear housing of the handle - with the curvature of the release lever following the curvature of the handle - with the release lever being under spring tension - with the release lever having a toggle contact point between the roll pin handle attachment point of the release lever and end of the release lever - being known in the art.

(J) Any design with a shortened dimension (when compared to the toggle design depicted in FIG. 1A) measured from the toggle roll pin hole to the toggle end point (contained in the upper handle) - contacting the upper handle - resulting in a greater degree of upper handle rotation and slidable jaw memeber movement - being known in the art.

(K) Designing fixed jaw members and lower handles (when compared to the information depicted in the Drawing Figures) with rivet hole positions maximizing strength and operability - in relation to cost.

Figure 71:
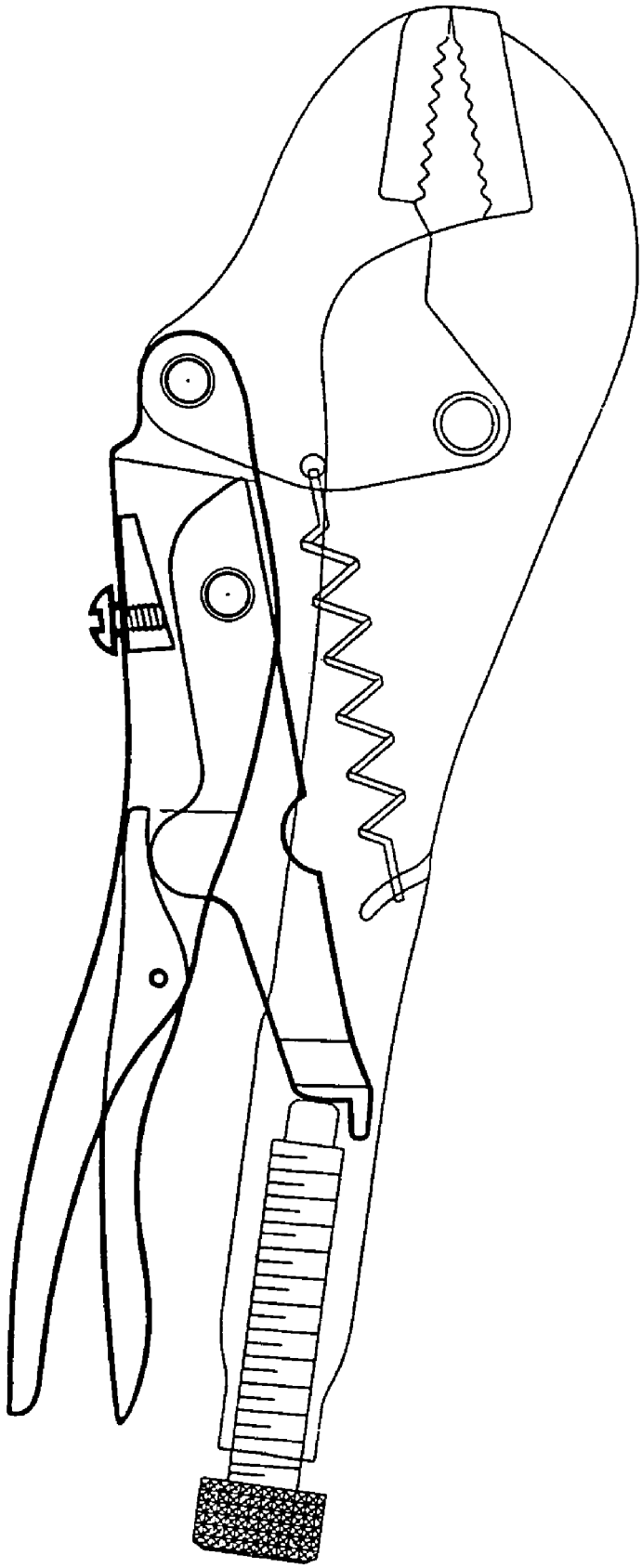
FIG. 71 - side view of pliers with economic handles incorporating the toggle angle adjustments mechanisms described herein.

(L) Any movable handle design known in the art, but more particularly (as illustrated by FIG. 71), incorporating the toggle angle adjustment mechanisms as described herein - with the toggle angle adjustment mechanisms being made workable by (i) having the movable handle curvature (finger or palm contact points) remain the same, (ii) having a slot means stamped/sheared out of the movable handle, and (iii) increasing the side view width dimension area of the movable handle - (the area being substantially around and/or between the rivet attachment points of the movable jaw and toggle to the movable handle) so as to provide a housing space for the securing of the toggle angle adjustment mechanisms.

(M) Designing an upper handle 40 (particularly - the middle section of upper handle 40) with a lesser height dimension (the lesser height dimension being known in the art) than the height dimension depicted in FIGS. 1–1A, and designing an upper handle 40 and a lower handle 24 with shortened length dimensions (the shortened length dimensions being known in the art) than the length dimensions depicted in FIGS. 1–1A (the height and length dimensions defined as looking from the top to bottom of FIGS. 1–1A - with fixed jaw member 10 to left, and adjustment screw 26 to the right).

(N) Designing contact edge 108 of slidable jaw member 12 with a rounded edge (or edges) to prevent or minimize contact edge 108 from marring the sliding surfaces of the support members of lower handle 24.

(O) Designing parts (fabrication and construction) with automated assembly processes (being known in the art) taken into consideration.

(P) Designing release lever 38 (to work with the above-described lesser height dimension of upper handle 40) with folded section 98 eliminated - resulting in a flat toggle contact point (being known in the art).

(Q) As taught by FIG. 163; all the fixed upper jaw members of *Figs*. 100, 101, 102, 103, 104, 105, 106, 107, 108, and 109 can each be engineered to substantially be accept between (in an opposing fixed upper jaw member parallel to slidable lower jaw member relation) the riveted section of support member 878, by being formed (by mechanism known in the art) to a substantially workable length and width dimension having rivet holes drilled through (or formed by mechanism known in the art) at locations aligning contiguously with locations of rivet holes 880 and 882 of the support member 878.

(R) As taught by FIG. 163; all the lower slidable jaw members of FIGS. 100, 101, 102, 103, 104, 105, 106, 107, 108, and 109 can each be engineered to substantially be accepted between (in an opposing upper fixed jaw member parallel to a lower slidable jaw member relation) slots 644 and 646 of support member 878, by being formed with an integral extension 884 (having rivet hole 886) and hook 888. It be understood, when compared to the location of the extension of the lower slidable jaw member of in FIG. 98, extension 652 is located on a side of slidable jaw member 648 parallelly opposing opposite to that of the location of the extension of the lower slidable jaw member shown in FIG. 98.

Figure 98:
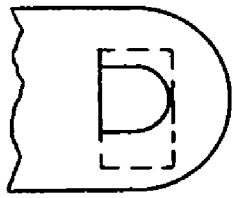
FIG. 98 - is a fragmented side view of a movable jaw member showing a hole able to accept flexible shaft.

(S) In consideration of the position of the integrally formed extension of the lower slidable jaw member of FIG. 98; extension 652 can be formed integrally to the lower slidable jaw member of FIG. 98 on a side that is parallelly opposing opposite to that of the side which the integrally formed extension of the lower slidable jaw member of FIG. 98 is located. Integral extension 884 (having rivet hole 886) is integrally formed to the semicircularly shaped outer dimension of the lower slidable jaw member of FIG. 98, having a substantially workable length and width dimension that is capable of sliding and locating between support member 878. It is understood, all the lower slidable jaw members of FIGS. 100, 101, 102, 103, 104, 105, 106, 107, 108, and 109 can each be integrally formed to accept the end of the lower slidable jaw member of FIG. 98 (represented by the jagged construction line), in a construction allowing for each of the lower slidable jaw members of FIGS. 100, 101, 102, 103, 104, 105, 106, 107, 108, and 109 to travel along (without binding) support member 878 in a workable relation.

(T) In consideration of the above-described location and construction of each of the lower slidable jaw members of FIGS. 100, 101, 102, 103, 104, 105, 106, 107, 108, and 109; it is understood that the lower slidable jaw members of FIGS. 100, 101, 102, 103, 104, 105, 106, 107, 108, and 109 can each be engineered with any pin or extension design (any pin or extension design slidable between the slots of each of the slotted sides of the support member designs known herein) known herein; and also understood is that the lower slidable jaw members of FIGS. 100, 101, 102, 103, 104, 105, 106, 107, 108, and 109 can each be engineered with any slidable plate design (the slidable plate design indicated by track assembly 752) being slidable and located on the outside of each of the support member designs known herein.

Figure 75:
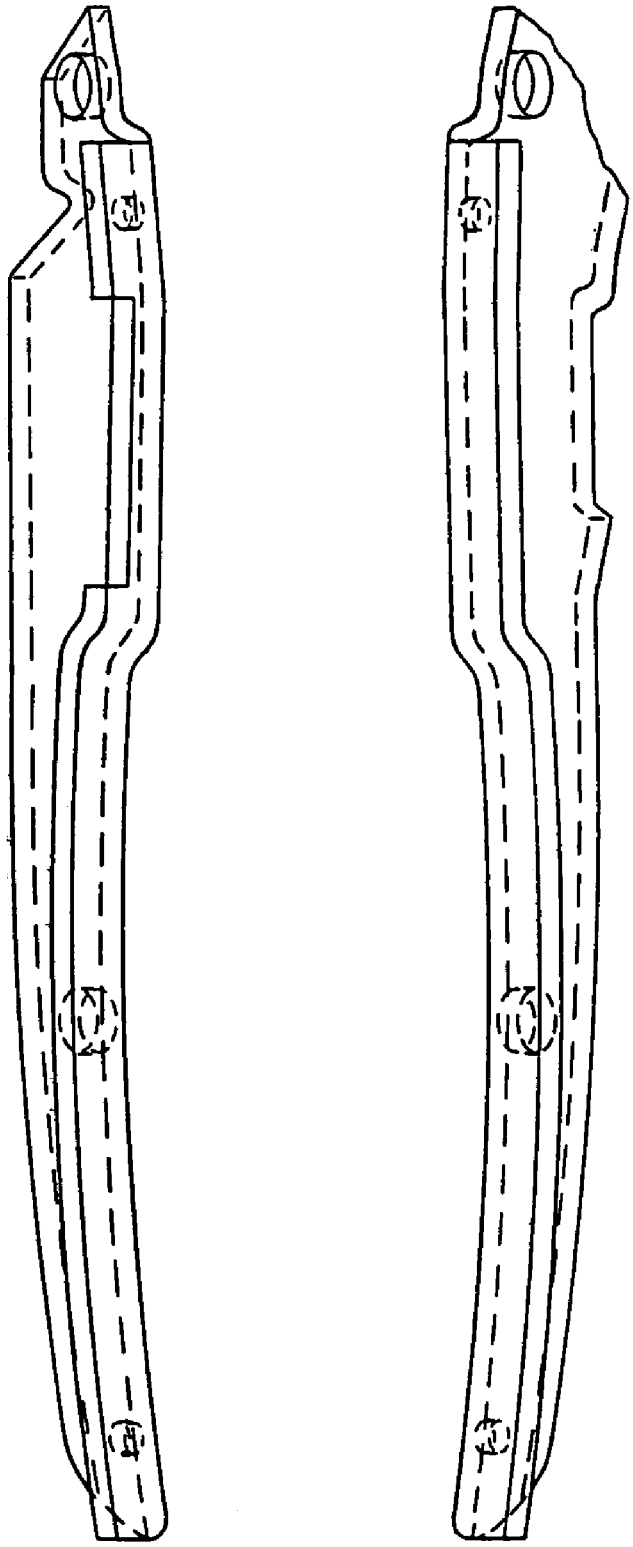
FIG. 75 - is an isometric view of a lower handle showing inner dimension capable of retaining internal mechanisms.
Figure 96:
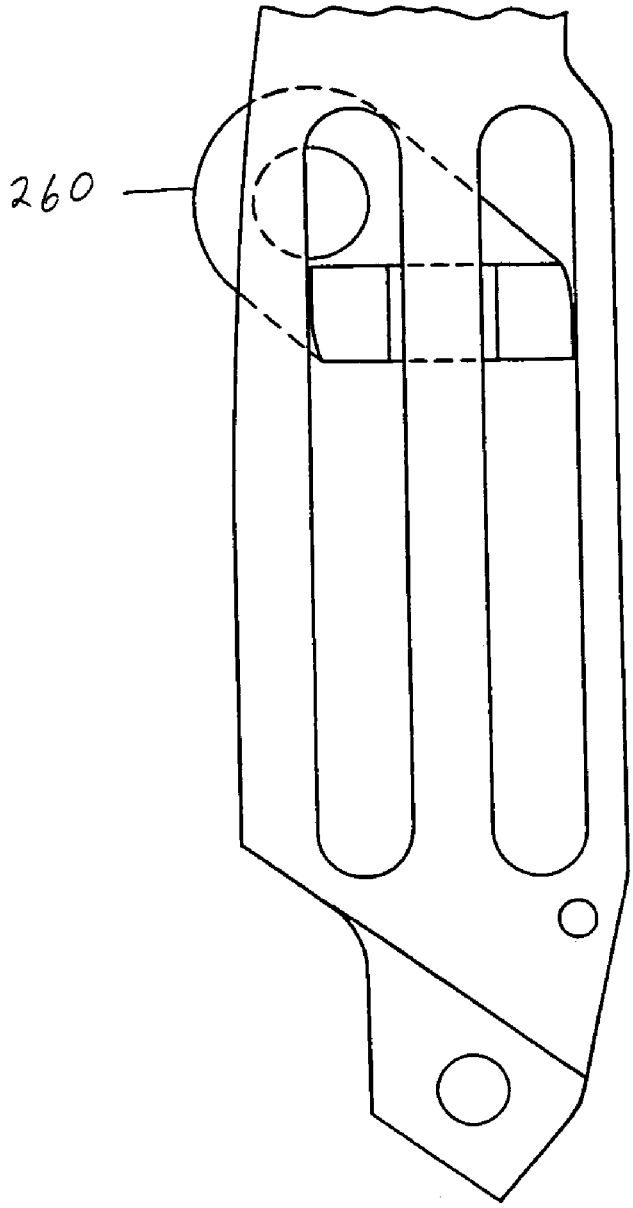
FIG. 96 - is an enlarged side view of a lower handle showing a clearance relationship between parallel slots and a locking crank.

Regarding FIG. 75; the slots of the slotted side wall section as depicted in FIG. 96 were purposely omitted to convey a better understanding of the general construction techniques as related to each handle side of lower handle 258.

(U) A first fixed upper jaw (indicated by fixed jaw member 250) having a first compression surface 898 on a rearward side thereof and disposed substantially in a first plane 892 and having a terminal end 890; and a support member (indicated by slotted support member 254) having a middle section 894 with accurate guide surfaces along an inner surface dimension of a side height section 896 of the middle section 894, the middle section 894 of the support member extending substantially at a right angle to and rearward from the first compression surface 898; and a first fixed lower handle (indicated by lower handle 258) extending rearward in a direction at an obtuse angle from a length dimension (when the length dimension is measured from a side view of the support member) of the support member, the support member integrally interconnecting an inner end section 900 rearward of the first fixed upper jaw - to a first curved forward section 902 of a closed sidewall end 904 of the first fixed lower handle, the first fixed lower handle having a second curved forward section 906 of a slotted sidewall 908 opposingly spaced parallelly apart from and opposite to the first curved forward section 902 of the closed sidewall end 904 ofsaid the first fixed lower handle; and a first track system 910 formed internally to the first fixed lower handle, consisting of a forward curved void between the first curved forward section 902 and the second curved forward section 906 of the first fixed lower handle, the first track system 910 having spaced right, left and bottom forward track sections mounted inwardly on a bottom sidewall 912 and on the slotted sidewall 908 and on the closed sidewall end 904 respectively and elongated horizontally in a plane along a side length dimension (when the length dimension is measured from a side view of the first fixed lower handle) of the first fixed lower handle; the first curved forward section 902 and the second curved forward section 906 being formed by curving inwardly towards the support member; and a second slidable lower jaw (indicated by movable jaw member 252) having a second compression surface 914 disposed substantially in a second plane 916 parallel to the first plane 892, the jaws members 250 and 252 having forwardly extending pressure surfaces, the second slidable lower jaw having a track follower assembly mechanism 918 thereon cooperatively correlated with the support member by internally contacting the inner surface dimension of side height section 896, and secured to the support member in a manner permitting the second slidable lower jaw to slide along the side height section 896 towards or away from the first fixed upper first jaw, while the second compression surface 914 is always maintained in substantial parallelism with the first compression surface 898; and second movable upper handle extending rearward away from the inner end section 900, second movable upper handle having a forward surface end 920 slidable and positioned by contacting the support member on an outer surface dimension of the side height section 896, the second movable upper handle having a first pivotal mechanism (indicated by flexible shafted 284) attaching the second movable upper handle to the second slidable lower jaw, in a manner for the pivoting of the second movable upper handle with a decreasing angle towards the bottom side wall 912 of the first handle and at times with an angle away from the bottom side wall 912 of the first handle; and a second track system 922 mounted internally to the second movable upper handle and having spaced right, left and top sections mounted on a first top right side wall 924, and on a second top left side wall 926, and a on first top side wall 928, and on a second top side wall 934, the second track system 922 having first carrier mechanism 930 and second carrier mechanism 932 located substantially perpendicular to the side width dimensions (the side width dimensions measured from a side view of the second movable upper handle) of the top right side wall 924 and the top left side wall 926; and threaded assembly 936 mounted on and between the carrier mechanisms 930 and 932, the threaded assembly 936 having a manually rotatable knob (indicated by adjustable knob 278) rotatable and moving screw adjustment portion (indicated by threaded member 280) fore and aft along the second track system 922, the screw adjustment portion connected rotatable to a slotted second movable upper handle positioning mechanism (indicated by adjustment member 272), the second movable upper handle positioning mechanism slidable and mounted in the second track system 922; and toggle mechanism (indicated by toggle locking member 268) movably mounted in the first track system 910 and rigidly guided by sliding and contacting the support member, the toggle mechanism pivotally attached to the second movable upper handle by a second pivotal mechanism (indicated by stepped shaft 270); and toggle stop 938 integrally attached to the toggle mechanism and urged (by spring internal spring 266) contacting adjustment member 272, the adjustment member 272 slidable and mounted in the first track system 922 by being slidable and contacting cooperative to a mountable slotted sidewall (indicated by curved slot spacing plate 274); and a pivot lever (indicated by adjustable lever 262) internally rotatable and mounted in the first track system 910, the pivot lever slidable and contacting an inner side width dimension of the top left side wall 926, the pivot lever slidable and pivotally attached to the second track system 922 by a forth pivotal mechanism (indicated by tension pin 302), the forth pivotal mechanism guidable in the second track system 922 by sliding and contacting and rotating in adjustment member 272 and curved slot spacing plate 274; and a first resilient mechanism (indicated by internal spring 266) internally secured in the second movable upper handle by a first rigid mechanism (indicated by rivet 940) and by first top side wall, the first resilient mechanism urging toggle mechanism at a decreasing angle towards the bottom side wall 912 of the first fixed lower handle; and a second resilient mechanism (indicated by internal spring 264) internally secured to the second movable upper handle by a fifth pivotal mechanism (indicated by rivet 288), the second resilient mechanism urging the pivot lever to rotate the forward surface end of the second movable handle towards the curved forward void of the first fixed lower handle; and a release lever (indicated by lock release lever 282) rotatable and mounted in the second movable handle and pivotally attached to the second movable upper handle by the fifth pivotal mechanism, the second resilient mechanism urging the release lever rotating towards first top side wall and second top side wall, the release lever is rotatable and contacted to toggle lock member 268 by manually depressing and substantially rotating the second movable upper handle to a locked position, the locked position of the second movable upper handle is unlocked by manually depressing and substantially rotating the release lever in a direction away from the first top side wall and second top side wall; and a locking crank 260 is released from first slot 942 and second slot 944 of slotted side wall end 908 by substantially rotating the release lever in a direction away from the first top side wall and second top side wall, the pivot lever is rotated and slid off pivoting plate 276 during depressing and substantially rotating the second movable upper handle to a locked position, and the handles are secured together by rivets 290, 292, 300, 298, 294, 296, 940, 288, and flexible shaft 284.

Figure 168A:
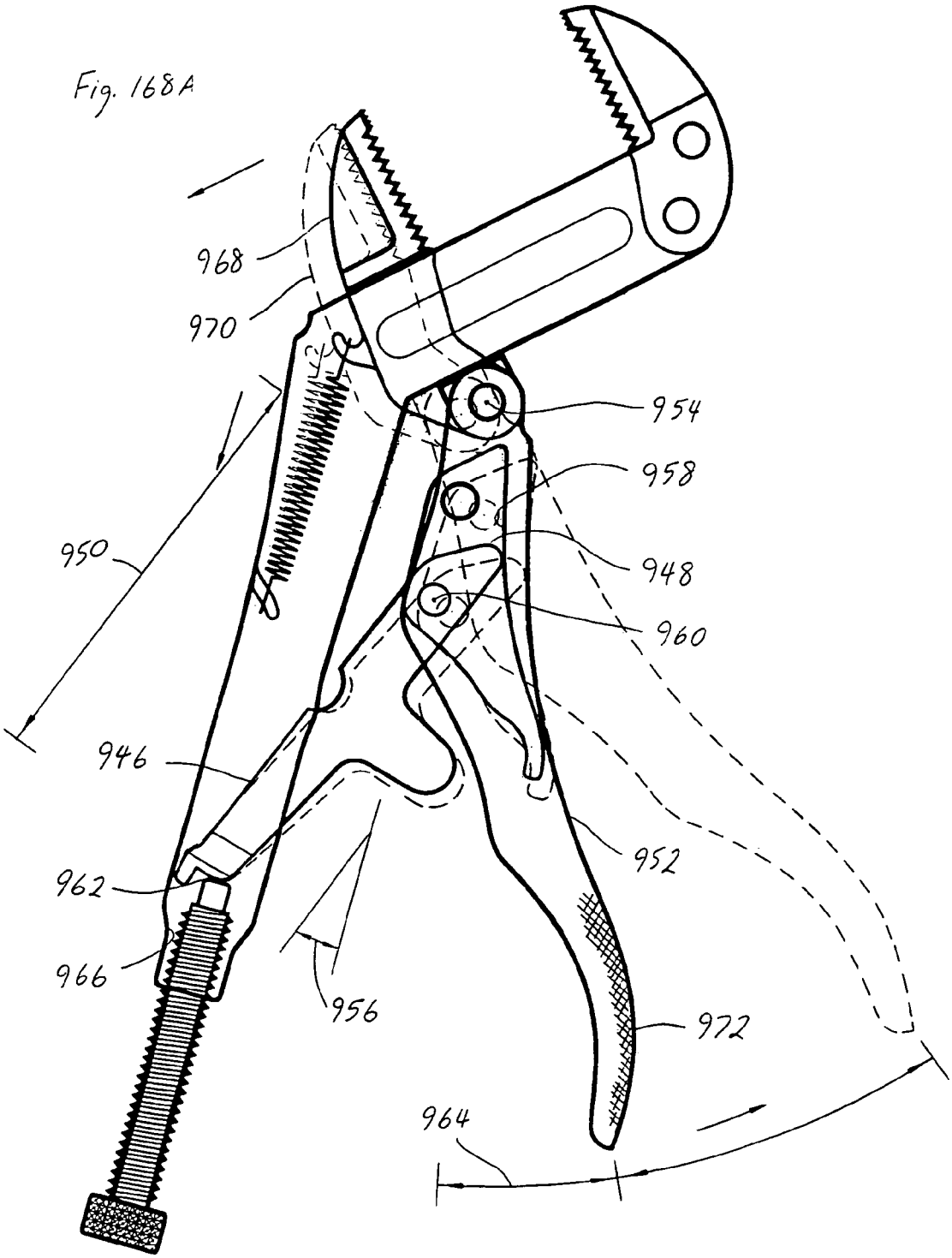

(V) Toggle 946 of FIG. 168A is constructed with a side length dimension 950. Side length dimension 950 allows for the travel of movable upper handle 952 about forward axis 954 with a measured angle indicated by degree of rotation 956. The measured angle of the degree of rotation 956 is measured from axis 954 through axis 960 and axis 962. The angle measurement of the degree of rotation 956 is same as the angle measurement of the degree of rotation of movable upper handle 764 of FIG. 168. (the angle measurement of the degree of rotation of movable upper handle 764 of FIG. 168 is measured with the same techniques as depicted in FIG. 168A).

Toggle tip 948 is constructed with a shortened length dimension; when the length dimension of toggle tip 948 is compared to the length dimension of toggle tip 864 of FIG. 168. Toggle tip 948 contacts an inner housing 958 as movable upper handle 952 is substantially rotated through a full range of motion as measured between the lines indicated by entire degree of rotation 964. Phantom lines as depicted on movable upper handle 952 and toggle 946 indicate the direction motion during toggle tip 948 contacting inner housing 958. Entire degree of rotation is measured from axis 954 through axis 960 and axis 962. It is understood movable upper handle 952 is rotatable in a direction opposite to that direction indicated by the phantom lines depicted on movable upper handle 952 and toggle 946.

Movable upper handle 952 has a roughened hand grip surface indicated by palm rest surface 972. Palm rest surface 972 offers a greater degree of hand grip when compared to all movable upper handles designs designed (and as related to the drawing FIGS. herein) with smoother hand grip surfaces.

It is understood movable upper 952 is constructible without the roughened hand grip surface indicated by palm rest surface 972. All the remaining substantially comparable mechanisms of FIG. 168A to FIG. 168 are assembled with the construction techniques as taught herein by the above-described construction techniques of all of the substantially comparable mechanisms of FIG. 168 to FIG. 168A.

(W) It is understood all fixed lower handle designs and/or all movable upper handle designs depicted herein can be designed having a roughened hand grip surface similar to palm rest surface 972. All fixed lower handle designs and/or all movable upper handle designs depicted herein can be modified with a roughened hand grip surface by a sand blasting process (or by mechanism known in the art) producing a substantially granular hand grip surface.

(X) All the mechanisms herein are designed with the understanding that the function, fabrication, construction, and operation described herein take into account substantially all materials known in the art, being commonly used in the manufacture of hand tools of similar design and function to the invention (herein as the Invention) as described herein. However, it is understood that the mechanisms described herein are designed substantially employing (but not limited to) alloy spring and tool steels of substantially workable hardness range or ranges (an example being, but not limited to, chrome-vanadium). The function, fabrication, construction, and operation described herein, together with the characteristics of the steel employed, substantially imparts the desired workable relation to the mechanisms of the Invention as described herein. Therefore, all the mechanisms herein are designed with the understanding that the function, fabrication, construction, and operation described herein take into account substantially any chromium plating process (or any coating or plating processes) utilizing corrosion resistant material or materials known in the art, being commonly used in the manufacture of hand tools of similar design and function to the invention herein as the Invention) as described herein. Therefore, substantially all the mechanisms herein susceptible to corrosion are substantially coated with corrosion resistant material or materials known in the art (examples being, but not limited to, oil (oil also used to lubricate moving parts of the Invention) copper-base alloys, zinc phosphate, black oxide coatings by immersion in sodium hydroxide and mixtures of nitrates and nitrites).

It is understood (A), (B), (C), (D), (B), (F), (G), (H), (I), (J), (K), (L), (NI), (N), (0), (P), (Q), (R), (S), (T), (U), (V), (W), (X),(Y), and (Z) substantially apply to the Invention in a substantially workable relation.

(Y) It is also understood that the Invention is made constructible by engineering FIG. 186 with an upper handle 1040 modified to accept a slidable plate arrangement of the type as taught by FIG. 170 - in combination with a support member configuration as taught and utilized in FIG. 170.

(Z) It is also understood that the Invention is made constructible by engineering any substantially substitutable rotatable plate arrangement for any other substantially substitutable slidable plate arrangement as taught by the upper handle configurations herein.

Figure 72:
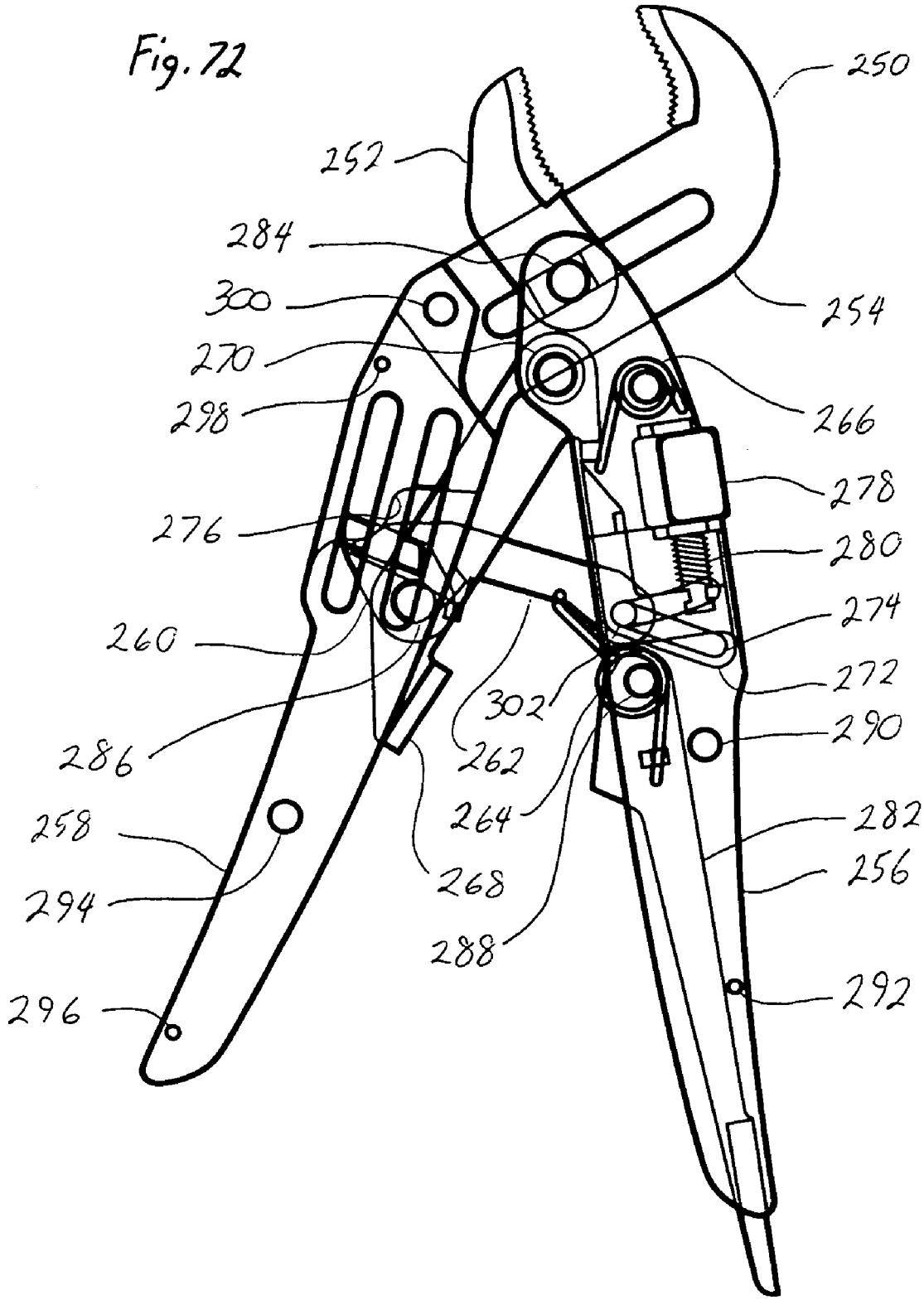
FIG. 72 - side view showing overall dimension of mechanisms in working relationship with hidden mechanisms represented by thinner continuous lines. Some details not shown in FIG. 72 for purposes of clarity.

FIG. 72 is a general construction showing the working relationship of mechanisms.

Figure 73:
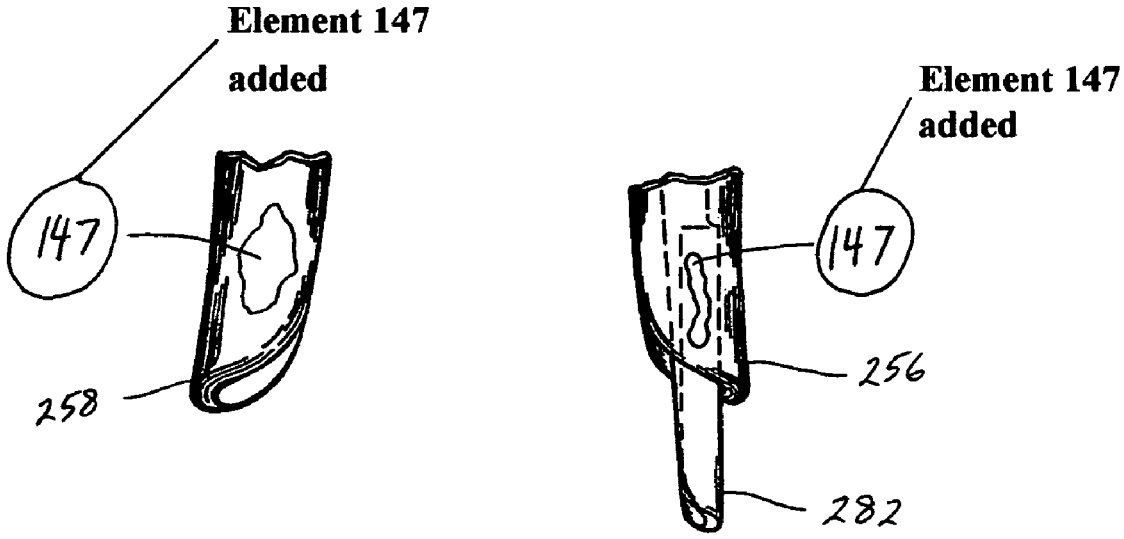
FIG. 73 - is a perspective view showing upper and lower handles of ergonomic design.

FIG. 73 is an ergonomic design of handles 256, 258 for the purpose of comfort. Lock release lever 282 is shown as having a rounded section.

Figure 74:
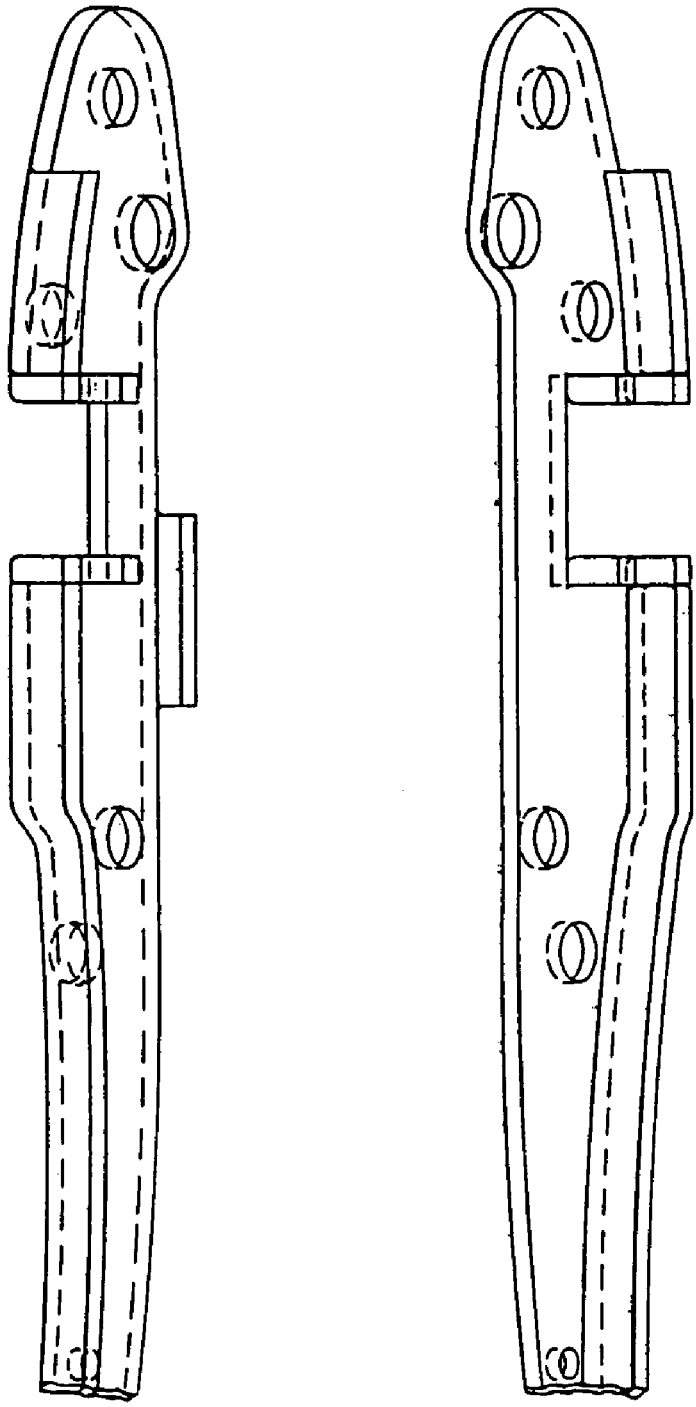
FIG. 74 - is an isometric view of an upper handle showing inner dimension capable of retaining internal mechanisms.

FIG. 74 is a construction of an upper handle being formed through a stamping/pressing process to provide an economic mechanism of manufacture.

FIG. 75 is a construction of a lower handle being formed through a stamping/pressing process to provide an economic mechanism of manufacture.

Figure 76:
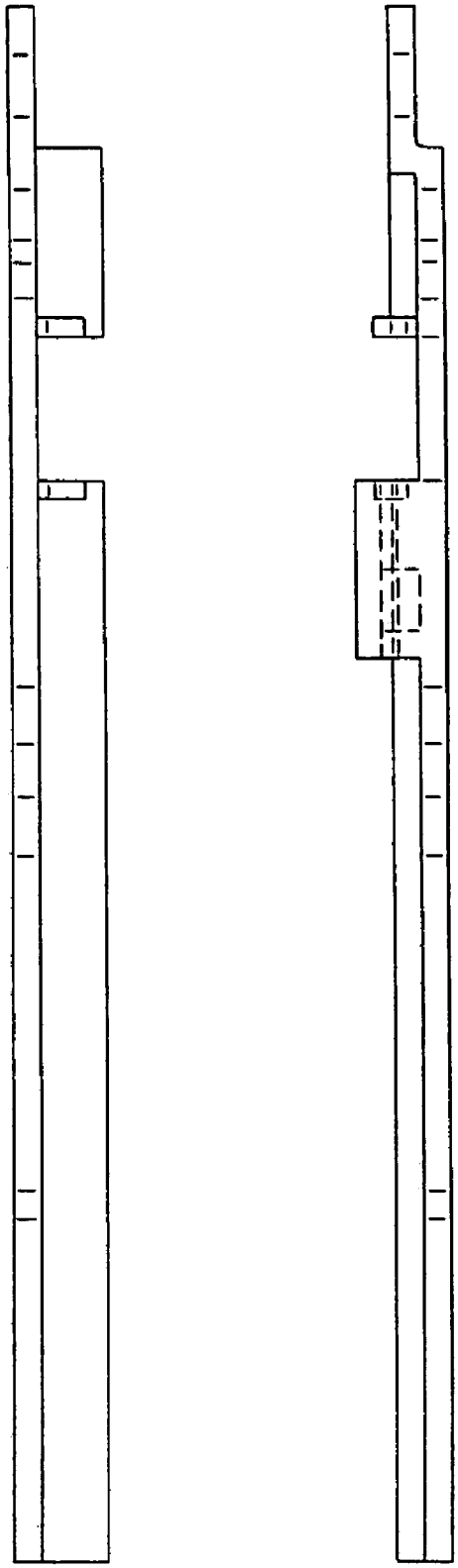
FIG. 76 - is a bottom view of an upper handle in constructible relation.

FIG. 76 is a construction of an upper handle being formed through a forging/machining process to provide a degree of strength.

Figure 77:
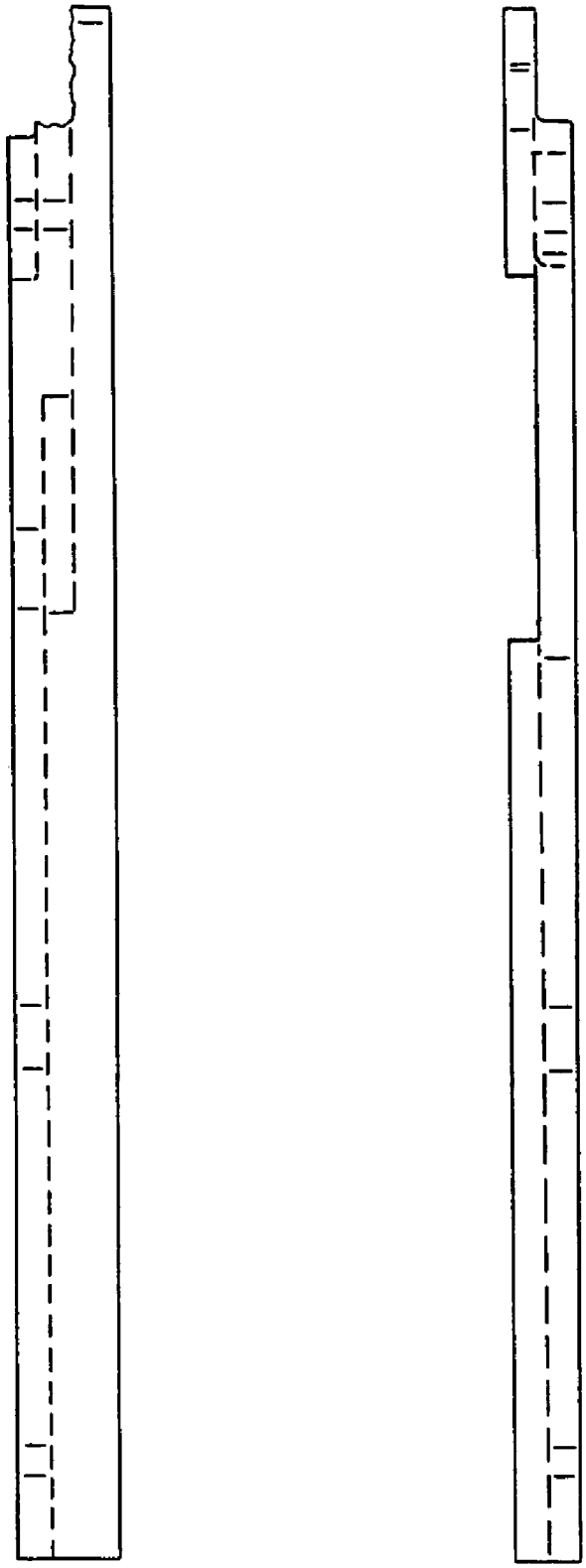
FIG. 77 - is a bottom view of a lower handle in constructible relation.

FIG. 77 is a construction of a lower handle being formed through a forging/machining process to provide a degree of strength and lower handle has a slotted section for the ejection of foreign matter.

Figure 78:
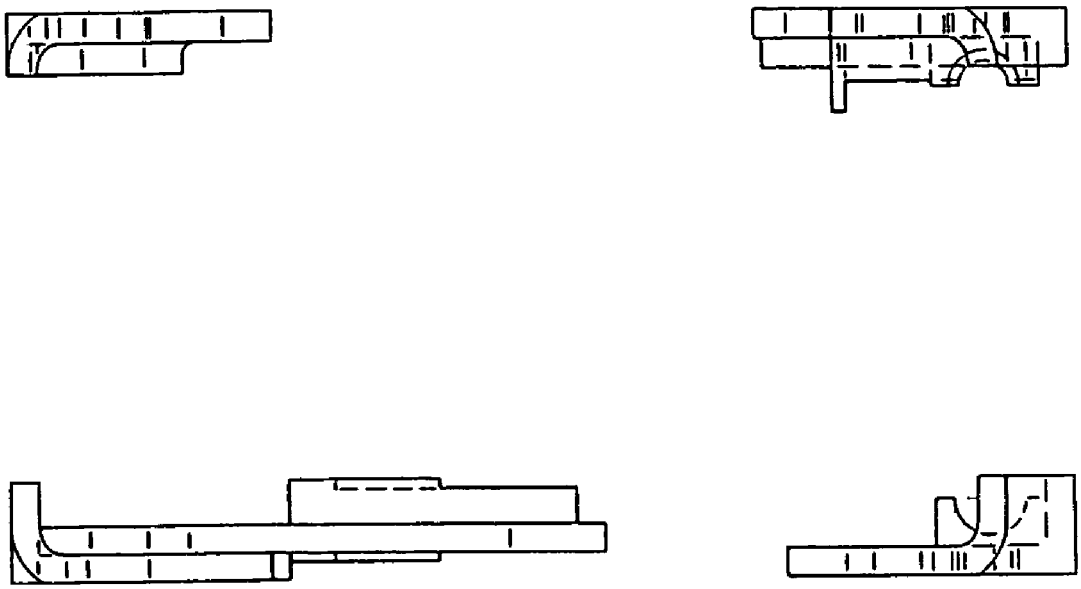
FIG. 78 - is a rear view of upper and lower handles in constructible relation.

FIG. 78 shows upper and lower handles being of a constructible width offering a degree of manipulation.

Figure 79:
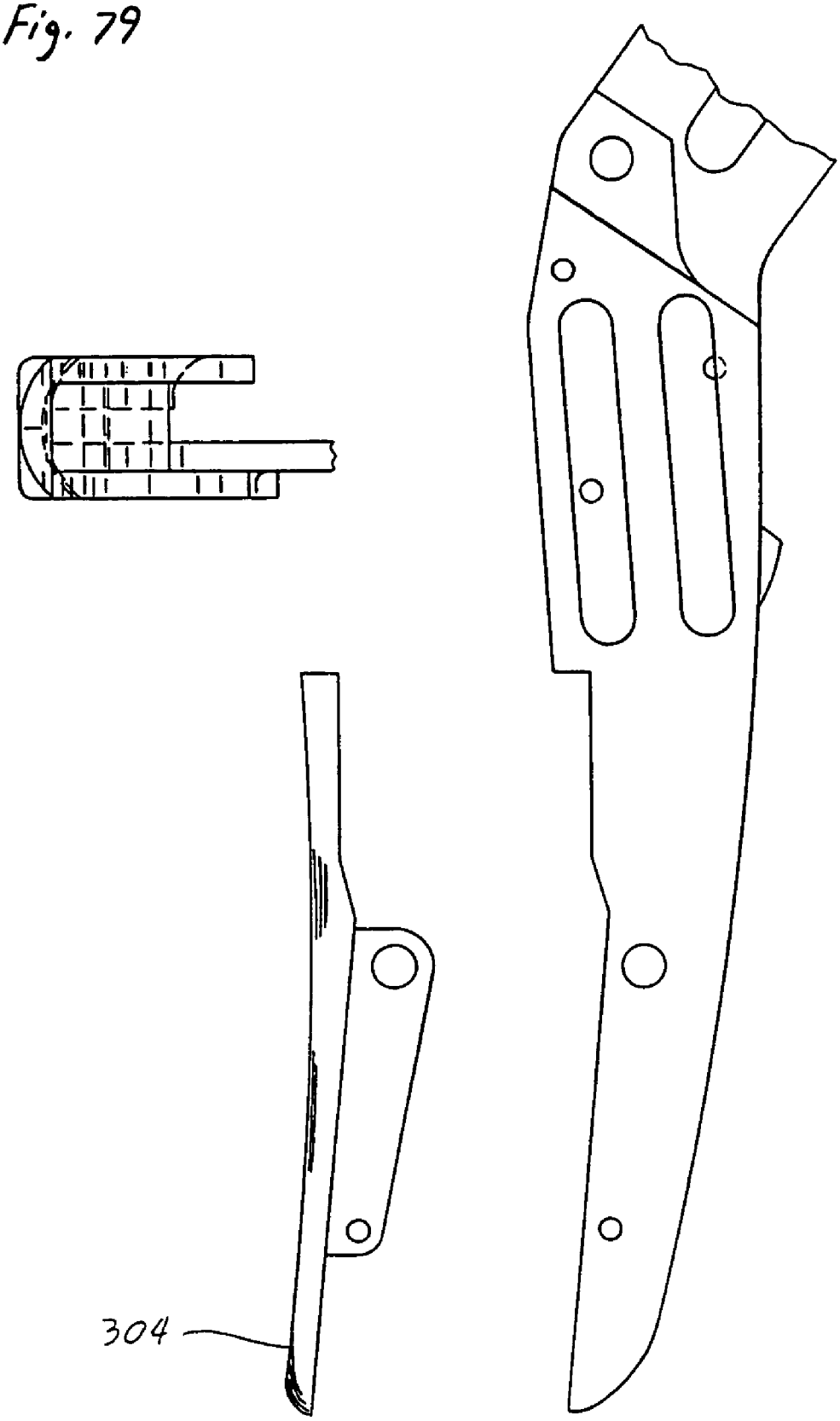
FIG. 79 - is a side and rear view of a lower handle being alternate in design having an attachable spacing member being of ergonomic design.

FIG. 79 is an ergonomic spacing member 304 attachable to a lower handle by rivets to provide an economic mechanism of manufacture.

Figure 80:
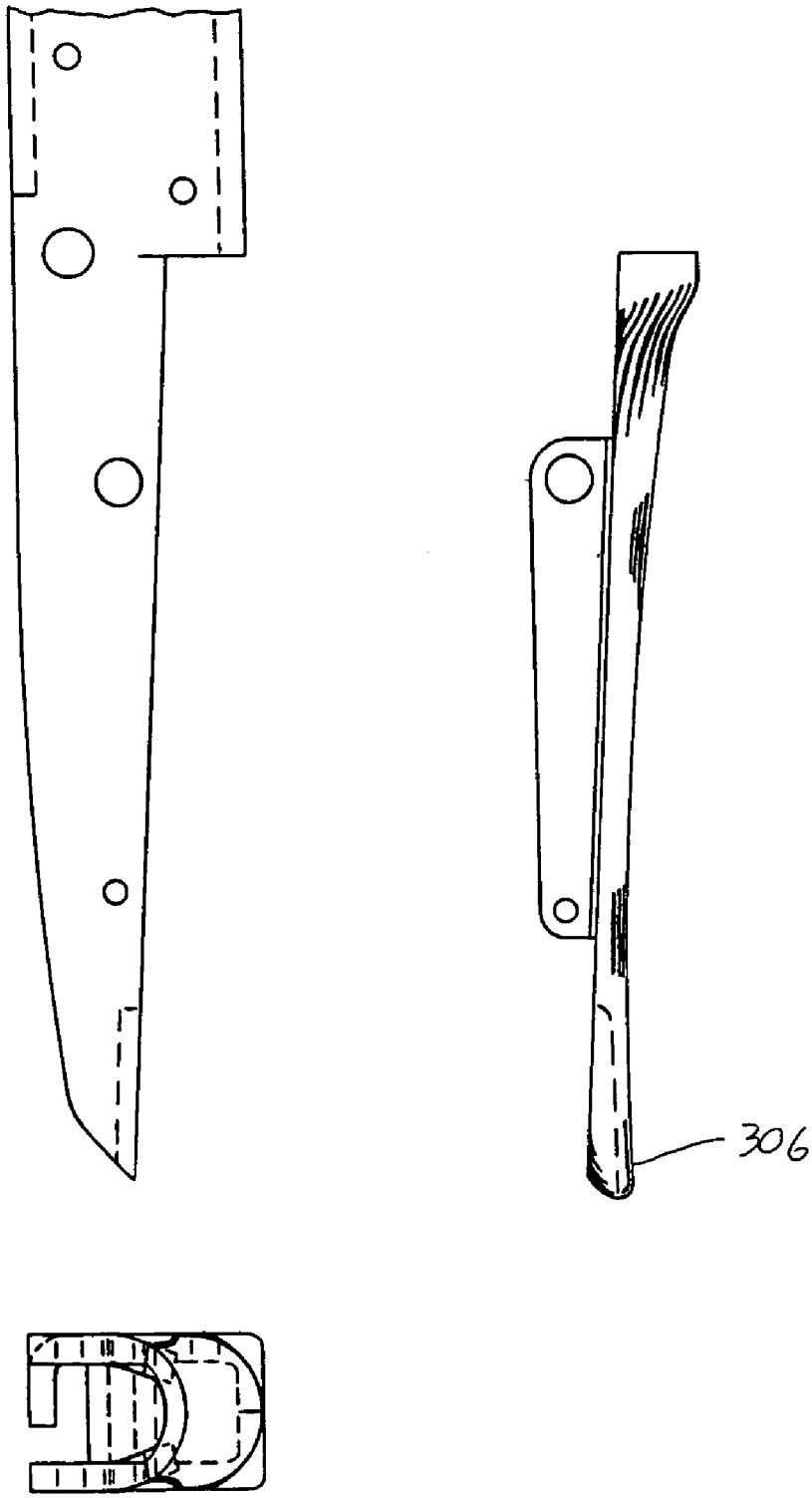
FIG. 80 - is a side and rear view of an upper handle being alternate in design having an attachable spacing member of ergonomic design.

FIG. 80 is an ergonomic spacing member 306 attachable to an upper handle by rivets to provide an economic mechanism of manufacture.

Figure 81:
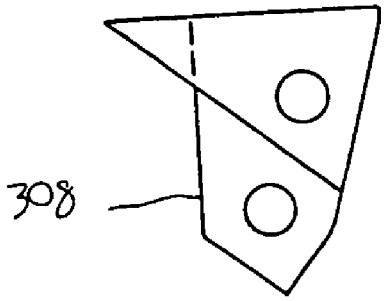
FIG. 81 - is a side, bottom, and rear view of a lower handle being alternate in design having an attachable retaining member in side and bottom view.
Figure 81:
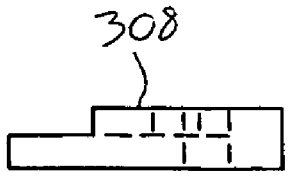
Figure 81:
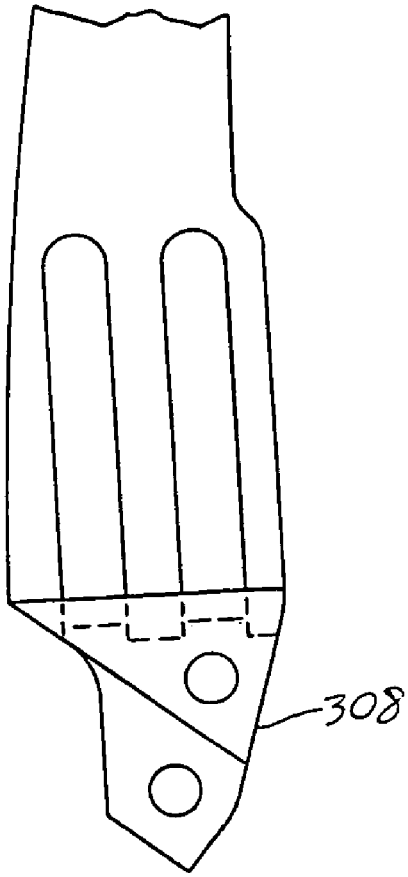
Figure 81:
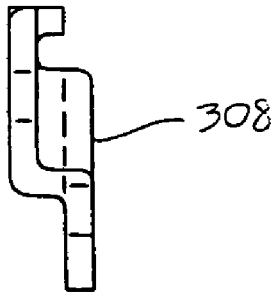

FIG. 81 is an alternate design of a lower handle to provide an attachment mechanism for slotted locking crank 310. Retaining member 308 attachable by rivets to a lower handle. Retaining member 308 is formed through a stamping/pressing process to provide an economic mechanism of manufacture.

Figure 82:
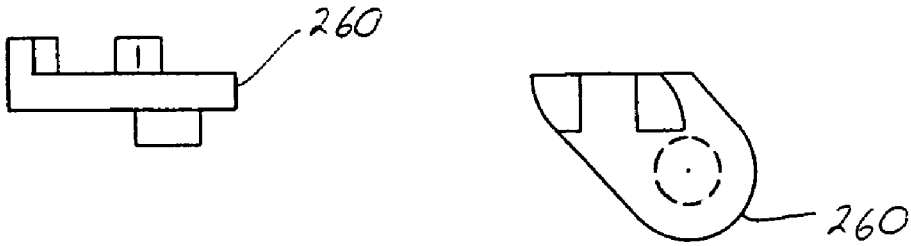
FIG. 82 - is a side and rear view of a slidable locking crank contiguous in relation to a lower handle.

FIG. 82 is locking crank 260 formed through a forging/machining process to provide a degree of ease in assembly.

Figure 83:
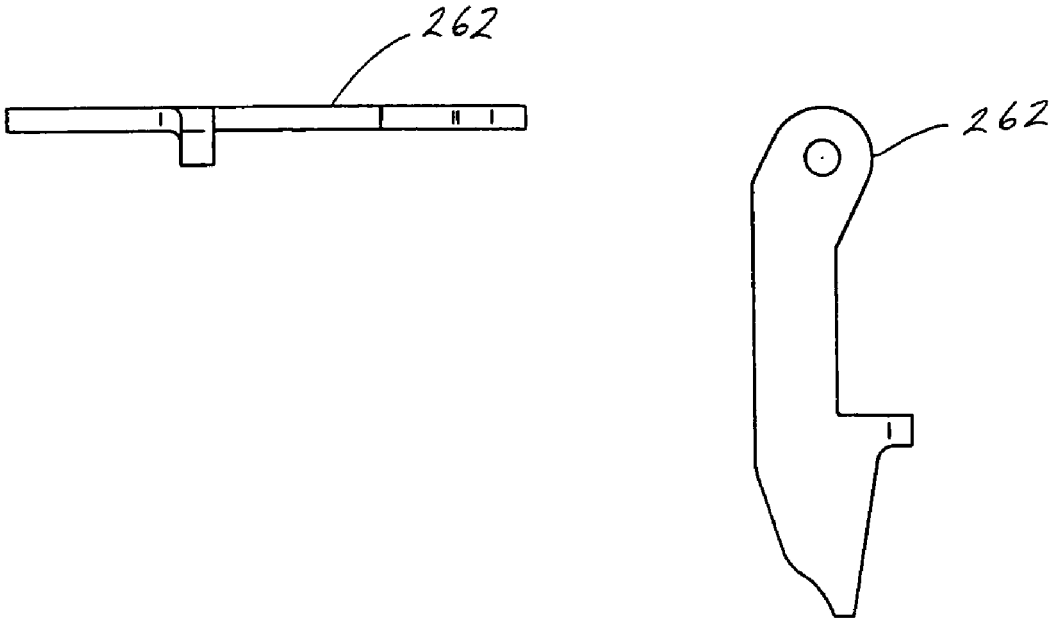
FIG. 83 - is a side and rear view of an adjustable lever having circular rotation in a lower handle and attachable to an upper handle.
Figure 82A:
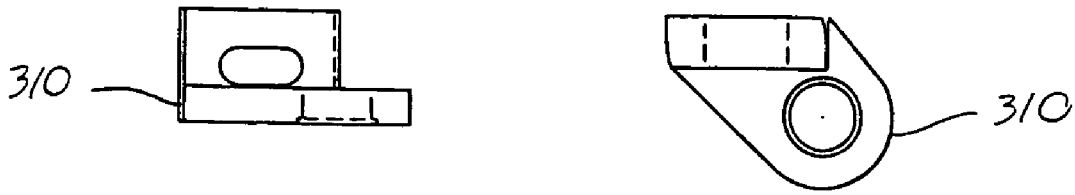
FIG. 82A - is a side and rear view of a slidable locking crank having a hole being alternate in design, being contiguous in relation to a lower handle.

FIG. 83 is adjustable lever 262 formed through a stamping/pressing process to provide an economic mechanism of manufacture.

FIG. 83A is locking crank 310 formed through a stamping/pressing process to provide a degree of strength which also provides an economic mechanism of manufacture.

Figure 84:
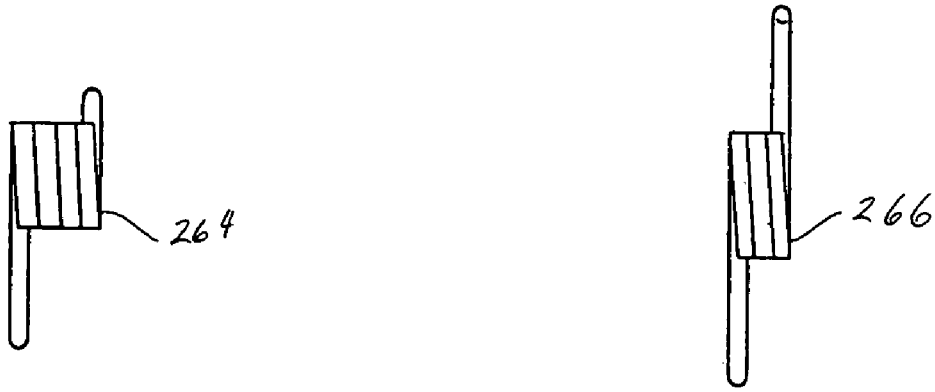
FIG. 84 - is a side view of internal springs attachable to an upper handle.

FIG. 84 shows internal springs 264 and 266 being of a width and shape to provide a degree of ease in assembly.

Figure 85:
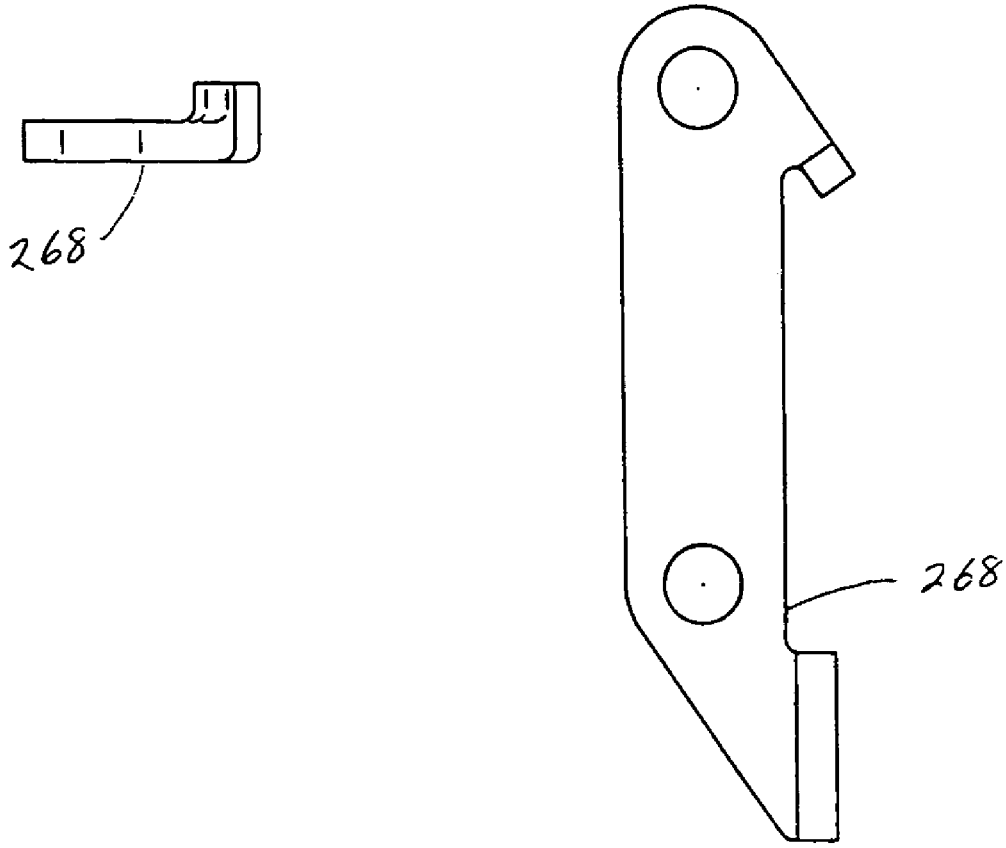
FIG. 85 - is a side and rear view of a toggle lock member attachable to an upper handle, and pivotally slidable and attachable to a lower handle.

FIG. 85 is toggle lock lever 268 formed through a stamping/pressing process to provide an economic mechanism of manufacture.

Figure 86:
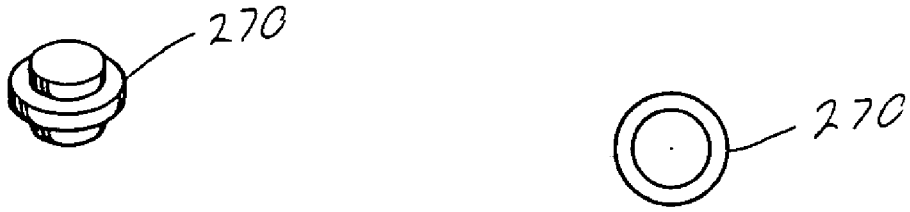
FIG. 86 - is an isometric and side view of a rotatable stepped shaft attachable to an upper handle and toggle lock member.

FIG. 86 is stepped shaft 270 attachable to an upper handle to provide an attachable spacing for toggle lock lever 268.

Figure 87:
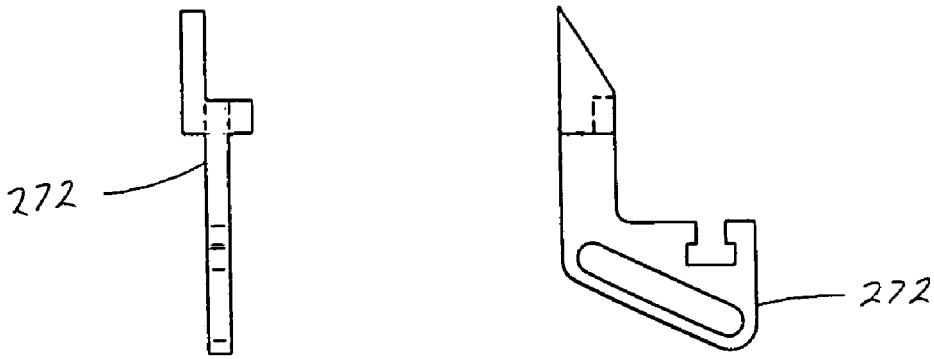
FIG. 87 - is a top and side view of a slidable adjustment member internally mountable in an upper handle.

FIG. 87 is adjustment member 272 formed through a forging/machining process to provide a degree of strength.

Figure 87A:
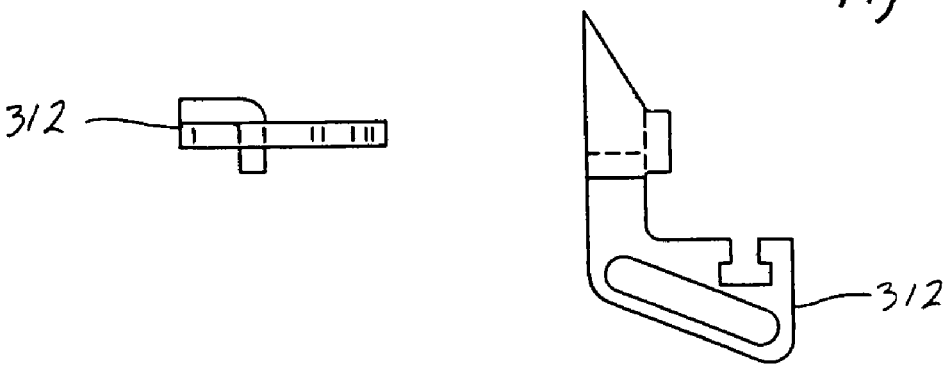
FIG. 87A - is a side and rear view of a slidable adjustment member being alternate in design, internally mountable in an upper handle.

FIG. 87A is adjustable member 312 formed through a stamping/pressing process to provide an economic mechanism of manufacture.

Figure 88:
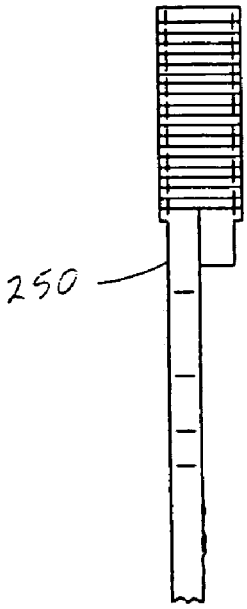
FIG. 88 - is a bottom view of a fixed jaw member being integral to a portion of a lower handle.

FIG. 88 is fixed jaw member 250 formed integral to a portion of a lower handle through a forging/machining process to provide a degree of strength.

Figure 89:
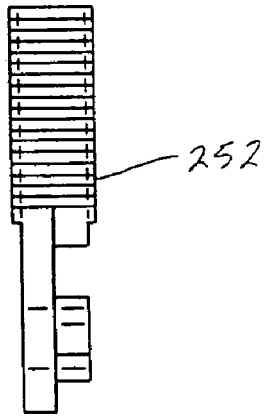
FIG. 89 - is a top view of a movable jaw member being attachable to a slotted support member.

FIG. 89 is movable jaw member 252 formed through a forging/machining process to provide a degree of strength.

Figure 90:
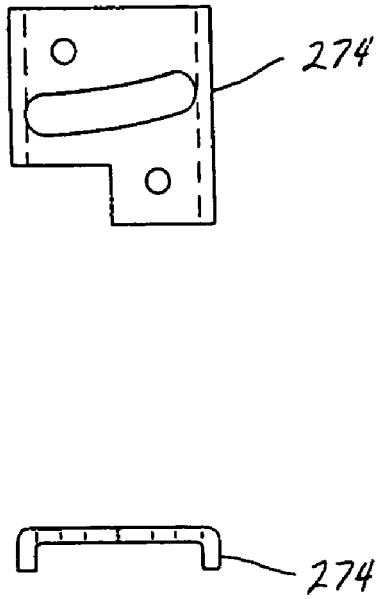
FIG. 90 - is a side and rear view of a curved slot spacing plate internally attachable by riveting to an upper handle.

FIG. 90 is curved slot spacing plate 274 formed through a stamping/pressing process, being attachable to an upper handle by riveting, to provide an economic mechanism of manufacture.

Figure 91:
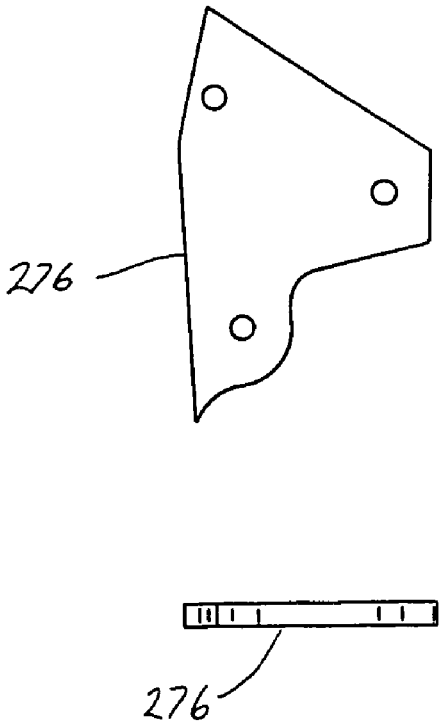
FIG. 91 - is a side and front view of a pivoting plate internally attachable by riveting to a lower handle.

FIG. 91 is pivoting plate 276 formed through a stamping process, being attachable to a lower handle by riveting, to provide an economic mechanism of manufacture.

FIG. 92 is adjustable knob 278 having a knurled surface to provide a degree of grip.

FIG. 93 is threaded member 280 being attachable to adjustable knob 278 and adjustment member 272.

Figure 94:
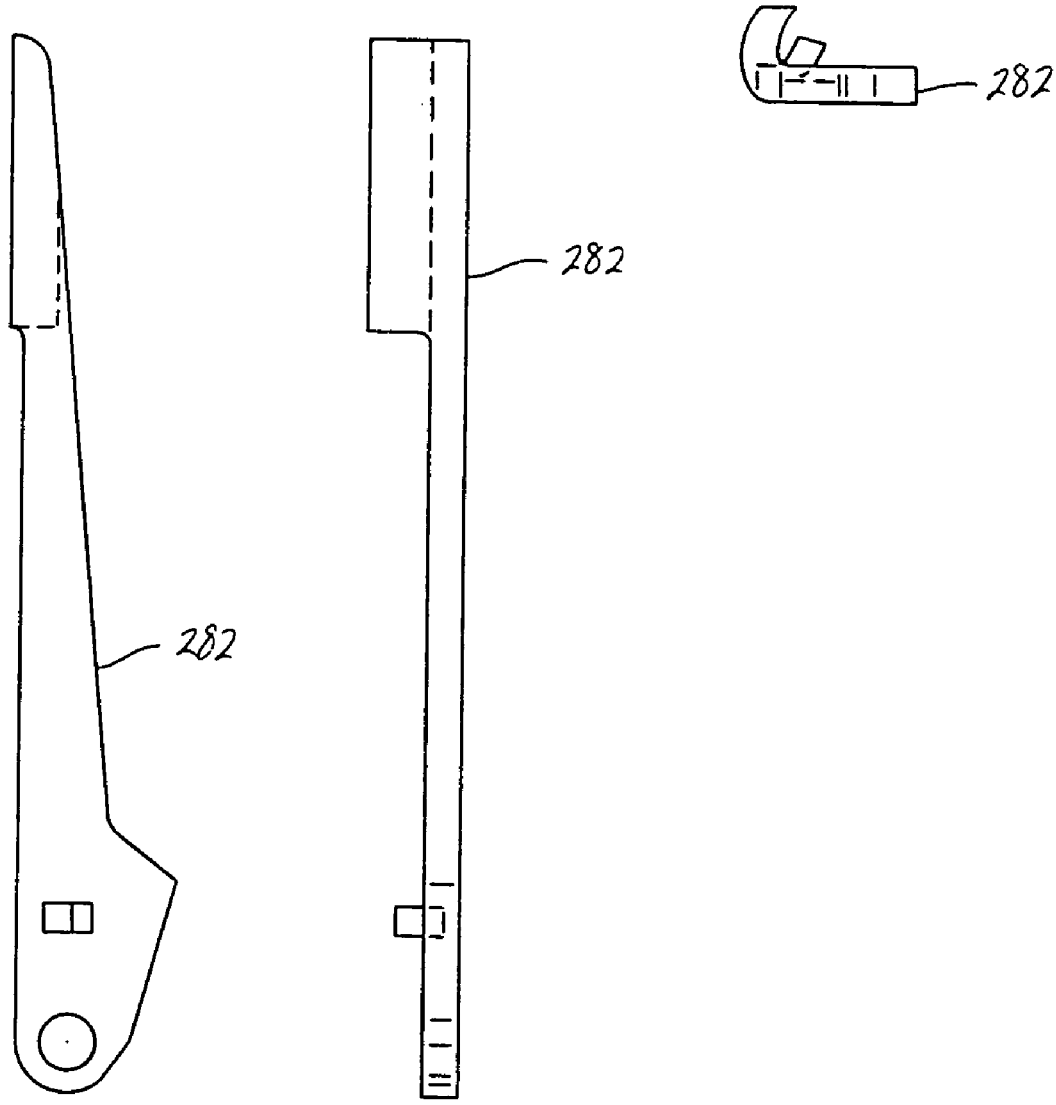
FIG. 94 - is a side, top, and rear view of a lock release lever attachable to an upper handle.

FIG. 94 is lock release lever 282 formed through a stamping/pressing process to provide an economic mechanism of manufacture. Lock release lever 282 is of a width being internal to an upper handle.

Figure 94A:
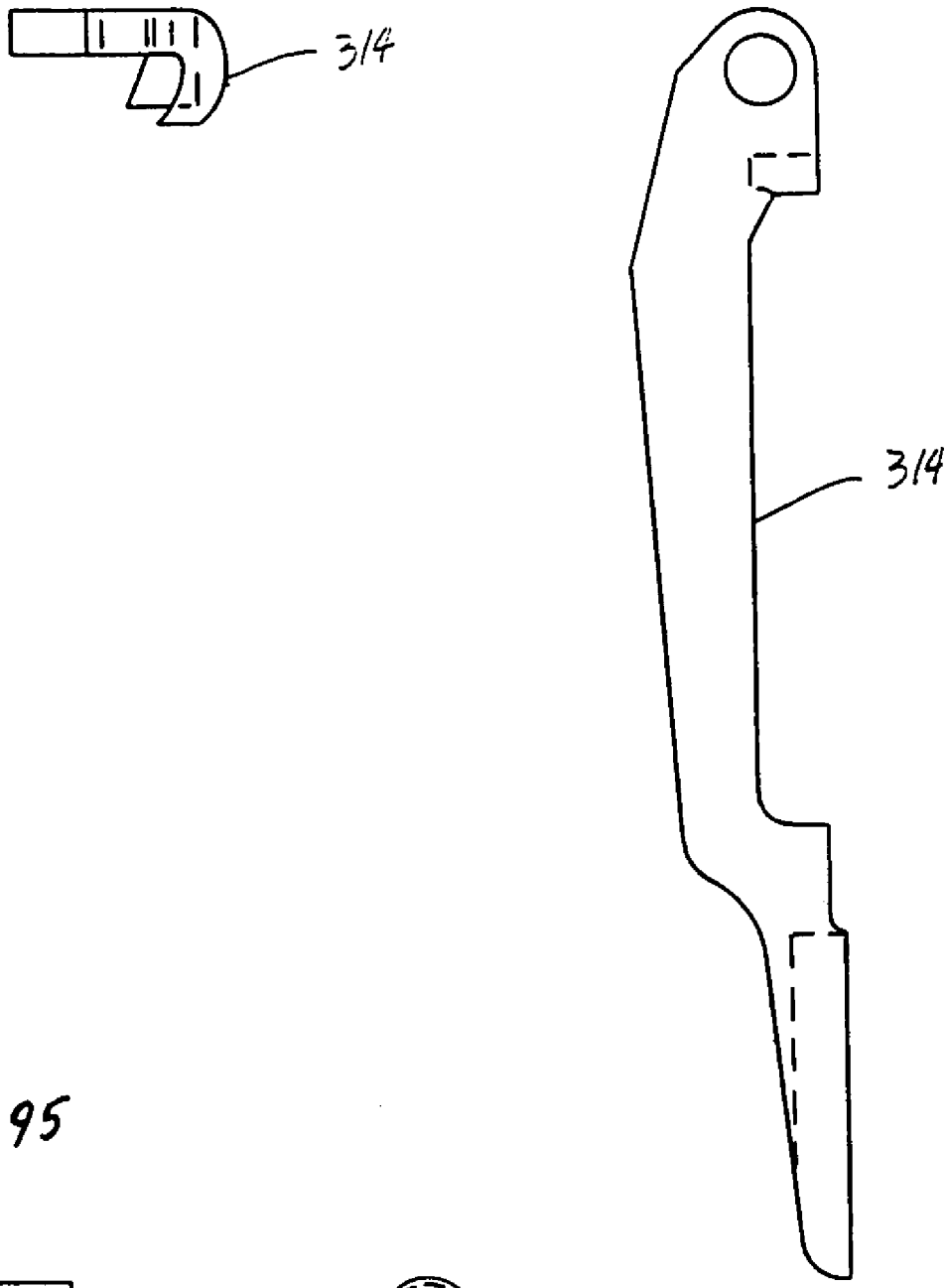
FIG. 94A - is a rear and side view of a lock release lever being of alternate design attachable to an upper handle.

FIG. 94A is lock release lever 314 formed through a stamping/pressing process to provide an economic mechanism of manufacture. Lock release lever 314 functioning in conjunction with spacing member 306.

Figure 95:
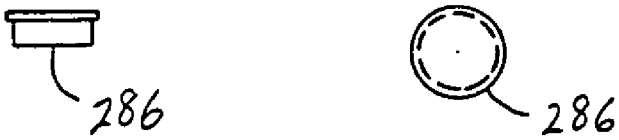
FIG. 95 - is a rear and side view of a flanged shaft attachable to locking crank of alternate design.

FIG. 95 is flanged shaft 286 attachable to locking crank 310.

FIG. 96 shows locking crank 260 being in a slidable relation to a lower handle having parallel slots.

Figure 97:
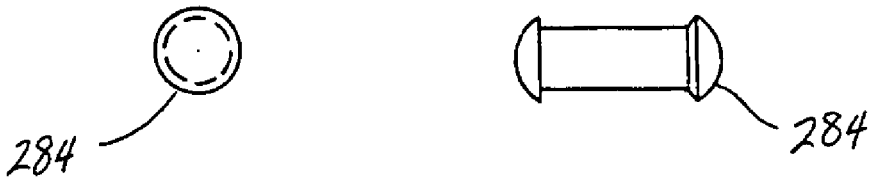
FIG. 97 - is a side and top view of a flexible shaft traveling in a slotted support member, attachable to a movable jaw member and an upper handle by riveting.

FIG. 97 is flexible shaft 284 attachable to movable jaw member 252 and upper handle 256 through a riveting process.

FIG. 98 shows a movable jaw member having a construction being in a contiguous, slidable relation to slotted support member 254.

Figure 99:
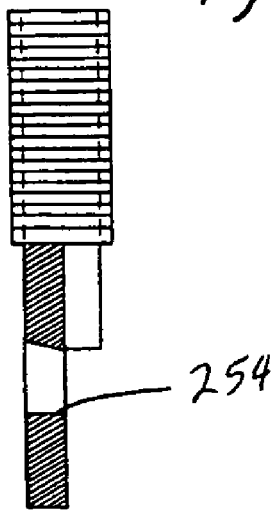
FIG. 99 - is a cross-sectional bottom view of a fixed jaw member showing a slotted support member which is angled to function with a flexible shaft.

FIG. 99 shows slotted support member 254 having a beveled slot formed through a machining process. Slotted support member 254 able to receive flexible shaft 284.

Figure 100:
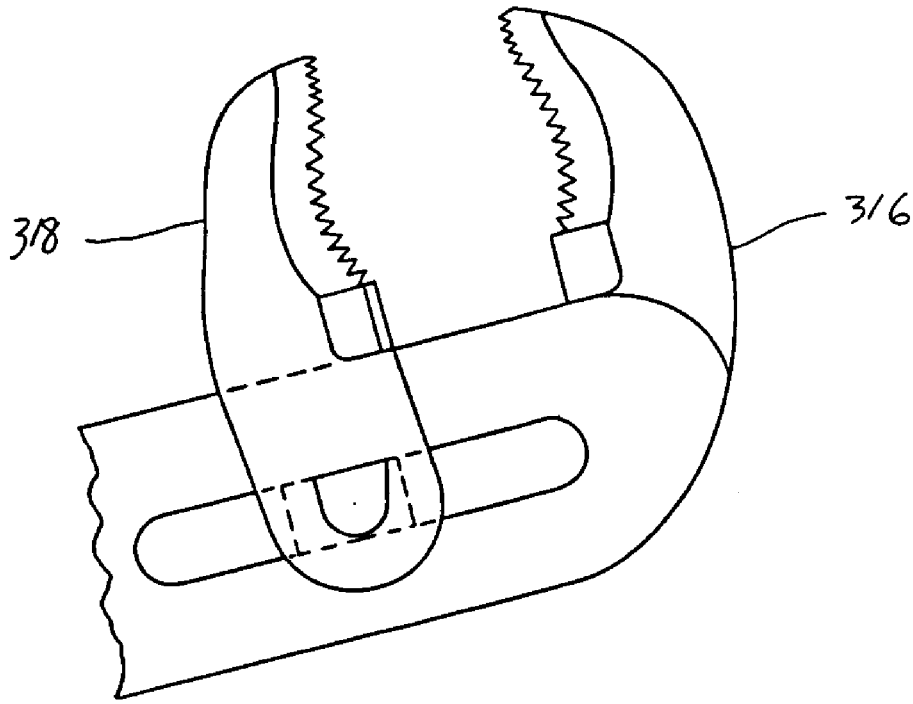
FIG. 100 - is a side, bottom, and top view of fixed and movable jaw members being curved with integral wire cutting apparatus.
Figure 100:
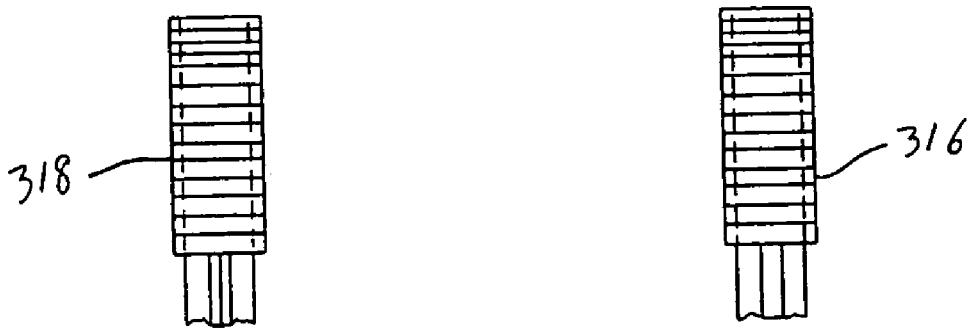

FIG. 100 is curved fixed jaw member 316, curved movable jaw member 318 and wire cutting apparatus being formed through a forging/machining process. Curved fixed jaw member 316 perpendicular to a length dimension of a slotted support member and parallel to length dimension of curved movable jaw member 318.

Figure 101:
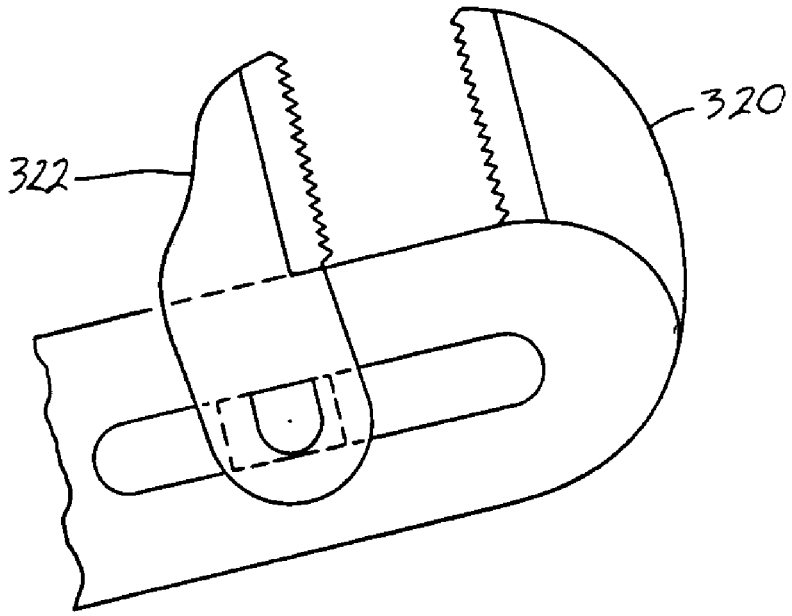
FIG. 101 - is a side and bottom view of fixed and movable jaw members being straight.
Figure 101:
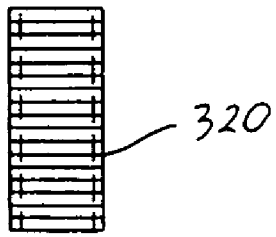

FIG. 101 is straight fixed jaw member 320 and straight movable jaw member 322 formed through a forging/machining process. Straight fixed jaw member 320 perpendicular to a length dimension of a slotted support member and parallel to length dimension of straight movable jaw member 322.

Figure 102:
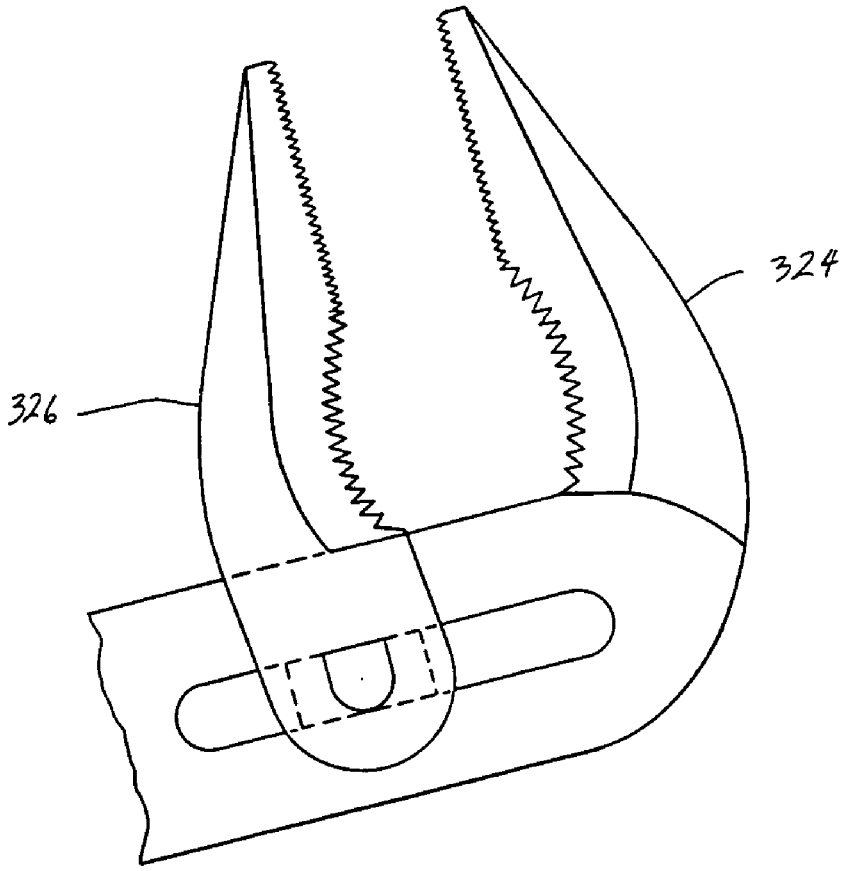
FIG. 102 - is a side and bottom view of fixed and movable jaw members being of the long nose type, having flat and curved sections.
Figure 102:
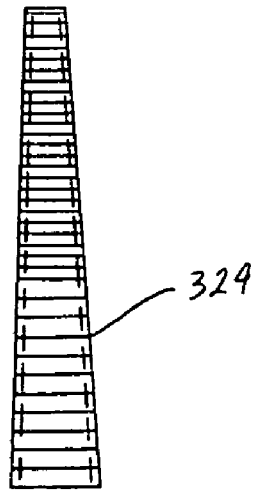

FIG. 102 is straight/curved long nose fixed jaw member 324 and straight/curved long nose movable jaw member 326 formed through a forging/machining process. Straight/curved long nose fixed jaw member 324 perpendicular to a length dimension of a slotted support member and parallel to length dimension of straight/curved long nose movable jaw member 326.

Figure 103:
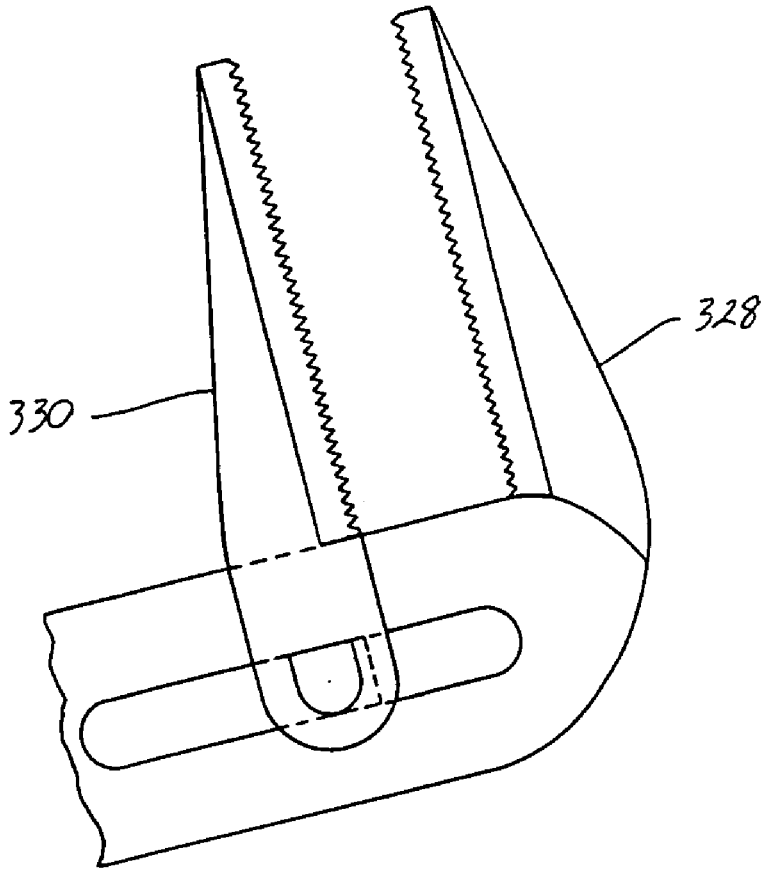
FIG. 103 - is a side and bottom view of fixed and movable jaw members being of the long nose type, having flat sections.
Figure 103:
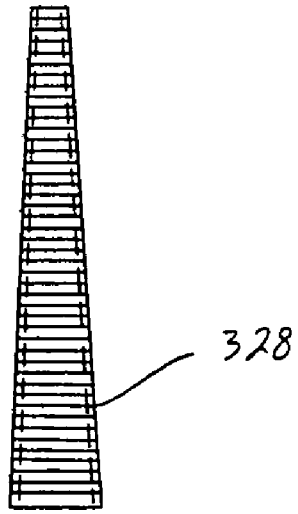

FIG. 103 is straight long nose fixed jaw member 328 and straight long nose movable jaw member 330 formed through a forging/machining process. Straight long nose fixed jaw member 328 perpendicular to a length dimension of a slotted support member and parallel to length dimension of straight long nose movable jaw member 330.

Figure 104:
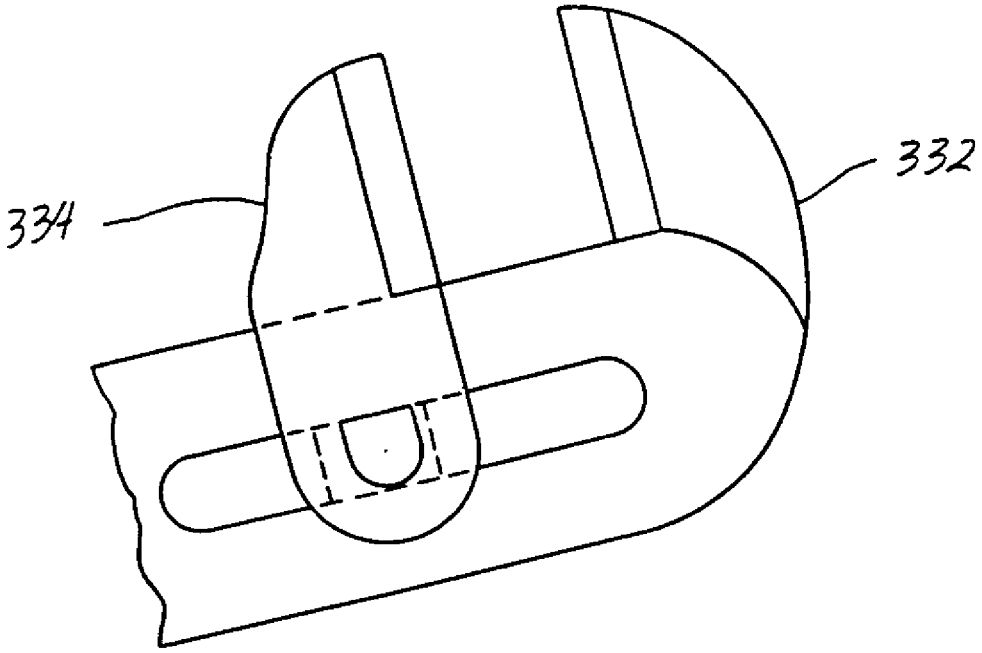
FIG. 104 - is a side and front view of fixed and movable jaw members being straight and convex in design.
Figure 104:
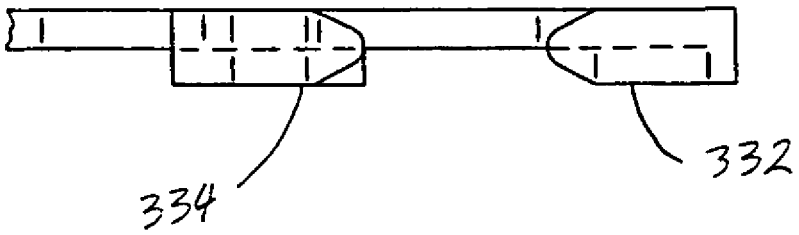

FIG. 104 is straight/convex fixed jaw member 332 and straight/convex movable jaw member 334 formed through a forging/machining process. Straight/convex fixed jaw member 332 perpendicular to a length dimension of a slotted support member and parallel to length dimension of straight/convex movable jaw member 334.

Figure 105:
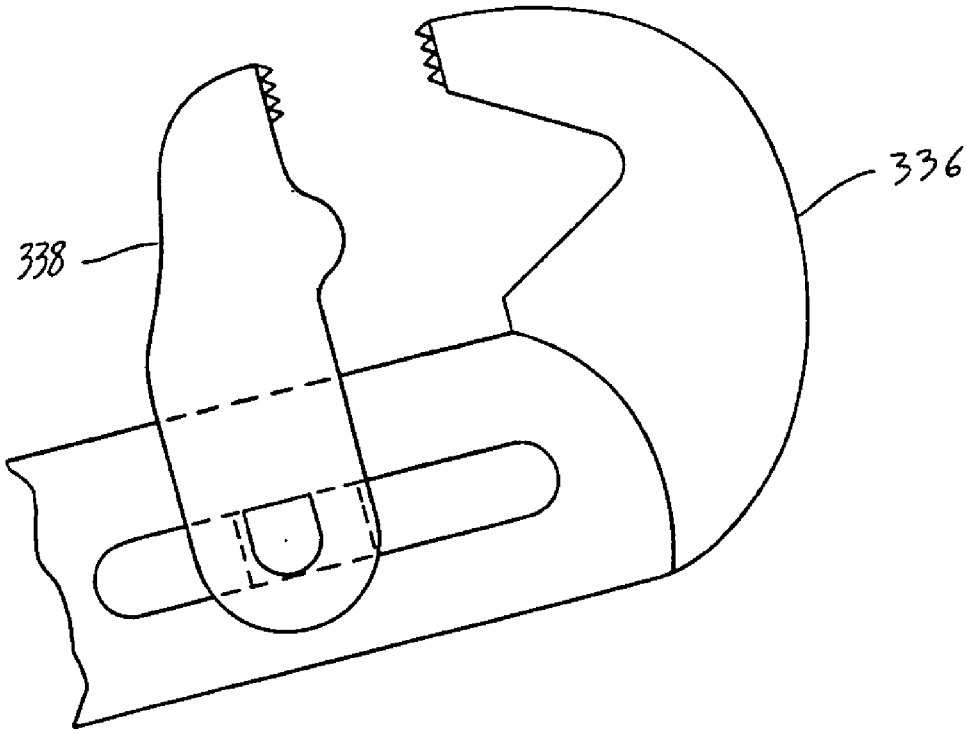
FIG. 105 - is a side and front view of fixed and movable jaw members being of the fastener removable type, having a V-shaped section and a semicircular section.
Figure 105:
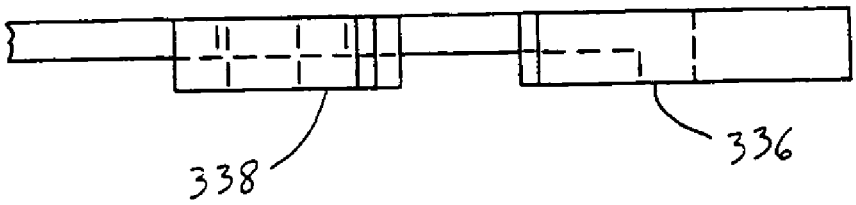

FIG. 105 is V-shaped fixed jaw member 336 and semicircular movable jaw member 338 formed through a forging/machining process. V-shaped fixed jaw member 336 perpendicular to a length dimension of a slotted support member and parallel to length dimension of semicircular movable jaw member 338.

Figure 106:
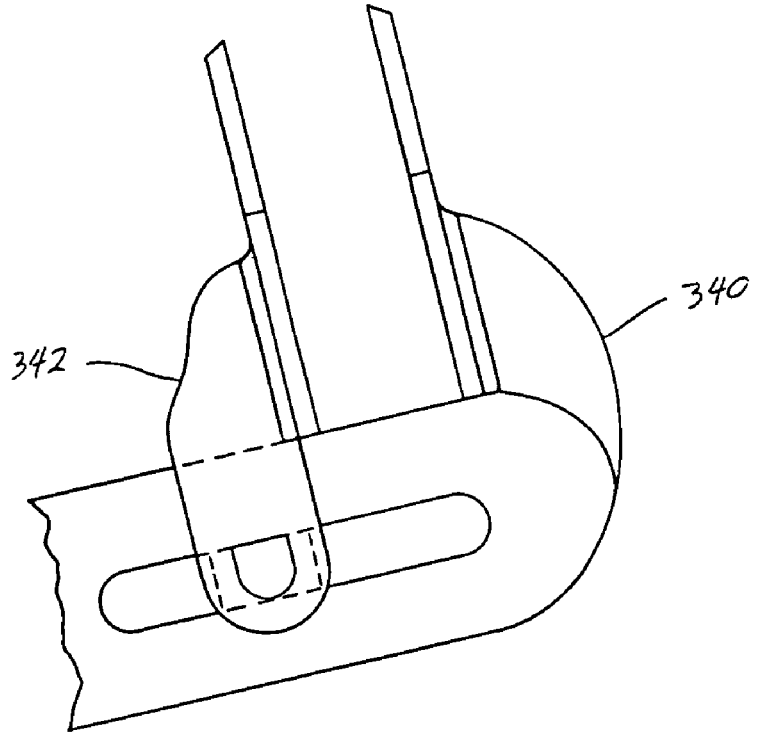
FIG. 106 - is a side and top view of fixed and movable jaw members showing extensions being formed integrally to fixed and movable jaw members.
Figure 106:
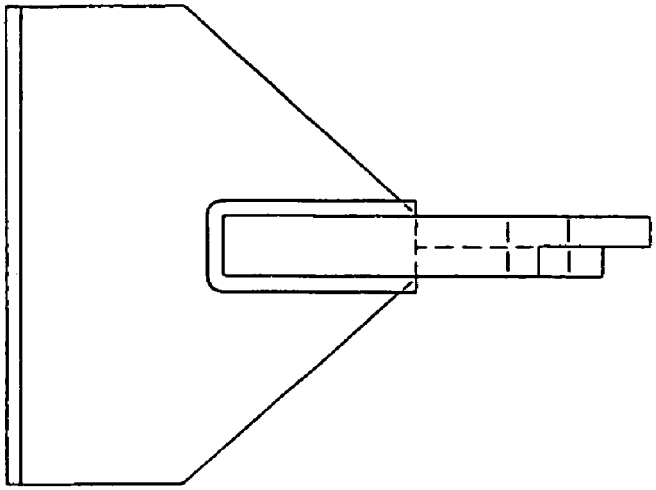

FIG. 106 is sheet metal fixed jaw member 340 and sheet metal movable jaw member 342 formed through a welding/stamping/forging/machining process. Sheet metal fixed jaw member 340 perpendicular to a length dimension of a slotted support member and parallel to length dimension of sheet metal movable jaw member 342.

Figure 107:
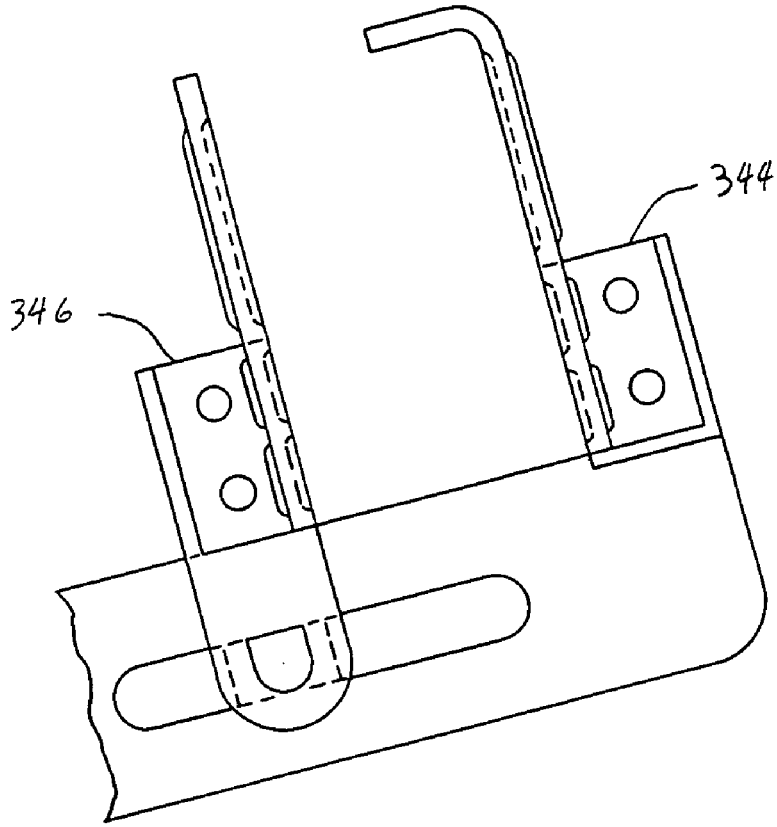
FIG. 107 - is a side and top view of fixed and movable jaw members showing a curved extension and a straight extension being attachable to fixed and movable jaw members by riveting.
Figure 107:
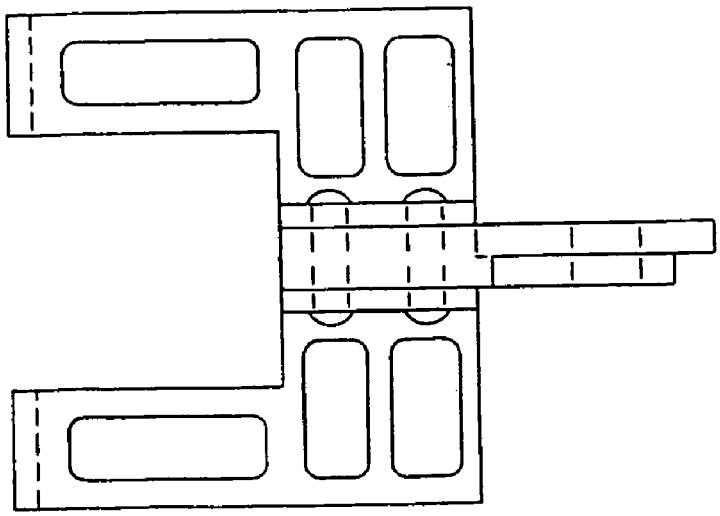

FIG. 107 is welding fixed jaw member 344 and welding movable jaw member 346 formed through a riveting/stamping/pressing/forging/machining process. Welding fixed jaw member 344 perpendicular to a length dimension of a slotted support member and parallel to length dimension of welding movable jaw member 346.

Figure 108:
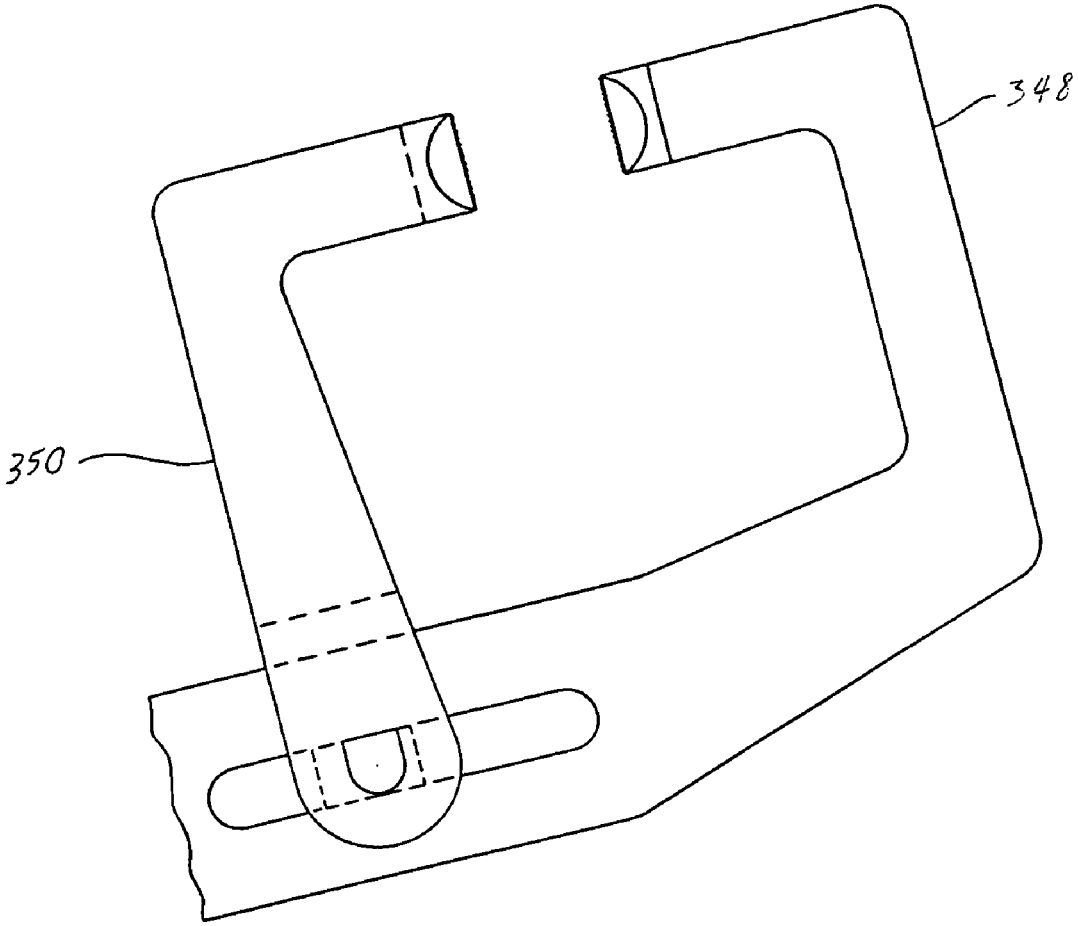
FIG. 108 - is a side, front and bottom view of fixed and movable jaw members being of the "C" clamp type, having clamp ends with gripping surfaces.
Figure 108:
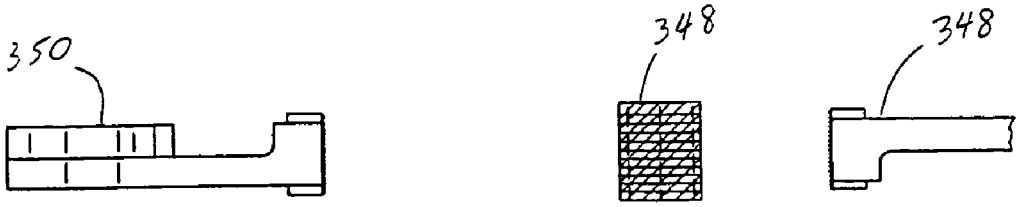

FIG. 108 is "C" clamp fixed jaw member 348 and "C" clamp movable jaw member 350 formed through a forging/machining process. "C" clamp fixed jaw member 348 perpendicular to a length dimension of a slotted support member and parallel to length dimension of "C" clamp movable jaw member 350.

Figure 109:
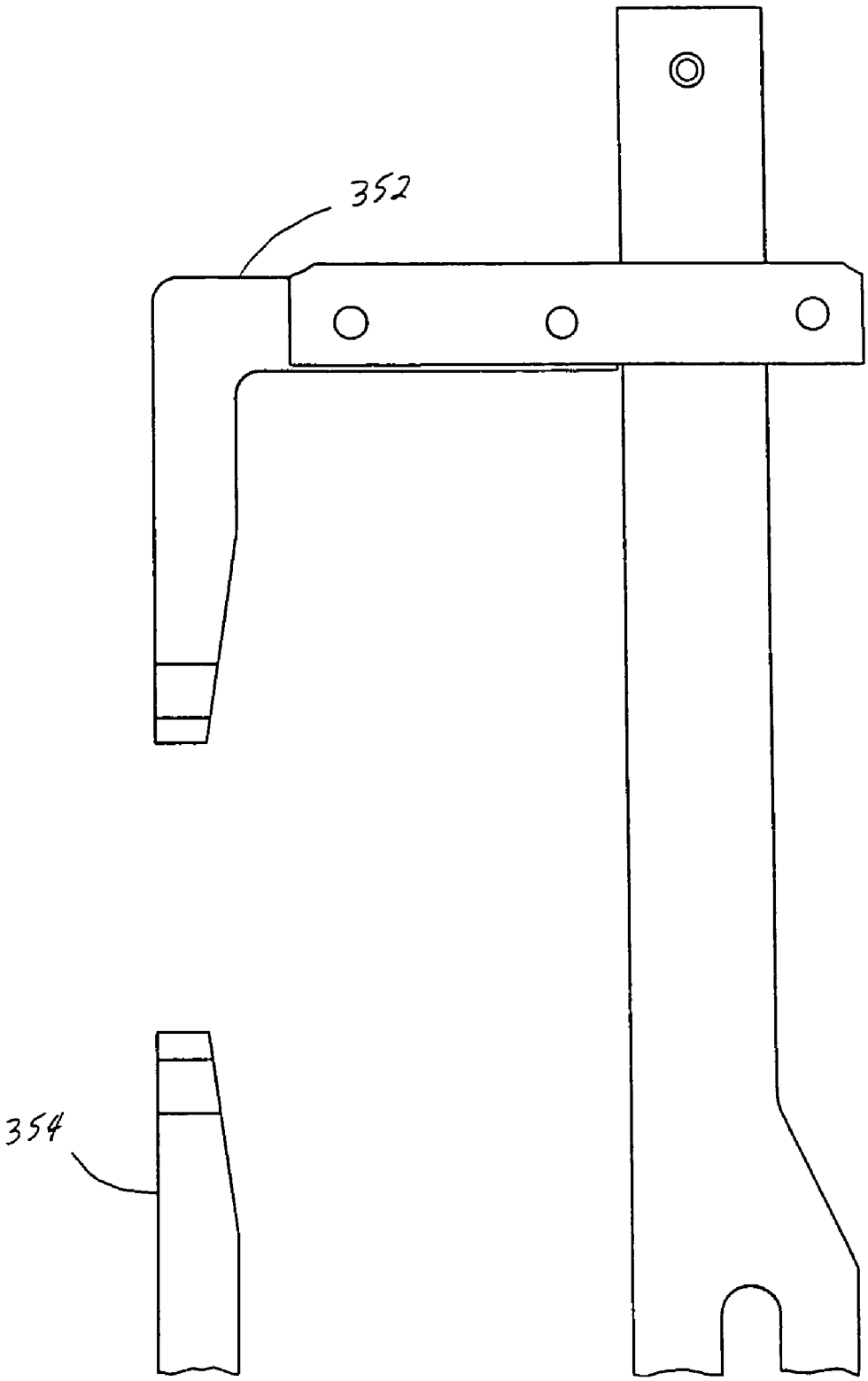
FIG. 109 - is a fragmented side view of an extending jaw member and a movable jaw member being of the locking bar type, having 90 degree sections.

FIG. 109 is bar clamp fixed jaw member 352 formed through a riveting/stamping/pressing/forging/machining process and bar clamp movable jaw member 354 formed through a forging/machining process. Bar clamp fixed jaw member 352 slidably perpendicular to a length dimension of a slotted support member and parallel to length dimension of bar clamp movable jaw member 354.

Figure 110:
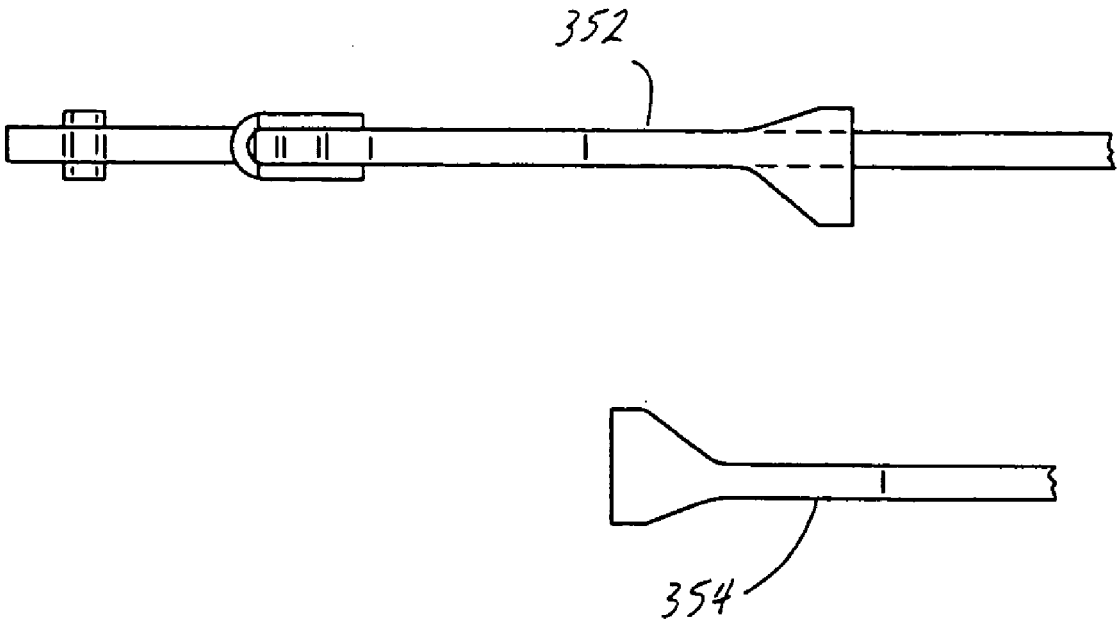
FIG. 110 - is a fragmented front view of an extending jaw member and a movable jaw member being of the locking bar type, having 90 degree sections.

FIG. 110 shows clamp ends formed integral to bar clamp fixed jaw member 352 and bar clamp movable jaw member 354.

FIG. 111 shows swivel pad 356 being alternately formed to "C" clamp fixed jaw member 348, "C" clamp movable jaw member 350, bar clamp fixed jaw member 352, and bar clamp movable jaw member 354 through a riveting/stamping/pressing/forging/machining process.

As defined by the specification, FIG. 72 has upper handle 256 opposing lower handle 258 being compressible by hand. Upper handle 256 pivots on a fulcrum which is tension pin 302 (being of a width internal to upper handle 256). Upper handle 256 slides movable jaw member 252 by movement of adjustable lever 262 being under tension by internal spring 264. Pivoting upper handle 256 rotates adjustable handle 262 on pivoting plate 276, moving toggle lock member 268 and locking crank 260 into lock position. Upper handle 256 rotates on flexible shaft 284 when movable jaw member 252 is in contact with object. Rotation of upper handle 256 rotates locking crank 260 into contact with parallel slots of lower handle 258, through use of toggle lock member 268 being under tension by internal spring 266.

Movable jaw member 252 (slidable in slotted support member 254 by flexible shaft 284) clamps an object between opposing fixed jaw member 250 by compression force of upper handle 256 and lower handle 258. Movable jaw member 252 and fixed jaw member 250 transmit clamping force to the object through flexible shaft 284 (attachable to upper handle 256 and toggle lock member 268 by stepped shaft 270), when locking crank 260 (attachable toggle lock member 268) is locked into parallel slots of lower handle 258 by compression force of upper handle 256 and lower handle 258 acting on toggle lock member 268.

Adjustable lever 262 slides off of pivoting plate 276 into lower handle 258 during compression of upper handle 256 and lower handle 258. Lock release lever 282 is in contiguous relation to toggle lock member 268, when upper handle 256 is fully compressed to lower handle 258 (movable jaw member 252, fixed jaw member 250, toggle lock member 268, locking crank 260, upper handle 256, and lower handle 258 being completely in clamped/locked position).

Depressing lock release lever 282 releases fixed jaw member 250, movable jaw member 252, toggle lock member 268, locking crank 260, upper handle 256, and lower handle 258 from completely clamped/locked position. Internal spring 264 exerts force on adjustable lever 262 (adjustable lever 262 exerts force on lower handle 258) bringing fixed jaw member 250, movable jaw member 252, toggle lock member 268, locking crank 260, upper handle 256, and lower handle 258 to fully open/unlocked position. Internal spring 264 exerts pressure on lock release lever 282, repositioning lock release lever 282 into upper handle 256.

Clamping force being adjustable by rotating adjustable knob 278 (attachable to adjustment member 272 by threaded member 280 or threaded member 281) which moves adjustment member 272 into contact with toggle lock member 268. Tension pin 302 (mounted to adjustable lever 262 and contiguous in a curved slot spacing plate and adjustment member 272) is held in a selected position relative to upper handle 256 by adjustable knob 278, threaded member 280 or threaded member 281, adjustment member 272, and a curved slot spacing plate. The angle of toggle lock member 268 and position of locking crank 260 (in relation to upper handle 256 and lower handle 258) are held in the selected position (after adjusting adjustable knob 268) by internal spring 266 exerting force on toggle lock member 268.

FIG. 100 has curved fixed jaw member 316 opposing curved movable jaw member 318 to clamp objects having rounded surfaces. The wire cutting apparatus integral to curved movable jaw member 318 is angled to cut when brought into contact with the flat surface of wire cutting apparatus integral to curved fixed jaw member 316.

FIG. 101 has straight fixed jaw member 320 opposing straight movable jaw member 322 to clamp objects having flat surfaces.

FIG. 102 has straight/curved long nose fixed jaw member 324 opposing straight/curved long nose movable jaw member 326 to clamp objects having rounded or flat surfaces which are in areas where space restrictions exist.

FIG. 103 has straight long nose fixed jaw member 328 opposing straight long nose movable jaw member 330 to clamp objects having flat surfaces which are in areas where space restrictions exists.

FIG. 104 has straight/convex fixed jaw member 332 opposing straight/convex movable jaw member 334 to pinch tubing and hoses.

FIG. 105 has V-shaped fixed jaw member 336 opposing semicircular movable jaw member 338 to clamp hexagonal shaped objects for removal.

FIG. 106 has sheet metal fixed jaw member 340 opposing sheet metal movable jaw member 342 to clamp sheet metal for making bends and crimps.

FIG. 107 has welding fixed jaw member 344 opposing welding movable jaw member 346 to clamp objects, offering a degree of visibility and work space during welding.

FIG. 108 has "C" clamp fixed jaw member 348 opposing "C" clamp movable jaw member 350 to clamp objects having "T" or "L" shaped dimensions.

FIG. 109 has bar clamp fixed jaw member 352 extending in relation to an opposing bar clamp movable jaw member 354 to clamp objects being in the range of the extension length.

The statement "obvious at the time the invention was made to a person having ordinary skill in the art" is meant herein to be construed as meaning: The information for which patent is sought anticipates art (designs) by others modifying the Invention under (A) through (Z) and (C1), (F1), (D1), (E1), and (X1) herein, because it is taught throughout the Specification and under (A) through (Z) and (C1), (F1), (D1), (E1), and (X1) that the Invention is made constructible by:

(C1) Any material design (including metallic) relating to the above-identified invention being known in the art.

(F1) Any composite material design relating to the above-identified invention (but more particularly relating to upper handle 256 and lower handle 258) being known in the art.

(D1) Any design being not ergonomic to the above-identified invention (but more particularly relating to upper 256 and lower handle 258) for the purposes of reducing manufacturing cost.

(E1) Any build design utilizing parallel plates relating to the above-identified invention, for purposes of strength and/or reducing manufacturing cost, being known in the art.

(X1) Any change in design (including mechanism geometry) relating to the above-identified invention for the purpose of reducing manufacturing cost.

FIG. 112 depicts the working relationship of mechanisms (some details not shown) being under spring tension - with jaw members in the fully open position.

Figure 113:
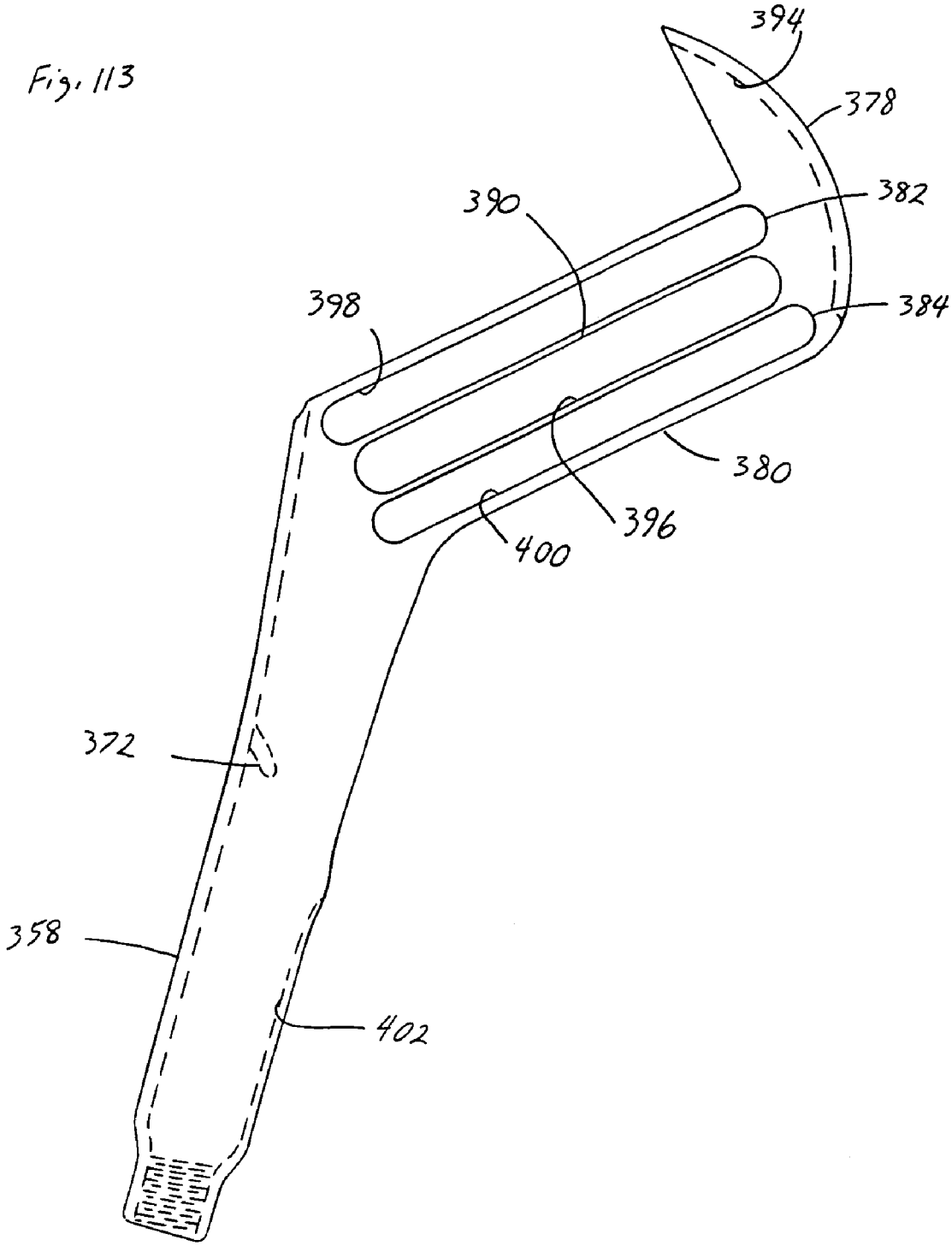
FIG. 113 - is a side view of lower handle with hidden dimensions shown by dashed lines, with strengthening ribs on each side of center slots.

FIG. 113 is lower handle 358 with the general shape of slots 390 and 396, strengthening ribs 382, 384, 398, and 400, hook 372, fixed jaw member 378, and rear track housing 402 being formed from a flat piece of sheet metal by a pressing/shearing process (or by mechanism known in the art). Support member 380 and final shape of rear track housing 402 are formed from the flat piece of sheet metal by a bending process. Fixed jaw member 378 is welded after each half of fixed jaw member 378 is aligned by the bending process. Weld seam 394 is shown as running along the top of fixed jaw member 378. Slot 390 is checked for the necessary tolerances and then is machined if needed.

Figure 114:
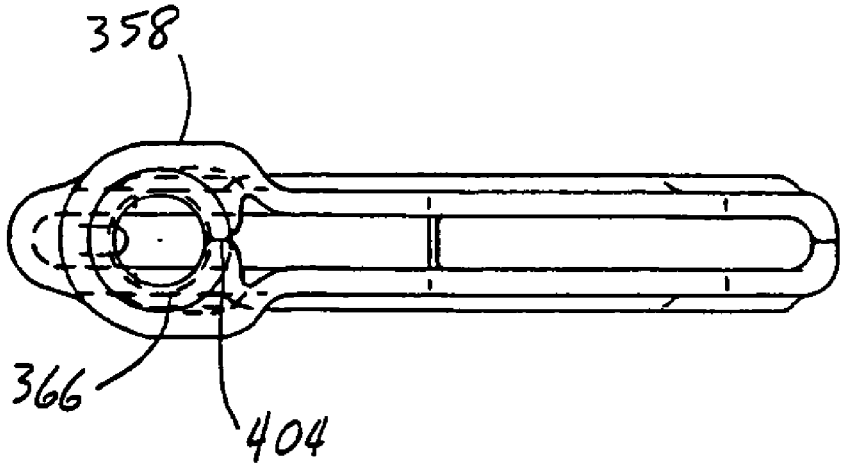
FIG. 114 - is a rear view of lower handle showing the weld seam of fixed jaw member.

FIG. 114 is lower handle 358 with weld seam 404 and threaded housing 366 formed by mechanism known in the art.

Figure 115:
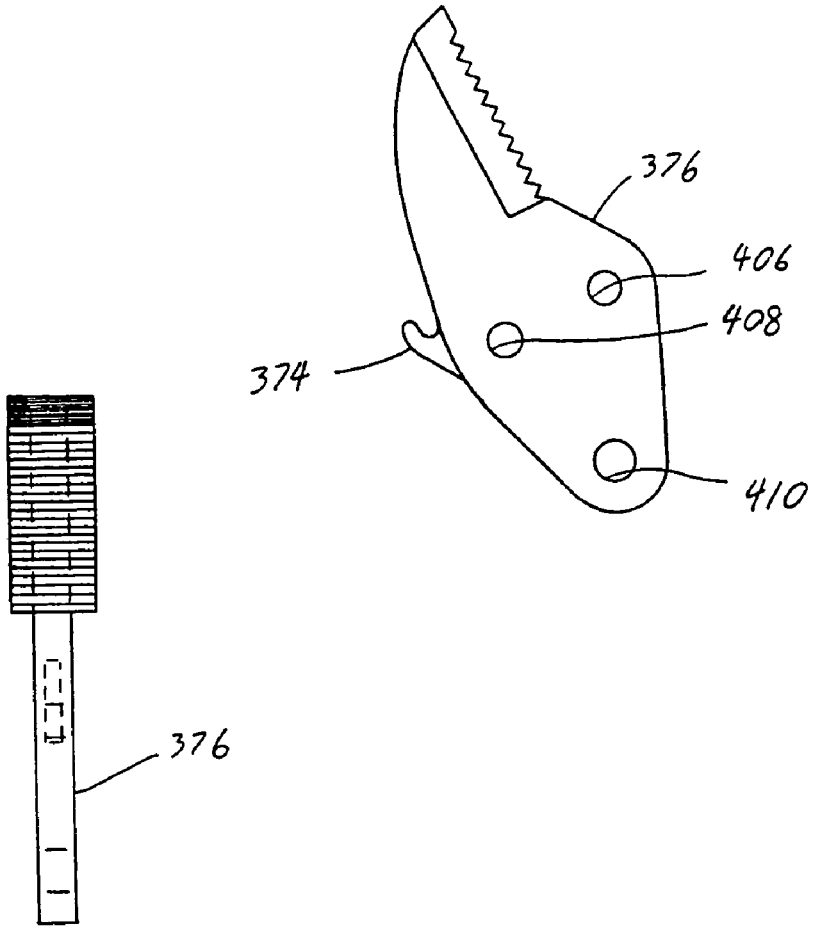
FIG. 115 - is a side and top view of slidable jaw member showing position of rivet hole, pin holes and hook.

FIG. 115 is slidable jaw member 376 formed from a material and forging process known in the art. Slidable jaw member 376 has integrally formed hook 374. Slidable jaw member 376 has pin holes 406 and 408 and rivet hole 410 drilled to the necessary tolerances after a general shape is created during the forging process.

FIG. 116 is jaw insert 392 that is inserted and welded into the spaced section of fixed jaw member 378 by mechanism known in the art.

FIG. 117 is pin 386 formed with a general shape to be fitted between slot 390 and into jaw member 376. Pin 386 is then formed to a final shape by a riveting process known in the art. Pin 388 is formed by the same processes as pin 386.

FIG. 118 depicts the working relationship of mechanisms (some details not shown) being under spring tension - with jaw members in the fully open position. FIG. 118 has oval strengthening ribs 412 and 414 (oval strengthening rib 414 hidden from view) as encircling slots of a support member. Oval strengthening ribs 412 and 414 are formed by processes similar to the forming processes of strengthening ribs 382, 384, 398, and 400.

FIG. 119 depicts the working relationship of mechanisms (some details not shown) being under spring tension - with jaw members in the fully open position. FIG. 119 has slidable jaw member 416 with a reduced height section as compared to the height section of fixed jaw member 376. Slidable jaw member 416 is formed by processes similar to the forming processes of fixed jaw member 376.

FIG. 120 depicts the working relationship of mechanisms (some details not shown) being under spring tension - with jaw members in the fully open position. FIG. 120 has a fixed jaw member with jaw insert 418 formed by processes similar to the forming processes of jaw insert 392. FIG. 120 has slidable jaw member 420 formed by processes similar to the forming processes of slidable jaw member 376.

FIG. 121 depicts the working relationship of mechanisms (some details not shown) being under spring tension - with jaw members in the fully open position. FIG. 121 has support member 422 formed by combination of the forming processes of support members 380 and 138. FIG. 121 has fixed jaw member 424 formed by processes similar to the forming processes of fixed jaw member 124.

FIG. 122 depicts the working relationship of mechanisms (some details not shown) being under spring tension - with jaw members in the fully open position. FIG. 122 has slidable jaw member 426 with an integrally formed extension 428.

FIG. 123 is slidable jaw member 426 formed by processes similar to the forming processes of slidable jaw member 376. Extensions 428 and 430 are machined to necessary tolerances after being formed from the forging processes of slidable jaw member 426.

FIG. 124 depicts the working relationship of mechanisms (some details not shown) being under spring tension - with jaw members in the fully open position. FIG. 124 has squared slots 432 and 434 formed by processes similar to the forming processes of slots 390 and 396. FIG. 124 has squared pins 436 and 438 formed by processes similar to the forming processes of pins 386 and 388.

FIG. 125 is squared pin 438 formed to a general shape to be fitted between squared slot 432 and into slidable jaw member 440. Squared pin 438 is then formed by a riveting process which secures squared pin 438 in slidable jaw member 440 and also allows for the rotation of squared pin 436 in pin hole 444 of slidable jaw member 440. Squared pin 436 is fitted between squared slot 434 (squared slot 434 is hidden from view) and into pin hole 442 and is formed by the same process as squared pin 438.

FIG. 126 depicts the working relationship of mechanisms (some details not shown) being under spring tension - with jaw members in the fully open position. The thinnest lines of FIG. 126 indicate the contours of metal formation or parts being under multiple layers of other parts.

FIG. 127 is lower handle 446 with the general shape of slots 482 and 520, strengthening ribs 470, 472, 474, and 476, fixed jaw member 466, slotted housing 454, and rivet holes 524, 526, and 528 being formed from a flat piece of sheet metal by a pressing/shearing process (or by mechanism known in the art). Support member 468 is formed from the flat piece of sheet metal by a bending process. The outer sides of fixed jaw member 466 are aligned by the bending process. Rear track housing 522 is formed by a combination of the pressing/shearing and the bending process.

FIG. 128 is lower handle 446 showing spacing 532 of fixed jaw member 466 constructed to accept jaw plates 484 and 530. FIG. 128 shows rear housing 454 having rear slots 534 and 536 constructed with tabs 538 and 540 formed from the flat piece of sheet metal by the combination of the pressing/shearing and the bending process.

FIG. 129 is lower handle 446 constructed with spacing 542.

FIG. 130 is jaw plate 544 with integrally formed hook 460 (hook 460 formed by a bending process), rivet holes 546, 548, and 550, and pin holes 552 and 554 all which are formed by a pressing/shearing process (or by mechanism known in the art).

FIG. 131 is jaw plate 556 (formed without a hook) with rivet holes 558, 560, and 562, and pin holes 564 and 566 formed by similar processes as the forming processes of jaw plate 544.

FIG. 132 is jaw plate 486 and rivet holes 568 and 570 formed by a pressing/shearing process.

FIG. 133 is jaw plate 574 and rivet holes 572 and 576 formed by the same forming processes as jaw plate 486.

FIG. 134 is jaw plate 484 and rivet holes 578, 580, 582 formed by a pressing/shearing process.

FIG. 135 is jaw plate 530 and rivet holes 584, 586, 588 formed by the same forming processes as jaw plate 486.

FIG. 136 is upper handle 448, rivet holes 590 and 592, and pin hole 594 being formed to a general shape from a flat piece of sheet metal by a pressing/shearing process (or by mechanism known in the art). Upper handle 448 is formed to a final shape by a bending process (or by mechanism known in the art).

FIG. 137 is release lever 516 and pin hole 593 being formed to a general shape from a flat piece of sheet metal by a pressing/shearing process (or by mechanism known in the art). Release lever 516 is formed to a final shape by a bending process (or by mechanism known in the art).

FIG. 138 depicts the working relationship of mechanisms (some details not shown) being under spring tension - with jaw members in the fully open position. FIG. 138 has upper handle 596 formed by processes similar to the forming processes of upper handle 448.

FIG. 139 is upper handle 596 constructed with a straight section 598.

FIG. 140 is release lever 600 formed by processes similar to the forming processes of release lever 516.

FIG. 141 depicts the working relationship of mechanisms (some details not shown) being under spring tension - with jaw members in the fully open position. FIG. 141 has upper handle 602 being constructed from two separate pieces of sheet metal that are separated by spacer 608.

FIG. 142 is handle plates 604 and 606 each formed from a separate piece of sheet metal by a pressing/shearing process (or by mechanism known in the art).

FIG. 143 is spacer 608 and rivet holes 610 and 612 formed out of a composite material known in the art (commonly utilized for hand tools) by an injection molding process.

FIG. 144 depicts the working relationship of mechanisms (some details not shown) being under spring tension - with jaw members in the fully open position. FIG. 144 has spacer 614 formed by processes similar the forming processes of spacer 608.

FIG. 145 depicts the working relationship of mechanisms (some details not shown) being under spring tension - with jaw members in the fully open position. FIG. 145 has release lever 616 constructed with spacing 618.

FIG. 146 is release lever 616 formed by processes similar to the forming processes of release lever 516.

FIG. 147 is toggle 450, spring attachment 462, toggle extension 518, rivet hole 620, and pin hole 622 formed (while heated or by mechanism known in the art) from a single piece of material (known in the art) by a pressing/shearing process (or by mechanism known in the art).

FIG. 148 is slidable retainer 510, pin retainer slot 624, and nut retainer slot 626 formed by a pressing/shearing/bending process.

FIG. 149 is pin 490 formed from a material and by mechanism known in the art.

FIG. 150 is slot plate 504 formed by a pressing/shearing process.

FIG. 151 is slot plate 506 formed by the same process as slot plate 504.

FIG. 152 is nut 508 formed from a material and by mechanism known in the art.

FIG. 153 depicts the threaded portion of threaded knob 502 as short alternating dash lines. Threaded knob 502 is formed from a material and by mechanism known in the art.

FIG. 154 is spring 514 with integrally formed hooks 625 and 628 being formed from a material and by mechanism known in the art.

FIG. 155 depicts the working relationship of mechanisms (some details not shown) being under spring tension - with jaw members in the fully open position. FIG. 155 has upper handle 630 formed by processes similar to the forming processes of upper handle 128.

FIG. 156 is upper handle 630 constructed with spacing 636 being able to accept slidable plates 632 and 634, and slidable jaw member.

FIG. 157 is slidable jaw member 126 formed by processes similar to the forming processes of slidable jaw member 12.

FIG. 158 is rivet 638 formed from a material and by mechanism known in the art.

FIG. 159 is rivet 640 formed from a material and by mechanism known in the art.

FIG. 160 is roll pin 642 formed from a material and by mechanism known in the art.

FIG. 161 is slidable plate 632 being formed from a pressing/shearing process.

FIG. 162 is slidable plate 634 formed by the same forming processes as slidable plate 632.

FIG. 163 depicts the working relationship of mechanisms (some details not shown) being under spring tension - with jaw members in the fully open position. FIG. 163 illustrates that the Invention is made constructible by engineering the support member and slidable jaw member with the mechanical design features of: a slot or slots (slots 646 and 644 as described in FIG. 163) in the above-mentioned support member - communicating with a slidable extension or extensions (extensions 650 and 652 as described in FIG. 163) - constructible to the above-mentioned slidable jaw member (slidable jaw member 648 shown in FIG. 163).

FIG. 164 is circular spacers 668 and 670 constructed of a material able to withstand (without being crushed) the pressures associated with the riveting procedure used to construct upper handle 602 or upper handle 672.

FIG. 165 depicts the working relationship of mechanisms (some details not shown) being under spring tension - with jaw members in the fully open position. FIG. 165 has upper handle 692 constructed with a single spring 694. Toggle 696 is constructed with toggle extension 698. Toggle 696 is equal in width dimension to toggle 450 and toggle extension 698 is equal in width dimension to toggle extension 518 (the width dimensions measured from a top view of toggle). Spring 694 is constructed form a material and by techniques known in the art. Release lever 700 is formed by processes similar (with spring attachment holes added) to the forming processes of release lever 516. Slidable jaw member 702 is constructed without an upper handle stop. Slidable jaw member 702 is formed by processes similar to the forming processes of slidable jaw member 464.

As defined in this specification; construction of parts for the Invention is as follows (FIG. 112): Jaw insert 392 is positioned into housing 654 and is welded into place. Slots 390 and 396 are checked for the correct tolerances and are machined if necessary. Slidable jaw member 376 is positioned between strengthening ribs 384 and 400. Pin 386 is positioned between slot 390 and is inserted into pin hole 408 of slidable jaw member 376. Pin 388 is positioned (in the opposite direction as compared to the insertion direction of pin 386) between slot 396 and is inserted into pin hole 406 of slidable jaw member 376. Pins 386 and 388 are then secured in slidable jaw member 376 by a pressing procedure.

Upper handle 360 is attached to slidable jaw member 376 by rivet 370. Rivet 370 is positioned through a forward rivet hole of upper handle 360 and through rivet hole 410 of slidable jaw member 376. Rivet 370 is then positioned through the other forward rivet hole of upper handle 360. Rivet 370 is then secured in place by a riveting procedure.

Toggle 362 is attached to upper handle 360 by rivet 368. Rivet 368 is positioned through a middle rivet hole of upper handle 360 and through a rivet hole of toggle 362. Rivet 368 is then positioned through the other middle rivet hole of upper handle 360. Rivet 368 is then secured in place by a riveting procedure.

Release lever 130 (generally designated by number 130) is attached to upper handle 360 by roll pin 364. Release lever 130 is positioned in upper handle 360. Roll pin 364 is positioned through a rearward pin hole of upper handle 360. Roll pin 364 is positioned through both pin holes of release lever 130. Roll pin 364 is then positioned through the other rearward pin hole of upper handle 360. Roll pin 364 is secured in place by the tension of the material that it is constructed of.

Spring 20 (generally designated by number 20) is attached to hook 374 of slidable jaw member 376. The other end of spring 20 is attached to hook 372 of lower handle 358. Toggle 362 is then rotated into rear track housing 402 of lower handle 358. Toggle 362 is secured in rear track housing 402 by the tension of spring 20.

Adjustment screw 134 is screwed and secured into threaded housing 366 of lower handle 358. Adjustment screw 134 contacts toggle 362.

FIGS. 118, 119, and 120 are assembled with the construction techniques as taught by the above-described construction techniques of FIG. 112.

As defined in this specification; construction of parts for the Invention is as follows (FIG. 121): Fixed jaw member 424 is a single forged piece positioned between support member 422, aligning the rivet holes of support member 422 with the rivet holes of fixed jaw member 424. Rivets are positioned in the rivet holes of support member 422 and fixed jaw member 424, securing fixed jaw member 424 in support member 422 by a riveting procedure. The remaining mechanisms of FIG. 121 are assembled with the construction techniques as taught by the above-described construction techniques of FIG. 112.

As defined in this specification; construction of parts for the Invention is as follows (FIG. 122): The extensions 428 and 430 of slidable jaw member 426 are positioned in the support member slots of FIG. 122. The support member sides of FIG. 122 are then pressed to a parallel relation - temporarily securing the extensions 428 and 430 of slidable jaw member 426 - in the support member slots of FIG. 122. The fixed jaw member of FIG. 122 is then positioned between the support member of FIG. 122 and is riveted in place. The riveted fixed jaw member of FIG. 122 secures slidable jaw member 426 in the support member slots of FIG. 122. The remaining mechanisms of FIG. 122 are assembled with the construction techniques as taught by the above-described construction techniques of FIG. 121.

As defined in this specification; construction of parts for the Invention is as follows (FIG. 124): Slidable jaw member 440 is positioned in the support member of FIG. 124. Squared pin 438 is positioned between squared slot 434 and is inserted into pin hole 444 of slidable jaw member 440.

Squared pin 436 is positioned between squared slot 432 and is inserted into pin hole 442 of slidable jaw member 440. Squared pins 436 and 434 are then secured to slidable jaw member 440 by a pressing procedure that allows for the rotation of squared pins 436 and 434 in pin holes 442 and 444. The remaining mechanisms of FIG. 124 are assembled with the construction techniques as taught by the above-described construction techniques of FIG. 112.

As defined in this specification; construction of parts for the Invention is as follows (FIG. 126): Jaw plates 484 and 530 are positioned in support member 468 - aligning rivet holes 578, 580, 582, with rivet holes 584, 586, 588; and also aligning rivet holes 578, 580, 582, 584, 586, 588 with rivet holes 524, 526, 528, 656, 658, 660. Jaw plates 484 and 530 are then secured in support member 468 by a riveting procedure.

Jaw plates 544, 556, 486, 574 are positioned to align rivet holes 568, 570, 572, 576, 546, 548, 558, 560. The jaw plates of slidable jaw member 464 are then secured together by a riveting procedure. Slidable jaw member 464 is then positioned in support member 468. Pin 478 is then positioned between slot 482 and inserted into pin holes 554 and 566 of slidable jaw member 464. Pin 480 is positioned in between slot 520 (in a insertion direction opposite to that of the insertion direction of pin 478) and inserted into pin holes 552 and 564 of slidable jaw member 464.

Toggle 450 is positioned in upper handle 448. Toggle 450 is attached to upper handle 448 by rivet 456. Rivet 456 is inserted through rivet hole 592, rivet hole 620, and the other middle rivet hole of upper handle 448. Toggle 450 is then secured in upper handle 448 by a riveting procedure.

Toggle 450 is then attached to slidable retainer 510. Pin 490 is inserted into pin hole 662 of toggle 450. Pin 490 is then positioned in pin retainer slot 624 of slidable retainer 510.

Nut 508 is then positioned in nut retainer slot 626 of slidable retainer 510. Threaded knob 502 is then secured in slidable retainer 510 by being screwed into nut 508.

The assembly of nut 508, threaded knob 502, slidable retainer 510, pin 490, and a portion of toggle 450 is slid into rear track housing 522 of lower handle 446 and the assembly is secured in rear track housing 522 by slot plates 504 and 506.

Slot plate 506 is positioned in rear slot 534 of slotted housing 454. Slot plate 506 is then positioned onto threaded knob 502. Slot plate 504 is positioned in rear slot 536 of slotted housing 454. Slot plate 504 is then positioned onto threaded knob 502. Slot plates 504 and 506 are then secured in slotted housing 454 by crimps 488 and 662. Crimps 488 and 662 are formed by a pressing procedure. Upper handle 448 and the above-described assembled parts are positioned to be attachable to slidable jaw member 464. Upper handle 448 is attached to slidable jaw member 464 by rivet 458. Rivet 458 is positioned through rivet hole 590 of upper handle 448. Rivet 458 is then positioned through rivet holes 550 and 562 of slidable jaw member 464. Rivet 458 is then positioned through the other forward hole of upper handle 448. Rivet 458 is then secured in place by a riveting procedure. Release lever 516 is attached to upper handle 448 by roll pin 452. Release lever 516 is positioned in upper handle 448. Spring 512 is positioned in release lever 516. Roll pin 452 is positioned through pin holes 594 and 596. Roll pin 452 is then positioned through spring 512 and then through the remaining pin holes of release lever 516 and upper handle 448. Roll pin 452 is secured in place by the tension of the material that it is constructed of. Spring 514 is attached to hook 460 of slidable jaw member 464 by hook 625. Spring 514 is then attached to spring attachment 462 of toggle extension 518 by hook 628.

As defined in this specification; construction of parts for the Invention is as follows (FIG. 138): Upper handle 596 is constructed with a straight section 598. Release lever 600 is positioned in straight section 598 of upper handle 596. The remaining mechanisms of FIG. 138 are assembled with the construction techniques as taught by the above-described construction techniques of FIG. 126.

As defined in this specification; construction of parts for the Invention is as follows (FIG. 141): Upper handle 602 is generally constructed by handle plates 604, 606, and spacer 608. Spacer 608 has circular spacer 668 inserted into rivet hole 610 and circular spacer 670 inserted into rivet hole 612. Spacer 608 is positioned between handle plates 604 and 606 and secured in place by rivets 664 and 666. Rivets 664 and 666 are positioned through the corresponding rivets holes of handle plate 604- and then are inserted through circular spacers 668 and 670 of spacer 608- and then are inserted through the corresponding rivet holes of handle plate 606. Rivets 664 and 666 are then secured in place by a riveting procedure. The remaining mechanisms are of FIG. 141 are assembled with the construction techniques as taught by the above-described construction techniques of FIG. 126.

As defined in this specification; construction of parts for the Invention is as follows (FIG. 144): Upper handle 672 is constructed with spacer 614 having a raised portion 674 being of a width no greater than the width of spacer 614 (the width of spacer 614 measured from the top view of upper handle 672). The remaining mechanisms are of FIG. 144 are assembled with the construction techniques as taught by the above-described construction techniques of FIG. 141.

As defined in this specification; construction of parts for the Invention is as follows (FIG. 145): Upper handle 676 is constructed with release lever 616 having a straight portion 678. The remaining mechanisms are of FIG. 145 are assembled with the construction techniques as taught by the above-described construction techniques of FIG. 126.

As defined in this specification; construction of parts for the Invention is as follows (FIG. 155): Slidable plates 632 and 634 are positioned in spacing 636 of upper handle 630. Jaw member 126 (generally designated by number 126) is then positioned between support member 680. Upper handle 630 (with slidable plates 632 and 634 positioned in spacing 636 so as to be spaced apart) is positioned over rivet hole 682 of slidable jaw member 126. Rivet 638 is positioned in this order: first, through rivet hole 684 of upper handle 630; second, through rivet hole 686 of slidable plate 632; fourth, through rivet hole 682 of slidable jaw member 126; fifth, through rivet hole 688 of slidable plate 634; and lastly, through rivet hole 690 of upper handle 630. Rivet 638 is then secured in upper handle 630 by a riveting procedure. The remaining mechanisms of FIG. 155 are assembled with the construction techniques as taught by the above-described construction techniques of FIG. 37.

As defined in this specification; construction of parts for the Invention is as follows (FIG. 165): Spring 694 is secured in upper handle 692 by being hooked onto spring attachment 704 of toggle extension 698; and then is spring 694 is hooked onto spring attachment 706 of release lever 700. The remaining mechanisms of FIG. 165 are assembled with the construction techniques as taught by the above-described construction techniques of FIG. 126 (excluding spring attachment to slidable jaw member).

As defined in this specification; construction of parts for the Invention is as follows (FIG. 168): Fixed jaw member 710 is constructed with weld seam 746 similar to weld seam 394 of fixed jaw member 378. The housing 750 (similar to housing 654) of fixed jaw member 710 is constructed to accept jaw insert 748 similar to jaw insert 392 of fixed jaw member 378. The remaining mechanisms of FIG. 168 are assembled with the construction techniques as taught by the above-described construction techniques of FIG. 155.

An alternative design to FIG. 168 is defined in this specification as being constructible by engineering the following mechanisms:

FIG. 161 and FIG. 162 depict slidable plates 634 and 632 as having substantially flat contact surfaces which contact support member 680 (FIG. 155 depicts the flat contact surfaces contacting the support member 680). So that a greater spacing of upper handle 630 away from the lower handle (depicted in FIG. 155) is possibly needed (particularly when upper handle 630 is in the locked position), it is suggested herein that rivet hole 688 and rivet hole 686 be perpendicularly spaced farther away from the point of contact with support member 680. This increased spacing increases the side length dimension (the side length dimension as depicted in FIG. 155) of slidable plates 634 and 632 and therefore, creating a rectangularly shaped side length dimension to slidable plates 634 and 632. All the width dimensions of slidable plates 634 and 632 remain the same, when the width dimensions of slidable plates 634 and 632 are measured from a top or bottom view of FIG. 155. The side length dimension of slidable jaw member 126 (the side length dimension of the slidable jaw member 126 as depicted in FIG. 155) is elongated to align the new position of rivet hole 688 and rivet hole 686 with the new position of rivet hole 682 of slidable jaw member 126. The width dimension of slidable jaw member 126 remains the same, when the width dimension of slidable jaw member 126 is measured from a top or bottom view of FIG. 155. Rivet holes 688, 686 and rivet hole 682 and including rivet holes 690 and 684 of upper handle 630 are all aligned farther away from and rearward from the point of contact of the rectangularly shaped the side length dimensions of slidable plates 634 and 632 to support member 680. The remaining mechanisms of FIG. 155 (excluding jaw member 126, and slidable plates 634 and 632) retain exactly the same dimensions and the same construction techniques as depicted in FIG. 155 and as taught herein. The phantom lines of FIG. 155 depict the alternative above-described design herein.

As defined in this specification; operation of the preferred embodiments is as follows (FIG. 168): The parallel jaw movement of the Invention is generally indicated by 708. Fixed jaw member 710 has a first compression surface 712 being in a first plane. Fixed jaw member 710 has a forward end in indicated by terminal end 714. Lower handle 716 extends rearward from terminal end 714.

Lower handle 716 extends substantially at an obtuse angle when obtuse angle 718 is measured from the first plane of first compression surface 712. The measurement of obtuse angle 718 shown in FIG. 168 is substantially 143 degrees; construction of obtuse angle 718 can be between 155 degrees and 115 degrees, but is not limited to being between 155 degrees and 115 degrees.

Slidable jaw member 720 has a second compression surface 722 being in a second plane substantially parallel to the first plane of first compression surface 712.

Support member 724 has a first side indicated by first support side 726. First support side 726 integrally interconnects a first side of fixed jaw member 710 (indicated by first jaw side 728) to a first side of lower handle 716 indicated by first handle side 730. Support member 724 has a second side indicated by second support side 732. Second support side 732 is opposingly spaced parallelly apart from first support side 726. Second support side 732 integrally interconnects a second side of fixed jaw member 710 (indicated by second jaw side 734) to a second side of lower handle 716 indicated by second handle side 736.

Support member 724 has a first straight track section formed by a first pair of outer parallel side walls indicated by first forward side wall 740 and first rearward side wall 738. Support member 724 has a second straight track section formed by a second pair of outer parallel side walls indicated by second forward side wall 742 and second rearward side wall 744. First forward side wall 740, first rearward side wall 738, second forward side wall 742 and second rearward side wall 744 are each disposed at a right angle (indicated by right angle 840) to first compression surface 712.

Slidable jaw member 720 has a adjustable track follower assembly generally indicated by track assembly 752. Track assembly 752 members are substantially rectangular in cross section and comprise: a first slidable plate 754 that contacts first rearward side wall 738; and also a first slidable contact edge 756 that contacts first forward side wall 740; and also a second slidable plate 758 that contacts second rearward side wall 744; and also a second slidable contact edge 760 that contacts second forward side wall 742. Track assembly 752 further comprises: rivet 762 extended at forward axis 842 (forward axis 842 being disposed parallel to the first plane of first compression surface 712); and also forward housing 766 located at a forward end section of movable upper handle 764. Forward housing 766 has a first side wall 768 that is opposingly spaced parallelly apart from a second side wall 770 of forward housing 766. First slidable plate 754 and second slidable plate 758 are each between first side wall 768 and second side wall 770. First side wall 768 contacts and secures first slidable plate 754. Second side wall 770 contacts and secures second slidable plate 758.

Slidable jaw member 720 has a rivet housing 772 being between and contacting first slidable plate 754 and second slidable plate 758. Rivet 762 rotatably secures and extends through a circular void in: first side wall 768; and first slidable plate 754; and rivet housing 772; and second slidable plate 758; and Second side wall 770. Track assembly 752 substantially maintains second compression surface 722 in a slidable parallelism with opposingly spaced first compression surface 712.

Movable upper handle 764 is attachable to slidable jaw member 720 by rivet 762 extending through rivet housing 772. Movable upper handle 764 extends rearward away from rivet 762. Movable upper handle 764 is positioned around rivet 762 to be at times substantially angled towards or away from lower handle 716.

Toggle 774 is attachable to a middle section of movable upper handle 764 by second rivet 776. Middle section of movable upper handle 764 is indicated by middle housing 778. Middle housing 778 has a first middle side wall 780 opposingly spaced parallelly apart from a second middle side wall 782. A partial section of toggle 774 is substantially and internally between first middle side wall 780 and second middle side wall 782. Second rivet 776 secures and extends through a circular void in: first middle side wall 780; and toggle rivet hole 784; and second middle side wall 782. Toggle 774 extends rearward away from second rivet 776. Toggle 774 has a rearward end indicated by contact end 786. Second rivet 776 extends through middle axis 844 (middle axis 844 being disposed parallel to the first plane of first compression surface). Middle axis 844 is disposed rearward of and is in parallelism with forward axis 842.

Lower handle 716 has a circularly shaped rear housing section indicated by rear track housing 788. Rear track housing 788 has slotted opening 790 substantially formed horizontally along a direction (indicated by line 846) a length of lower handle 716. Slotted opening 790 substantially opposes bottom closed section 804 of rear track housing 788. Rear track housing 788 has a first circularly shaped rear track side wall 792 opposingly spaced parallelly apart from a second circularly shaped rear track side wall 794.

Slotted opening 790 receives moved contact end 786. Contact end 786 is positioned between first circularly shaped rear track side wall 792 and second circularly shaped rear track side wall 794. Contact end 786 has integrally formed first tab 796, substantially opposing integrally formed second tab 798. Contact end 786 is secured in rear track housing 788 by first tab 796 and second tab 798.

Lower handle 716 has circularly shape threaded rear housing 800 extending rearward away from rear track housing 788. Slotted opening 790 closes off at an end to integrally form rear track housing 788 to threaded rear housing 800. Threaded rear housing 800 has an internally formed threaded section indicated by internal threads 802.

Threaded screw 806 has an externally formed threaded section indicated by external threads 808. External threads 808 are attachable to internal threads 802 of threaded rear housing 800. Threaded screw 806 has forward extension 810 mounted and contacting contact end 786 of toggle 774. The positioned contact area (indicated by internally contained movable pivot axis 848) comprises forward extension 810 contacting contact end 786.

Threaded screw 806 has an integrally formed circular end with a roughened surface indicated by knurled end 812. Knurled end 812 is turned to position movable pivot axis 848 in rear track housing 788. Lower handle 716 has a forward section (indicated by spring housing 850) extending forwardly away from rear track housing 788. Spring housing 850 has a first spring housing side wall 852 opposingly spaced parallelly apart from a second spring housing side wall 854. Bottom closed section 804 extends (from threaded rear housing 800) substantially along a bottom length of lower handle 716 to integrally form a curved bottom section of first spring housing side wall 852 to a curved bottom section of second spring housing side wall 854. Slotted opening 790 extends (from threaded rear housing 800) substantially along a top length of lower handle 716 to space apart a straight top section of first spring housing side wall 852 from a straight top section of second spring housing side wall 854. First spring housing side wall 852 is integrally formed to first handle side 730 and second spring housing side wall 854 is integrally formed to second handle side 736. The forward end section of bottom closed section 804 has handle hook 814 extending upwardly towards slotted opening 790. Handle hook 814 is spaced between first spring housing side wall 852 and second spring housing side wall 854. Handle hook 814 is integrally formed to a bottom section of lower handle 716. Slidable jaw member 720 has integrally formed jaw hook 816 spaced between first support side 726 and second support side 732. Jaw hook 816 extends downwardly away from second compression surface 722. Spring 822 is positioned between first spring housing side wall 852 and second spring housing side wall 854. First hook 818 of spring 822 attaches to jaw hook 816 and second hook 820 of spring 822 attaches to handle hook 814.

Release lever 824 is pivotally attachable to a rear section of movable upper handle 764. Rear section of movable upper handle 764 is indicated by rear housing 826. Rear housing 826 has a first rear side wall 828 opposingly spaced parallelly apart from a second rear side wall 830. Release lever 824 is substantially between first rear side wall 828 and second rear side wall 830. Release lever 824 has a middle section indicated by release lever housing 834. Release lever 824 has a first release lever side wall 836 opposingly spaced parallelly apart from a second release lever side wall 836. Tension roll pin 832 secures release lever 824 in rear housing 826 by extending through a circular void in: first rear side wall 828; and first release lever side wall 836; and second release lever side wall 838; and second rear side wall 830. Tension roll pin 832 extends through rear axis 856. Rear axis 856 is disposed rearward of and is in parallelism with middle axis 844.

Movable upper handle 764 is externally mounted from and does not contact lower handle 716 or support member 724. Movable upper handle 764 is manually depressed with a result of rotating about forward axis 842, causing second compression surface 722 to substantially move towards first compression surface 712 with a substantially parallel movement. The manual depression of movable upper handle 764 results in toggle 774 rotating about middle axis 844 and movable pivot axis 848, causing contact end 786 to pressure forward extension 810. The pressuring of contact end 786 against forward extension 810 coupled with this depression of movable upper handle 764 sets in motion: slidable jaw member 720 with track assembly 752; and also jaw hook 816; and also first hook 818; and also a substantial portion of spring 822 towards first compression surface 712 of fixed jaw member 710.

Movable upper handle 764 is fully manually rotated causing a forward section of release lever 824 (indicated by release lever tip 858) to contact a middle section of toggle 774 (indicated by toggle stop 860). Movable upper handle 764 is in a locked position when fully rotated. A rear section of release lever 824 (indicated by release lever end 862) is manually depressed with a result of rotating release lever 824 about rear axis 856, causing release lever tip 858 to pressure up off of toggle stop 860. The pressure release of release lever tip 858 from toggle stop 860 causes movable upper handle 764 to rotate away from line 846 at an increasing angle. The rotation of movable upper handle 764 away from line 846 is partly facilitated by a combination of tension from spring 822, track rivet 762, and second rivet 776. Tension from spring 822 urges slidable jaw member 720 with track assembly 752; and also jaw hook 816; and also first hook 818; and also a substantial portion of spring 822 away from first compression surface 712 of fixed jaw member 710.

The rotation of movable upper handle 764 away from line 846 is halted by a forward section of toggle 774 (indicated by toggle tip 864) contacting an integrally formed top section of movable upper handle 764 (indicated by top closed section 866). Top closed section 866 extends (from forward housing 766) substantially along a top length of movable upper handle 764 to integrally form a curved top section of first middle side wall 780 to a curved top section of second middle side wall 782. Movable upper handle 764 has a opposing side walls spaced parallelly apart with the an opening (indicated by movable upper handle opening 868) facing towards slotted opening 790. Movable upper handle opening 868 substantially extends along a bottom length of movable upper handle 868.

Varying the locking pressure, by the adjustment of the opposingly parallel measurement between first compression surface 712 and second compression surface 722, is accomplished by the threaded rotation of threaded screw 806. The constructed assembly (indicated by movable upper handle assembly 870) comprising: slidable jaw member 720 with track assembly 752; jaw hook 816; first hook 818; a substantial portion of spring 822; toggle 774; release lever 824; threaded screw 806; and movable upper handle 764 are urged towards terminal end 714 by manually rotating knurled end 812 in a first rotation direction. Movable upper handle assembly 870 is urged away from terminal end 714 by manually rotating knurled end 812 in a second rotation direction opposite to that of the first rotation direction.

As defined in this specification; operation of the preferred embodiments is as follows (FIG. 155): The mechanisms depicted in FIG. 155 are constructed and function similarly to the above-described mechanisms of FIG. 168, with the different features being: a single forged fixed jaw member 876 riveted to a support member. Substantially in some instances, fixed jaw member 876 generally adds degrees of strength; and reduces costs of fabrication and construction to an overall design. The overall width dimensions (when the width dimensions are measured from a top or bottom view of FIG. 168) of the comparable mechanisms of FIG. 168 to FIG. 155 (including fixed jaw members, slidable jaw members, release levers, slidable plates, toggles, rivets, threaded screws, springs, support members, hooks, lower handles, tension pins and movable upper handles) are the same.

As defined in this specification; operation of the preferred embodiments is as follows (FIG. 169): The mechanisms depicted in FIG. 169 are constructed and function similarly to the above-described mechanisms of FIG. 168, with the different features being: upper handle 872 and toggle 874 modified to accept comparable mechanisms of FIG. 168. The overall width dimensions (when the width dimensions are measured from a top or bottom view of FIG. 169) of the comparable mechanisms of FIG. 169 to FIG. 168 (including fixed jaw members, slidable jaw members, release levers, slidable plates, toggles, rivets, threaded screws, springs, support members, hooks, lower handles, tension pins and movable upper handles) are the same.

As defined in this specification; operation of the preferred embodiments is as follows (FIG. 112): The mechanisms depicted in FIG. 112 are constructed and function similarly to the above-described mechanisms of FIG. 168, with the different features being: a portion of track follower assembly mechanisms located centrally in a slotted support member; and also strengthening ribs located on each side of each slot of each side of the support member. Upper handle 360 is shortened in length and width (the width dimension measured from a top view of upper handle 360) as compared to movable upper handle 764.

Pins 386 and 388 are secured in slots 390 and 396 of support member 380. Slidable jaw member 376 travels in and is secured between the sides of support member 380 by pins 386 and 388.

As defined in this specification; operation of the preferred embodiments is as follows (FIG. 118): The mechanisms depicted in FIG. 118 are constructed and function similarly to the above-described mechanisms of FIG. 112, with the different features being: oval strengthening ribs located on each side of each slot of each side of a support member.

Substantially in some instances, oval strengthening ribs 412 and 414 add degrees of strength to an overall design. The overall width dimensions (when the width dimensions are measured from a top or bottom view of FIG. 118) of the comparable mechanisms of FIG. 118 to FIG. 112 (including fixed jaw members, slidable jaw members, slidable pins, release levers, toggles, rivets, threaded screws, springs, support members, hooks, lower handles, tension pins, and movable upper handles) are the same.

As defined in this specification; operation of the preferred embodiments is as follows (FIG. 119): The mechanisms depicted in FIG. 119 are constructed and function similarly to the above-described mechanisms of FIG. 118, with the different features being: a reduced side height dimension (the height dimension of slidable jaw member 416 measured from a side view) of slidable jaw member 416 as compared to the side height dimension slidable jaw member 376. The reduction of side height reduces the costs of fabrication and construction of slidable jaw member 416. The overall width dimensions (when the width dimensions are measured from a top or bottom view of FIG. 119) of the comparable mechanisms of FIG. 119 to FIG. 118 (including fixed jaw members, slidable jaw members, slidable pins, release levers, toggles, rivets, threaded screws, springs, support members, hooks, lower handles, tension pins and movable upper handles) are the same.

As defined in this specification; operation of the preferred embodiments is as follows (FIG. 120): The mechanisms depicted in FIG. 120 are constructed and function similarly to the above-described mechanisms of FIG. 118, with the different features being: fixed jaw member 418 and slidable jaw member 420 each has a flat compression surface. Each the flat compression surface of fixed jaw member 418 and slidable jaw member 420 to primarily engage parallelly opposed jaw receiving surfaces of a bolt head or nut (fasteners known in the art) and at times to secondarily engage angled surfaces interconnected to the parallelly opposed jaw receiving surfaces of a bolt head or nut (fasteners known in the art. The overall width dimensions (when the width dimensions are measured from a top or bottom view of FIG. 120) of the comparable mechanisms FIGS. 120 to 118 (including fixed jaw members, slidable jaw members, slidable pins, release levers, toggles, rivets, threaded screws, springs, support members, hooks, lower handles, tension pins and movable upper handles) are the same.

As defined in this specification; operation of the preferred embodiments is as follows (FIG. 121): The mechanisms depicted in FIG. 121 are constructed and function similarly to the above-described mechanisms of FIG. 112, with the different features being a single forged fixed jaw member 424 riveted to support member 422. Substantially in some instances, fixed jaw member 424 adds degrees of strength; and reduces costs of fabrication and construction to an overall design. The overall width dimensions (when the width dimensions are measured from a top or bottom view of FIG. 121) of the comparable mechanisms FIGS. 121 to 112 (including fixed jaw members, slidable jaw members, slidable pins, release levers, toggles, rivets, threaded screws, springs, support members, hooks, lower handles, tension pins and movable upper handles) are the same.

As defined in this specification; operation of the preferred embodiments is as follows (FIG. 122): The mechanisms depicted in FIG. 122 are constructed and function similarly to the above-described mechanisms of FIG. 121, with the different features being: extension 428 and extension 430 being integrally formed to slidable jaw member 426. Substantially in some instances, extension 428 and extension 430 add degrees of strength; and reduces costs of fabrication and construction to an overall design. The overall width dimensions (when the width dimensions are measured from a top or bottom view of FIG. 122) of the comparable mechanisms FIGS. 122 to 121 (including fixed jaw members, slidable jaw members, slidable pins, release levers, toggles, rivets, threaded screws, springs, support members, hooks, lower handles, tension pins and movable upper handles) are the same.

As defined in this specification; operation of the preferred embodiments is as follows (FIG. 124): The mechanisms depicted in FIG. 124 are constructed and function similarly to the above-described mechanisms of FIG. 112, with the different features being: squared pin 438 secured in and rotatable in slot 432, and squared pin 436 secured in and rotatable in slot 434. When compared to slidable squared pins that do not rotate (or structures of similar function), surface pressure on slots 432 and 434 is more uniformly distributed by the flat and rotatable contact surfaces of squared pins 438 and 436 contacting the parallel opposing contact surfaces of slots 432 and 434. The pressure releasing rotatable feature of squared pins 438 and 436 readily assists in releasing slidable jaw member 440 from the slotted support member (of FIG. 124) during the unlocking procedure of the movable upper handle (of FIG. 124). The overall width dimensions (when the width dimensions are measured from a top or bottom view of FIG. 124) of the comparable mechanisms of FIG. 124 to FIG. 112 (including fixed jaw members, slidable jaw members, slidable pins, release levers, toggles, rivets, threaded screws, springs, support members, hooks, lower handles, tension pins, and movable upper handles) are the same.

The mechanical principle of the rotatable feature of squared pins 438 and 436 is comparable to the mechanical principle of the rotatable feature of first slidable plate 754 and second slidable plate 758. When compared to slidable plates that do not rotate (or structures of similar function), the rotatable feature of first slidable plate 754 and second slidable plate 758 assists in releasing slidable jaw member 720 from support member 724 during the unlocking procedure of movable upper handle 764.

Figure 69:
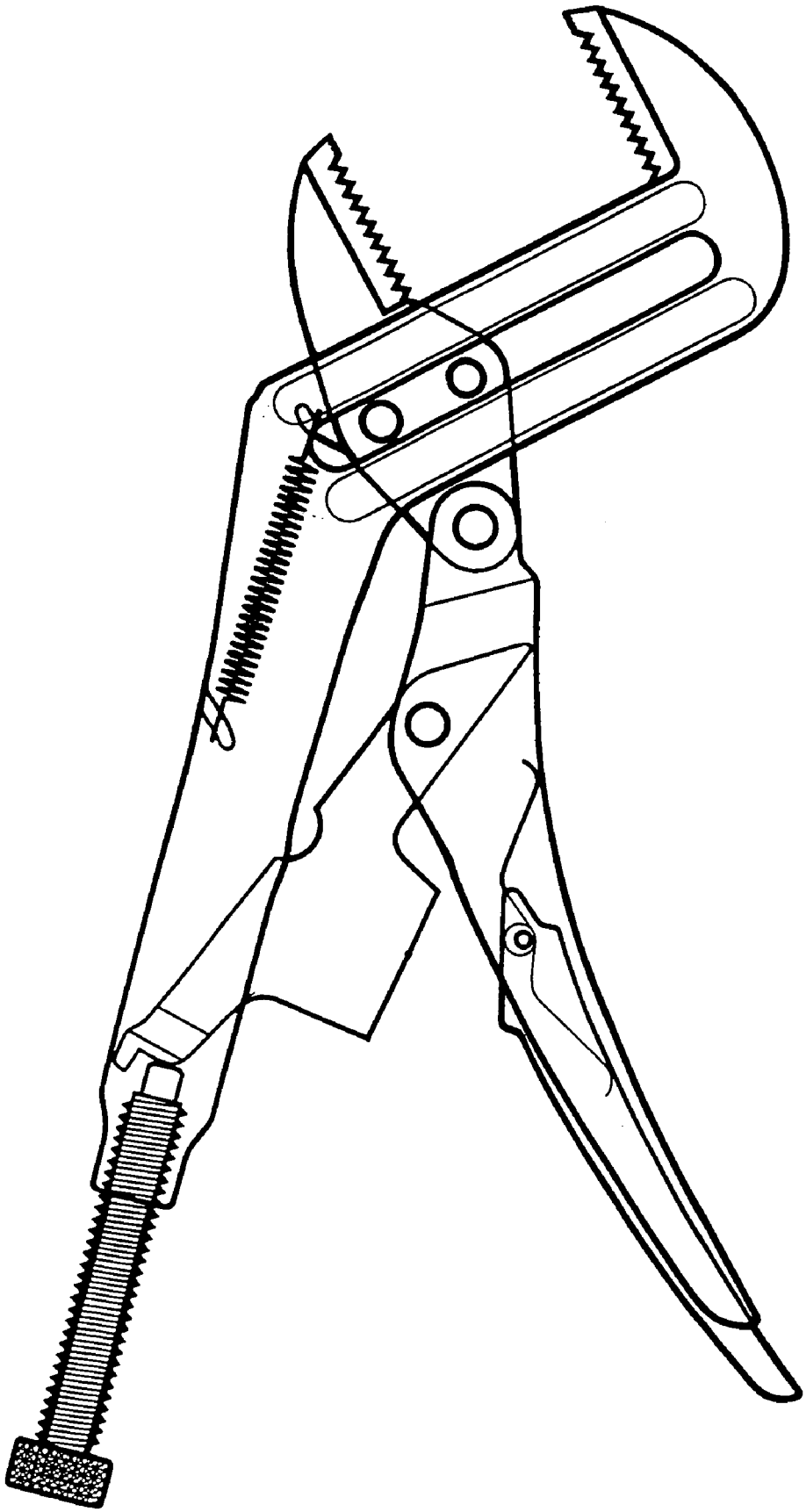
FIG. 69 - is a comprehensive side view showing overall dimensions of mechanisms in working relationship, with hidden mechanisms represented by thinner continuous lines. The thinnest lines of FIG. 69 represent the contours of part formation.

As defined in this specification; operation of the preferred embodiments is as follows (FIG. 69): The mechanisms depicted in FIG. 69 are constructed and function similarly to the above-described mechanisms of FIG. 169, with the different features being: track follower assembly mechanisms that are constructed and function similarly to the above-described track follower assembly mechanisms of FIG. 112. The overall width dimensions (when the width dimensions are measured from a top or bottom view of FIG. 69) of the comparable mechanisms of FIG. 69 to FIGS. 112 and 169 (including fixed jaw members, slidable jaw members, slidable pins, release levers, toggles, rivets, threaded screws, springs, support members, hooks, lower handles, tension pins, and movable upper handles) are the same.

As defined in this specification; operation of the preferred embodiments is as follows (FIG. 126): The mechanisms depicted in FIG. 126 function similarly to the above-described mechanisms of FIG. 69.

The adjustment of slidable jaw member 464 is as follows: Threaded knob 502 is rotated in a first direction with a result of pressuring slot plates 504 and 506, causing nut 508 to pressure sidable retainer 510 towards fixed jaw member 466; and slidable retainer 510 pressures pin 490 towards fixed jaw member 466; and pin 490 pressures toggle 450 and toggle extension 518, and rivet 456 towards fixed jaw member 466; and rivet 456 pressures upper handle 448, release lever 516, spring 512, and roll pin 452 towards fixed jaw member 466; and toggle extension 518 allows spring 514 to travel towards fixed jaw member 466; and upper handle 448 pressures rivet 458 towards fixed jaw member 466; and rivet 458 pressures slidable jaw member 464 and hook 460 towards fixed jaw member 466; and slidable jaw member 464 pressures pins 480 and 478 towards fixed jaw member 466; and hook 460 allows spring 514 to travel towards fixed jaw member 466.

The readjustment of slidable jaw member 464 is as follows: Threaded knob 502 is rotated in a second direction opposite to that of the first direction, with a result of pressuring slot plates 504 and 506 causing the opposite change of events that is above-described.

The clamping procedure of FIG. 126 is as follows: Upper handle 448 is manually depressed with a result of rotating release lever 516 contacting toggle 450; and the rotation of upper handle 448 pressures rivet 458 and 456; and rivet 458 pressures slidable jaw member 464; and slidable jaw member 464 pressures pins 480 and 478 in slots 482 and 520 of support member 468, with a result of slidable jaw member 464 clamping an object between fixed jaw member 466; and toggle 450 is held in place by pressuring pin 490 and rivet 456; and pin 490 is held in place by pressuring slidable retainer 510; and slidable retainer 510 is held in place by pressuring nut 508; and nut 508 is held in place by pressuring threaded knob 502; and threaded knob 502 is held in place by pressuring slot plates 504 and 506; and slot plates 504 and 506 are held in place by being crimped in slotted housing 454; and slidable retainer 510 is held in place by pressuring lower handle 446; and spring 514 is expanded between toggle extension 518 and hook 460.

The release of clamping pressure of the clamping procedure of FIG. 126 is as follows: Release lever 516 is manually depressed with a result of rotating up off of toggle 450; and spring 512 pressures an internal handle surface of upper handle 448, and an internal surface of release lever 516, and an outer circular surface of roll pin 452; and the depression of release lever 516 results in compressing spring 512 and pressuring roll pin 452; and the depression of release lever 516 results in the rotation upper handle 448; and the rotation of upper handle 448 causes the rotation of toggle 450; and the combined rotation of upper handle 448 and toggle 450 releases pressure from rivets 458 and 456; and the rotation of toggle 450 releases pressure from pin 490; and the release of pressure from rivet 458 causes the release of pressure from slidable jaw member 446; and the release of pressure from slidable jaw member 446 results in pins 478 and 480 being release from slots 482 and 520 of support member 468; and the release of pressure from pins 478 and 480 results in the release of slidable jaw member 446 from support member 468, with the result of releasing the clamped object from between said fixed jaw member 466 and the slidable jaw member 464; and spring 514 is contracted between hook 460 and toggle extension 518 assisting in the rotation of upper handle 448 and toggle 450, and also assisting in slidable jaw member 464 being pulled away from fixed jaw member 466; and the rotation of upper handle 448 is halted by contacting slidable jaw member 464; and spring 512 pressures release lever 516 back to a position occupied by release lever 516 before the depression release lever 516. Spring 512 is substantially formed from a circular wire material with sufficient tensioning qualities known in the art; and spring 512 is formed to a final shape depicted.

As defined in this specification; operation of the preferred embodiments is as follows (FIG. 138): The mechanisms depicted in FIG. 138 are constructed and function similarly to the above-described mechanisms of FIG. 126, with the different features being: a portion of upper handle 596 and release lever 600 constructed with a straight section. Substantially in some instances, the straight section of upper handle 596 and release lever 600 reduces costs of fabrication. The overall width dimensions (when the width dimensions are measured from a top or bottom view of FIG. 138) of the comparable mechanisms of FIG. 138 to FIG. 126 (including fixed jaw members, slidable jaw members, slidable pins, release levers, toggles, toggle extensions, rivets, threaded knobs, slot plates, springs, support members, hooks, slidable retainers, pins, nuts, lower handles, tension pins, and movable upper handles) are the same.

As defined in this specification; operation of the preferred embodiments is as follows (FIG. 145): The mechanisms depicted in FIG. 145 are constructed and function similarly to the above-described mechanisms of FIG. 126, with the different features being: a portion of release lever 616 constructed with a straight section 678. Substantially in some instances, the straight section 678 reduces costs of fabrication. The overall width dimensions (when the width dimensions are measured from a top or bottom view of FIG. 145) of the comparable mechanisms of FIG. 145 to FIG. 126 (including fixed jaw members, slidable jaw members, slidable pins, release levers, toggles, toggle extensions, rivets, threaded knobs, slot plates, springs, support members, hooks, slidable retainers, pins, nuts, lower handles, tension pins, and movable upper handles) are the same.

As defined in this specification; operation of the preferred embodiments is as follows (FIG. 165): The mechanisms depicted in FIG. 165 are constructed and function similarly to the above-described mechanisms of FIG. 126, with the different features being: A single spring performing the function of the two springs arrangement depicted in FIG. 126. Slidable jaw member 702 is modified (when compared to slidable jaw 464) to contact upper handle 692. Spring 694 is expanded between toggle 696 release lever 700; and spring 694 is attached to toggle extension 698 and spring attachment 706. The overall width dimensions (when the width dimensions are measured from a top or bottom view of FIG. 165) of the comparable mechanisms of FIG. 165 to FIG. 126 (including fixed jaw members, slidable jaw members, slidable pins, release levers, toggles, toggle extensions, rivets, threaded knobs, slot plates, support members, slidable retainers, pins, nuts, lower handles, tension pins, and movable upper handles) are the same.

As defined in this specification; operation of the preferred embodiments is as follows (FIG. 141): The mechanisms depicted in FIG. 141 are constructed and function similarly to the above-described mechanisms of FIG. 126, with the different features being: upper handle 602 constructed with spacer 608. Substantially in some instances, the handle plate and spacer construction of FIG. 141 reduces costs of fabrication. The overall width dimensions (when the width dimensions are measured from a top or bottom view of FIG. 141) of the comparable mechanisms of FIG. 141 to FIG. 126 (including fixed jaw members, slidable jaw members, slidable pins, release levers, toggles, toggle extensions, rivets, threaded knobs, slot plates, springs, support members, hooks, slidable retainers, pins, nuts, lower handles, tension pins, and movable upper handles) are the same.

As defined in this specification; operation of the preferred embodiments is as follows (FIG. 144): The mechanisms depicted in FIG. 144 are constructed and function similarly to the above-described mechanisms of FIG. 141, with the different features being: Upper handle 672 is constructed with spacer 614. Spacer 614 has raised portion 674 offering a greater degree of hand grip to upper handle 672, when the hand grip of handle 672 is compared to the hand grip of upper handle 602. The overall width dimensions (when the width dimensions are measured from a top or bottom view of FIG. 144) of the comparable mechanisms of FIG. 144 to FIG. 141 (including fixed jaw members, slidable jaw members, slidable pins, release levers, toggles, toggle extensions, rivets, threaded knobs, slot plates, springs, support members, hooks, slidable retainers, pins, nuts, lower handles, tension pins, spacers, and movable upper handles) are the same.

As defined in this specification; part fabrication of the above-identified invention is as follows:

FIG. 170 depicts the working relationship of mechanisms (some details not shown being hidden from view) being under spring tension - with jaw members in the fully open position. FIG. 170 is an alternate design to that of FIG. 165.

FIG. 171 is a side view of lower handle 974 formed by similar shearing/bending processes as that of lower handle 446, with differences being: lower handle 974 is slightly longer in overall length than lower handle 446; lower 446 has no slots in the support member 976; and lower handle 446 has a hand grip extension 978.

FIG. 172 depicts a narrowing forward section of hand grip extension 978 formed to a final shape by a bending process.

FIG. 173 depicts hand grip extension 978 having a forward channel 980 formed with sidewalls spaced apart.

FIG. 174 depicts the working relationship of mechanisms (some details not shown being hidden from view) being under spring tension - with jaw members in the fully open position. FIG. 174 is an alternate design to that of FIG. 112.

FIG. 175 depicts upper handle 982 formed by similar shearing/bending processes to that of upper handle 360; with differences being straight sidewalls 984 and 986 formed rearward from forward housing 988 (as depicted in FIG. 175A); rivet hole 990 is formed closer to the forward most rivet hole 992 of upper handle 982, as compared to the rivet hole locations of upper handle 360; and upper handle 982 has no rearward roll pin hole of the type utilized by upper handle 360.

FIG. 176 depicts the working relationship of mechanisms (some details not shown being hidden from view) being under spring tension - with jaw members in the fully open position. FIG. 176 is an alternate design to that of FIG. 168.

FIG. 178 depicts upper handle 994 formed by similar shearing/bending processes to that of movable upper handle 764; with differences being straight sidewalls 996 and 998 formed rearward of forward housing 1000, and formed the entire length of upper handle 994 (as depicted in FIG. 177); rivet hole 1002 and rivet hole 1004 are formed apart lengthwise with a greater spaced distance (as measured from the side view shown) as compared to the locations of rivet holes 990 and 992 of upper handle 982; and upper handle 994 has no rearward roll pin hole of the type utilized by upper handle 764.

FIG. 179 depicts the working relationship of mechanisms (some details not shown being hidden from view) being under spring tension - with jaw members in the fully open position. FIG. 179 is an alternate design to that of FIG. 174.

FIG. 180 depicts straight sidewalls 1012 and 1014 that are formed rearward from forward housing 1016.

FIG. 181 depicts upper handle 1006 - formed from a flat piece of sheet steel by a shearing process that produces a basic shape outline of upper handle 1006, the rivet holes 1008 and 1010 are punched or drilled through, and then the final shape of upper handle 1006 is formed by a bending process. The lengthwise spacing of rivet holes 1010 and 1008 is the same distance as the lengthwise spacing of rivet holes 992 and 990.

FIG. 182 depicts the working relationship of mechanisms (some details not shown being hidden from view) being under spring tension - with jaw members in the fully open position, with the motion of unlocking a toggle release link also shown. FIG. 182 is an alternate design to that of FIG. 179.

FIG. 183 depicts the working relationship of mechanisms (some details not shown being hidden from view) being under spring tension - with jaw members in the fully open position, with the motion of unlocking a toggle release link also shown. FIG. 183 is an alternate design to that of FIG. 182. FIG. 183 does not use rivets to secure the upper fixed jaw insert as is depicted in FIG. 182.

FIG. 184 depicts straight sidewalls 1020 and 1022 that are formed rearward from forward housing 1024.

FIG. 185 depicts upper handle 1018 - formed from a flat piece of sheet steel by a shearing process that produces a basic shape outline of upper handle 1018, the rivet holes 1028 and 1026 are punched or drilled through, and then the final shape of upper handle 1018 is formed by a bending process. The lengthwise spacing of rivet holes 1026 and 1028 is the same distance as the lengthwise spacing of rivet holes 1004 and 1002.

FIG. 186 depicts the working relationship of mechanisms (some details not shown being hidden from view) being under spring tension - with jaw members in the fully open position. FIG. 186 is an alternate design to that of FIG. 170.

FIG. 187 depicts straight sidewalls 1030 and 1032 that are formed rearward from forward housing 1034.

FIG. 188 depicts upper handle 1040 - formed from a flat piece of sheet steel by a shearing process that produces a basic shape outline of upper handle 1040, the rivet holes 1038 and 1036 are punched or drilled through, and then the final shape of upper handle 1040 is formed by a bending process. The lengthwise spacing of rivet holes 1036 and 1038 is a shorter distance than the lengthwise spacing of rivet holes 990 and 992 of upper handle 982.

FIG. 189 depicts curved sidewalls 1042 and 1044 that are formed rearward from forward housing 1046.

FIG. 190 depicts upper handle 1052 - formed from a flat piece of sheet steel by a shearing process that produces a basic shape outline of upper handle 1052, the rivet holes 1048 and 1050 and roll pin hole 1054 are punched or drilled through, and then the final shape of upper handle 1040 is formed by a bending process. The lengthwise spacing of rivet holes 1050 and 1048 is the same distance as the lengthwise spacing of rivet hole 784 to that of the other rivet hole of movable upper handle 764.

FIG. 191 depicts toggle 1056 with a widen width dimension to a pivot end 1058 formed while hot by a pressing process.

FIG. 192 depicts toggle 1056 with a flat release lever compression surface - formed by a shearing and/or machining process.

FIGS. 193 and 194 depict release lever 700 as being formed by similar techniques as taught by FIG. 137.

FIGS. 195 and 196 depict toggle 696 as being formed by similar techniques as taught in the art by shearing/punching process, whereby such process tapers a terminal from being rectangularly shaped.

FIGS. 197 and 198 depict upper handle 692 as being formed by similar techniques as taught by FIG. 139.

FIGS. 199 and 200 depict spring 694 as being formed by techniques well known in the art to form wire being under substantial coil tensioning pressure.

FIGS. 201 and 202 depict spring 512 as being formed by techniques well known in the art to form wire being under substantial tensioning pressure.

FIG. 203 depicts slidable jaw member 420 as being formed with a flat compression surface.

FIG. 204 depicts jaw insert 418 as being formed with a flat compression surface.

FIGS. 205 and 206 depict toggle 362 as being formed by shearing/punching and stamping techniques known in the art.

FIGS. 207 and 208 depict adjustment screw 134 formed by techniques well known in the art.

FIGS. 209 and 210 depict release lever 130 formed by techniques as taught by well known in the art.

FIG. 211 depicts toggle 1062 with a shortened rounded toggle tip 1064 formed by shearing and/or machining processes.

FIG. 212 depicts toggle 1062 with a widen width dimension to a pivot end 1066 formed while hot by a pressing process.

FIG. 213 depicts toggle 1068 with a shortened narrowed toggle tip 1070 formed by shearing and/or machining processes.

FIG. 214 depicts toggle 1068 with a widen width dimension to a pivot end 1072 formed while hot by a pressing process.

FIG. 215 depicts toggle 1074 and a toggle extension 1076 formed by a pressing and shearing and/or machining process mechanism known in the art.

FIG. 216 depicts toggle 1074 having rivet hole 1078, pin hole 1080, and spring attachment hole 1082 formed by a punching and/or drilling process known in the art; before or after the final outer shape of toggle 1074 is formed.

FIG. 217 depicts toggle release link 1084 having spaced straight sidewalls 1086 and 1088 formed rearward of a forward housing 1090.

FIG. 218 depicts toggle release link 1084 having rivet hole 1092 formed forward of countersunk rivet hole 1094. Toggle release link 1084 is sheared from a flat piece of sheet steel to a first shape; rivet hole 1092 and countersunk rivet hole 1094 are punched and/or drilled through, countersunk rivet hole 1094 is reamed or pressed to a final countersunk shape; toggle 1084 is folded and bent to a final shape.

FIG. 219 depicts toggle release link 1096 having spaced straight sidewalls 1098 and 1100 formed rearward of a forward housing 1102.

FIG. 220 depicts toggle release link 1096 having rivet hole 1104 and countersunk rivet hole 1106 formed with a lengthwise distance further apart as compared to the lengthwise distance between rivet hole 1092 and countersunk rivet hole 1094 (as measured from the side view). Toggle release link 1096 has a greater overall length dimension than toggle release link 1084, otherwise - toggle release link 1096 is formed by the same forming processes as toggle release link 1084.

FIG. 221 depicts toggle release link 1108 having spaced straight sidewalls 1110 and 1112 formed rearward of a forward housing 1114.

FIG. 222 depicts toggle release link 1108 having rivet hole 1116 and countersunk rivet hole 1118 formed with a lengthwise distance closer together as compared to the lengthwise distance between rivet hole 1092 and countersunk rivet hole 1094 (as measured from the side view). Toggle release link 1096 has the same overall length dimension as compared to the overall length dimension of toggle release link 1084; toggle release link 1096 has a curved shape to forward housing 1114 as compared to the forward housings 1102 and 1090; otherwise - toggle release link 1108 is formed by the same forming processes as toggle release link 1084.

FIG. 223 depicts rivet 1130 being formed to a final shape by a riveting process; and obviously, rivet 1130 is first cylindrical in shape during the construction of a movable upper handle (generically describing upper handle designs as taught herein) attachable to a movable slidable jaw member (generically describing slidable members as taught herein) such the type as depicted in FIG. 170.

FIG. 224 depicts release link rivet 1140 being formed to a final shape by a riveting process; and release link rivet 1140 is first cylindrical in shape during the construction of toggle 1074 attachable to toggle release link 1108. The ends of release link rivet 1140 are formed (flared out) by a riveting process and then these flared ends 1194 and 1196 are pressed or machined flat, in contrast to the convex flared ends as depicted by rivet 1130.

FIGS. 225 and 226 depict upper handle 1126 as being formed to a final shape by a shearing/punching and bending process.

FIGS. 227 and 228 depict toggle 1134 as having an integral extensions 1196 and 1198 formed by a machining process that substantially forms the final shape of toggle 1134.

FIG. 229 depicts an alternate design to that of FIG. 186. The fabrication of mechanical parts that make up the alternate design of FIG. 229 are described throughout this specification; and these mechanical parts of FIG. 229 are made separately identifiable by transparently superimposing (from the side view) any mechanical parts as previously described throughout this specification, which exactly outline the mechanical parts as depicted in FIG. 229; and these superimposed mechanical counterparts are meant to three dimensionally represent the mechanisms of FIG. 229.

FIG. 230 is an alternate design to that of FIG. 229. FIG. 230 depicts upper handle 1188 as being formed by techniques similar to those techniques as taught by FIG. 175.

FIGS. 231 and 232 depict upper handle 1188 as being formed with a curved palm rest arc of the type shown in FIG. 168A.

FIG. 233 depicts rotatable plate 1190 as being formed by a shearing/punching process.

FIG. 234 depicts rotatable plate 1192 as being formed by a shearing/punching process.

As defined in this specification; construction of parts for the Invention is as follows (FIG. 176): Toggle 1062 is placed in toggle release link 1096, and release link rivet 1152 is placed in countersunk rivet hole 1106 and then is riveted into place - securing toggle 1062 in toggle release link 1096. The assembled toggle release link 1096 is then placed into upper handle 994. Rivet 1154 is placed through rivet hole 1002 and 1104, then rivet 1154 secures toggle release link 1096 - in upper handle 994 by being riveted into place. Slidable plates 1144 and 1146 (slidable plate 1146 - hidden from view) are slid over the outer side width dimension of lower slidable jaw member 1148. Upper handle 994 has forward housing 1000 that is slid over slidable plates 1144 and 1146 and slidable jaw member 1148. Rivet 1150 is slid through rivet hole 1004 and through the rivet holes of slidable plates 1144 and 1146 and slidable jaw member 1148; and rivet 1150 secures slidable plates 1144 and 1146 and slidable jaw member 1148 by being riveted to a final shape. The remaining mechanisms of FIG. 174 are assembled with the same techniques as taught by FIG. 168. Rivets 1154 and 1150 are fabricated with the same width and length dimensions as rivet 1130. Release link rivet 1152 is fabricated with the same width and length dimensions as release link rivet 1140.

As defined in this specification; construction of parts for the Invention is as follows (FIG. 179): The mechanisms of FIG. 179 are assembled with the same construction techniques as taught by FIG. 174; the only difference being a different shape to upper handle 1006 as compared to upper handle 982.

As defined in this specification; construction of parts for the Invention is as follows (FIG. 186): Toggle 1074 is placed in toggle release link 1108, and release link rivet 1156 is placed in countersunk rivet hole 1118 and then is riveted into place - securing toggle 1074 in toggle release link 1108. The assembled toggle release link 1108 is then placed into upper handle 1040. Rivet 1158 is placed through rivet hole 1038 and 1116, then and rivet 1158 rotatably secures toggle release link 1108 - in upper handle 1040 by being riveted into place. Pin 1160 is positioned in pin hole 1080. Spring 1162 is attached to toggle extension 1076 by being hooked through attachment hole 1082. The remaining mechanisms of FIG. 186 are assembled with the same techniques as taught by FIG. 126 and FIG. 170. Rivet 1158 is fabricated with the same width and length dimensions as rivet 1030. Release link rivet 1156 is fabricated with the same width and length dimensions as release link rivet 1140. Pin 1160 is fabricated with the same width and length dimensions as pin 490. Spring 1162 is fabricated with the same width and length dimensions and tension load as spring 514.

As defined in this specification; operation of the preferred embodiments is as follows:

FIG. 170 has hand grip extension 978 extending downward from support member 976, hand grip extension 978 adds support to the hand grip surface on which to place the fingers so that slippage of the finger grip is minimized. Extensions 1198 and 1200 substantially centralize toggle 1134 in upper handle 1126. The remaining mechanisms of FIG. 170 operate in the manner as taught by FIGS. 165 and 155.

FIG. 174 has toggle release link 1084 replacing the mechanical advantages as taught by the mechanisms: release lever 130, rivet 368, and toggle 362 (as depicted in FIG. 112) by providing an additional pivot point - as defined by the central axis point 1164 of rivet 1142; and a movable pivot point - as defined by central axis point 1166 of release link rivet 1140. Upper handle 982 is rotated through an arc downward towards fixed lower handle 1168, this handle rotation brings in line - central axis point 1164, central axis point 1166, central axis point 1170 of rivet 1172, and pivot axis point 1174 - defined as the contact point of adjustable screw 1176 to pivot end 1072; this point alignment 1178 (indicated by the dashed line) is measured as a 180 degree angle, which has the result of locking the pliers onto a work piece.

The combined function of the toggle release link 1084 with toggle 1068 provides gained mechanical leverage during the unlocking of a clamped object (unlocking the toggle) - where the upper handle 982 is now easily rotated upwards away from fixed lower handle 1168 (as depicted by the dashed lines in FIGS. 182 and 183). This upwards rotation of upper handle 982 efficiently and substantially rotates toggle release link 1084 and toggle 1068 a direction so that central axis point 1164 and central axis point 1166 are now move out of point alignment 1178 as measured by the 180 degree angle. The toggle 1068 is now unlocked and the adjustment screw 1176 can be rotated for another clamping procedure.

The previously described substantial 180 degree measurement of the plane depicted by the dashed line of point alignment 1178 - is the end of rotation (of the mechanisms which are measured along this line) of upper handle 982 traveled through an arc during the clamping of an object. The remaining mechanisms of FIG. 174 operate in a manner that is comparable to the comparable mechanisms as taught by FIG. 112.

The combination of toggle release link 1084 and toggle 1068 configured in a working relation with upper handle 982; generally, facilitates a handle configuration (when considering such handle configuration applies to the other Drawing Figures employing a toggle release link) that allows for a greater jaw capacity, since the toggle release link 1084 combined with toggle 1068 (this release link/toggle configuration—depicted in FIGS. 176, 179, 182, 183, and 186) of FIG. 174 - offers a greater range ofjaw travel over support member 976. The greater range jaw of travel is due to the fact that the rearward handle end 1180 has a greater range of rotation before reaching an undesirable close distance from fixed lower handle 1168. This greater range of upper handle 982 travel and rotation is compared to the lesser range of handle travel and rotation of upper handles 360 or 448, which are limited by the need to rotate toggle release levers during the toggle unlocking procedure.

FIG. 186 has toggle release link 1108 and toggle 1074 - that operate in a manner similar to FIGS. 174, 176, 179, 182, and 183, while also providing toggle adjustment screw 1182 - with the advantage of being substantially housed in the lower handle section 1184 at all times (during adjustment or otherwise). This has the advantage of reducing the overall length of the pliers (as compared to the overall of the pliers in the other Drawing Figures not incorporating a slidable retainer - such as type taught by slidable retainer 510). This reduced overall length is particularly beneficial in small work space areas - where it is awkward to manipulate pliers properly. The adjustment screw 1182 has a greater travel range as compared to the travel range of threaded knob 502. This greater travel range takes advantage of the space offered by the incorporation of hand grip extension 1186.

The remaining mechanisms of FIG. 186 operate in a manner similar to the mechanisms depicted in FIGS. 126, 138, 141, 144 and 145.

FIG. 229 operates in a manner similar to FIG. 186, with the difference in being that FIG. 229 has no central slots constructed substantially in - what has been commonly referred to herein and connected herewith as; the support member structure of the invention. The operation of such support member structure previously described above—has already been taught in this specification by FIG. 168. The operation of the remaining mechanisms of FIG. 229 have been taught by FIG. 186.

FIG. 230 operates in a manner similar to FIG. 229, with the difference being that FIG. 230 has handle 1188 operating in a manner as taught by FIG. 168. It should been known handle 1188 does not have a release lever as taught by FIG. 168; however, the comparable handle mechanisms of FIG. 230 to that of FIG. 168 (and in particular the substantially arc shape of handle 1188) operate similarly.

FIGS. 233 and 234 are rotatable plates 1190 and 1192: It should be known that it is obvious for one having ordinary skill in the field to have rotatable plates 1190 and 1192 substitutable for (meaning construable in place of and performing as a replacement functionality of any slidable plate combinations as taught through out this specification herein) slidable plates 1120 and 1122, or slidable plates 1144 or 1146, or first slidable plate 754 and second slidable plate 758, or slidable plate 632 and 634. The operation of rotatable plates 1190 and 1192 is as follows: Rotatable plates 1190 and 1192 are substantially rotatable along the structure that has been taught herein (and commonly referred to) as a support member; rotatable plates 1190 and 1192 are riveted contiguous to the structure that has been commonly referred to (and as taught) herein as the sides of the inside of a forward housing of an upper handle respectively; rotatable plates 1190 and 1192 are riveted contiguous to the structure that has been commonly referred to (and as taught) herein as the outside sides of the structure that has been commonly referred to (and as taught) herein as a slidable jaw member; and attachment point 1202 is described as the point in between where the slidable jaw member (as described above) has a substantial riveted pivotal attachment point to the previously above-described forward housing of the previously above-described upper handle respectively.

FIG. 235 illustrates rotatable plates 1190 and 1192 as being spaced apart in parallel and this parallel spacing is described as attachment point 1202.

FIG. 236 illustrates adjustment screw 1182 as having a longer threaded section—when such longer threaded section of adjustment screw 1182 is compared to the threaded section of threaded knob 502. Adjustment screw 1182 is substantially rotatable in operation and is comparable in function as taught by threaded knob 502 herein.

FIG. 237 depicts the working relationship of mechanisms (some details not shown) being under spring tension - with jaw members in an open position. Slidable jaw member 1204 (having identical dimensions to that of slidable jaw member 426) is placed between the support member 1206 (having identical dimensions to that of support member 138) before support member 1206 is riveted to fixed jaw member 1208.

FIG. 238 depicts the working relationship of mechanisms (some details not shown) being under spring tension - with jaw members in an open position. Slidable jaw member 1210 (having identical dimensions to that of slidable jaw member 12) is placed between the support member 1212 (having identical dimensions to that of support member 976) before support member 1212 is riveted to fixed jaw member 1214.

FIG. 239 depicts the working relationship of mechanisms (some details not shown) being under spring tension - with jaw members in an open position. Slidable jaw member 1216 is placed between support member 1218 before support member 1218 is welded together to accept fixed jaw member 1220. The remaining mechanisms of FIG. 239 are fabricated and constructed as taught by FIG. 174.

FIGS. 240 and 241 show upper handle 1222 being fabricated and constructed as taught by upper handle 982.

FIG. 242 depicts the working relationship of mechanisms (some details not shown) being under spring tension - with jaw members in an open position. Slidable jaw member 1224 is slid between support member 1226; and slidable jaw member 1224 is then riveted to upper handle 1228. The remaining mechanisms of FIG. 242 are fabricated and constructed as taught by FIG. 176.

FIG. 243 depicts the working relationship of mechanisms (some details not shown) being under spring tension - with jaw members in an open position. FIG. 243 is an alternate design to that of FIG. 242 with fixed jaw member 1230 being attachable to support member 1232 by a riveting process. The remaining mechanisms of FIG. 243 are fabricated and constructed as taught by FIGS. 242 and 168A.

FIG. 244 is slidable jaw member 1234 being fabricated and constructed by similar techniques as taught by slidable jaw member 126.

FIG. 245 depicts the working relationship of mechanisms (some details not shown) being under spring tension - with jaw members in an open position. FIG. 245 is an alternate design to that of FIG. 239; and is fabricated and constructed as taught by FIGS. 239 and 174.

FIGS. 246 and 247 (FIG. 247 shows a rivet hole 1242) is toggle release link 1236 showing a bend 1238. Toggle release link 1236 being fabricated and constructed similar to that as taught by toggle release link 1108.

FIG. 248 is toggle 1240 being fabricated and constructed by techniques as taught by toggle 1062 and 1068.

FIG. 249 is upper handle 1244 showing toggle stop tabs 1246 and 1248 being bent to a final shape by a pressing process after being sheared/stamped to a first shape out of a flat piece of sheet steel.

FIG. 250 is upper handle 1244 showing the position of rivet hole 1250 and 1252. Upper handle 1244 being fabricated and constructed by techniques as taught by upper handles 1222 and 982.

FIG. 251 is adjustment screw 1254 being fabricated and constructed by techniques as taught by adjustment screw 134.

FIG. 252 is slidable jaw member 1216 with extensions 1256 and 1258 having rounded edges.

FIG. 253 is slidable jaw member 1216 being fabricated and constructed by similar techniques as taught by slidable jaw member 426.

FIG. 254 is lower handle 1260 having an opening 1262 and a weld seam 1264 being fabricated and constructed by techniques as taught by lower handle 358 and fixed jaw member 378.

FIG. 255 is lower handle 1260 showing fixed jaw member 1220 and support member 1218 being fabricated and constructed by techniques as taught by lower handle 358, fixed jaw member 378, and support member 724.

FIG. 256 shows spring 1266 being fabricated and constructed by techniques as taught by spring 20; and FIG. 256 depicts the working relationship of mechanisms (some details not shown) being under spring tension - with jaw members in an open position; and FIG. 256 is fabricated and constructed as taught by FIGS. 239, 174, 170, and 235.

FIG. 257 is lower handle 1268 being fabricated and constructed as taught by FIGS. 239, 174, 170, and 235.

FIG. 258 is lower handle 1268 with hook 1270 being fabricated and constructed as taught by FIGS. 1A, 2 and hook 22.

FIG. 259 is lower handle 1268 showing parallel spaced strengthening ribs 1272 and 1274 being fabricated and constructed as taught by FIGS. 239, 176, and 235.

FIG. 260 is toggle release link 1276 being fabricated and constructed as taught by FIGS. 221, 222 and toggle release link 1108.

FIG. 261 is upper handle being fabricated and constructed as taught by FIGS. 240, 241, 175A, 175 and upper handle 982.

FIG. 262 is toggle 1280 with toggle extension 1282 being fabricated and constructed with similar techniques as taught by FIG. 215 and toggle 1074.

FIG. 263 is slidable jaw member 1284 being fabricated and constructed as taught by FIGS. 237, 245, 123 and slidable jaw member 426.

FIG. 264 is slidable jaw member 1210 and upper handle 1286 being fabricated and constructed as taught by combining FIGS. 1, 169 and 170.

FIG. 265 is slidable jaw member 1216 and upper handle 1222 being fabricated and constructed as taught by combining FIGS. 122, 176, and 174.

FIG. 266 is slidable jaw member 1234 and upper handle 1288 (upper handle 1288 fabricated and constructed as taught by upper handles 1228 and 994) being fabricated and constructed as taught by FIGS. 238 and 168A.

FIG. 267 is slidable jaw member 1204 and upper handle 1290 (upper handle 1290 fabricated and constructed as taught by upper handle 148) being fabricated and constructed as taught by combining FIGS. 122 and 37. The mechanical principles of FIG. 267 are taught by FIG. 163 and slidable jaw member 428.

As defined in this Specification the operation of the preferred embodiments is as follows:

FIG. 239: Slidable jaw member 1216 is urged towards fixed jaw member 1220 (formed by weld seam 1264) when upper handle 1222 is compressed. Opening 1262 allows for slidable jaw member 1216 traveling substantially parallel in support member 1218 - by extension 1256 contiguously contacting strengthening rib 1292 and extension 1258 contiguously contacting strengthening rib 1294. The function of the remaining mechanisms of FIG. 239 are comparable in operation as taught by FIGS. 168, 168A, 122 and 174.

FIG. 243 is the Preferred Embodiment: Slidable jaw member 1234 is urged towards fixed jaw member 1230 when upper handle 1288 is compressed. Slidable jaw member 1234 travels substantially parallel in support member 1232 by rivet 1296 contiguously contacting support member 1232. The function of the remaining mechanisms of FIG. 243 are comparable in operation as taught by the FIGS. 168, 168A, and as taught within the context of the Specification.

FIG. 245: Slidable jaw member 1298 is urged towards fixed jaw member 1300 when upper handle 1244 is compressed. The slidable substantially parallel movement of slidable jaw member 1298 in support member 1302 is made possible by extensions 1304 and 1306 contiguously contacting strengthening ribs 1308 and 1310. Rivet 1250 attaches upper handle 1244 to slidable jaw member 1298. Rivet 1252 attaches toggle release link 1236 to upper handle 1244. Toggle release link 1236 is mountable to toggle 1240 by use of rivet 1312. Adjustment screw 1254 contacts toggle 1240 at contact point 1314. Adjustment screw 1254 is turned therefore adjusting slidable jaw member 1298 in relation to fixed jaw member 1300. When upper handle 1244 is compressed to a locked position, bend 1238 contacts contact point 1316 of toggle 1240. When upper handle 1244 is opened to an unlocked position, bend 1238 of toggle release link 1236 contacts toggle stop tabs 1246 and 1248. The function of the remaining mechanisms of FIG. 245 are comparable in operation as taught by FIGS. 239, 168, 168A, 122 and 174.

FIG. 256: Slidable jaw member 1284 is urged towards fixed jaw member 1318 when upper handle 1278 is compressed. Slidable jaw member 1284 travels substantially parallel in support member 1320 - by extension 1322 contiguously contacting strengthening rib 1272 and extension 1324 contiguously contacting strengthening rib 1274. Toggle release link 1276 is rotatable to make contact with contact point 1326 of toggle 1280 when upper handle 1278 is compressed to a locked position. When upper handle 1278 is opened to an unlocked position toggle extension 1282 contacts rivet 1328. Spring 1266 attaches to hook 1270. Spring 1266 attaches to hook 1330. The function of the remaining mechanisms of FIG. 256 are comparable in operation as taught by FIGS. 239, 168, 168A, 122, 170 and 174.

FIG. 237: All of the necessary parts to disclose the Invention are depicted in FIG. 237 and FIG. 267. Any and/or all of such combined parts (of FIG. 237) - by being combined in a workable relationship (at the time of such combination thereby disclosing the Invention) teach how to create the Invention. Since any and/or all of such comparable parts are interchangeable among the various Drawing Figures; the engineering of the rearrangement of mechanisms of the various Drawing Figures (thereby disclosing FIG. 237) disclose the Invention.

FIG. 238: All of the necessary parts to disclose the Invention are depicted in FIG. 238 and FIG. 264. Any and/or all of such combined parts (of FIG. 238) - by being combined in a workable relationship (at the time of such combination thereby disclosing the Invention) teach how to create the Invention. Since any and/or all of such comparable parts are interchangeable among the various Drawing Figures: the engineering of the rearrangement of mechanisms of the various Drawing Figures (thereby disclosing FIG. 238) disclose the Invention.

It is understood: Combining two of the related two dimensional Drawing Figures depicted herein (for example, combining a side view with a bottom view of the same part) contains the necessary information for the deduction of a third dimensional view from the related two dimensional Drawing Figures depicted herein; and therefore, the Invention is taught constructible by engineering the following mechanisms of the Drawing Figures as depicted and described herein.

It is also understood: Combining two of the related two dimensional Drawing Figures depicted herein (for example, combining a side view with a top view of the same part) contains the necessary information for the deduction of a third dimensional view from the related two dimensional Drawing Figures depicted herein; and therefore, the Invention is taught constructible by engineering the following mechanisms of the Drawing Figures as depicted and described herein.

It is further understood: Any part and/or parts (that disclose the Invention) taught throughout the Specification as being constructed in a workable relationship (combined to disclose the Invention) - is/are comparable in function to any other part and/or parts; when any such part and/or parts disclose(s) the same dimensions (any such comparable part and/or parts dimensions are indicated by measurement taken from the matching side view(s) and/or top view(s) and/or bottom view(s) ) as the dimensions of any such other part and/or parts (any such comparable other part and/or parts dimensions are also indicated by measurement taken from the matching side view(s) and/or top view(s) and/or bottom view(s) ). Therefore, the interchangeability of the comparable part and/or parts defined as such: (as depicted in the Drawing Figures and described in the Specification) teach how to create the preferred embodiments and alternate embodiments of the Invention.

It is therefore understood; from the information which was taught by the preceding depiction and description of the alternate embodiments and preferred embodiments, as defined in the Specification and Drawing Figures, that the objectives of Parallel Jaw Locking Toggle Wrench/Pliers with Economic/Ergonomic Handles (the Invention) have been fully reached.

It is therefore further understood; from the taught preceding depiction and description of the preferred embodiment(s) herein, within the applicable Patent Statues: the construction technictues and operation of mechanisms were presented so as to convey a working knowledge of the Invention in a way: "as to enable any person skilled in the art to which it pertains, or with which it is most nearly connected, to make and use the same"; and also, so as to convey a working knowledge of creating and utilizing the Invention in: "the best mode contemplated by the inventor of carrying out his invention."; and furthermore, as was taught in the preceding depiction and description of the alternate and preferred embodiments herein: the construction techniciues and operation of mechanisms of the Invention were additionally presented so as to inform: that there are a multitude of design modifications and/or design variations of the Invention which are possible from an engineering perspective; and as such, the information herein is not exhaustive in any way; and also as such, the information herein is not to be contemplated, or construed, or deemed, as limiting the essential spirit and/or scope of the Invention to a precise design feature, and/or a precise design form, and/or a precise design use, as was taught herein.

It is therefore still further understood; the appended and allowed Genus claim, Species claims and Dependent claims cover any and all combination(s) of generic and specific mechanism(s) constructed in a workable relationship which disclose the Invention; and furthermore; as was taught in the preceding comparable parts of the Invention herein, within the applicable Patent Statues: the interchangeability of parts of the Invention were presented so as to inform: that any and all engineering effort(s) to construct the Invention, and/or engineering efforts to construct the Invention by designing around the Invention, including the reverse engineering of the Invention; will be viewed, construed, and deemed, at the time of any and all such engineering effort(s), as being: "obvious at the time the invention was made to a person having ordinary skill in the art"; and as such, the information herein serves to inform and additionally warn: that any and all such above-described engineering effort(s) regarding the Invention, whether such engineering effort(s) are successful or not, infringe(s) upon the allowed claims.

What is claimed is:

1. An adjustable hand tool substantially embodying a wrench or pliers comprising:

a fixed jaw member having a first compression surface disposed substantially in a first plane and having a terminal end;

a substantially rectangularly shaped support member having a substantially rectangularly shaped middle section with accurate guide surfaces; said accurate guide surfaces of said middle section having a forward side wall opposingly spaced parallelly apart from a rearward side wall; said support member having an interconnecting means for substantially integrally connecting to said fixed jaw member, at an area substantially where the accurate guide surfaces of said middle section have said forward side wall and said rearward side wall respectively; said middle section of said support member extending substantially at a right angle to and rearwardly from said first compression surface;

a substantially rectangularly shaped fixed lower handle having a spaced forward section; said support member having said interconnecting means substantially integrally connecting to said forward section of said lower handle, at an area substantially where the middle section has said forward side wall and said rearward side wall respectively; said lower handle substantially extending rearwardly in a direction at an obtuse angle from said support member; said lower handle having a first side wall opposingly spaced apart from a second side wall; said first side wall and said second side wall substantially integrally formed to a bottom closed section extending substantially along said lower handle;

a slidable jaw member having a second compression surface disposed substantially in a second plane; said second plane substantially parallel to said first plane of said first compression surface; said slidable jaw member having a track follower assembly means thereon for cooperatively correlating with said support member; said track follower assembly means slidably contacting said support member, in a manner permitting said slidable jaw member to substantially rectangularly slide along said support member towards or away from said fixed jaw member, while said second compression surface is always maintained in substantial parallelism with said first compression surface; said track follower assembly substantially externally located from said lower handle;

a movable upper handle having a forward surface end externally located from said lower handle; said upper handle having a substantially forwardly located first means for pivotably attaching to said slidable jaw member; said upper handle having the first means for rotating said upper handle rotatably about a forward axis; said forward axis disposed substantially parallel to said first plane of said first compression surface; said upper handle rotating about said forward axis being at times substantially angled towards or away from said lower handle in a manner pressuring said slidable jaw member towards or away from said fixed jaw member respectively; said upper handle having a right side wall opposingly spaced apart from a left side wall; said right side wall and said left side wall substantially integrally formed to a top closed side wall of said upper handle; said upper handle extends rearwardly away from said forward axis;

a toggle substantially urging said slidable jaw member and said upper handle externally from said lower handle; said toggle having a substantially intermediately located second means for pivotably attaching said toggle to said upper handle; said toggle having the second means for rotating the toggle rotatably about a middle axis; said middle axis is substantially disposed rearwardly of and is in substantial parallelism with said forward axis; said toggle having a substantially internally located third means for pivotably sliding the toggle substantially internally in said lower handle; said toggle having said third means for rotating the toggle rotatably about a movable pivot axis; said movable pivot axis substantially internal and adjustably slidable in said lower handle; said toggle having a toggle tip cooperatively correlating with said toggle for halting rotation of said toggle in said upper handle; said toggle tip externally located from said lower handle; said toggle having a toggle stop substantially causing said upper handle to be in a fully rotatably locked position externally from said lower handle; said toggle stop externally located from said lower handle;

a release lever substantially externally releasing pressure off of said slidable jaw member and said fixed jaw member respectively and in a manner substantially rectangularly from said support member and externally from said lower handle; said release lever having a substantially rearwardly located forth means for pivotably attaching said release lever to said upper handle; said release lever having said forth means for rotating the release lever rotatably about a rear axis; said rear axis is substantially disposed rearwardly of and is in substantial parallelism with said middle axis; said release lever rotatably contacting to said toggle; said upper handle and said toggle are unlocked by said release lever substantially manually rotatable in a direction pressuring said release lever up off of said toggle stop;

a resilient means for substantially urging, as a cooperatively correlating constructed assembly, said slidable jaw member, said upper handle, said toggle, and said release lever in a location substantially externally from said lower handle and at times in a direction urging said slidable jaw member moving away from said fixed jaw member; said resilient means substantially internally located and pivotably secured for rotating substantially internally; and a threaded assembly having a fifth means for substantially positioning said slidable jaw member, said upper handle, said toggle, and said release lever, as said cooperatively correlating constructed assembly, in a location substantially externally from said lower handle and at times in a direction having said slidable jaw member moving towards or away from said fixed jaw member; said threaded assembly internally securable having said fifth means rotatably mountable thereon; said fifth means substantially manually rotatable fore and aft of said threaded assembly in a manner for varying locking pressure urged on said toggle to said upper handle and substantially externally urged on said slidable jaw member rectangularly along said support member.

2. An adjustable hand tool comprising:

a fixed jaw member having a first compression surface disposed substantially in a first plane;

a support member having a middle section with accurate guide surfaces; said accurate guides surfaces of said middle section having a forward side wall opposingly spaced parallelly apart from a rearward side wall respectively; said support member having an interconnecting means for substantially connecting to said fixed jaw member; said support member extending substantially at at a right angle from said first compression surface;

a fixed lower handle having a spaced forward section; said support member having said interconnecting means substantially connecting to said forward section of said lower handle; said lower handle substantially extending rearwardly in a direction at an obtuse angle from said support member;

a slidable jaw member having a second compression surface disposed substantially in a second plane; said second plane substantially parallel to said first plane of said first compression surface; said slidable jaw member having a track follower assembly means thereon for cooperatively correlating with said support member; said track follower assembly means slidably contacting said support member, in a manner perinitting said slidable jaw member to substantially slide along said support member towards or away from said fixed jaw member, while said second compression surface is always maintained in substantial parallelism with said first compression surface;

a movable upper handle having a substantially forwardly located first means for pivotably attaching to said slidable jaw member; said upper handle having said first means for rotating said upper handle rotatably about a forward axis; said upper handle rotating about said forward axis being at times substantially angled towards or away from said lower handle in a manner pressuring said slidable jaw member towards or away from said fixed jaw member respectively; said upper handle extends rearwardly away from said forward axis;

a toggle substantially urging said slidable jaw member and said upper handle; said toggle having a second means for pivotably attaching said toggle to said upper handle; said toggle having the second means for rotating the toggle rotatably about a middle axis; said toggle having a third means for pivotably sliding the toggle in said lower handle; said toggle having said third means for rotating the toggle rotatably about a movable pivot axis; said movable pivot axis slidable in said lower handle; said toggle having a toggle stop substantially causing said upper handle to be in a fully rotatably locked position externally from said lower handle;

a release lever releasing pressure off of said slidable jaw member and said fixed jaw member respectively; said release lever having a substantially rearwardly located forth means for pivotably attaching said release lever to said upper handle; said release lever having said forth means for rotating the release lever rotatably about a rear axis; said release lever rotatably contacting to said toggle; said upper handle and said toggle are unlocked by said release lever substantially manually rotatable in a direction pressuring said release lever up off of said toggle stop;

a resilient means for substantially urging, as a cooperatively correlating constructed assembly, said slidable jaw member, said upper handle, and said toggle in a direction urging said slidable jaw member moving away from said fixed jaw member; said resilient means substantially internally rotatable; and a threaded assembly having a fifth means for substantially positioning said slidable jaw member, said upper handle, and said toggle, as said cooperatively correlating constructed assembly, in a direction having said slidable jaw member moving towards or away from said fixed jaw member; said threaded assembly securable having said fifth means rotatably mountable thereon; said fifth means substantially manually rotatable fore and aft of said threaded assembly in a manner for varying locking pressure urged on said toggle to said upper handle.

3. The adjustable hand tool of claim 2 further including a toggle release link pivotably attachable to said upper handle and rotatably attachable to said toggle; said toggle release link manually rotatable by said upper handle in a manner for unlocking said toggle.

4. The adjustable hand tool of claim 3 wherein said fifth means is substantially rotatable internally fore and aft of said threaded assembly and is manually rotatable externally of said threaded assembly, in a manner for varying locking pressure urged on said toggle to said upper handle.

5. The adjustable hand tool of claim 4 further including a spring pivotably attachable to said slidable jaw member and rotatably attachable to said toggle;

said spring for urging said slidable jaw member, said upper handle, toggle and said toggle release link.

6. The adjustable hand tool of claim 3 further including a spring pivotably attachable to said slidable jaw member and pivotably attachable to said lower handle; said spring for urging said slidable jaw member, said upper handle, said toggle and said toggle release link.

7. The adjustable hand tool of claim 6 wherein said fifth means is substantially rotatable internally fore and aft of said threaded assembly and is manually rotatable externally of said threaded assembly, in a manner for varying locking pressure urged on said toggle to said upper handle.

8. The adjustable hand tool of claim 2 wherein said fifth means is substantially rotatable internally fore and aft of said threaded assembly and is manually rotatable externally of said threaded assembly, in a manner for varying locking pressure urged on said toggle to said upper handle.

9. The adjustable hand tool of claim 8 further including a spring pivotably attachable to said slidable jaw and rotatably attachable to said toggle; said spring for urging said slidable jaw member, said upper handle, and said toggle.

10. The adjustable hand tool of claim 9 further including a spring urging said release lever in a manner for securing said release lever contiguously in said upper handle.

11. The adjustable hand tool of claim 2 further including a spring urging said release lever in a manner for securing said release lever contiguously in said upper handle.

12. The adjustable hand tool of claim 2 further including a substantially grip enabling coating material covering said upper handle and said lower handle respectively.

13. The adjustable hand tool of claim 12 further including a substantially grip enabling coating material covering said release lever.

14. The adjustable hand tool of claim 12 wherein said coating material covers a handle.

15. The adjustable hand tool of claim 2 further including a second threaded assembly having a sixth means for substantially positioning said slidable jaw member, said upper handle, and said toggle, as a cooperatively correlating constructed assembly, in a direction having said slidable jaw member moving towards or away from said fixed jaw member; said second threaded assembly securable to said upper handle and having said sixth means rotatably mountable thereon; said sixth means manually rotatable in a manner for varying locking pressure urged on said toggle to said upper handle.

16. An adjustable hand tool comprising:

a fixed jaw member having a first compression surface disposed substantially in a first plane;

a support member having a middle section with accurate guide surfaces; said accurate guides surfaces of said middle section having a forward side wall opposingly spaced parallelly apart from a rearward side wall respectively; said support member having an interconnecting means for substantially connecting to said fixed jaw member; said support member extending substantially at at a right angle from said first compression surface;

a fixed lower handle having a spaced forward section; said support member having said interconnecting means substantially connecting to said forward section of said lower handle; said lower handle substantially extending rearwardly in a direction at an obtuse angle from said support member;

a slidable jaw member having a second compression surface disposed substantially in a second plane; said second plane substantially parallel to said first plane of said first compression surface; said slidable jaw member having a track follower assembly means thereon for cooperatively correlating with said support member; said track follower assembly means slidably contacting said support member, in a manner permitting said slidable jaw member to substantially slide along said support member towards or away from said fixed jaw member, while said second compression surface is always maintained in substantial parallelism with said first compression surface;

a movable upper handle having a substantially forwardly located first means for pivotably attaching to said slidable jaw member; said upper handle having said first means for rotating said upper handle rotatably about a forward axis; said upper handle rotating about said forward axis being at times substantially angled towards or away from said lower handle in a manner pressuring said slidable jaw member towards or away from said fixed jaw member respectively; said upper handle extends rearwardly away from said forward axis;

a toggle substantially urging said slidable jaw member and said upper handle; said toggle having a second means for pivotably attaching said toggle to said upper handle; said toggle having the second means for rotating the toggle rotatably about a middle axis; said toggle having a third means for pivotably sliding the toggle in said lower handle; said toggle having said third means for rotating the toggle rotatably about a movable pivot axis; said movable pivot axis slidable in said lower handle; said toggle having a toggle tip cooperatively correlating with said toggle for halting rotation of said toggle in said upper handle; said toggle having a toggle stop substantially causing said upper handle to be in a fully rotatably locked position externally from said lower handle;

a release lever releasing pressure off of said slidable jaw member and said fixed jaw member respectively; said release lever having a substantially rearwardly located forth means for pivotably attaching said release lever to said upper handle; said release lever having said forth means for rotating the release lever rotatably about a rear axis; said release lever rotatably contacting to said toggle; said upper handle and said toggle are unlocked by said release lever substantially manually rotatable in a direction pressuring said release lever up off of said toggle stop;

a resilient means for substantially urging, as a cooperatively correlating constructed assembly, said slidable jaw member, said upper handle, and said toggle in a direction urging said slidable jaw member moving away from said fixed jaw member; said resilient means substantially internally rotatable; and a threaded assembly having a fifth means for substantially positioning said slidable jaw member, said upper handle, and said toggle, as said cooperatively correlating constructed assembly, in a direction having said slidable jaw member moving towards or away from said fixed jaw member; said threaded assembly securable having said fifth means rotatably mountable thereon; said fifth means substantially manually rotatable fore and aft of said threaded assembly in a manner for varying locking pressure urged on said toggle to said upper handle.

* * * * *